US010821738B2

(12) United States Patent
Kawate et al.

(10) Patent No.: US 10,821,738 B2
(45) Date of Patent: Nov. 3, 2020

(54) LIQUID CONTAINER, LIQUID CONSUMING APPARATUS AND ELECTRICAL CONNECTOR

(71) Applicant: SEIKO EPSON CORPORATION, Tokyo (JP)

(72) Inventors: Hiroyuki Kawate, Yamanashi (JP); Tokujiro Okuno, Fukuoka (JP); Yoshiyuki Tanaka, Nagano (JP); Katsutomo Tsukahara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/202,214

(22) Filed: Nov. 28, 2018

(65) Prior Publication Data

US 2019/0092031 A1 Mar. 28, 2019

Related U.S. Application Data

(62) Division of application No. 15/124,945, filed as application No. PCT/JP2015/001348 on Mar. 11, 2015, now Pat. No. 10,179,459.

(30) Foreign Application Priority Data

Mar. 14, 2014 (JP) ..... 2014-051787
Mar. 14, 2014 (JP) ..... 2014-051789
(Continued)

(51) Int. Cl.
*B41J 2/175* (2006.01)
*B41J 29/02* (2006.01)
*B41J 29/13* (2006.01)

(52) U.S. Cl.
CPC ..... *B41J 2/17526* (2013.01); *B41J 2/1752* (2013.01); *B41J 2/1753* (2013.01);
(Continued)

(58) Field of Classification Search
CPC .. B41J 2/17526; B41J 2/17513; B41J 2/1752; B41J 2/17523; B41J 2/1753; B41J 2/17546; B41J 2/17553
See application file for complete search history.

(56) References Cited

U.S. PATENT DOCUMENTS 5,860,363 A 1/1999 Childers et al.
6,203,147 B1 3/2001 Battey et al.
(Continued)

FOREIGN PATENT DOCUMENTS

CN 101585265 A 11/2009
EP 2653313 A2 10/2013
(Continued)

*Primary Examiner* — Jason S Uhlenhake
(74) *Attorney, Agent, or Firm* — Global IP Counselors, LLP

(57) ABSTRACT

A liquid container includes a liquid supply portion, a liquid container body, and a container-side electrical connection structure provided to have a contact portion that is configured to come into contact with an apparatus-side electrical connection structure provided in a liquid consuming apparatus. The container-side electrical connection structure includes a placement portion configured to place the contact portion to be located above the liquid container body in the direction of gravity in a process of connecting the liquid container with the liquid consuming apparatus.

11 Claims, 83 Drawing Sheets

F18–F18 PARTIAL SECTIONAL VIEW

(30) Foreign Application Priority Data

Mar. 14, 2014 (JP) ..... 2014-051791
Mar. 14, 2014 (JP) ..... 2014-051907

(52) U.S. Cl.
CPC ..... *B41J 2/17513* (2013.01); *B41J 2/17523* (2013.01); *B41J 2/17546* (2013.01); *B41J 2/17553* (2013.01); *B41J 29/02* (2013.01); *B41J 29/13* (2013.01); *B41J 2002/17516* (2013.01)

(56) References Cited

U.S. PATENT DOCUMENTS

| | | | | |
|---|---|---|---|---|
| 6,375,315 | B1 | 4/2002 | Steinmetz et al. | |
| 6,416,166 | B1 | 7/2002 | Robinson et al. | |
| 7,891,789 | B2 | 2/2011 | Hibbard et al. | |
| 2002/0171713 | A1 | 11/2002 | Ueno et al. | |
| 2003/0222940 | A1 | 12/2003 | Seino et al. | |
| 2005/0001888 | A1 | 1/2005 | Seino et al. | |
| 2005/0243148 | A1 | 11/2005 | Miyazawa et al. | |
| 2007/0206076 | A1 | 9/2007 | Seino et al. | |
| 2008/0106575 | A1 | 5/2008 | Shimizu et al. | |
| 2008/0136878 | A1 | 6/2008 | Nozawa et al. | |
| 2008/0284810 | A1 | 11/2008 | Shimizu et al. | |
| 2009/0290001 | A1 | 11/2009 | Domae | |
| 2012/0056938 | A1 | 3/2012 | Ishizawa et al. | |
| 2013/0147883 | A1* | 6/2013 | Enomoto | B41J 2/1752 347/86 |
| 2013/0182050 | A1* | 7/2013 | Aoki | B41J 2/1721 347/86 |
| 2013/0182051 | A1 | 7/2013 | Aoki et al. | |
| 2014/0055535 | A1* | 2/2014 | Takagi | B41J 2/1752 347/86 |
| 2014/0063145 | A1 | 3/2014 | Iwamuro et al. | |
| 2014/0139572 | A1 | 5/2014 | Polk et al. | |
| 2014/0247310 | A1 | 9/2014 | Ishizawa et al. | |
| 2015/0352850 | A1 | 12/2015 | Ishizawa et al. | |
| 2016/0001563 | A1 | 1/2016 | Takagi et al. | |
| 2016/0221350 | A1 | 8/2016 | Takagi et al. | |

FOREIGN PATENT DOCUMENTS

| | | | |
|---|---|---|---|
| JP | 59-212272 | A | 12/1984 |
| JP | 62-184856 | A | 8/1987 |
| JP | 11-348303 | A | 12/1999 |
| JP | 2002-120382 | A | 4/2002 |
| JP | 2004-168341 | A | 6/2004 |
| JP | 2006-069030 | A | 3/2006 |
| JP | 2007-090646 | A | 4/2007 |
| JP | 2009-172918 | A | 8/2009 |
| JP | 2009-202346 | A | 9/2009 |
| JP | 2010-058525 | A | 3/2010 |
| JP | 2011-235652 | A | 11/2011 |
| JP | 2012-116102 | A | 6/2012 |
| JP | 2012-116202 | A | 6/2012 |
| JP | 2012-158343 | A | 8/2012 |
| JP | 2012-206464 | A | 10/2012 |
| JP | 2013-212706 | A | 10/2013 |
| JP | 2014-043016 | A | 3/2014 |
| WO | 2004/037541 | A1 | 5/2004 |
| WO | 2014/034111 | A1 | 3/2014 |

* cited by examiner

F6I-F6I SECTIONAL VIEW

ENLARGED VIEW OF AREA R6J

F6N-F6N SECTIONAL VIEW

F13-F13 SECTIONAL VIEW

VIEW FROM ARROW F16B

Fig.16D
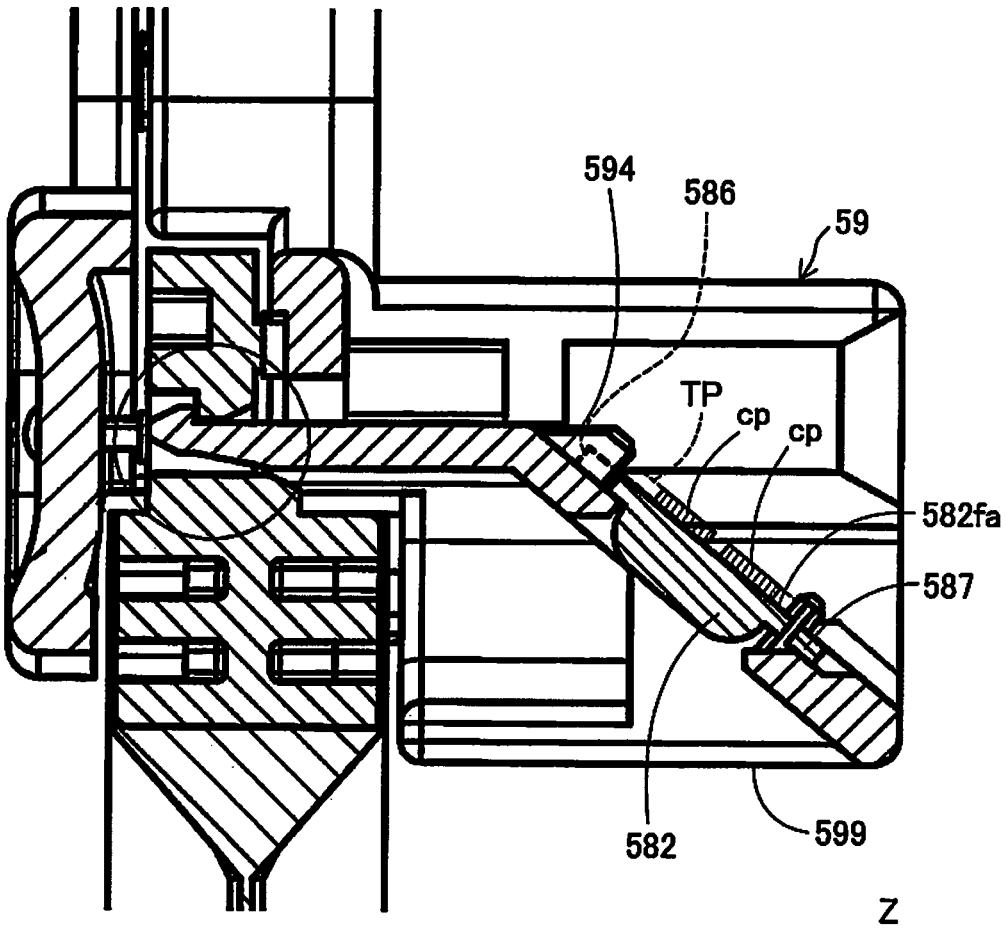
F13a–F13a PARTIAL SECTIONAL VIEW
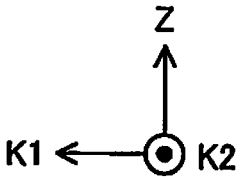

F17Da-F17Da PARTIAL SECTIONAL VIEW

F17Db-F17Db PARTIAL SECTIONAL VIEW

F18-F18 PARTIAL SECTIONAL VIEW

F20-F20 PARTIAL SECTIONAL VIEW

F22A-F22A PARTIAL SECTIONAL VIEW

F22B-F22B PARTIAL SECTIONAL VIEW

F25A-F25A PARTIAL SECTIONAL VIEW

F25B-F25B PARTIAL SECTIONAL VIEW

F28-F28 SECTIONAL VIEW

F29-F29 SECTIONAL VIEW

F32-F32 SECTIONAL VIEW

F25A-F25A PARTIAL SECTIONAL VIEW

F5B-F5B PARTIAL SECTIONAL VIEW

F38-F38 SECTIONAL VIEW

30(30C)
50(50C)
35
368
364a(364)
577a
(577)
57
55
56
577d
(577)
364d
(364)
40
365
465A
465B
465
Z
K2
K1

F45-F45 SECTIONAL VIEW

LIQUID CONTAINER, LIQUID CONSUMING APPARATUS AND ELECTRICAL CONNECTOR

CROSS-REFERENCE TO RELATED APPLICATIONS

The present application claims priority from Japanese patent applications 2014-051787, 2014-051789, 2014-051791 and 2014-051907 filed on Mar. 14, 2014, the contents of which are hereby incorporated by reference into this application.

BACKGROUND

Technical Field

The present disclosure relates to technology used for a liquid consuming apparatus.

Related Art

According to a conventionally known technique, a liquid container body is placed in a pull-out cartridge case and is mounted to a liquid consuming apparatus, so as to supply ink contained in the liquid container body to the liquid consuming apparatus (for example, WO 2004/037541). WO 2004/037541 discloses a liquid container including a liquid containing bag configured to container a liquid inside thereof and a case for placing the liquid containing bag therein (cartridge case), as a technique for supplying a liquid to a printer as a liquid consuming apparatus (for example, WO 2004/037541). In the technique of WO 2004/037541, the cartridge case is configured to be pulled out from the printer. After the liquid containing bag is mounted in the cartridge case, the liquid container is inserted into the printer, so as to be connected with the printer. This causes the ink contained in the liquid containing bag to be flowed to the printer through a liquid supply port provided in the liquid containing bag.

An ink container configured to supply ink from outside of a printer has also been known as a technique of supplying ink to the printer as a liquid consuming apparatus (for example, JP 2009-202346A).

According to the above prior art (WO 2004/037541), it is required to place the liquid container body in the cartridge case in the process of mounting the liquid container body to the liquid consuming apparatus. In this process, the user is required to hold the liquid container body having flexibility. This causes inconvenience in handling. There is accordingly a difficulty in mounting the liquid container body to the liquid consuming apparatus. Holding the liquid container body causes an external force to be directly applied to the liquid container body. There is accordingly a possibility that the liquid container body is damaged. Damaging the liquid container body causes a problem that the liquid inside of the liquid container body is leaked out.

According to the technique described in WO 2004/037541, the liquid containing bag and the liquid supply port are arranged side by side in a horizontal direction in the process of connecting the liquid container with the printer. This is likely to cause size expansion of a printer-side placement space in which the liquid container is placed in the horizontal direction. This also causes a need for the cartridge case to support the liquid containing bag in the horizontal direction and is thus likely to increase the manufacturing cost of the liquid container. This also causes a need to mount the liquid containing bag in the cartridge case prior to connection of the liquid container with the printer and is thus likely to complicate the process for connecting the liquid container with the printer (mounting process).

The above prior art discloses a liquid supply port mounted in a sealing member of a liquid container body and a memory unit provided in a separate attachment member different from the liquid container body. This memory unit is attached to the liquid container body in a variable manner at a position away from the liquid supply port mounted in the sealing member of the liquid container body. In the process of connecting the liquid container body with the liquid consuming apparatus, the liquid container body is mounted in the cartridge case with taking into account the position of the liquid supply port and the position of the memory unit, and the liquid container body is then connected with the liquid consuming apparatus using the cartridge case in which the liquid container body is mounted. This prior art is, however, likely to cause the following problems. One example is the likelihood of increasing the number of operations to connect the liquid container body with the liquid consuming apparatus. Another example is a difficulty in the operation of mounting the liquid container body with taking into account the positions of the liquid supply port and the memory unit, due to the configuration that the liquid supply port and the memory unit are supported on the different components or due to the liquid container body that is readily deformed and is not easily held. Another example is an increase in total number of components by using the cartridge case as the separate member.

SUMMARY

One object of the disclosure is accordingly to provide a technique of achieving connection of required parts with a liquid consuming apparatus with a less number of components. One object of the disclosure is also to provide a technique of connecting a liquid container with a liquid consuming apparatus by a simple operation process.

One object is to provide a liquid container having the improved handling property for mounting to a liquid consuming apparatus. One object of the disclosure is to provide a liquid container with the reduced possibility that the user directly touches a liquid container body. One object of the disclosure is to provide a liquid container that is readily mountable to a liquid consuming apparatus. One object of the disclosure is to reduce the space occupied by a liquid container. One object is to provide a liquid container that is readily connectable with a liquid consuming apparatus.

According to the technique described in JP 2009-202346A, on the other hand, an ink container includes an ink bag configured to contain ink therein and a connection structure (ink supply portion) configured to flow out the ink from the ink bag. When ink is supplied to the printer, the ink container is arranged such that the ink supply portion is located below the ink bag in the direction of gravity.

With regard to connection of the ink container with the printer in the state that the ink container is suspended in the direction of gravity, like the technique of JP 2009-202346A, however, there is no disclosure of the technique that provides an electrical connection structure in the link container and connects the electrical connection structure of the ink container with an electrical connection structure provided in the printer.

Connecting the electrical connection structure of the ink container with the electrical connection structure of the printer enables, for example, various pieces of information (for example, the color of ink, the date of manufacture and the remaining amount of ink) with regard to the ink container to be sent from the ink container to a controller of the printer via the electrical connection structure of the ink container. There is accordingly a demand for a technique of easily connecting the electrical connection structure of the ink container with the electrical connection structure of the printer. There is also a demand for a technique of ensuring good connection between the electrical connection structure of the ink container and the electrical connection structure of the printer. Other needs include, for example, cost reduction, resource saving, easy manufacture and improvement of usability over the prior art.

These problems are not characteristic of the ink container configured to supply ink to the printer but are commonly found in a liquid consuming apparatus and a liquid container configured to supply a liquid to the liquid consuming apparatus.

In order to solve at least one of the problems described above, the disclosure may be implemented by aspects described below.

(1) According to one aspect of the disclosure, there is provided a liquid container configured to be connectable with a liquid consuming apparatus. The liquid container comprises a liquid supply portion configured to be connectable with the liquid consuming apparatus; a liquid container body configured to communicate with the liquid supply portion and contain a liquid therein; and a container-side electrical connection structure provided to have a contact portion that is configured to come into contact with an apparatus-side electrical connection structure provided in the liquid consuming apparatus. The container-side electrical connection structure includes a placement portion configured to place the contact portion to be located above the liquid container body in the direction of gravity in a process of connecting the liquid container with the liquid consuming apparatus.

In the liquid container of this aspect, the contact portion is placed on the placement portion. Even in the free state that the liquid container body is suspended in the direction of gravity by its own weight, this configuration ensures good electrical connection between the container-side electrical connection structure and the apparatus-side electrical connection structure.

(2) In the liquid container of the above aspect, the placement portion may be supported by a first support assembly that is movable in a first direction intersecting with the direction of gravity in a process of connecting the liquid container with the liquid consuming apparatus. The container-side electrical connection structure may include a plurality of the contact portions. A contact plane defined by the plurality of contact portions may be inclined such that a lower side of the contact plane is located on a first direction side of an upper side of the contact plane.

In the liquid container of this aspect, the contact plane is inclined such that its lower side is located on the first direction side of its upper side. The apparatus-side electrical connection structure may thus be inclined such that its upper side is protruded relative to its lower side in an opposite direction opposite to the first direction. This reduces the likelihood that impurity such as dust adheres to the apparatus-side electrical connection structure. This configuration thus ensures the better electrical connection between the container-side electrical connection structure and the apparatus-side electrical connection structure of the liquid consuming apparatus.

(3) In the liquid container of the above aspect, the placement portion may include a restriction element configured to abut on the first support assembly and restrict motion of the container-side electrical connection structure in an opposite direction opposite to the first direction.

In the liquid container of this aspect, the restriction element restricts the motion of the placement portion in the opposite direction. This reduces the likelihood that the container-side electrical connection structure (more specifically, its contact portions) and the apparatus-side electrical connection structure are separated away from each other. This configuration stably maintains the electrical connection between the container-side electrical connection structure and the apparatus-side electrical connection structure.

(4) In the liquid container of the above aspect, the placement portion and the liquid supply portion may be arranged side by side in a direction intersecting with the first direction. The placement portion may include a rotation restriction element configured to abut on the first support assembly and restrict rotation of the container-side electrical connection structure about the liquid supply portion.

In the liquid container of this aspect, rotation of the placement portion is restricted by the rotation restriction element. This configuration further stably maintains the electrical connection between the container-side electrical connection structure and the apparatus-side electrical connection structure.

(5) In the liquid container of the above aspect, the placement portion may be configured such that the contact portions come into contact with the apparatus-side electrical connection structure that is configured to be displaceable in a direction intersecting with the first direction.

In the liquid container of this aspect, the apparatus-side electrical connection structure may be displaced following the motion of the placement portion when the contact portions come into contact with the apparatus-side electrical connection structure. This configuration ensures the further better electrical connection between the container-side electrical connection structure and the apparatus-side electrical connection structure.

(6) In the liquid container of the above aspect, the placement portion may include a container-side electrical connection structure positioning element that is positioned by a positioning structure provided in the apparatus-side electrical connection structure for positioning in the first direction and in the direction intersecting with the first direction, when the contact portions come into contact with the apparatus-side electrical connection structure.

In the liquid container of this aspect, the container-side electrical connection structure positioning element positions the contact portions relative to the apparatus-side electrical connection structure. This configuration ensures the good contact between the contact portions and the apparatus-side electrical connection structure.

(7) In the liquid container of the above aspect, the container-side electrical connection structure positioning element may be provided on respective sides across the contact portions.

The configuration of the liquid container according to this aspect reduces the likelihood that the contact portions are inclined relative to the apparatus-side electrical connection structure, compared with a configuration that the container-side electrical connection structure positioning element is provided only on one side.

(8) In the liquid container of the above aspect, the placement portion may include a container-side electrical connection structure upper restriction portion configured to abut on the liquid consuming apparatus and restrict motion of the container-side electrical connection structure in a reverse direction reverse to the direction of gravity when the contact portion comes into contact with the apparatus-side electrical connection structure.

The configuration of the liquid container according to this aspect restricts the motion of the placement portion in the reverse direction reverse to the direction of gravity (upward in the direction of gravity). This configuration ensures the good contact between the contact portion and the apparatus-side electrical connection structure. This accordingly ensures the further better electrical connection between the container-side electrical connection structure and the apparatus-side electrical connection structure.

(9) In the liquid container of the above aspect, the placement portion may have an upper portion that is covered by a cover portion provided in the liquid consuming apparatus to be located above the apparatus-side electrical connection structure and to be protruded in the opposite direction opposite to the first direction, when the contact portions come into contact with the apparatus-side electrical connection structure.

In the liquid container of this aspect, the presence of the cover portion reduces the likelihood that impurity such as dust falls from above the apparatus-side electrical connection structure to adhere to the contact portions. This configuration ensures the further better electrical connection between the container-side electrical connection structure and the apparatus-side electrical connection structure.

(10) According to another aspect of the disclosure, there is provided a liquid consuming apparatus configured to be connectable with a liquid container that comprises a liquid container body configured to contain a liquid therein, a liquid supply portion configured to cause the liquid contained in the liquid container body to be flowed to outside, and a container-side electrical connection structure. The liquid consuming apparatus comprises a liquid introduction portion configured to be connected with the liquid supply portion; an electrical connection unit configured to have an apparatus-side electrical connection structure that comes into contact with a contact portion of the container-side electrical connection structure; a stationary member configured such that the liquid introduction portion and the electrical connection unit are attached to the stationary member; and a first support assembly provided to be movable relative to the stationary member in a first direction intersecting with the direction of gravity and configured to support the container-side electrical connection structure on an upper side of the liquid container body in the direction of gravity in a process of connecting the liquid container with the liquid consuming apparatus. The apparatus-side electrical connection structure is attached to the stationary member such as to be displaceable in a direction intersecting with the first direction.

In the liquid consuming apparatus of this aspect, the apparatus-side electrical connection structure may be displaced in the process of connecting the container-side electrical connection structure with the apparatus-side electrical connection structure. This configuration ensures the good electrical connection between the container-side electrical connection structure and the apparatus-side electrical connection structure.

(11) In the liquid consuming apparatus of the above aspect, the electrical connection unit may include an apparatus-side positioning structure configured to position the contact portion of the container-side electrical connection structure in the first direction and in the direction intersecting with the first direction.

In the liquid consuming apparatus of this aspect, the apparatus-side positioning structure positions the contact portion relative to the apparatus-side electrical connection structure. This configuration ensures the good contact between the contact portion and the apparatus-side electrical connection structure. This accordingly ensures the good electrical connection between the container-side electrical connection structure and the apparatus-side electrical connection structure.

(12) In the liquid consuming apparatus of the above aspect, the apparatus-side positioning structure may be arranged at respective sides across the apparatus-side electrical connection structure.

The configuration of the liquid consuming apparatus according to this aspect reduces the likelihood that the contact portion is inclined relative to the apparatus-side electrical connection structure, compared with a configuration that the apparatus-side positioning structure is provided only on one side.

(13) The liquid consuming apparatus of the above aspect may further comprise an apparatus-side upper restriction portion configured to restrict motion of the container-side electrical connection structure in a reverse direction reverse to the direction of gravity when the contact portion of the container-side electrical connection structure comes into contact with the apparatus-side electrical connection structure.

The configuration of the liquid consuming apparatus according to this aspect restricts the motion of the container-side electrical connection structure in the reverse direction reverse to the direction of gravity (upward in the direction of gravity). This ensures the further better electrical connection between the container-side electrical connection structure and the apparatus-side electrical connection structure.

(14) In the liquid consuming apparatus of the above aspect, the stationary member may include a cover portion that is protruded in an opposite direction opposite to the first direction such as to cover an upper portion of the apparatus-side electrical connection structure.

In the liquid consuming apparatus of this aspect, the presence of the cover portion reduces the likelihood that impurity such as dust falls from above the apparatus-side electrical connection structure to adhere to the apparatus-side electrical connection structure. This configuration ensures the further better electrical connection between the container-side electrical connection structure and the apparatus-side electrical connection structure.

(15) According to another aspect of the disclosure, there is provided an electrical connector. The electrical connector comprises an electrical connection structure including a plurality of contact portions that are configured to come into contact with an apparatus-side electrical connection structure of an electrical connection unit provided in a liquid consuming apparatus, and a placement portion in which the contact portions are placed. The placement portion is supported by a first support assembly that is configured to be movable in a first direction intersecting with the direction of gravity in a process of connecting the electrical connector with the liquid consuming apparatus. A contact plane defined by the plurality of contact portions is inclined such that a lower side of the contact plane is located on a first direction side of an upper side of the contact plane.

In the electrical connector of this aspect, the contact plane is inclined such that its lower side is located on the first direction side of its upper side. The apparatus-side electrical connection structure may thus be inclined such that its upper side is protruded relative to its lower side in an opposite direction opposite to the first direction. This reduces the likelihood that impurity such as dust adheres to the apparatus-side electrical connection structure. This configuration thus ensures the better electrical connection between the electrical connection structure of the electrical connector and the apparatus-side electrical connection structure of the liquid consuming apparatus.

(16) In the electrical connector of the above aspect, the placement portion may include a restriction element configured to abut on the first support assembly and restrict motion of the placement portion in an opposite direction opposite to the first direction.

In the electrical connector of this aspect, the restriction element restricts the motion of the placement portion in the opposite direction. This reduces the likelihood that the contact portions and the apparatus-side electrical connection structure are separated away from each other. This configuration stably maintains the electrical connection between the electrical connection structure and the apparatus-side electrical connection structure.

(17) In the electrical connector of the above aspect, the placement portion may include a rotation restriction element configured to abut on the first support assembly and restrict rotation of the placement portion.

In the electrical connector of this aspect, rotation of the placement portion is restricted by the rotation restriction element. This configuration further stably maintains the electrical connection between the electrical connection structure and the apparatus-side electrical connection structure.

All the plurality of components included in each of the aspects of the disclosure described above are not essential, but some components among the plurality of components may be appropriately changed, omitted or replaced with other additional components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the disclosure described above may be combined with part or all of the technical features included in another aspect of the disclosure described above to provide one independent aspect of the disclosure.

For example, one aspect of the disclosure may be implemented as an apparatus comprising one or more elements out of a plurality of elements, i.e., a liquid supply portion, a liquid container body, a container-side electrical connection structure and a holding structure. Accordingly this apparatus may include a liquid supply portion or may not include the liquid supply portion. This apparatus may include a liquid container body or may not include the liquid container body. This apparatus may include a container-side electrical connection structure or may not include the container-side electrical connection structure. This apparatus may include a holding structure or may not include the holding structure.

Another aspect of the disclosure may be implemented as an apparatus comprising one or more elements out of a plurality of elements, i.e., a stationary member and a first support assembly. Accordingly this apparatus may include a stationary member or may not include the stationary member. This apparatus may include a first support assembly or may not include the first support assembly.

Another aspect of the disclosure may be implemented as an apparatus comprising one or more elements out of a plurality of elements, i.e., an electrical connection structure and a holding structure. Accordingly this apparatus may include an electrical connection structure or may not include the electrical connection structure. This apparatus may include a holding structure or may not include the holding structure.

For example, another aspect of the disclosure may be implemented as an apparatus comprising one or more elements out of a plurality of elements, i.e., a liquid container body, a liquid supply port, an operation member, a positioning structure and a container-side electrical connection structure. Accordingly this apparatus may include a liquid container body or may not include the liquid container body. This apparatus may include a liquid supply port or may not include the liquid supply port. This apparatus may include an operation member or may not include the operation member. This apparatus may include a positioning structure or may not include the positioning structure. This apparatus may include a container-side electrical connection structure or may not include the container-side electrical connection structure.

For example, another aspect of the disclosure may be implemented as an apparatus comprising one or more elements out of a plurality of elements, i.e., an operation member, a positioning structure and a container-side electrical connection structure. Accordingly this apparatus may include an operation member or may not include the operation member. This apparatus may include a positioning structure or may not include the positioning structure. This apparatus may include a container-side electrical connection structure or may not include the container-side electrical connection structure.

For example, another aspect of the disclosure may be implemented as an apparatus comprising one or more elements out of a plurality of elements, i.e., a liquid container body, an operation member and a liquid supply portion. Accordingly this apparatus may include a liquid container body or may not include the liquid container body. This apparatus may include an operation member or may not include the operation member. This apparatus may include a liquid supply portion or may not include the liquid supply portion. Any of these aspects solves at least one of various problems such as downsizing of the apparatus, cost reduction, resource saving, easy manufacture and improvement of usability. Part or all of the technical features in each of the aspects with regard to the liquid container body described above may be applied to any of these apparatuses. The state of "substantially parallel" is not restricted to the completely parallel state but includes the approximately parallel state with a slight error or with a slight deviation. In other words, the state of "substantially parallel" in the description hereof includes the state that is not completely parallel in such a range that provides the advantageous effects described herein. The term "plane" in the description hereof includes a plane with slight irregularities and a slightly curved plane, as well as a flat plane.

For example, another aspect of the disclosure may be implemented as an apparatus comprising one or more elements out of a plurality of elements, i.e., a liquid container body and a liquid supply portion. Accordingly this apparatus may include a liquid container body or may not include the liquid container body. This apparatus may include a liquid supply portion or may not include the liquid supply portion.

Each of these aspects solves at least one of various problems such as downsizing of the apparatus, cost reduction, resource saving, easy manufacture and improvement of usability. Part or all of the technical features in each of the aspects with regard to the liquid container or the electrical connector described above may be applied any of these apparatuses.

The disclosure may be implemented by any of various aspects other than the liquid container, the liquid consuming apparatus and the electrical connector, for example, a method of manufacturing the liquid container, a liquid consumption system including the liquid container and the liquid consuming apparatus, a unit including the electrical connector and a liquid container body configured to contain a liquid therein, and a system including the electrical connector and the liquid consuming apparatus.

BRIEF DESCRIPTION OF THE DRAWINGS

FIG. 16D is an F13*a*-F13*a* partial sectional view of FIG. 13;

DETAILED DESCRIPTION OF EXEMPLARY EMBODIMENTS

A. Embodiment

Figure 1:
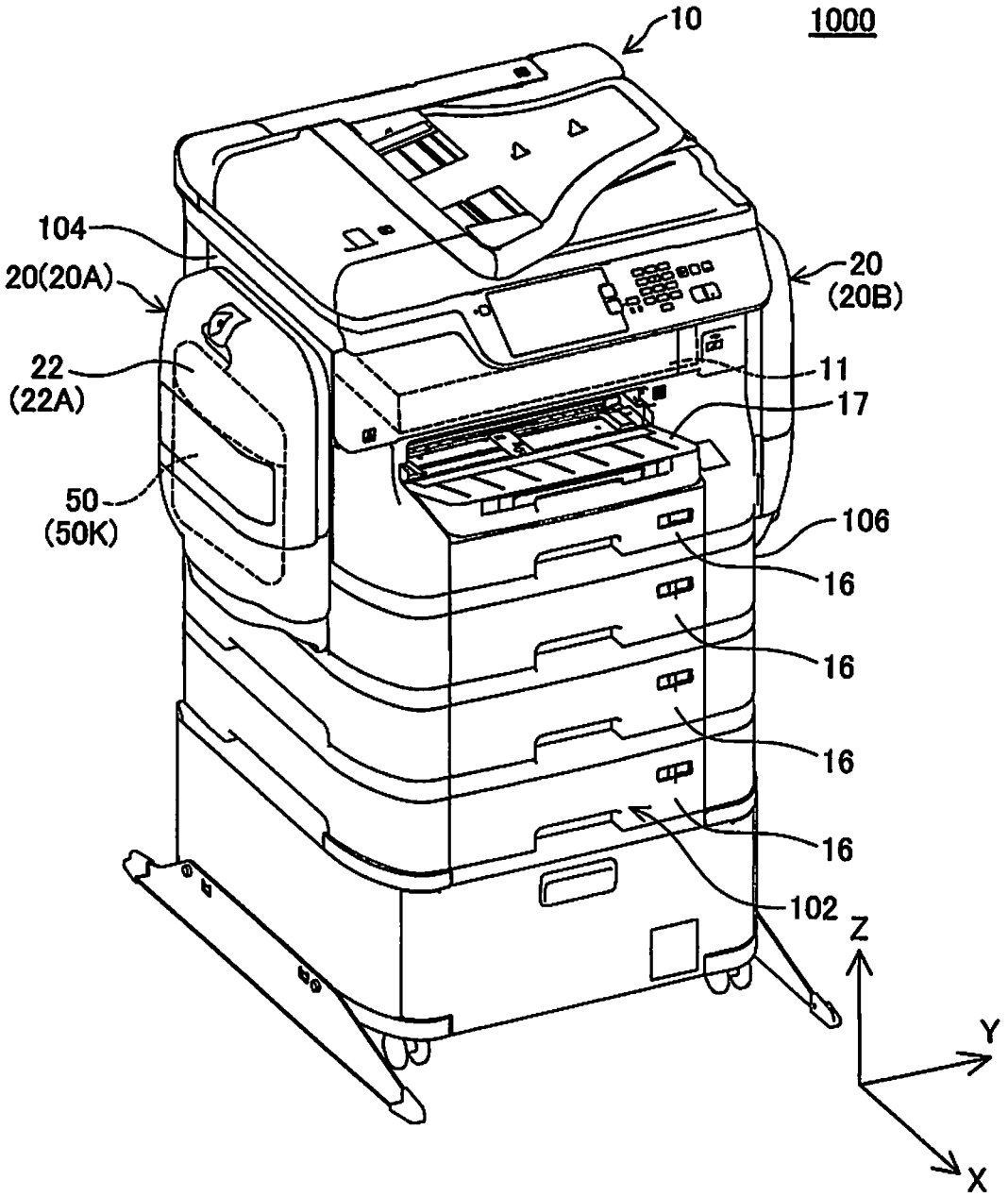
FIG. 1 is a first perspective view illustrating the schematic configuration of a liquid consumption system.
Figure 2:
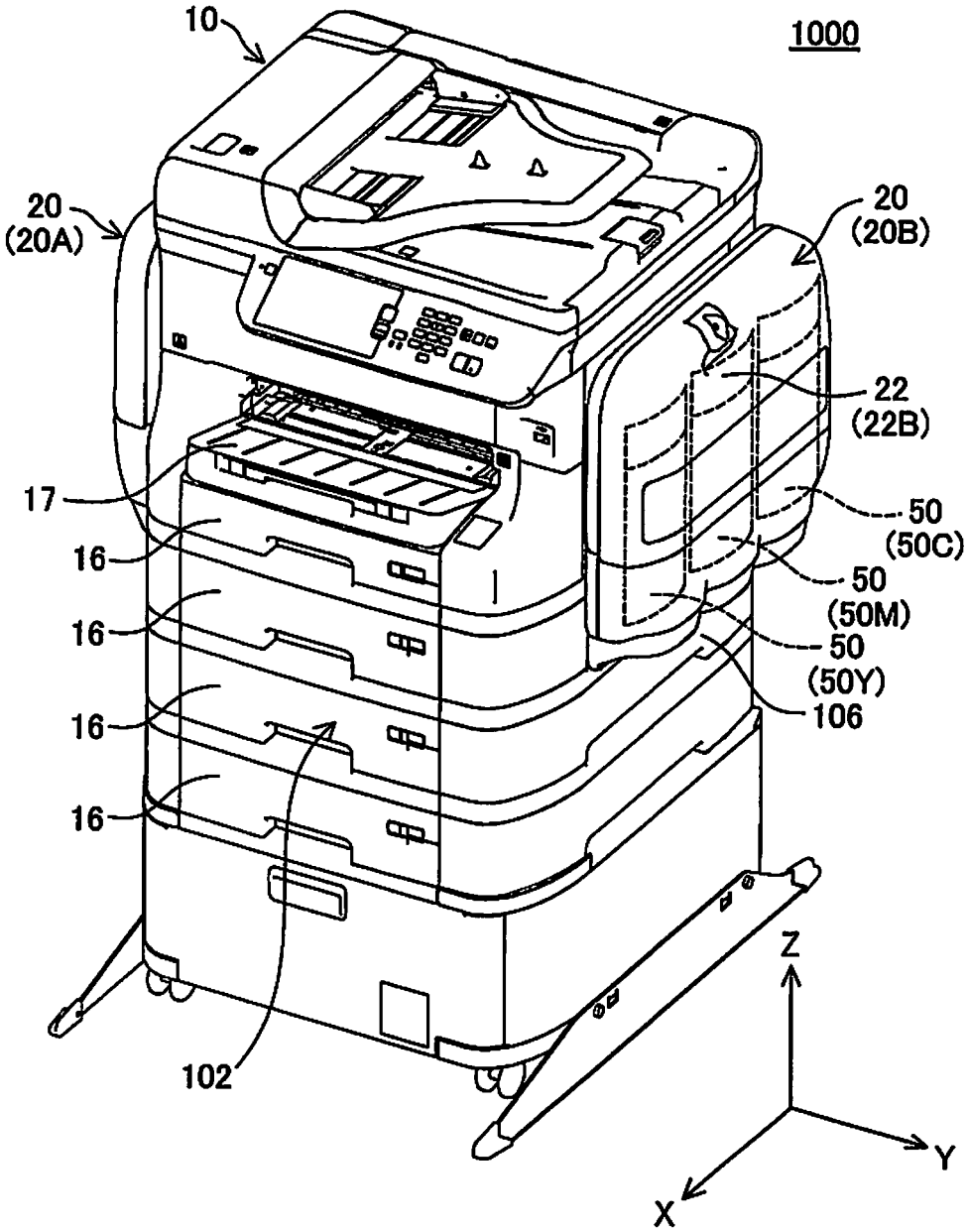
FIG. 2 is a second perspective view illustrating the schematic configuration of the liquid consumption system.
Figure 3:
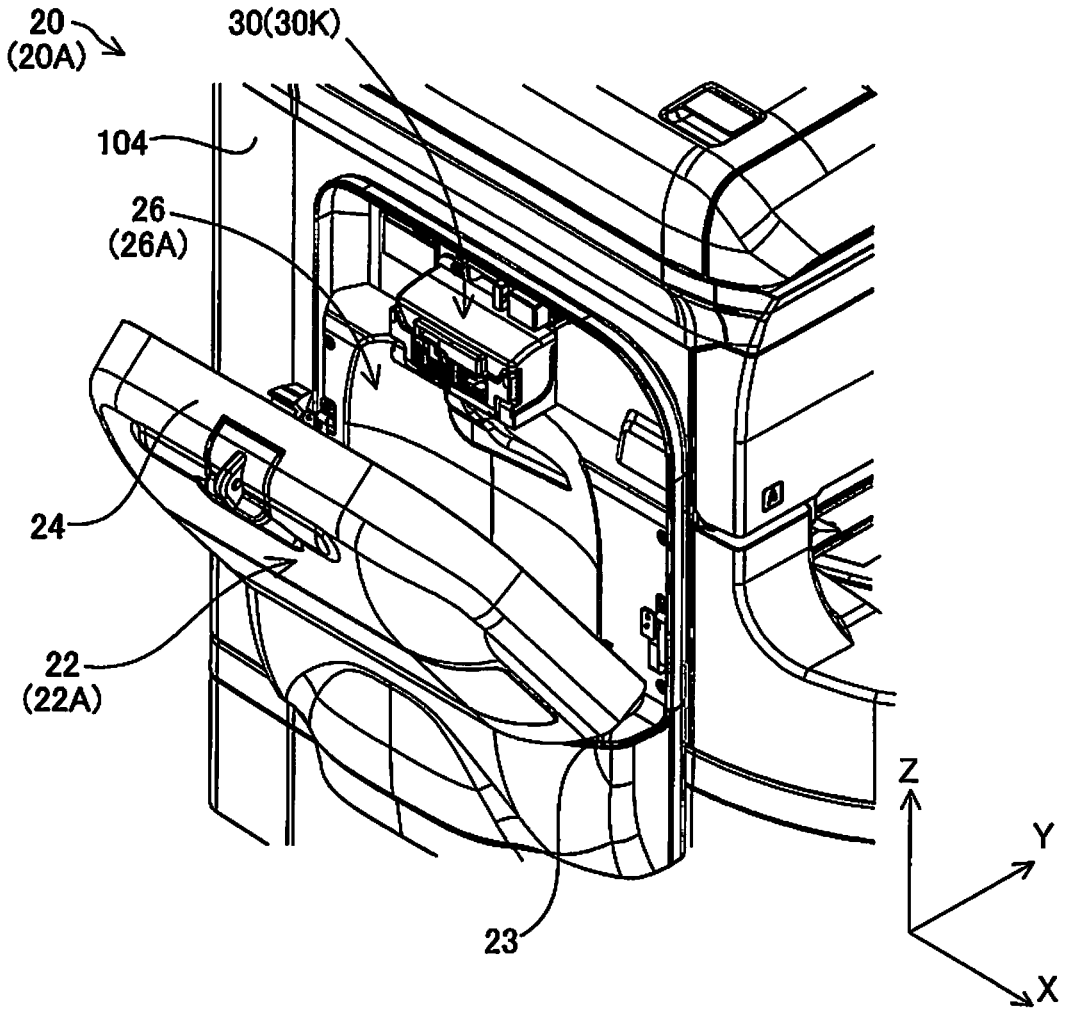
FIG. 3 is a first diagram illustrating a liquid supply device.
Figure 4:
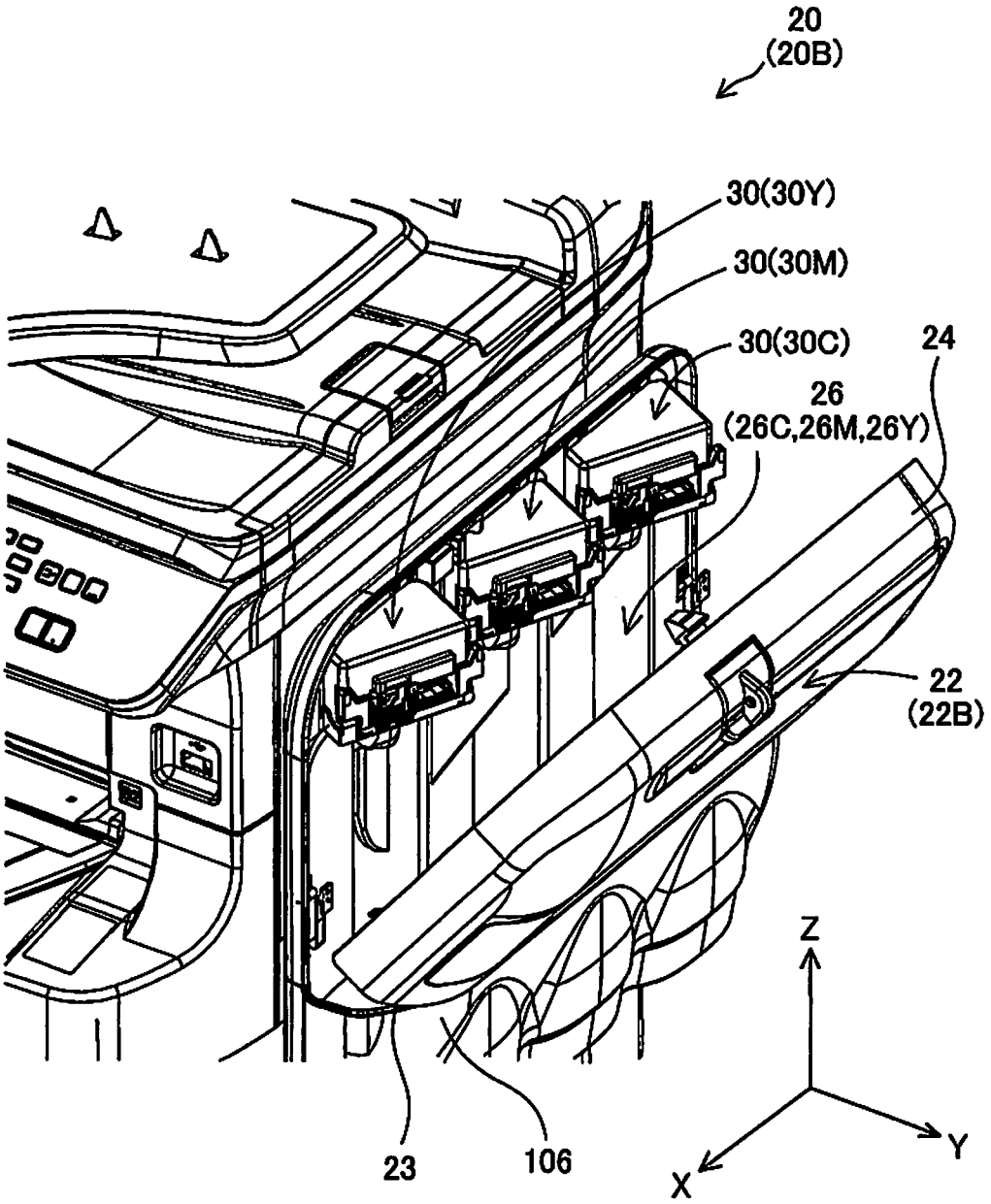
FIG. 4 is a second diagram illustrating the liquid supply device.
Figure 5A:
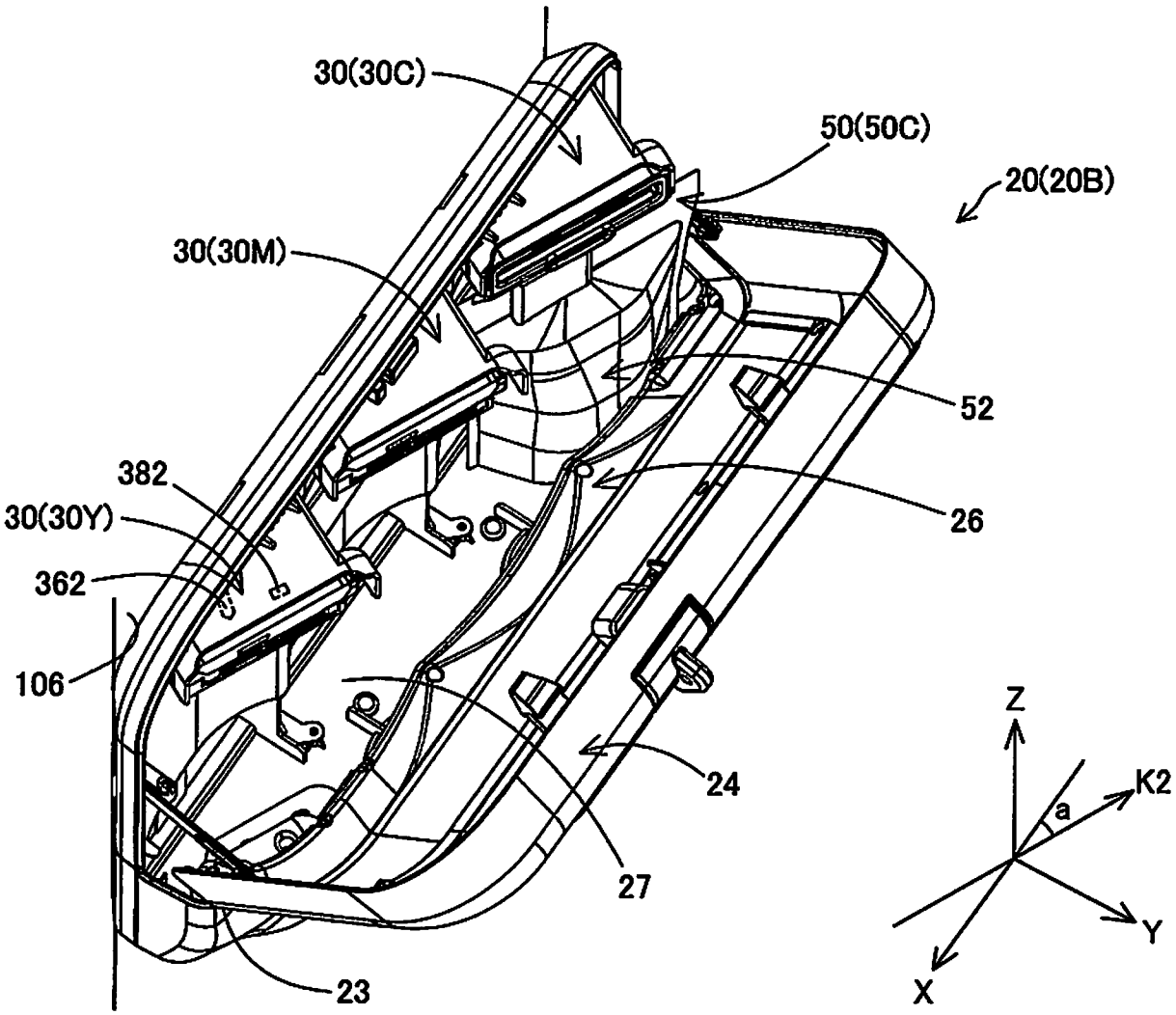
FIG. 5A is a third diagram illustrating the liquid supply device.

A-1. Configuration of Liquid Consumption System:

FIG. 1 is a first perspective view illustrating the schematic configuration of a liquid consumption system 1000. FIG. 2 is a second perspective view illustrating the schematic configuration of the liquid consumption system 1000. FIG. 3 is a first diagram illustrating a liquid supply device 20. FIG. 4 is a second diagram illustrating the liquid supply device 20. FIG. 5A is a third diagram illustrating the liquid supply device 20. FIG. 3 and FIG. 4 illustrate the state that liquid containers 50 described later are demounted. FIG. 5A illustrates the state that one liquid container 50 is mounted. XYZ axes that are orthogonal to one another are illustrated in FIGS. 1 to 5A.

As shown in FIG. 1, the liquid consumption system 1000 includes a printer 10 as a liquid consuming apparatus and two liquid supply devices 20. In the use state of the liquid consumption system 1000, the printer 10 is placed on a horizontal plane defined by an X-axis direction and a Y-axis direction. Accordingly a Z-axis direction is defined as vertical direction (direction of gravity, top-bottom direction); −Z-axis direction is defined as vertically downward and +Z-axis direction is defined as vertically upward. The liquid supply device 20 is configured to supply ink as a liquid to the printer 10. A liquid container 50 (liquid containing vessel unit 50, liquid container unit 50) included in the liquid supply device 20 is detachably connected with (mounted to) the printer 10.

The printer 10 is an inkjet printer. The printer 10 includes a recording mechanism 11, paper feed trays 16 and a paper eject tray 17. A plurality of the paper feed trays 16 are provided at positions of different heights in the vertical direction. The paper feed trays 16 are provided on an apparatus first surface (apparatus front face, front face) 102 as the front face of the printer 10. Recording media (for example, sheets of paper) on which images such as letters and characters are printed (recorded) by the printer 10 are placed in the paper feed trays 16.

The recording mechanism 11 includes a record head (not shown) configured to eject ink. The record head is connected with the liquid supply devices 20 through flow pipes such as tubes. The record head uses and ejects ink supplied from the liquid supply device 20 on the recording medium to perform recording (printing). The recording medium after recording is discharged to the paper eject tray 17.

Each of the two liquid supply devices 20 supplies ink to the printer 10 via a liquid introduction portion 362. The two liquid supply devices 20 are respectively provided on an apparatus second surface (also called apparatus first side face or apparatus first side wall) 104 and an apparatus third surface (also called apparatus second side face or apparatus second side wall) 106 that are arranged to intersect with the apparatus first surface (also called apparatus front face or apparatus front wall) 102 of the printer 10. The apparatus first surface 102 to the apparatus third surface 106 are respectively surfaces approximately perpendicular to the installation plane of the printer 10 in the use state of the printer 10. The apparatus second surface 104 and the apparatus third surface 106 are opposed to each other. The liquid supply device 20 provided on the apparatus second surface 104 is also called first liquid supply device 20A, and the liquid supply device 20 provided on the apparatus third surface 106 is also called second liquid supply device 20B. When there is no need to distinguish between the first and the second liquid supply devices 20A and 20B, these are simply called liquid supply devices 20.

As shown in FIG. 1, the first liquid supply device 20A includes one cover member 22 as a liquid container holder, one liquid container 50 and one mounting/demounting unit 30 (shown in FIG. 3). As shown in FIG. 2, the second liquid supply device 20B includes one cover member 22 as a liquid container holder, three liquid containers 50 and three mounting/demounting units 30 (shown in FIG. 4) provided corresponding to the respective liquid containers 50. In the description below, when there is a need to distinguish between the two cover members 22, these are expressed by reference signs "22A" and "22B". When there is a need to distinguish among the four liquid containers 50, these are expressed by reference signs "50K", "50C", "50M" and "50Y". When there is a need to distinguish among the four mounting/demounting units 30, these are expressed by reference signs "30K", "30C", "30M" and "30Y". The numbers of the cover members 22, the liquid containers 50 and the mounting/demounting units 30 are not limited to those described above. For example, the number of the liquid containers 50 may be three or less or may be five or more. The number of the mounting/demounting units 30 may be determined corresponding to the number of the liquid containers 50. The number of the cover members 22 may be one or may be three or more. The mounting/demounting unit 30 may be regarded as a component of the liquid supply device 20 or may be regarded as a component of the printer 10.

The four liquid containers 50 respectively contain (are filled with) different types of inks. According to this embodiment, yellow (Y), magenta (M), cyan (C) and black (K) inks are respectively contained in the different liquid containers 50. The liquid container 50K includes a liquid container body configured to contain black ink. The liquid container 50C includes a liquid container body configured to contain cyan ink. The liquid container 50M includes a liquid container body configured to contain magenta ink. The liquid container 50Y includes a liquid container body configured to contain yellow ink. As shown in FIGS. 3 and 4, the liquid containers 50 are placed in housing spaces 26 defined by the cover members 22 to place the liquid containers 50 therein. More specifically, the liquid container 50K is placed in a housing space 26A (shown in FIG. 3), and the liquid containers 50C, 50M and 50Y are placed in a housing space 26B (shown in FIG. 4). The mounting/demounting units 30 are also placed in the housing spaces 26.

The liquid container 50 is detachably mounted to the mounting/demounting unit 30 shown in FIGS. 3 and 4. The mounting/demounting unit 30K is placed inside of the cover member 22A. The mounting/demounting units 30C, 30M and 30Y are placed inside of the cover member 22B. As shown in FIG. 3, the mounting/demounting unit 30K is provided on the apparatus second surface 104 of the printer 10. As shown in FIG. 4, the mounting/demounting units 30C, 30M and 30Y are provided on the apparatus third surface 106 of the printer 10. When the liquid container 50 is mounted to the mounting/demounting unit 30, the ink contained in the liquid container 50 is supplied to the record head of the printer 10 by means of a supply mechanism (not shown) with pump function of the printer 10.

As shown in FIG. 3, the cover member 22A is attached to the apparatus second surface 104 as the outer wall of the printer 10. As shown in FIG. 4, the cover member 22B is attached to the apparatus third surface 105 as the outer wall of the printer 10. As shown in FIGS. 3 and 4, the cover member 22 is configured to be openable and closable by rotating the other end portion (top) 24 on the vertically upper side about one end portion (bottom) 23 on the vertically lower side as the support point. After consumption of ink contained in the liquid container 50, the user opens the cover member 22 and demounts the used liquid container 50 from the mounting/demounting unit 30. The user then mounts a new liquid container 50 to the mounting/demounting unit 30 and subsequently closes the cover member 22.

As shown in FIG. 5A, the cover member 22 has a bottom face 27 that forms the bottom of the housing space 26. The bottom face 27 is located below the mounting/demounting unit 30 in the direction of gravity. The bottom face 27 is a portion which the bottom of the liquid container 50 (or more specifically the bottom of a liquid container body 52) comes into contact with. A projection may be provided on the bottom face 27, such that the bottom of the liquid container 50 comes into contact with the projection.

As illustrated with regard to the mounting/demounting unit 30Y, the mounting/demounting unit 30 includes a liquid introduction portion 362 as a liquid supply connection structure and an electrical connection structure (supply-side electrical connection structure or an apparatus-side electrical connection structure) 382. A liquid supply portion 57 (shown in FIG. 9) of the liquid container 50 is connected with the liquid introduction portion 362. Ink contained in the liquid container 50 flows through the liquid supply portion 57 to the liquid introduction portion 362. The ink flowing to the liquid introduction portion 362 then flows to the record head of the recording mechanism 11 (shown in FIG. 1). A circuit board 582 (shown in FIG. 9) as a container-side electrical connection structure comes into contact with and is thereby electrically connected with the electrical connection structure 382. The liquid introduction portion 362 and the electrical connection structure 382 are arranged side by side along a K2-axis direction. The K2-axis direction is a direction that is orthogonal to the Z-axis direction and is parallel to a plane (horizontal plane) defined by the X-axis direction and the Y-axis direction. A substrate unit 58 described later may be regarded as the container-side electrical connection structure.

As shown in FIG. 5A, the liquid introduction portion 362 and the electrical connection structure 382 are respectively arranged at positions visible from the apparatus first surface 102. More specifically, the K2-axis direction in which the liquid introduction portion 362 and the electrical connection structure 382 are arranged side by side intersects with the direction perpendicular to the apparatus first surface 102 (X-axis direction) at an angle a that is larger than zero degree and is not greater than 90 degrees. This angle a is an angle formed counterclockwise from the K2 axis to the X axis when the liquid supply device 20 is placed on the apparatus third surface 106 (shown in FIG. 2) that is located on the right side of the apparatus first surface 102. This angle a is also an angle formed clockwise from the K2 axis to the X axis when the liquid supply device 20 is placed on the apparatus second surface 104 (shown in FIG. 1) that is located on the left side of the apparatus first surface 102. In other words, one of the liquid introduction portion 362 and the electrical connection structure 382 placed on a side nearer to the apparatus first surface 102 (for example, the liquid introduction portion 362) is located on the outer side (for example, +Y-axis direction side) of the outer wall (for example, the apparatus third surface 106) where the respective components 362 and 382 are supported, compared with the other placed on a side farther from the apparatus first surface 102 (for example, the electrical connection structure 382).

When the printer 10 is viewed from the apparatus first surface 102, this configuration enables the user to observe the liquid introduction portion 362 and the electrical connection structure 382. The user can thus readily recognize the position of connection where the liquid container 50 is connected with the mounting/demounting unit 30. This angle a is preferably between 15 degrees and 60 degrees inclusive and is more preferably between 20 degrees and 50 degrees inclusive. This configuration enables the position of connection to be readily recognized and suppresses expansion of the housing space 26 in the Y-axis direction. This accordingly allows the capacity of the housing space 26 to be efficiently utilized for placing the mounting/demounting unit 30 therein.

The first liquid supply device 20A (shown in FIG. 3) which the liquid container 50K containing black ink is mounted in may have the angle a equal to zero degree. The second liquid supply device 20B (shown in FIG. 4) which the liquid containers 50C, 50M and 50Y containing yellow and other color inks are mounted in may have the angle a satisfying the above range (greater than zero degree and not greater than 90 degrees). In other words, the direction in which the liquid introduction portion 362 and the electrical connection structure 382 of the first liquid supply device 20A are arranged side by side may be parallel to the outer wall (for example, the apparatus second surface 104 shown in FIG. 1). The liquid container 50K containing black ink is generally filled with a greater amount of ink, compared with the other liquid containers 50C, 50M and 50Y containing color inks. Accordingly the liquid container 50K has the larger outer shape than the other liquid containers 50C, 50M and 50Y. The respective components of the liquid container 50K provided corresponding to the liquid introduction portion 362 and the electrical connection structure 382 of the first liquid supply device 20A are, however, also arranged parallel to the apparatus second surface 104. This configuration suppresses the outer shape of the first liquid supply device 20A from being significantly different from the second outer shape of the second liquid supply device 20B.

Figure 5B:
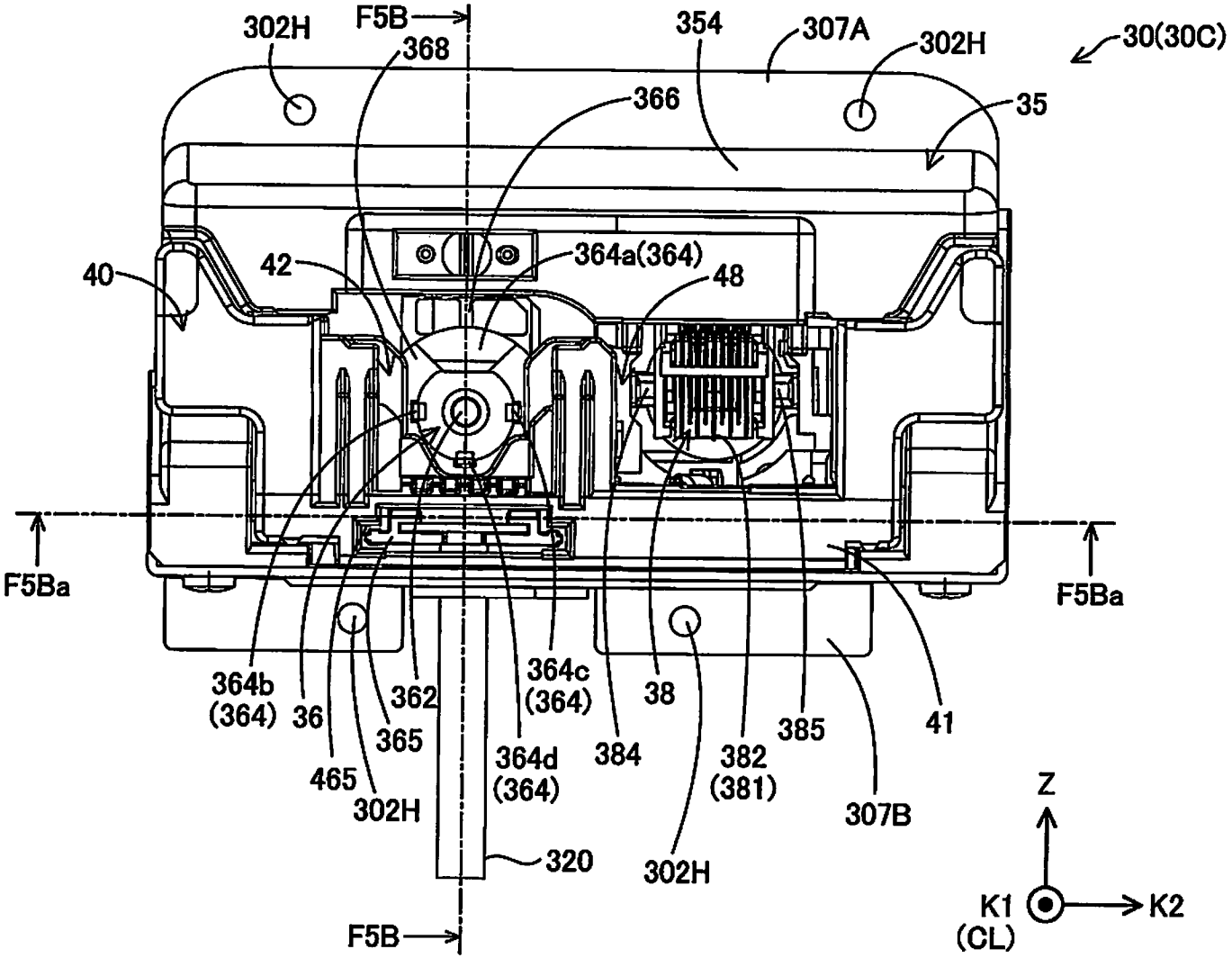
FIG. 5B is a front view illustrating a mounting/demounting unit.
Figure 5C:
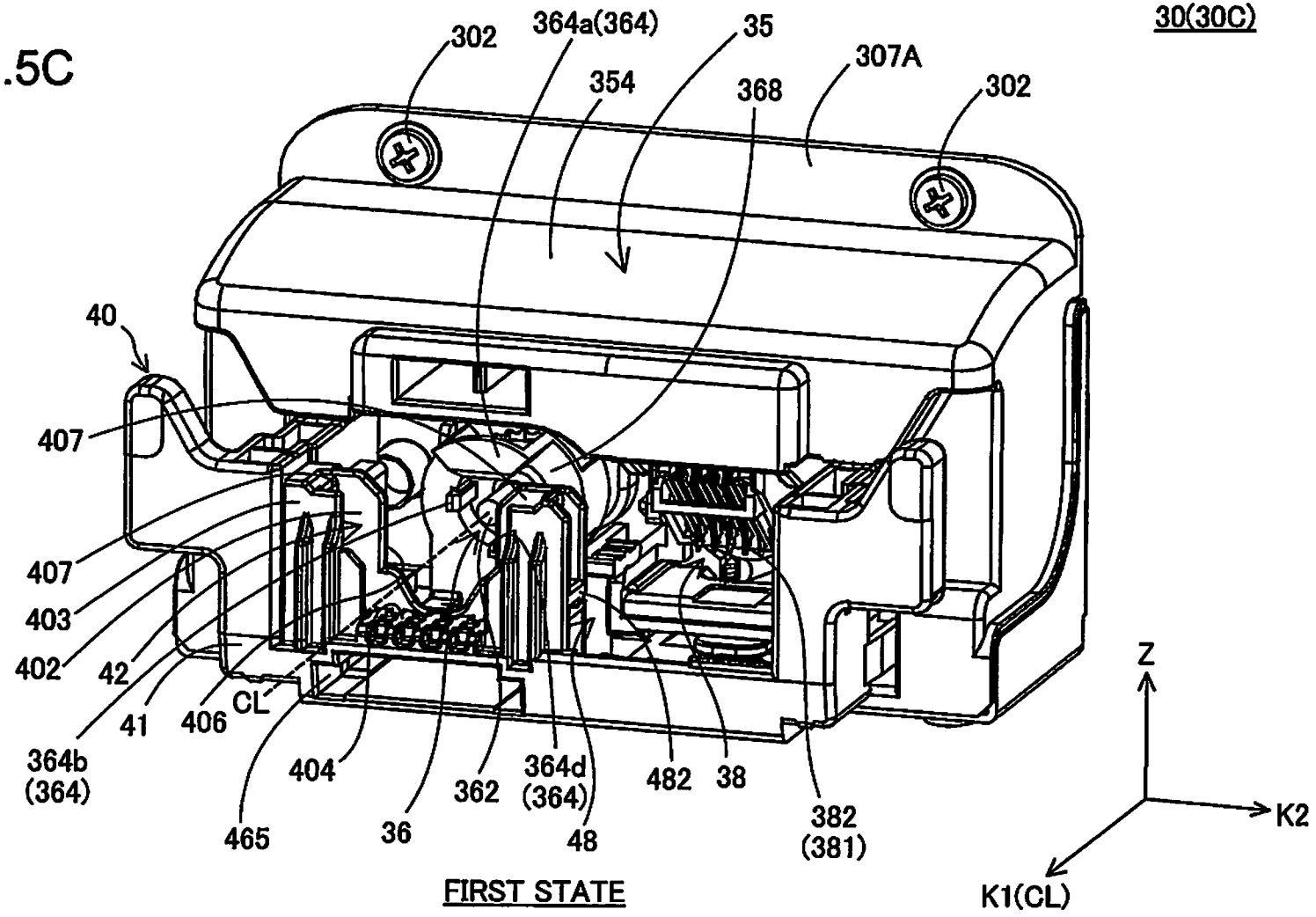
FIG. 5C is a diagram illustrating a first state in which a movable member is protruded outward relative to a stationary member.
Figure 6A:
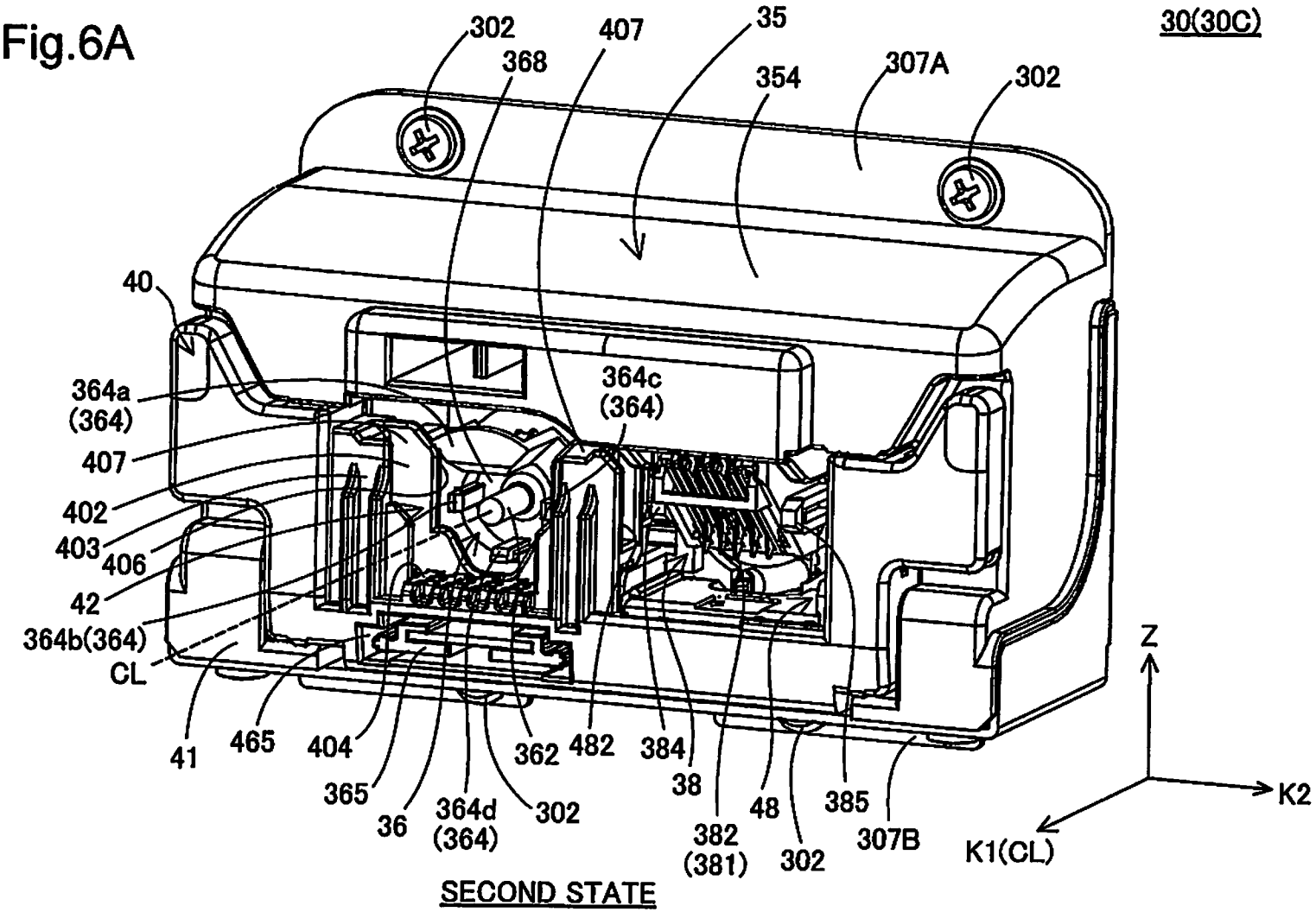
FIG. 6A is a diagram illustrating a second state in which the movable member is placed in the stationary member.
Figure 6B:
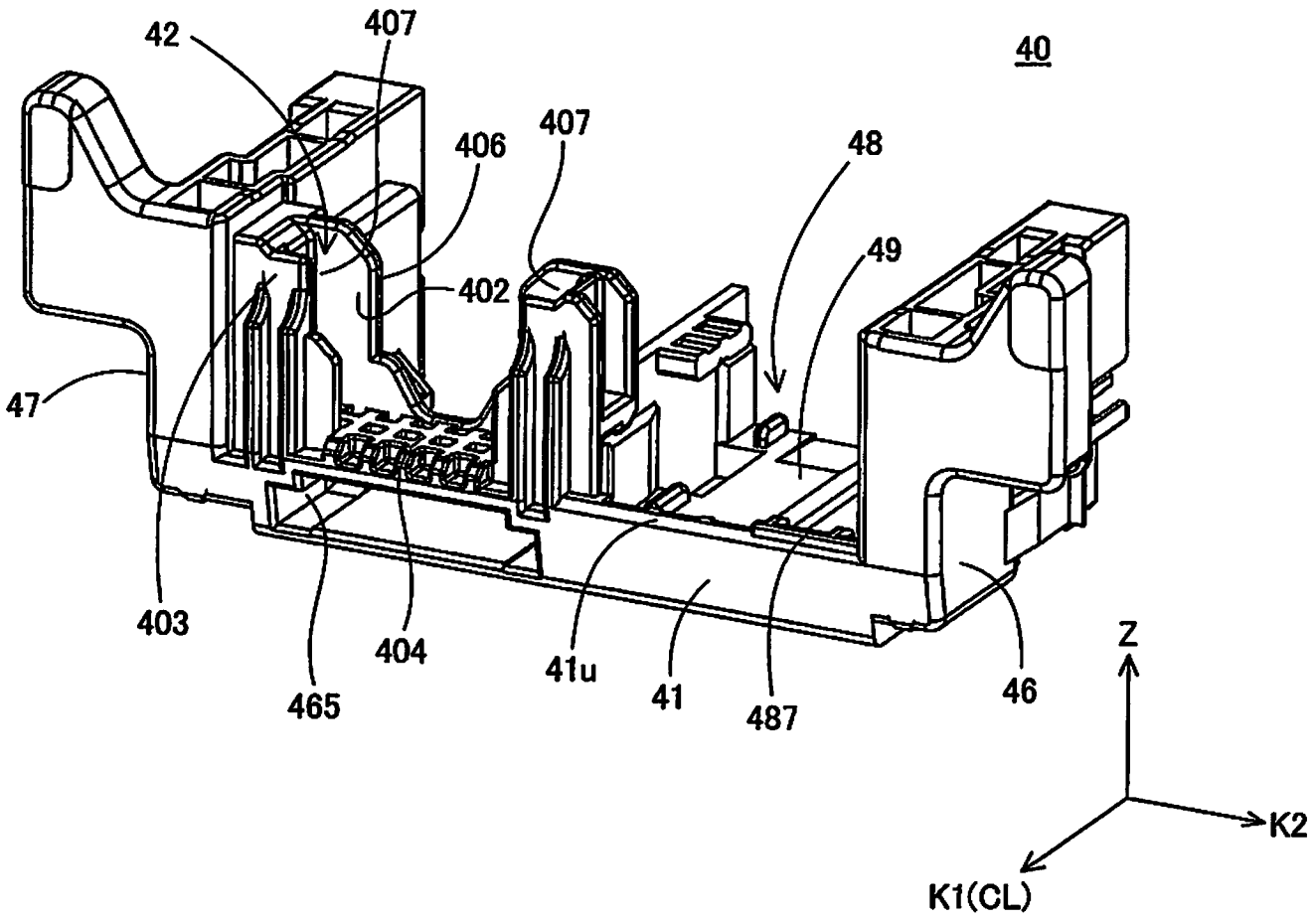
FIG. 6B is a first perspective view illustrating the movable member.
Figure 6C:
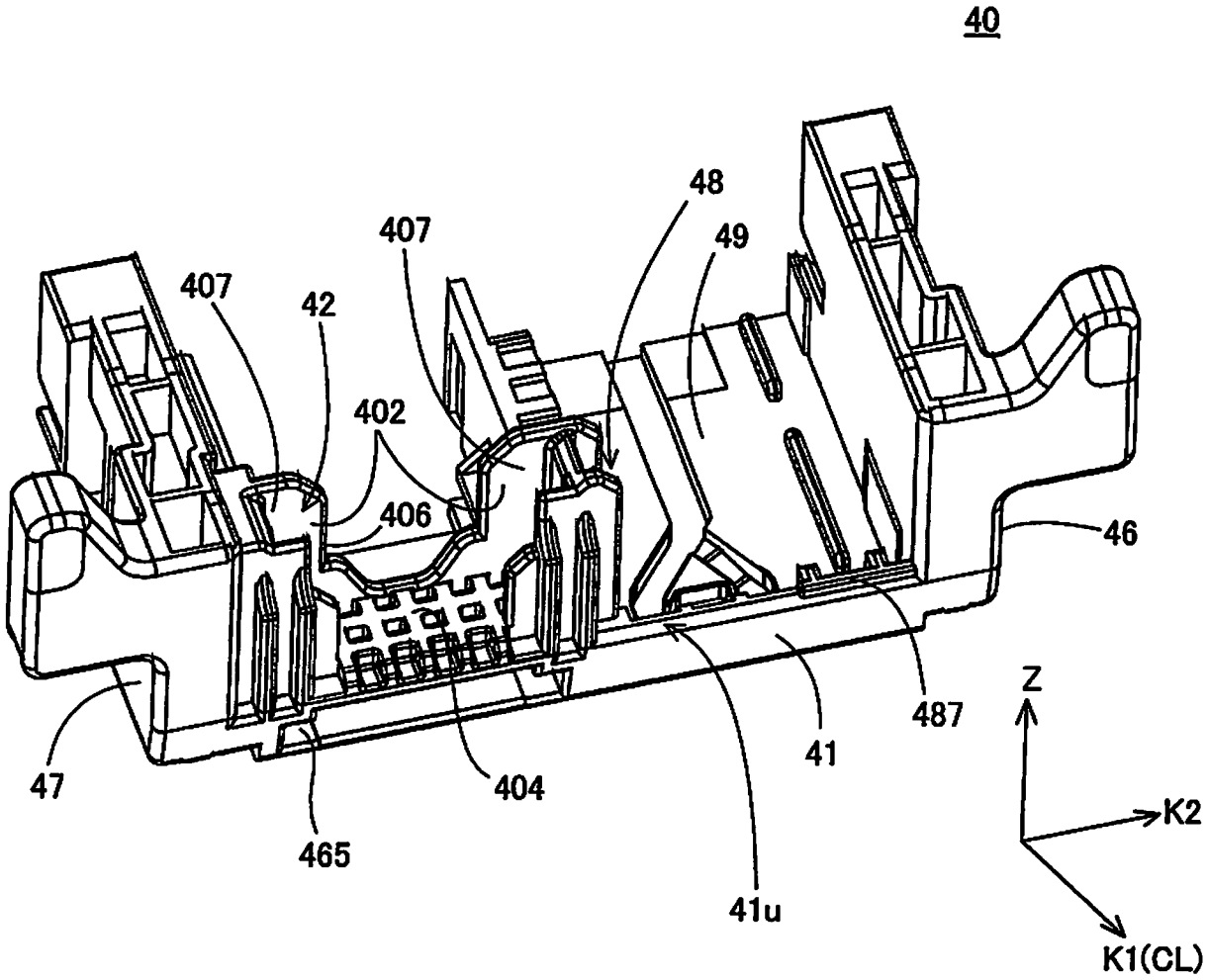
FIG. 6C is a second perspective view illustrating the movable member.
Figure 6D:
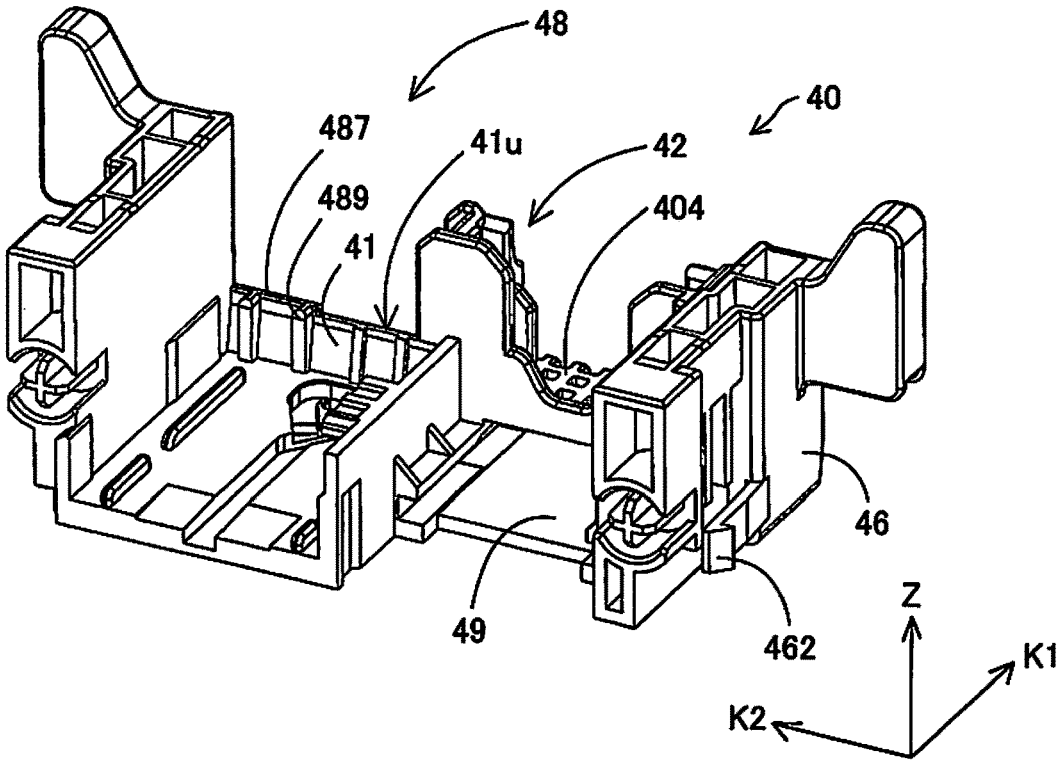
FIG. 6D is a third perspective view illustrating the movable member.

A-2. General Configuration of Mounting/Demounting Unit 30:

FIG. 5B is a front view illustrating the mounting/demounting unit 30. FIG. 5C is a first perspective view illustrating the mounting/demounting unit 30. FIG. 6A is a second perspective view illustrating the mounting/demounting unit 30. FIG. 5C illustrates a first state (set state) in which a movable member 40 is protruded outward relative to a stationary member 35. FIG. 6A illustrates a second state (mounted state) in which the movable member 40 is placed in the stationary member 35. FIG. 6B is a first perspective view illustrating the movable member 40. FIG. 6C is a second perspective view illustrating the movable member 40. FIG. 6D is a third perspective view illustrating the movable member 40. The configuration is described with regard to the mounting/demounting unit 30C as an example with reference to FIGS. 5B to 6D. The other mounting/demounting units 30K 30M and 30Y have similar configurations to that of the mounting/demounting unit 30C. As shown in FIG. 5C, the mounting/demounting unit 30 includes the stationary member 35 and the movable member (first support assembly) 40. The movable member 40 is movable in a +K1-axis direction and in a −K1-axis direction (first direction, connection direction).

The liquid container 50 is mounted to the mounting/demounting unit 30 by the following two operations. The state that the liquid container 50 is mounted to the mounting/demounting unit 30 is also called "mounted state (connected state)". The mounted state (connected state) denotes the state that the liquid supply portion 57 (flow portion 57) of the liquid container 50 described later is connected with the liquid introduction portion (liquid introduction needle) 362 of the mounting/demounting unit 30 and that the circuit board (container-side electrical connection structure) 582 of the liquid container 50 is electrically connected with the electrical connection structure (apparatus-side electrical connection structure) 382 of the mounting/demounting unit 30. In the mounted state, the ink contained in the liquid container 50 is allowed to flow toward the printer 10. In the description hereof, the description on the container-side electrical connection structure 582 may be perceived with replacement by contact portions cp.

First Operation:

The user makes the mounting/demounting unit 30 in the first state and subsequently sets the liquid container 50 on the movable member 40.

Second Operation:

After the first operation, the user presses the movable member 40 toward the stationary member 35 via the liquid container 50 and thereby makes the mounting/demounting unit 30 in the second state.

In the second state of the mounting/demounting unit 30, a lock mechanism restricts the motion of the movable member 40 in the +K1-axis direction relative to the stationary member 35. Pressing the movable member 40 inward (in the −K1-axis direction or first direction) relative to the stationary member 35 in the second state releases the lock by the lock mechanism. This enables the movable member 40 to be moved relative to the stationary member 35 such as to be protruded outward (in the +Z-axis direction) and changes over the state of the mounting/demounting unit 30 from the second state to the first state.

As shown in FIG. 5B, the stationary member 35 includes a first mounting wall 307A protruded upward in the direction of gravity and a second mounting wall 307B protruded downward in the direction of gravity. Two through holes 302H are formed in the first mounting wall 307A, and two through holes 302H are formed in the second mounting wall 307B. Screws 302 (shown in FIG. 5C) as fixing members are inserted into the respective through holes 302H. The mounting/demounting unit 30 (or more specifically the stationary member 35) is fixed to the surfaces 104 and 106 of the printer 10 (shown in FIGS. 3 and 4) by the four screws 302. More specifically, the mounting/demounting unit 30K (shown in FIG. 3) is fixed to the second surface 104 by a plurality of screws 302. The mounting/demounting units 30C, 30M and 30Y (shown in FIG. 4) are fixed to the third surface 106 by a plurality of screws 302.

As shown in FIG. 5B, the stationary member 35 includes a liquid introduction mechanism 36 and a contact mechanism (electrical connection unit) 38. The liquid introduction mechanism 36 includes a liquid introduction portion 362. Connecting a liquid supply portion of the liquid container 50 described later with the liquid introduction portion 362 enables the ink contained in the liquid container 50 to flow. The liquid introduction portion 362 communicates with a record head of the printer 10. The liquid introduction mechanism 36 and the contact mechanism 38 are respectively fixed to the stationary member 35 such as to communicate with the record head of the printer 10 via the stationary member 35.

The liquid introduction portion 362 is formed in a needle-like shape inside of which ink is allowed to flow. The liquid introduction portion 362 is extended along a center axis CL. A direction along this center axis CL (in which the liquid introduction portion 362 is extended) is defined as K1-axis direction. The K1-axis direction is orthogonal to the Z-axis direction. A direction orthogonal to the K1-axis direction and the Z-axis direction is defined as K2-axis direction. A plane defined by the K1-axis direction and the K2-axis direction is parallel to a plane defined by the X-axis direction and the Y-axis direction shown in FIG. 1. With regard to the K1-axis direction, an outward direction of the printer 10 is +K1-axis direction, and an inward direction of the printer 10 is −K1-axis direction.

The liquid introduction mechanism 36 and the contact mechanism 38 are arranged side by side along the K2-axis direction. The liquid introduction portion (liquid supply connection structure) 362 of the liquid introduction mechanism 36 and the electrical connection structure (apparatus-side electrical connection structure) 382 of the contact mechanism 38 are arranged adjacent to each other in the K2-axis direction. With regard to the K2-axis direction, a direction from the liquid introduction mechanism 36 toward the contact mechanism 38 is +K2-axis direction, and a direction from the contact mechanism 38 toward the liquid introduction mechanism 36 is −K2-axis direction. In the mounting/demounting unit 30, the Z-axis direction is also called "height direction", the K1-axis direction is also called "width direction", and the K2-axis direction is also called "depth direction".

The liquid introduction mechanism 36 includes a liquid introduction main body 368, the liquid introduction portion 362 and supply portion positioning structures 364. The liquid supply portion of the liquid container 50 described later is connected with the liquid introduction portion 362, so as to allow the ink contained in the liquid container 50 to flow. The liquid introduction portion 362 communicates with a record head of the printer 10 through a liquid flow tube 320. The liquid flow tube 320 is a flexible hose. The liquid supply portion (liquid lead-out portion) 57 (shown in FIG. 9) of the liquid container 50 is moved in the −K1-axis direction (first direction) accompanied with the motion of the movable member 40, so as to be connected with the liquid introduction portion 362.

As shown in FIG. 5C, the liquid introduction portion 362 is formed in a needle-like shape in which ink is allowed to flow. The liquid introduction portion 362 is extended along a center axis CL. The direction along this center axis CL (in which the liquid introduction portion 362 is extended) is defined as K1-axis direction. The K1-axis direction is orthogonal to the Z-axis direction and the K2-axis direction. A plane defined by the K1-axis direction and the K2-axis direction is parallel to a plane defined by the X-axis direction and the Y-axis direction shown in FIG. 1. With regard to the K1-axis direction, an outward direction of the printer 10 is +K1-axis direction, and an inward direction of the printer 10 is −K1-axis direction. The liquid introduction portion 362 and the supply portion positioning structures 364 are provided on the liquid introduction main body 368 such as to be protruded in the +K1-axis direction from the liquid introduction main body 368.

As shown in FIG. 5B, the supply portion positioning structures 364 are arranged to surround the liquid introduction portion 362 about the center axis CL (shown in FIG. 5C). The supply portion positioning structures 364 serve to position the liquid supply portion 57 in a direction intersecting with the K1-axis direction (direction along a plane parallel to the Z-axis direction and the K2-axis direction according to this embodiment) in the process of connecting the liquid supply portion (liquid lead-out portion) 57 with the liquid introduction portion 362.

The supply portion positioning structures 364 include a first supply portion positioning structure 364*a*, a second supply portion positioning structure 364*b*, a third supply portion positioning structure 364*c* and a fourth supply portion positioning structure 364*d*. The first to the fourth supply portion positioning structures 364*a* to 364*d* are members respectively protruded from the liquid introduction main body 368. The first supply portion positioning structure 364*a* is projected on the +K1-axis direction side of the other supply portion positioning structures 364*b* to 364*d*. The first supply portion positioning structure 364*a* is located immediately above the liquid introduction portion 362 and is projected on the +K1-axis direction side of the liquid introduction portion 362. In other words, the first supply portion positioning structure 364*a* is arranged to overlay the liquid introduction portion 362.

The first supply portion positioning structure 364*a* is located above the liquid introduction portion 362 in the direction of gravity (on the +Z-axis direction side of the liquid introduction portion 362). The second supply portion positioning structure 364*b* is located on the −K2-axis direction side of the liquid introduction portion 362. The third supply portion positioning structure 364*c* is located on the +K2-axis direction side of the liquid introduction portion 362. The fourth supply portion positioning structure 364*d* is located below the liquid introduction portion 362 in the direction of gravity (on the −Z-axis direction side of the liquid introduction portion 362). The first and the fourth supply portion positioning structures 364*a* and 364*d* are opposed to each other across the liquid introduction portion 362 in the direction of gravity. The second and the third supply portion positioning structures 364*b* and 364*c* are opposed to each other across the liquid introduction portion 362 in the K2-axis direction.

The first to the fourth supply portion positioning structures 364*a* to 364*d* respectively have planes that are arranged to face the liquid introduction portion 362. The liquid supply portion 57 of the liquid container 50 abuts on these planes, so that the liquid supply portion 57 is positioned relative to the liquid introduction portion 362 in a plane direction perpendicular to the K1-axis direction.

As shown in FIG. 5B and FIG. 6A, the liquid introduction main body 368 further has a guide structure 365 located below the liquid introduction portion 362 in the direction of gravity. The guide structure 365 is a plate-like member extended in the +K1-axis direction from a lower end of the liquid introduction main body 368. The guide structure 365 is placed in a guiding portion 465 that is included in the movable member 40 and is provided as a through hole as described later. The guide structure 365 is placed in the guiding portion 465 with some backlash in the Z-axis direction. This configuration allows the position of the movable member 40 to be finely adjusted relative to the liquid introduction portion 362 in the Z-axis direction when the movable member 40 is moved in the K1-axis direction.

As shown in FIGS. 5B to 6A, the contact mechanism 38 includes the electrical connection structure (main body-side electrical connection structure, apparatus-side electrical connection structure) 382 with a plurality of (nine in this embodiment) apparatus-side terminals 381 and a plurality of (two in this embodiment) apparatus-side board positioning structures 384 and 385. In the mounted state of the liquid container 50, the apparatus-side terminals 381 of the electrical connection structure 382 come into contact with and are thereby electrically connected with a circuit board of the liquid container 50. This allows for communication of various pieces of information (for example, the color of ink and the date of manufacture of the liquid container 50) between the circuit board of the liquid container 50 and the printer 10. The apparatus-side terminal 381 is formed from an elastically deformable metal leaf spring. The apparatus-side board positioning structures 384 and 385 are arranged on the respective sides with the apparatus-side terminals 381 of the electrical connection structure 382 placed therebetween in the K2-axis direction (in the direction in which the liquid introduction mechanism 36 and the contact mechanism 38 are arranged side by side). The apparatus-side board positioning structures 384 and 385 serve to determine the final position of the circuit board of the liquid container 50 relative to the electrical connection structure 382 in the process of mounting the liquid container 50 to the mounting/demounting unit 30. The apparatus-side board positioning structures 384 and 385 are members extended along the K1-axis direction. The details of the apparatus-side board positioning structures 384 and 385 will be described later.

The stationary member 35 includes a protective member 354 serving as a cover portion. The protective member 354 is arranged to cover at least the upper portion of the liquid introduction mechanism 36. The protective member 354 is also arranged to cover at least the upper portion of the contact mechanism 38. In other words, the protective member 354 is located above the liquid introduction portion 362 of the liquid introduction mechanism 36 and the electrical connection structure 382 of the contact mechanism 38 and is arranged to be protruded in the +K1-axis direction (direction opposite to the first direction) from the wall surface of the printer 10 (for example, the apparatus third surface 106 shown in FIG. 2). This configuration reduces the possibility that any extraneous substance such as dust entering the housing space 26 from above the mounting/demounting unit 30 in the course of opening and closing the cover member 22 adheres to the liquid introduction portion 362 and the electrical connection structure 382. This accordingly reduces the possibility that any extraneous substance is included in the ink supplied from the liquid container 50 to the printer 10. This also reduces the likelihood that any extraneous substance adheres to the electrical connection structure 382. This reduces failure in connection between the electrical connection structure 382 and the circuit board of the liquid container 50 described later. The presence of the protective member 354 also reduces the likelihood that the user directly touches the liquid introduction portion 362 and the electrical connection structure 382. This reduces the possibility that the liquid introduction portion 362 and the electrical connection structure 382 are damaged.

As shown in FIG. 5C, the movable member 40 is configured to be movable along the K1-axis direction relative to the stationary member 35. The movable member 40 includes a base portion 41, a supply portion support structure 42 and a board support structure 48. The base portion 41 forms a front face (front wall) of the movable member 40 located on the +K1-axis direction side. The base portion 41 is arranged approximately parallel to the Z-axis direction and the K2-axis direction. The supply portion support structure 42 and the board support structure 48 are respectively connected with the base portion 41. The supply portion support structure 42 and the board support structure 48 are members respectively extended in the +Z-axis direction (upward) from the base portion 41. The guiding portion 465 that is a hole passing through in the K1-axis direction is formed in the base portion 41. The guiding portion 465 is formed immediately below the supply portion support structure 42.

The supply portion support structure 42 is a member configured to determine the position of the liquid container 50 (more specifically, its liquid supply portion) relative to the liquid introduction portion 362. The supply portion support structure 42 comes into contact with a container body support assembly 51 of the liquid container 50 described later and thereby supports the container body support assembly 51 such that a liquid container body 52 is located below the container body support assembly 51 in the direction of gravity. When the mounting/demounting unit 30 is viewed along the K1-axis direction, the supply portion support structure 42 is provided at a position overlapping the liquid introduction portion 362. The supply portion support structure 42 is provided to form a recessed shape toward the −Z-axis direction. The supply portion support structure 42 has grooves 407 formed on respective sides in the K2-axis direction. Insertion of positioning structures of the liquid container 50 described later into the grooves 407 restricts the motion of the liquid supply portion of the liquid container 50 and roughly positions the liquid container 50 relative to the mounting/demounting unit 30. More specifically, the motion of the liquid supply portion of the liquid container 50 is restricted by a plurality of surfaces defining and forming the supply portion support structure 42 (for example, a first support surface 402, a second support surface 403 and a third support surface 404). This roughly positions the liquid container 50 relative to the mounting/demounting unit 30. A cutout portion 406 is formed in the first support surface 402 of the supply portion support structure 42 located on the liquid introduction portion 362-side. The cutout portion 406 is formed in a concave shape that is open on the +Z-axis direction side. When the mounting/demounting unit 30 is viewed along the K1-axis direction, the cutout portion 406 is provided at a position overlapping the liquid introduction portion 362. In the first state where the movable member 40 is moved to the most +K1-axis direction side relative to the stationary member 35, the cutout portion 406 is located on the +K1-axis direction side of the liquid introduction portion 362. As shown in FIG. 6A, a leading end of the liquid introduction portion 362 is located inside of the cutout portion 406 in the second state.

The board support structure 48 is a member configured to determine the position of the liquid container 50 (more specifically, its circuit board) relative to the contact mechanism 38. When the mounting/demounting unit 30 is viewed along the K1-axis direction, the board support structure 48 is provided at a position overlapping the contact mechanism 38. The board support structure 48 is provided to form a recessed shape toward the −Z-axis direction. The motion of the circuit board of the liquid container 50 is restricted by a plurality of surfaces defining and forming the board support structure 48 (for example, a first board support surface 482).

As described above, the movable member 40 is used to connect the liquid container 50 with the printer 10. The movable member 40 is thus also called "connecting member 40". The connecting member 40 is colored in the color of ink contained in the corresponding liquid container 50K, 50C, 50M or 50Y which is to be connected with the mounting/demounting unit 30 among the plurality of liquid containers 50K, 50C, 50M and 50K provided to respectively contain different colors of inks. For example, the connecting member 40 included in the mounting/demounting unit 30Y that is to be connected with the liquid container 50Y containing yellow ink is colored in yellow. Herein "colored in the color of ink" includes colored in a similar color to the color of ink. The "similar color" may be any color in a range that enables the user to identify the corresponding liquid container 50 to be connected with when observing the connecting member 40. The "similar color" means, for example, colors having the hue differences of 0 (zero) to 3 in the 20 color wheel (also called modified Munsell color wheel) employed in JIS standards (JIS Z 8102).

As shown in FIG. 6D, part of a bottom 41*u* of the board support structure 48 (top of the base portion 41) forms an apparatus-side rotation restriction element 487. The apparatus-side rotation restriction element 487 is a member projected on the +Z-axis direction side of the remaining part of the bottom 41*u*. The apparatus-side rotation restriction element 487 abuts on the liquid container 50 to restrict rotation of the liquid container 50. The board support structure 48 also has an apparatus-side restriction element 489 provided on a rear face of the base portion 41. The apparatus-side restriction element 489 is a rib formed from the bottom to the top of the rear face of the base portion 41. The apparatus-side restriction element 489 abuts on the liquid container 50 to restrict the motion of the liquid container 50 in the +K1-axis direction (direction opposite to the first direction).

As shown in FIGS. 6B to 6D, the movable member 40 further includes a first side face (first side wall) 46, a second side face (second side wall) 47 and a bottom 49 (bottom wall 49). The base portion 41, the first side face 46 and the second side face 47 are members respectively extended in the +Z-axis direction from the bottom 49. The first side face 46 and the second side face 47 are opposed to each other. The first side face 46 and the second side face 47 are approximately parallel to the Z-axis direction and the K1-axis direction. The bottom 49 is approximately parallel to the K1-axis direction and the K2-axis direction.

As shown in FIG. 6D, a locking pawl 462 is provided on the first side face 46. A locking pawl 472 (shown in FIG. 6G) is provided on the second side face 47, like the first side face 46. The locking pawls 462 and 472 are locked to the stationary member 35, so as to prevent an excessive motion of the movable member 40 in the +K1-axis direction. This configuration prevents the movable member 40 from being dropped off from the stationary member 35.

A-3. General Configuration of Liquid Introduction Mechanism 36

Figure 6E:
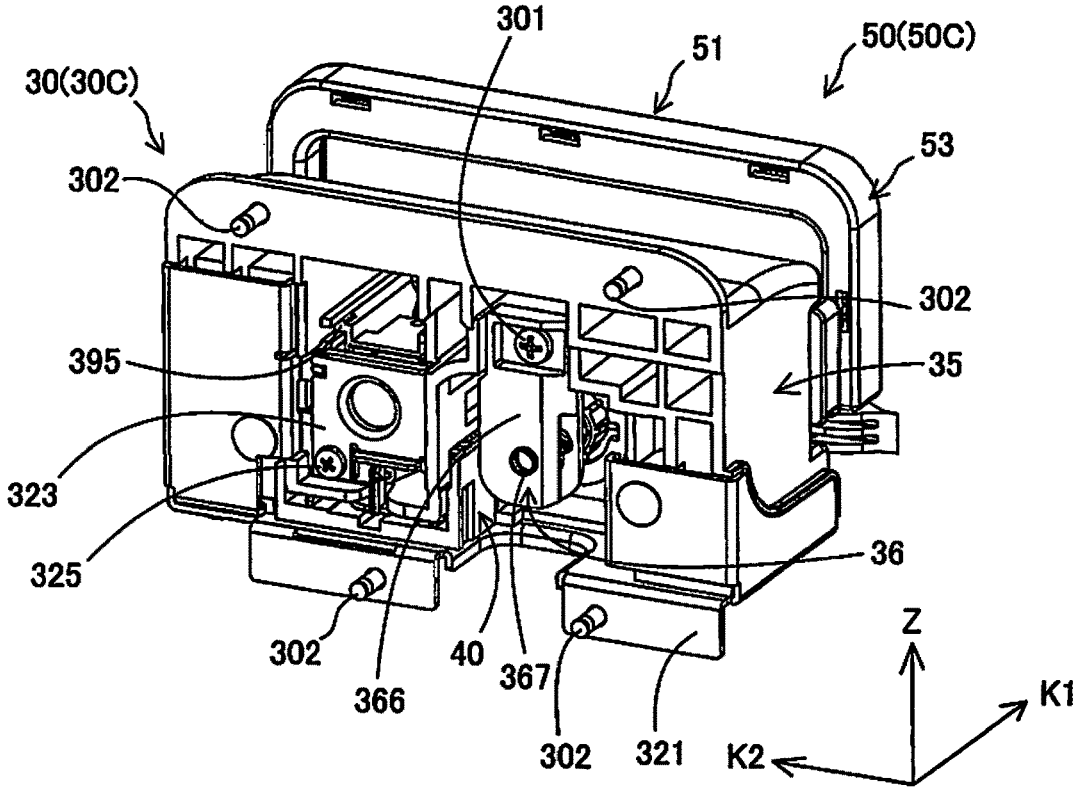
FIG. 6E is a perspective view illustrating the mounting/demounting unit.
Figure 6F:
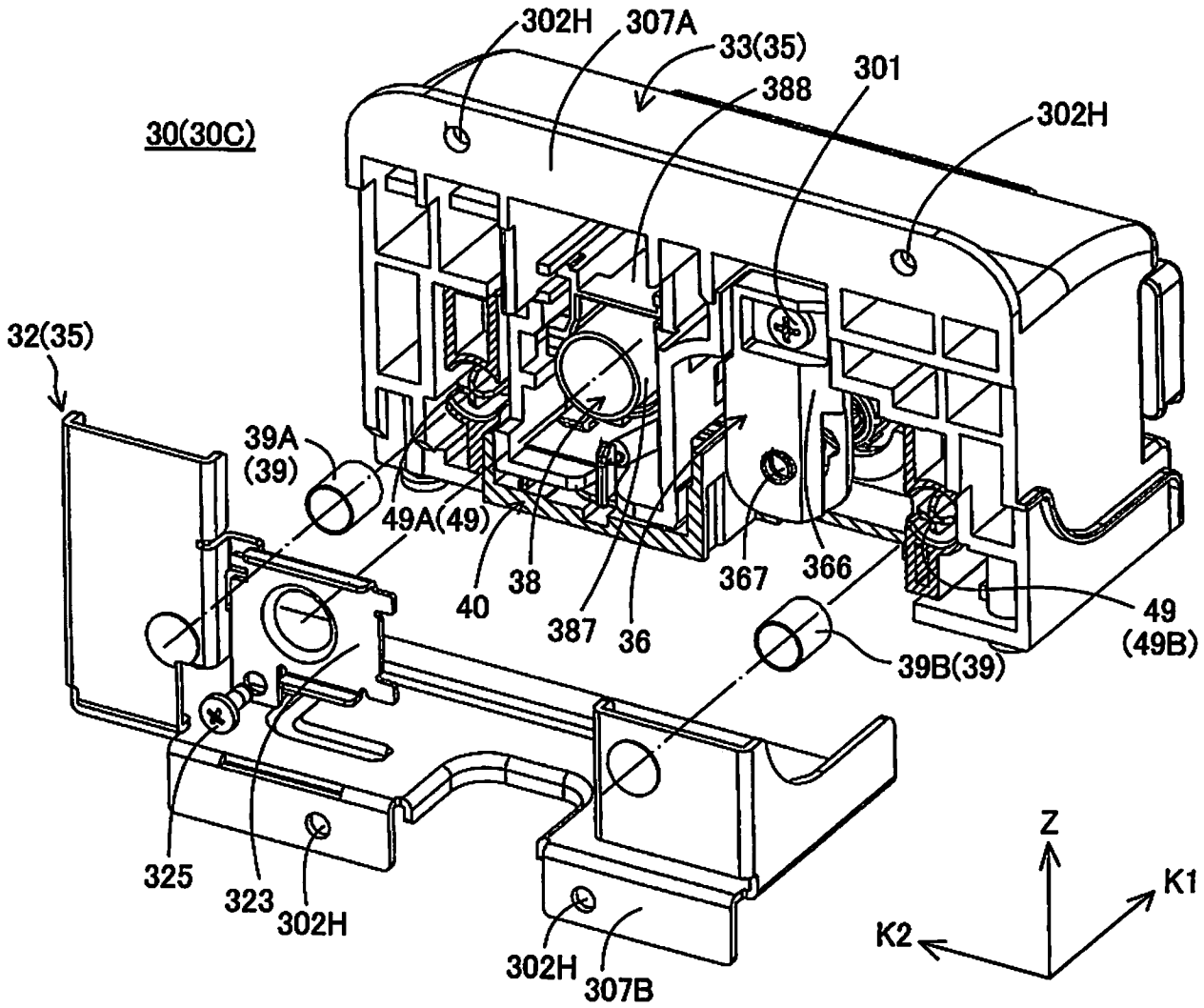
FIG. 6F is an exploded perspective view illustrating the mounting/demounting unit.
Figure 6G:
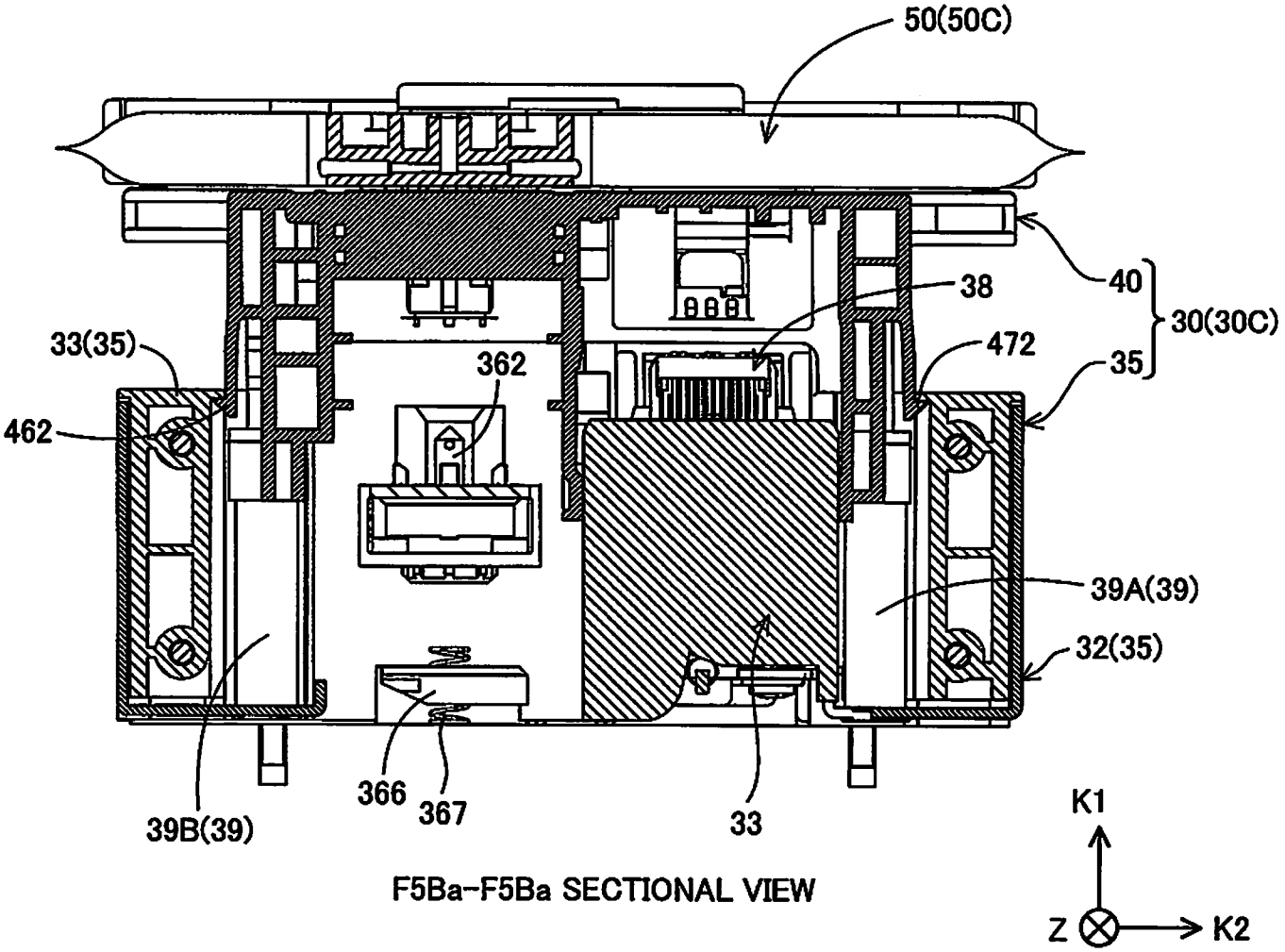
FIG. 6G is an F5Ba-F5Ba sectional view of FIG. 5B.

FIG. 6E is a perspective view illustrating the mounting/demounting unit 30. FIG. 6F is an exploded perspective view illustrating the mounting/demounting unit 30. FIG. 6G is an F5Ba-F5Ba sectional view of FIG. 5B. For the purpose of better understanding, a container body support assembly 51 of the liquid container 50 set to the mounting/demounting unit 30 is also illustrated in FIG. 6E. For the purpose of better understanding, a −K1-axis direction end face of the movable member 40 is shown by single hatching in FIG. 6F. For the purpose of better understanding, the liquid container 50 is also illustrated in FIG. 6G.

As shown in FIGS. 6E and 6F, the liquid introduction mechanism 36 is attached to the stationary member 35 (more specifically its second stationary member 33) by means of a screw 301. The liquid introduction mechanism 36 includes a fixation structure 366 as a second support structure directly attached to the stationary member 35 and a coil spring 367 as a pressing member.

The coil spring 367 is inserted through the fixation structure 366. The coil spring 367 has one end projected on the −K1-axis direction side of the fixation structure 366 and the other end projected on the +K1-axis direction side of the fixation structure 366. The liquid introduction portion 362 is pressed in the +K1-axis direction by the coil spring 367. The fixation structure 366 supports the liquid introduction mechanism 36 including the liquid introduction portion 362 to be displaceable in a direction intersecting with the first direction (−K1-axis direction). According to this embodiment, the direction intersecting with the first direction is a direction along a plane parallel to the K2-axis direction and the Z-axis direction. The details of this configuration will be described later.

As shown in FIG. 6F, the stationary member 35 includes a first stationary member 32, a second stationary member 33 and a sheet metal 323. A second mounting wall 307B is provided on the first stationary member 32, and a first mounting wall 307A is provided on the second stationary member 33. The first stationary member 32 serves as an auxiliary member to support the second stationary member 33. Two coil springs 39A and 39B are placed as pressing members between the first stationary member 32 and the movable member 40. The coil springs 39A and 39B are arranged with the contact mechanism 38 and the liquid introduction mechanism 36 placed therebetween in the K2-axis direction. When there is no need to distinguish between the two coil springs 39A and 39B, these are expressed by a reference sign "39".

The coil spring 39 has one end arranged to abut on the first stationary member 32 and the other end arranged to abut on the movable member 40. A spring receiver 49A of the movable member 40 is inserted in the other end of the coil spring 39A, and a spring receiver 49B of the movable member 40 is inserted in the other end of the coil spring 39B. When there is no need to distinguish between the two spring receivers 49A and 49B, these are expressed by a reference sign "49".

When the mounting/demounting unit 30 is in the second state shown in FIG. 6A, the coil spring 39 presses the movable member 40 in the +K1-axis direction. In the second state, a non-illustrated lock mechanism restricts the motion of the movable member 40 in the +K1-axis direction. When the lock mechanism is unlocked, the movable member 40 is pressed toward the +K1-axis direction by the pressing force of the coil spring 39, so that the mounting/demounting unit 30 shifts to the first state shown in FIG. 5C. As shown in FIG. 6G, the locking pawls 462 and 472 are locked to the stationary member 35, in order to prevent the movable member 40 from being excessively moved in the +K1-axis direction relative to the stationary member 35. This configuration prevents the movable member 40 from being dropped off from the stationary member 35.

As shown in FIGS. 6E and 6F, the sheet metal 323 is attached to the second stationary member 33 by means of a screw 325.

A-4. Detailed Configuration of Contact Mechanism 38 and Mounting/Demounting Unit 30

Figure 6H:
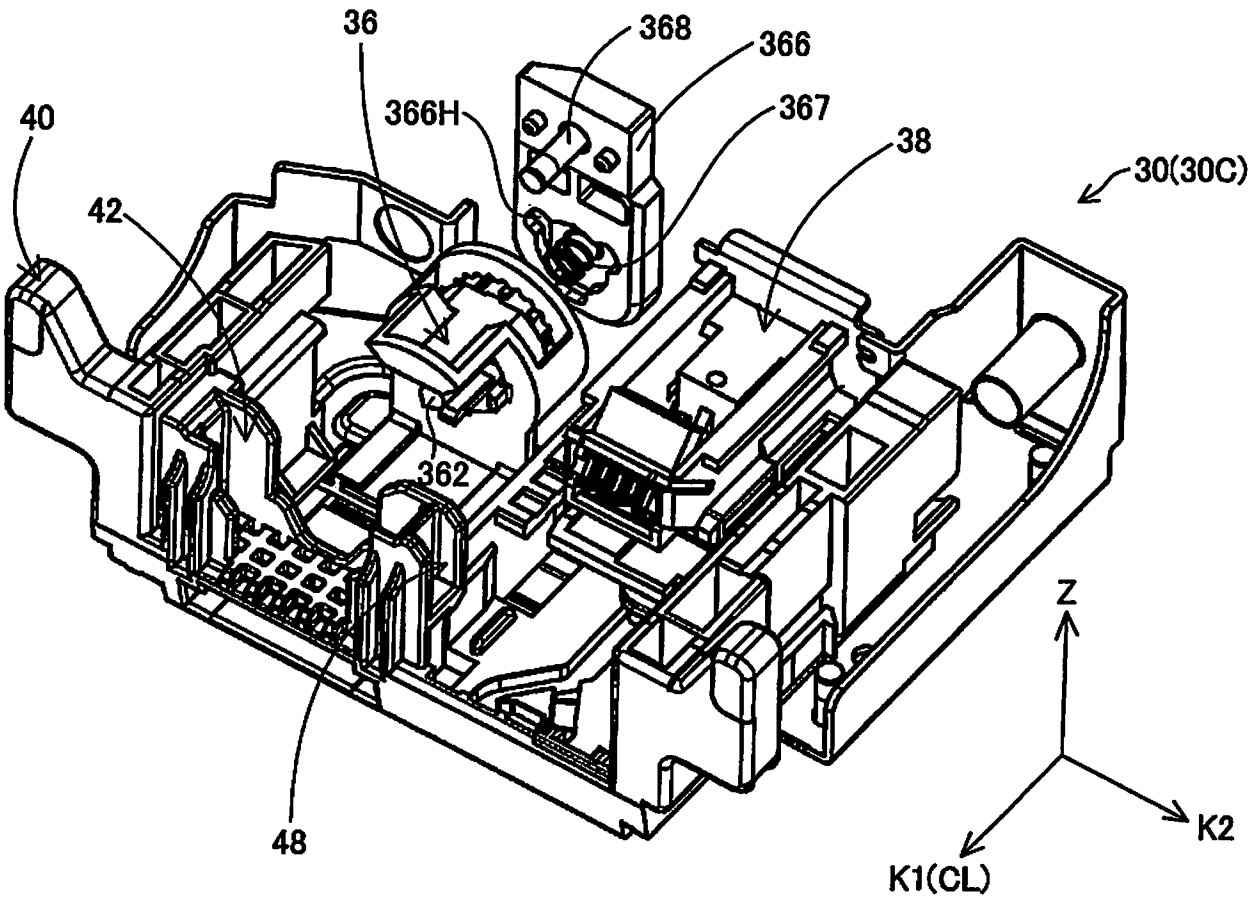
FIG. 6H is a perspective view illustrating part of the mounting/demounting unit.
Figure 6I:
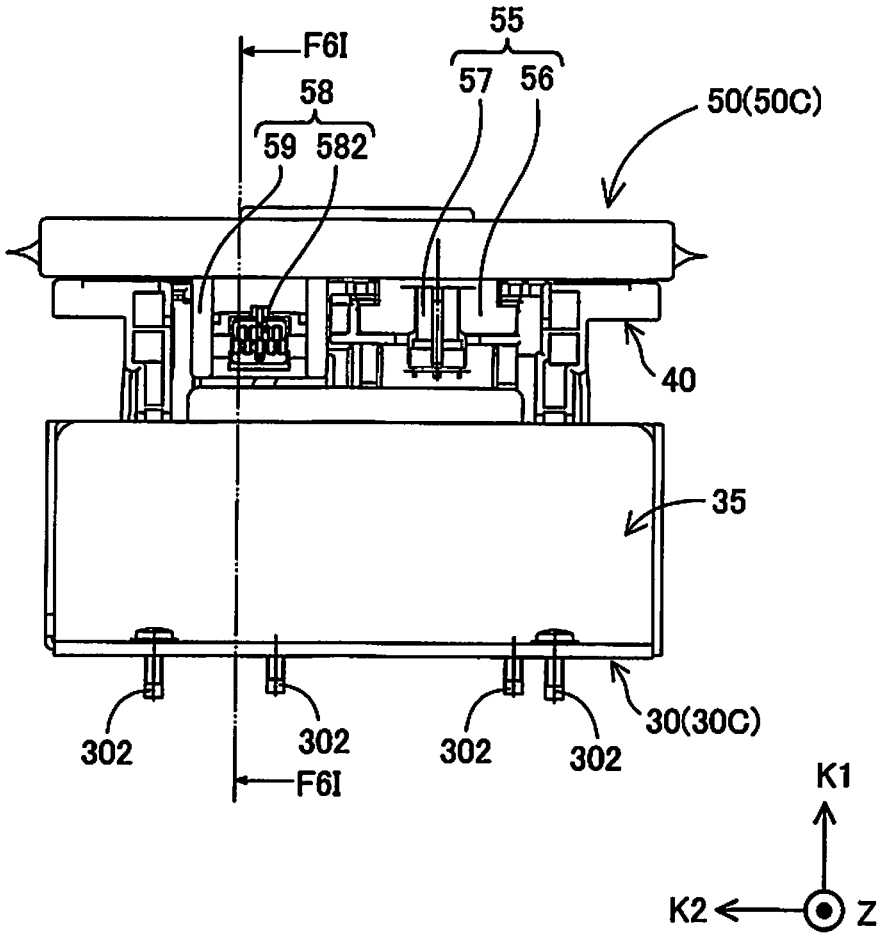
FIG. 6I is a top view illustrating the mounting/demounting unit.
Figure 6J:
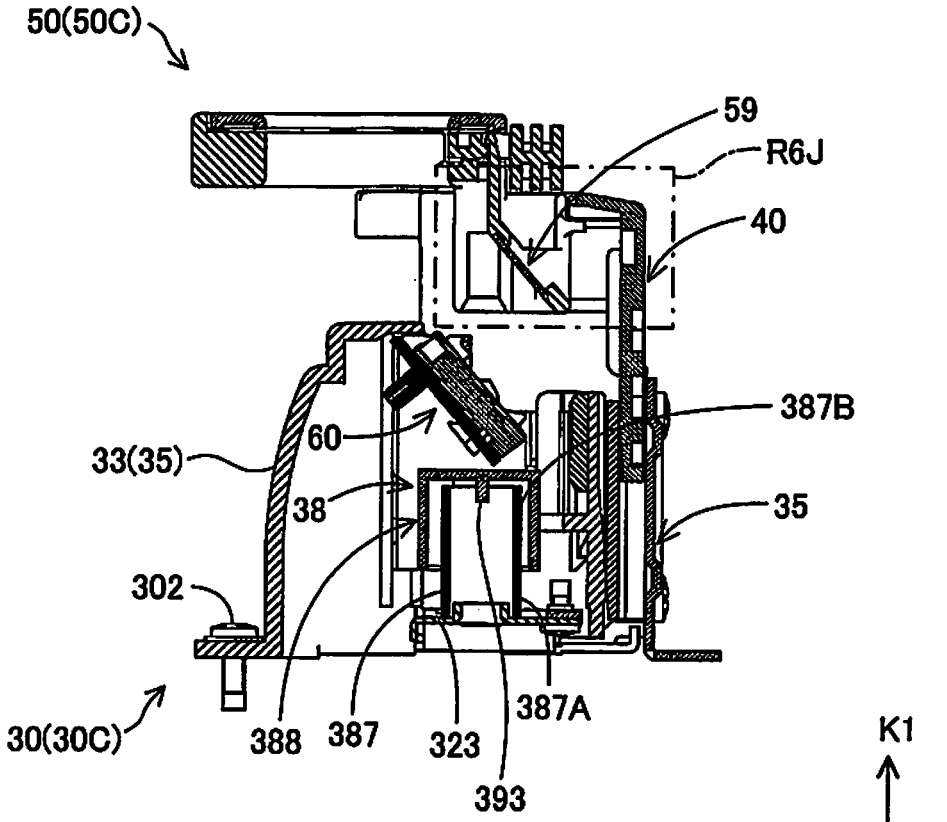
FIG. 6J is an F6I-F6I sectional view of FIG. 6I.
Figure 6K:
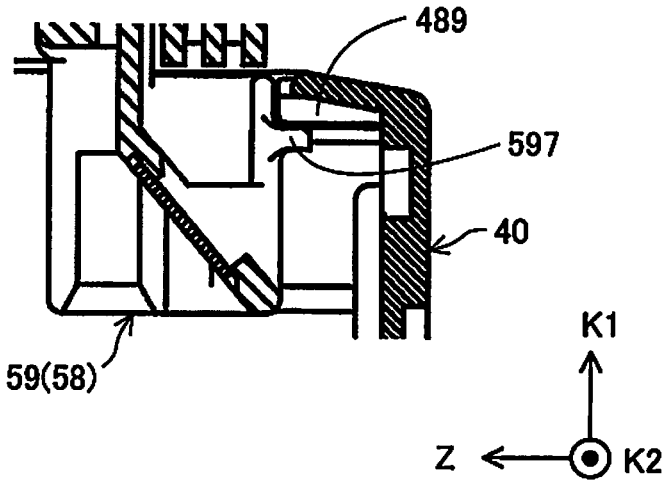
FIG. 6K is a partial enlarged view of an area R6J in FIG. 6J.
Figure 6L:
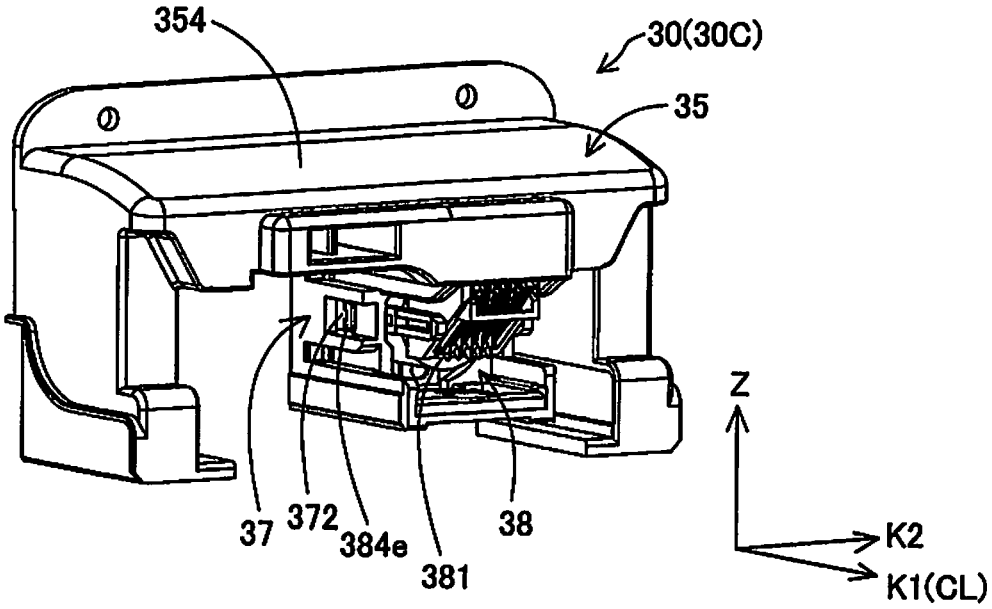
FIG. 6L is a perspective view illustrating the state that a contact mechanism is mounted to the stationary member.
Figure 6M:
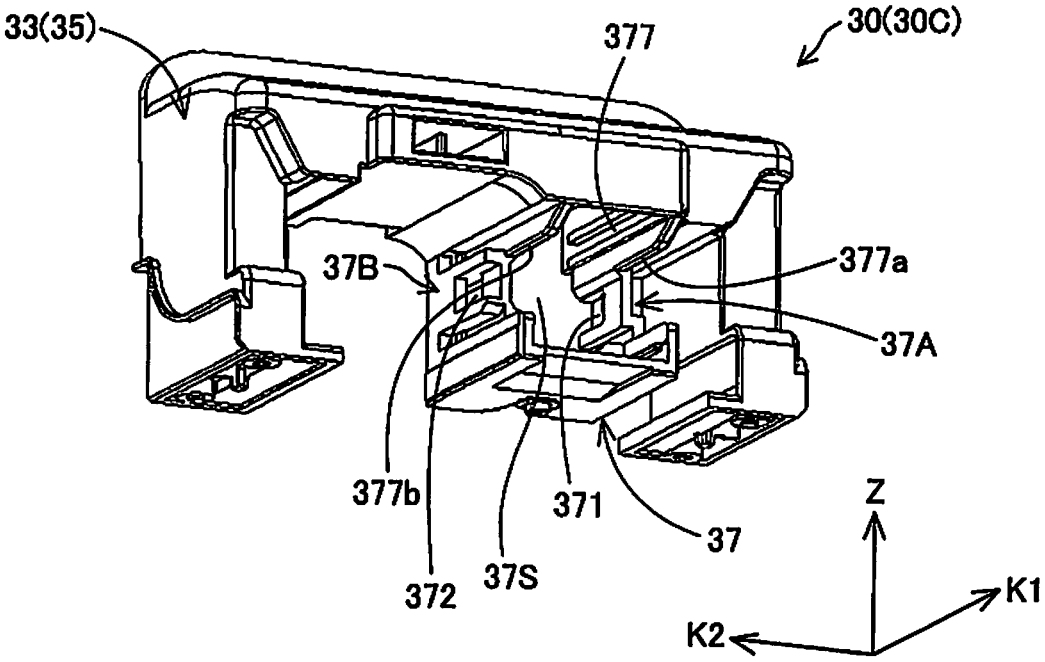
FIG. 6M is a perspective view illustrating the stationary member.
Figure 6N:
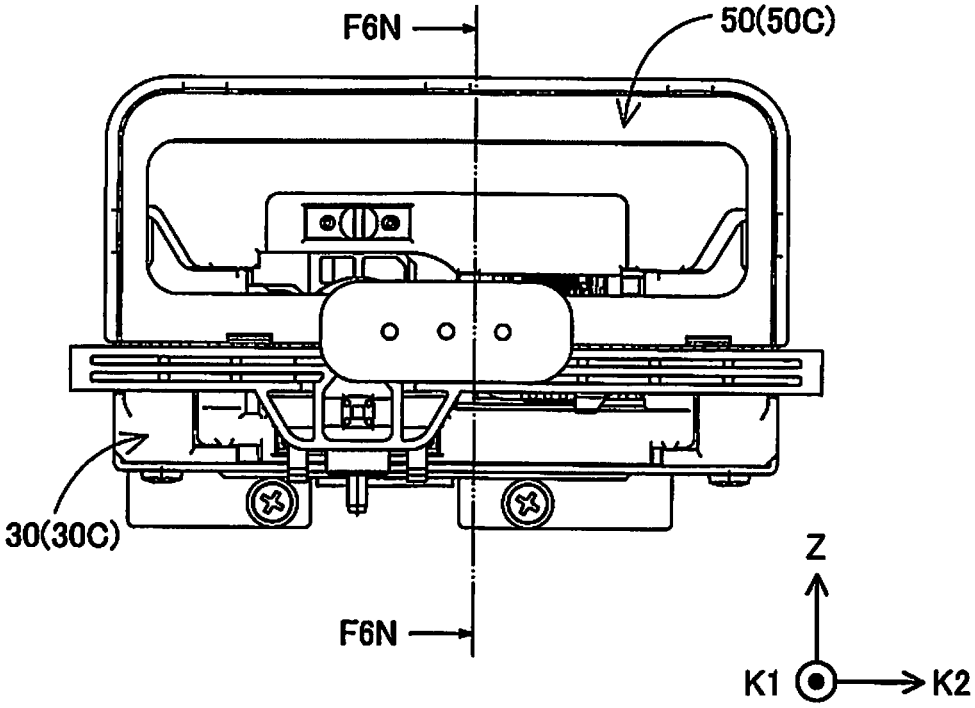
FIG. 6N is a front view illustrating the mounting/demounting unit.
Figure 6O:
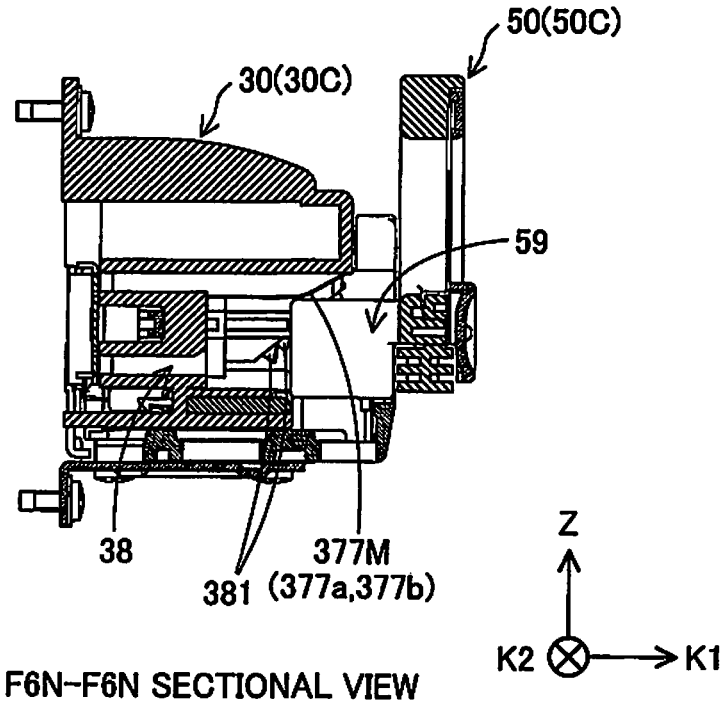
FIG. 6O is an F6N-F6N sectional view of FIG. 6N.
Figure 6P:
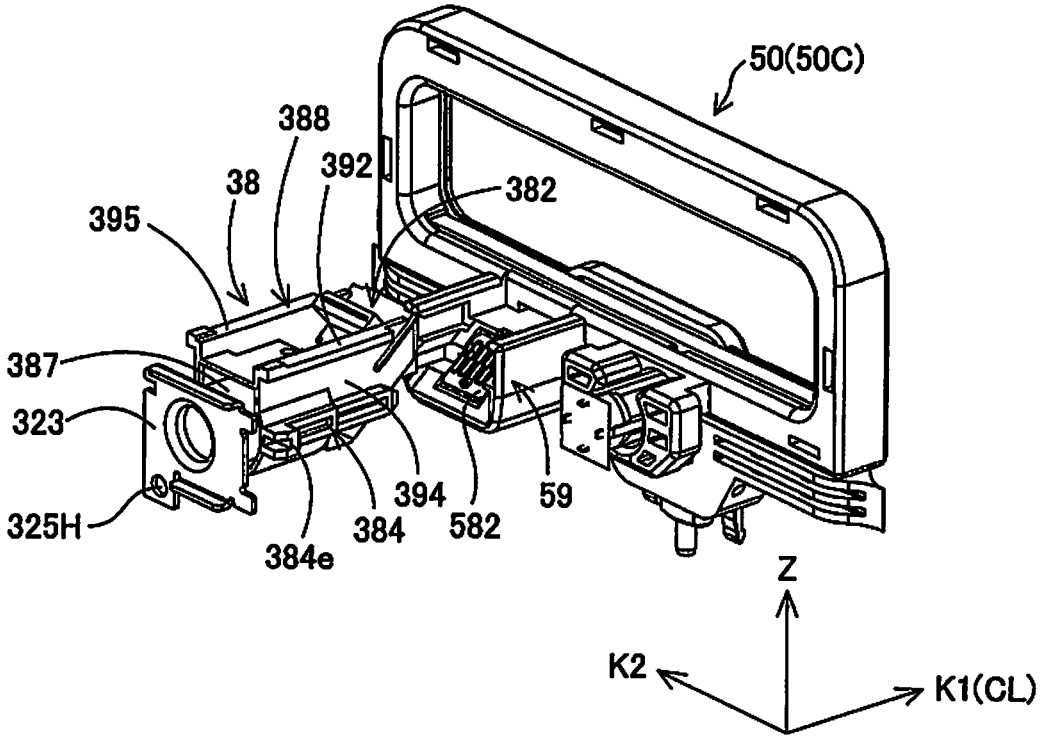
FIG. 6P is a perspective view illustrating the contact mechanism.
Figure 6Q:
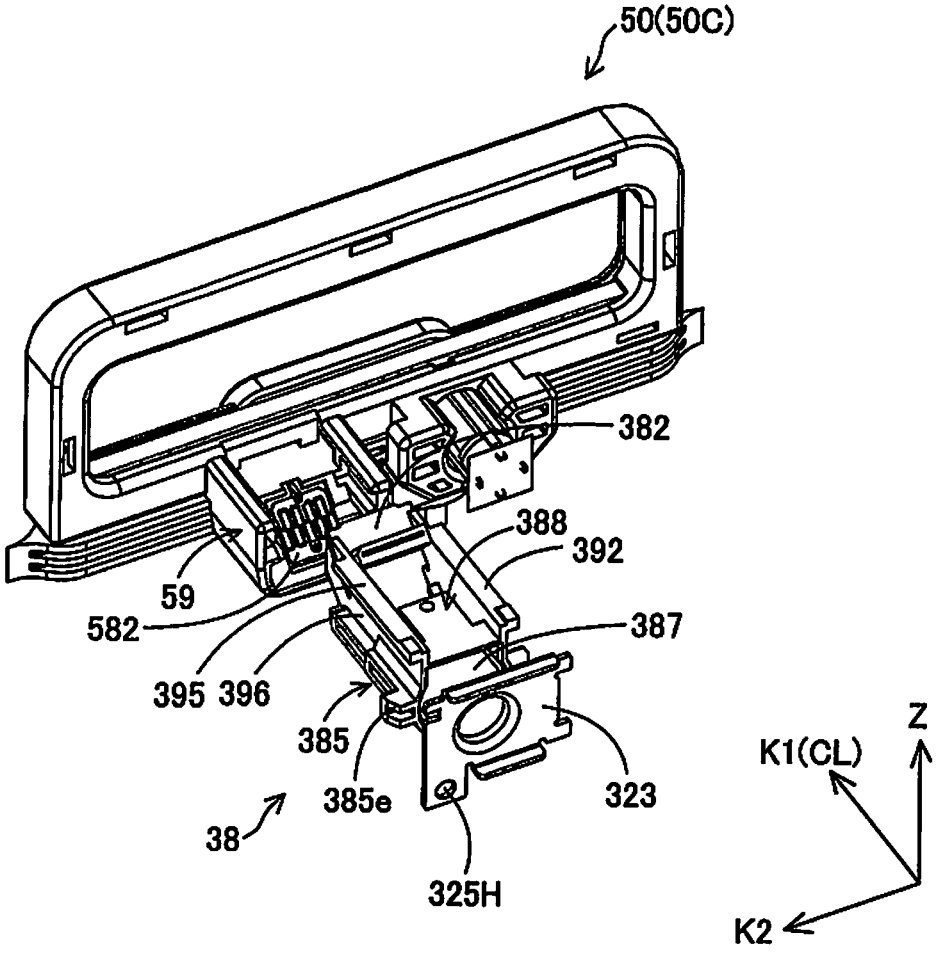
FIG. 6Q is a perspective view illustrating the contact mechanism.
Figure 6R:
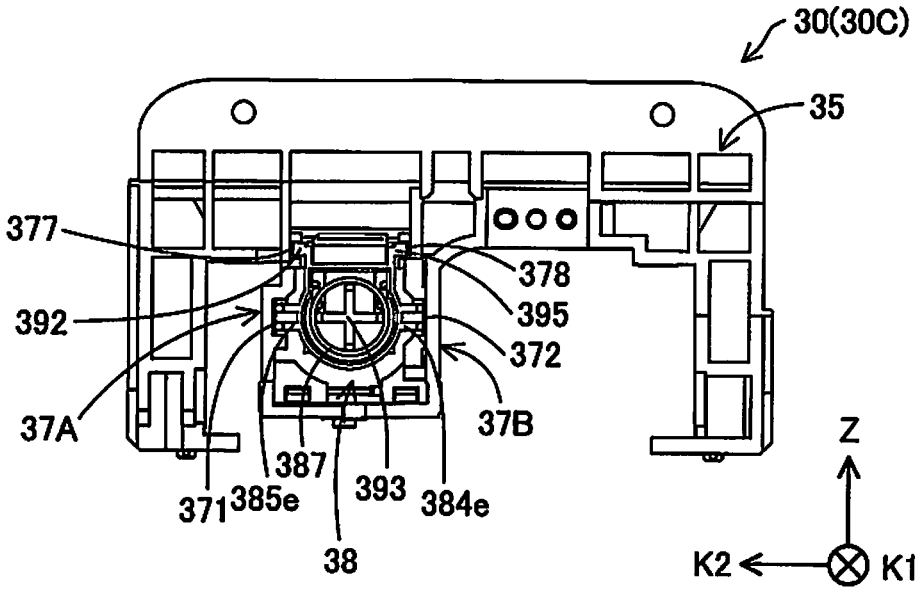
FIG. 6R is a rear view of FIG. 6E.
Figure 6S:
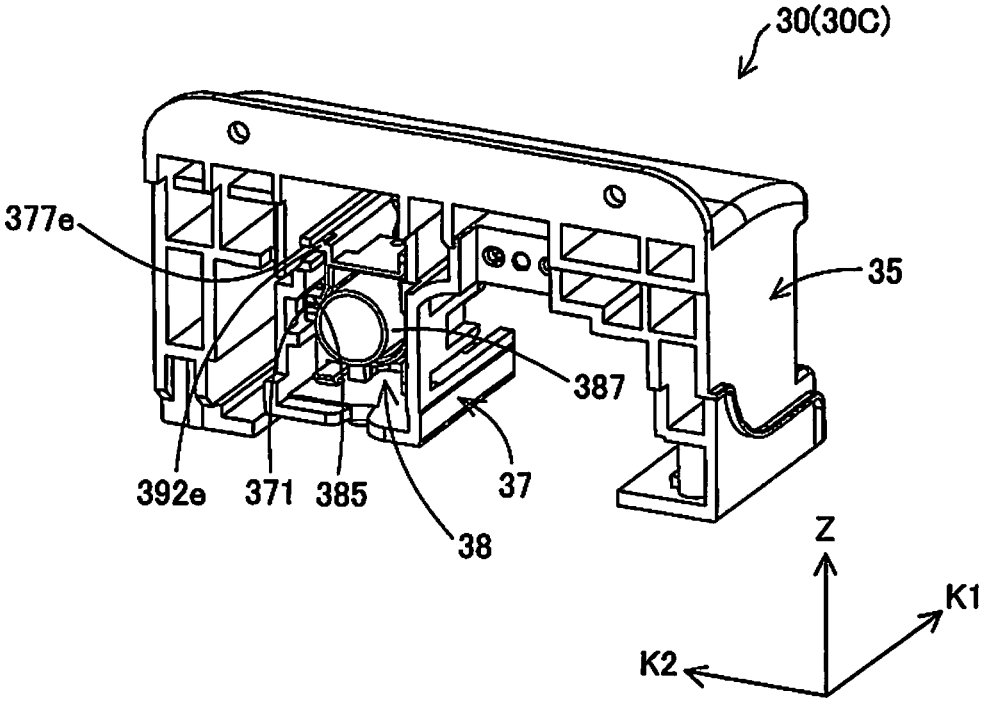
FIG. 6S is a perspective view of FIG. 6R.
Figure 6T:
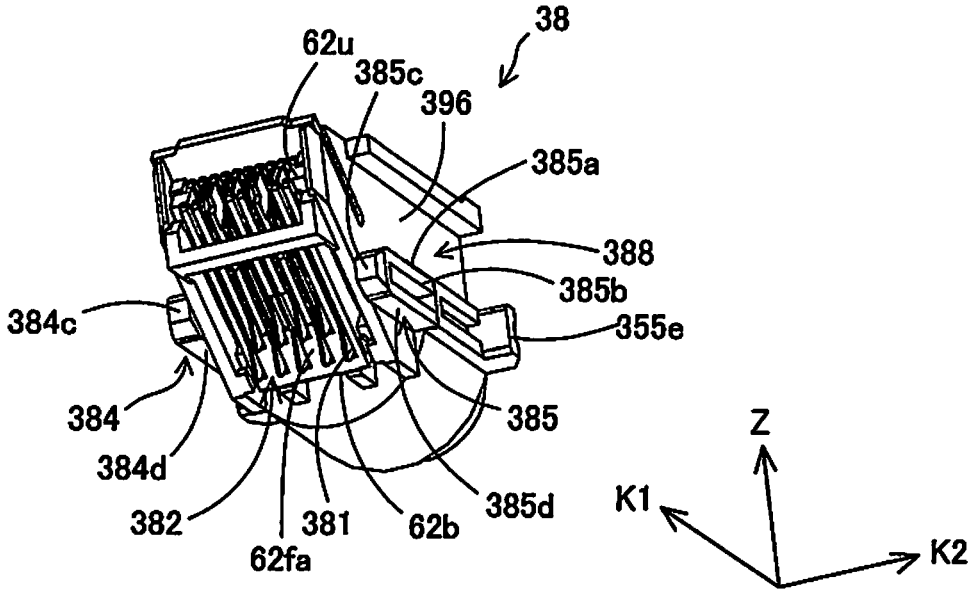
FIG. 6T is a perspective view illustrating the contact mechanism.
Figure 6U:
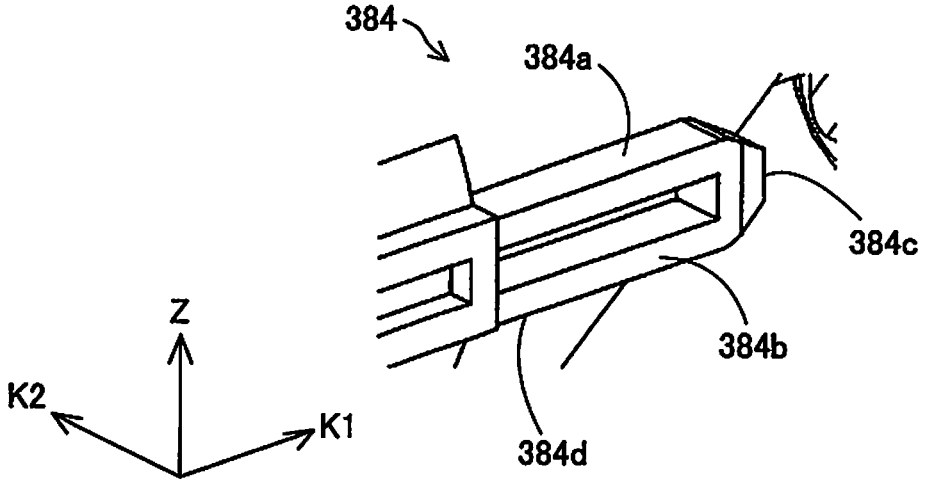
FIG. 6U is an enlarged view illustrating an apparatus-side board positioning structure of the contact mechanism.
Figure 6V:
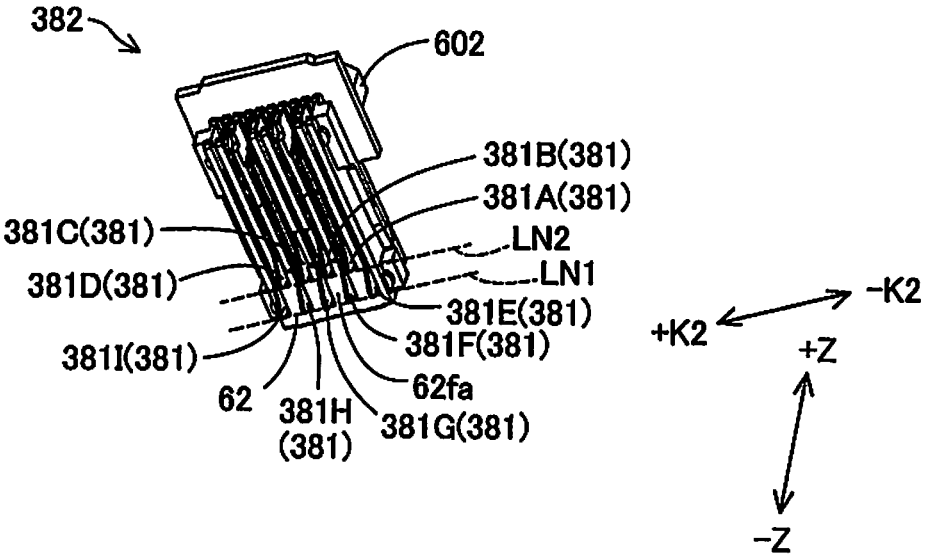
FIG. 6V is a perspective view illustrating an electrical connection structure.

The detailed configuration of the contact mechanism 38 and the mounting/demounting unit 30 is described with reference to FIGS. 6H to 6V, in addition to FIG. 6E, FIG. 6F and FIG. 6G. FIG. 6H is a perspective view illustrating part of the mounting/demounting unit 30. FIG. 6I is a top view illustrating the mounting/demounting unit 30. FIG. 6J is an F6I-F6I sectional view of FIG. 6I. FIG. 6K is a partial enlarged view of an area R6J in FIG. 6J. FIG. 6L is a perspective view illustrating the state that the contact mechanism 38 is mounted to the stationary member 35. FIG. 6M is a perspective view illustrating the stationary member 35. FIG. 6N is a front view illustrating the mounting/demounting unit 30C. FIG. 6O is an F6N-F6N sectional view of FIG. 6N. FIG. 6P is a perspective view illustrating the contact mechanism 38. FIG. 6Q is a perspective view illustrating the contact mechanism 38. FIG. 6R is a rear view of FIG. 6E. FIG. 6S is a perspective view of FIG. 6R. FIG. 6T is a perspective view illustrating the contact mechanism 38. FIG. 6U is an enlarged view illustrating the apparatus-side board positioning structure 384 of the contact mechanism 38. FIG. 6V is a perspective view illustrating the electrical connection structure 382. The liquid container 50 is also illustrated in FIG. 6I. Part of the liquid container 50 is also illustrated in FIGS. 6N, 6P and 6Q. The sheet metal 323 and the coil spring 325 shown in FIG. 6E are omitted from the illustration of FIG. 6R.

As shown in FIGS. 6L and 6M, the second stationary member 33 has a fixation structure 37 to which the contact mechanism 38 is mounted. The contact mechanism 38 is mounted to the fixation structure 37 with some backlash. This configuration causes the electrical connection structure 382 of the contact mechanism 38 to be displaceable in a direction intersecting with the first direction (−K1-axis direction) (in the embodiment, a direction along a plane parallel to the Z-axis direction and the K2-axis direction). The details of this configuration will be described later.

As shown in FIG. 6M, the fixation structure 37 has a receiving space 37S configured to receive the contact mechanism 38 therein. The fixation structure 37 has a first partition wall 37A and a second partition wall 37B arranged to define the receiving space 37S. The first partition wall 37A forms a side face on the −K2-axis direction side of the receiving space 37S. The second partition wall 37B forms a side face on the +K2-axis direction side of the receiving space 37S.

The first partition wall 37A includes a first mounting portion 377 (right-side first mounting portion 377), a second mounting portion 371 (right-side second mounting portion 371) and an apparatus-side upper restriction portion 377*a*. The first and second mounting portions 377 and 371 are portions to which the contact mechanism 38 is mounted. The first mounting portion 377 is a groove arranged to face the receiving space 37S. The second mounting portion 371 is a through hole arranged to receive part of the contact mechanism 38 therein. The second mounting portion 371 may, however, be formed in any other shape to receive part of the contact mechanism 38 therein and may be formed as a groove. The apparatus-side upper restriction portion 377*a* is a surface facing down in the direction of gravity. The apparatus-side upper restriction portion 377*a* abuts on the substrate unit 58 when the substrate unit 58 of the liquid container 50 (shown in FIG. 7) is connected with the electrical connection structure 382 of the contact mechanism 38, so as to restrict the upward motion of the substrate unit 58 in the direction of gravity (Z-axis direction).

The second partition wall 37B has a similar configuration to that of the first partition wall 37A with difference only in their positions. More specifically, the second partition wall 37B includes a first mounting portion 378 (left-side first mounting portion 378) shown in FIG. 6R, a second mounting portion 372 (left-side second mounting portion 372) shown in FIG. 6M and an apparatus-side upper restriction portion 377*b* (shown in FIG. 6M). The first mounting portion 378 has the same configuration as that of the first mounting portion 377 of the first partition wall 37A, and the second mounting portion 372 has the same configuration as that of the second mounting portion 371 of the first partition wall 37A. The apparatus-side upper restriction portion 377*b* has the same configuration as that of the apparatus-side upper restriction portion 377*a* of the first partition wall 37A. When there is no need to distinguish between the two apparatus-side upper restriction portions 377*a* and 77*b*, these are expressed by a reference sign "377M".

As shown in FIG. 6O, the apparatus-side upper restriction portion 377M is located above the apparatus-side terminals 381 in the direction of gravity. The apparatus-side upper restriction portion 377M has a tapered +K1-axis direction end. The apparatus-side upper restriction portion 377M has a −K1-axis direction end that forms a horizontal plane. The +K1-axis direction end of the apparatus-side upper restriction portion 377M is located on the +K1-axis direction side of the apparatus-side terminals 381.

As shown in FIG. 6P, the contact mechanism 38 includes a coil spring 387 as a pressing member, the electrical connection structure 382 (shown in FIG. 5B), and a holding member 388 configured to hold the electrical connection structure 382.

As shown in FIG. 6J, a convex (spring receiver) of the sheet metal 323 is inserted in one end 387A of the coil spring 387. The one end 387A of the coil spring 387 is accordingly supported by the sheet metal 323. The other end 387B of the coil spring 387 is placed inside of the holding member 388. As shown in FIG. 6J and FIG. 6R, a rib 393 as a spring receiver is provided inside of the holding member 388. The other end 387B of the coil spring 387 is placed inside of the holding member 388 via an opening formed in a rear wall (wall on the −K1-axis direction side) of the holding member 388. The rib 393 is inserted in the other end 387B. This configuration causes the other end 387B of the coil spring 387 to be supported by the holding member 388. The coil spring 387 presses the holding member 388 in the +K1-axis direction.

As shown in FIGS. 6P, 6Q and 6T, the holding member 388 includes a first side wall 394 and a second side wall 396. The first side wall 394 and the second side wall 396 are opposed to each other. The first side wall 394 is located on the −K2-axis direction side, and the second side wall 396 is located on the +K2-axis direction side. The first side wall 394 and the second side wall 396 are surfaces approximately along the direction of gravity (Z-axis direction).

As shown in FIG. 6P and FIG. 6Q, the contact mechanism 38 includes a first contact-side positioning structure (apparatus-side positioning structure) 384 and a second contact-side positioning structure (apparatus-side positioning structure) 385 serving as the positioning structures (apparatus-side board positioning structures). The first and the second contact-side positioning structures 384 and 385 serve to position the circuit board 582 of the liquid container 50 (more specifically its liquid container-side terminals 581 shown in FIG. 13A) and the apparatus-side terminals 381 of the electrical connection structure 382 relative to each other. More specifically, the liquid container-side terminals 581 and the apparatus-side terminals 381 are positioned relative to each other in the −K1-axis direction (first direction) and in a direction intersecting with the −K1-axis direction (direction along a plane parallel to the Z-axis direction and the K1-axis direction).

The first and the second contact-side positioning structures 384 and 385 are arranged with the electrical connection structure 382 placed therebetween in the K2-axis direction. The first and the second contact-side positioning structures 384 and 385 have similar configurations with difference only in their positions.

The first and the second contact-side positioning structures 384 and 385 are members respectively extended along the K1-axis direction (connecting direction). As shown in FIG. 6P, the first contact-side positioning structure 384 is protruded outward from the first side wall 394. As shown in FIG. 6Q, the second contact-side positioning structure 385 is protruded outward from the second side wall 396.

As shown in FIG. 6P, the first contact-side positioning structure 384 has a locking element 384*e* on its −K1-axis direction end. As shown in FIG. 6Q, the second contact-side positioning structure 385 has a locking element 385*e* on its −K1-axis direction end. The locking element 384*e* is locked to the wall surface of the second mounting portion 372 as shown in FIGS. 6L and 6M, and the locking element 385*e* is locked to the wall surface of the second mounting portion 371 (not shown). This configuration restricts the motion in the +K1-axis direction of the holding member 388 that is pressed in the +K1-axis direction by the coil spring 387 (shown in FIG. 6J).

As shown in FIG. 6U, the first contact-side positioning structure 384 has first to fourth restriction elements 384*a* to 384*d* on its +K1-axis direction end. The first to the fourth restriction elements 384*a* to 384*d* serve to position the substrate unit 58 (shown in FIG. 9) of the liquid container 50 relative to the electrical connection structure 382. More specifically, the first contact-side positioning structure 384 achieves positioning in the first direction (−K1-axis direction) and in a direction intersecting with the first direction (direction parallel to a plane defined by the Z-axis direction and the K2-axis direction).

As shown in FIG. 6U, the first restriction element 384*a* forms a top face of the first contact-side positioning structure 384. The second restriction element 384*b* forms a side face of the first contact-side positioning structure 384. As shown in FIGS. 6T and 6U, the third restriction element 384*c* forms a leading edge face of the first contact-side positioning structure 384. The fourth restriction element 384*d* forms a bottom face of the first contact-side positioning structure 384. The first restriction element 384*a* is located on the +Z-axis direction side. The second restriction element 384*b* is located on the −K2-axis direction side. The third restriction element 384*c* is located on the +K1-axis direction side. The fourth restriction element 384*d* is located on the −Z-axis direction side. The respective restriction elements 384*a* to 384*d* are approximately planar surfaces.

As shown in FIG. 6T, the second contact-side positioning structure 385 has a similar configuration to that of the first contact-side positioning structure 384. More specifically, the second contact-side positioning structure 385 has a first restriction element 385*a*, a second restriction element 385*b*, a third restriction element 385*c* and a fourth restriction element 385*d*. The first to the fourth restriction elements 385*a* to 385*d* serve to position the substrate unit 58 (shown in FIG. 9) of the liquid container 50 relative to the electrical connection structure 382. More specifically, like the first contact-side positioning structure 384, the second contact-side positioning structure 385 achieves positioning in the first direction (−K1-axis direction) and in the direction intersecting with the first direction (direction parallel to the plane defined by the Z-axis direction and the K2-axis direction). The first restriction element 385*a* forms a top face of the second contact-side positioning structure 385. The second restriction element 385*b* forms a side face of the second contact-side positioning structure 385. The third restriction element 385*c* forms a leading edge face of the second contact-side positioning structure 385. The fourth restriction element 385*d* forms a bottom face of the second contact-side positioning structure 385. The first restriction element 385*a* is located on the +Z-axis direction side. The second restriction element 385*b* is located on the +K2-axis direction side. The third restriction element 385*c* is located on the +K1-axis direction side. The fourth restriction element 385*d* is located on the −Z-axis direction side. The respective restriction elements 385*a* to 385*d* are approximately planar surfaces.

As shown in FIG. 6T, the electrical connection structure 382 is held on the +K1-axis direction side of the holding member 388. As shown in FIG. 6V, the electrical connection structure 382 includes a terminal holder 62 held on the holding member 388, nine apparatus-side terminals 381A to 381I held on the terminal holder 62 and a connector 602 held on the terminal holder 62. When there is no need to distinguish among the nine apparatus-side terminals 381A to 381I, these are expressed by a reference sign "381".

As shown in FIG. 6T, a surface 62*fa* of the terminal holder 62 is inclined such that a lower end 62*b* is located on the −K1-axis direction side of an upper end 62*u*. Respective one ends of the apparatus-side terminals 381 are exposed on the surface 62*fa*. Respective other ends of the apparatus-side terminals 381 are electrically connected with the connector 602 (shown in FIG. 6V). The connector 602 is electrically connected with a controller of the printer 10 via wiring.

As shown in FIG. 6V, the plurality of apparatus-side terminals 381A to 381I that constitute an apparatus-side terminal group are arranged in two lines LN1 and LN2 formed at different locations in the Z-axis direction. The lines LN1 and LN2 are parallel to the K2-axis direction.

As shown in FIG. 6P and FIG. 6Q, the first side wall 394 has a support wall portion 392 protruded in the −K2-axis direction (outward). The support wall portion 392 is provided on the top of the first side wall 394. The support wall portion 392 is a member extended along the K1-axis direction. The second side wall 396 has a support wall portion 395 protruded in the +K2-axis direction (outward). The support wall portion 395 is formed in a similar configuration to that of the support wall portion 392 of the first side wall 394.

The first contact-side positioning structure 384, the second contact-side positioning structure 385, the support wall portion 392 and the support wall portion 395 provided in the holding member 388 as described above are members configured to support the holding member 388 to the second stationary member 33 to be displaceable in an in-plane direction perpendicular to the K1-axis direction. The mechanism for such displacement is described in detail below.

As shown in FIG. 6R, the support wall portion 392 is inserted into the first mounting portion 377 of the fixation structure 37, while the support wall portion 395 is inserted into the first mounting portion 378 of the fixation structure 37. The locking element 385*e* is inserted into the second mounting portion 371, while the locking element 384*e* is inserted into the second mounting portion 372. The support wall portions 392 and 395 are inserted into the first mounting portions 377 and 378 with some clearance (backlash) in at least the direction of gravity (Z-axis direction). The locking elements 385*e* and 384*e* are inserted into the second mounting portions 371 and 372 with some clearance (backlash) in at least the K2-axis direction. This configuration causes the holding member 388 provided to hold the electrical connection structure 382 to be mounted to the stationary member 35 such as to be displaceable in an in-plane direction (the Z-axis direction and the K2-axis direction) perpendicular to the K1-axis direction.

As shown in FIG. 6K, a restriction element 597 provided as a projection on a circuit board holding structure 59 of the liquid container 50 described later abuts on the apparatus-side restriction element 489 provided in the movable member 40. This restricts the motion of the liquid container 50 in the +K1-axis direction (direction opposite to the first direction).

Figure 7:
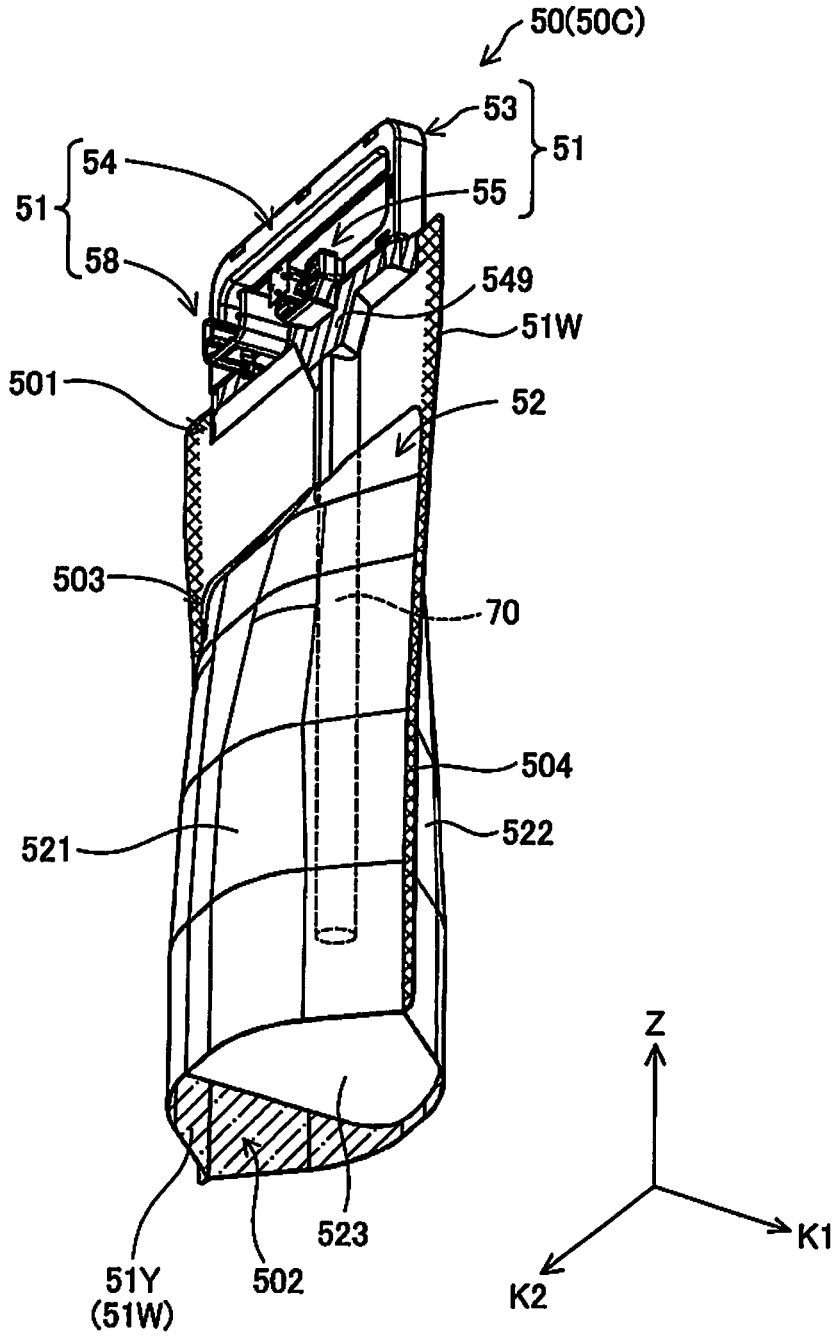
FIG. 7 is a first perspective view illustrating a liquid container.
Figure 8:
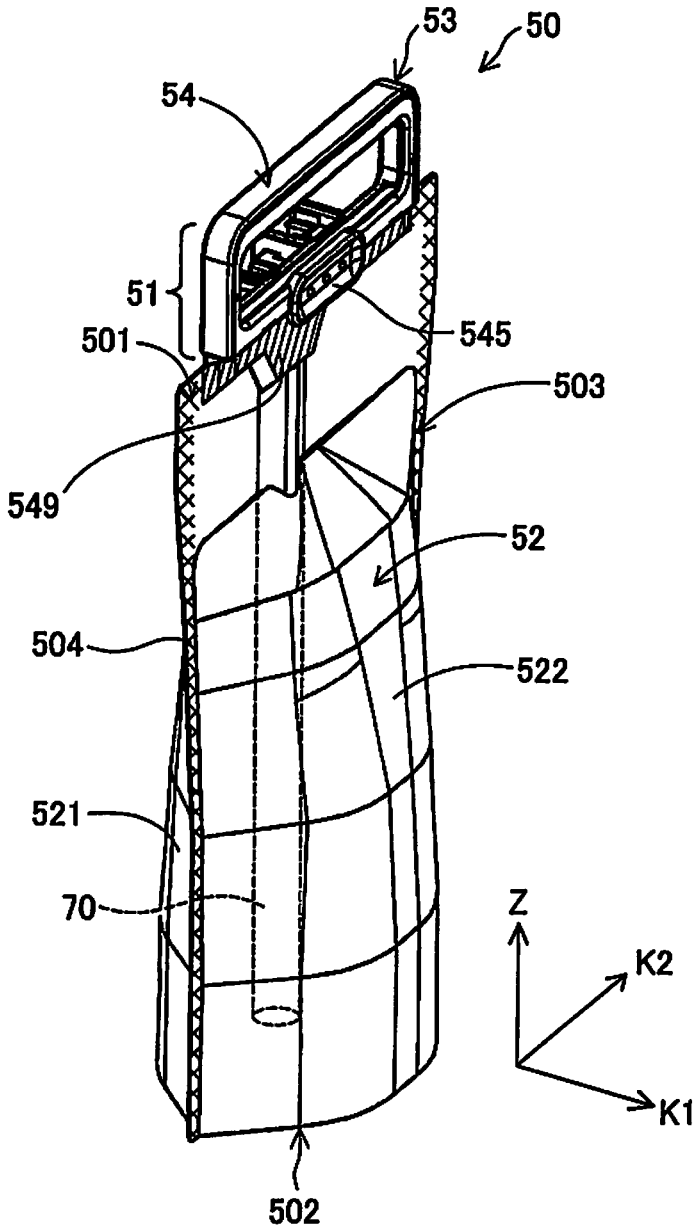
FIG. 8 is a second perspective view illustrating the liquid container.
Figure 8A:
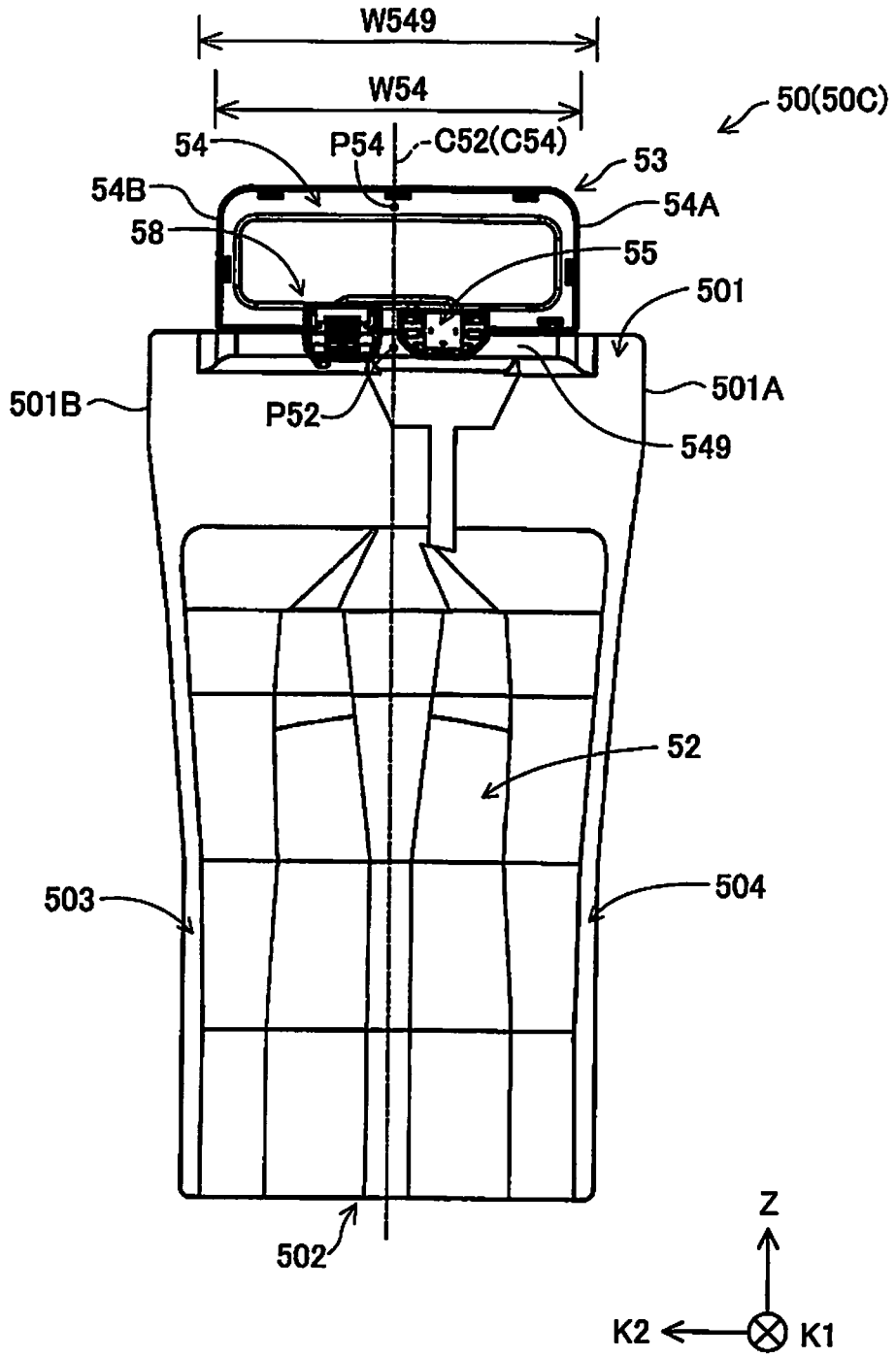
FIG. 8A is a front view illustrating the liquid container.
Figure 8B:
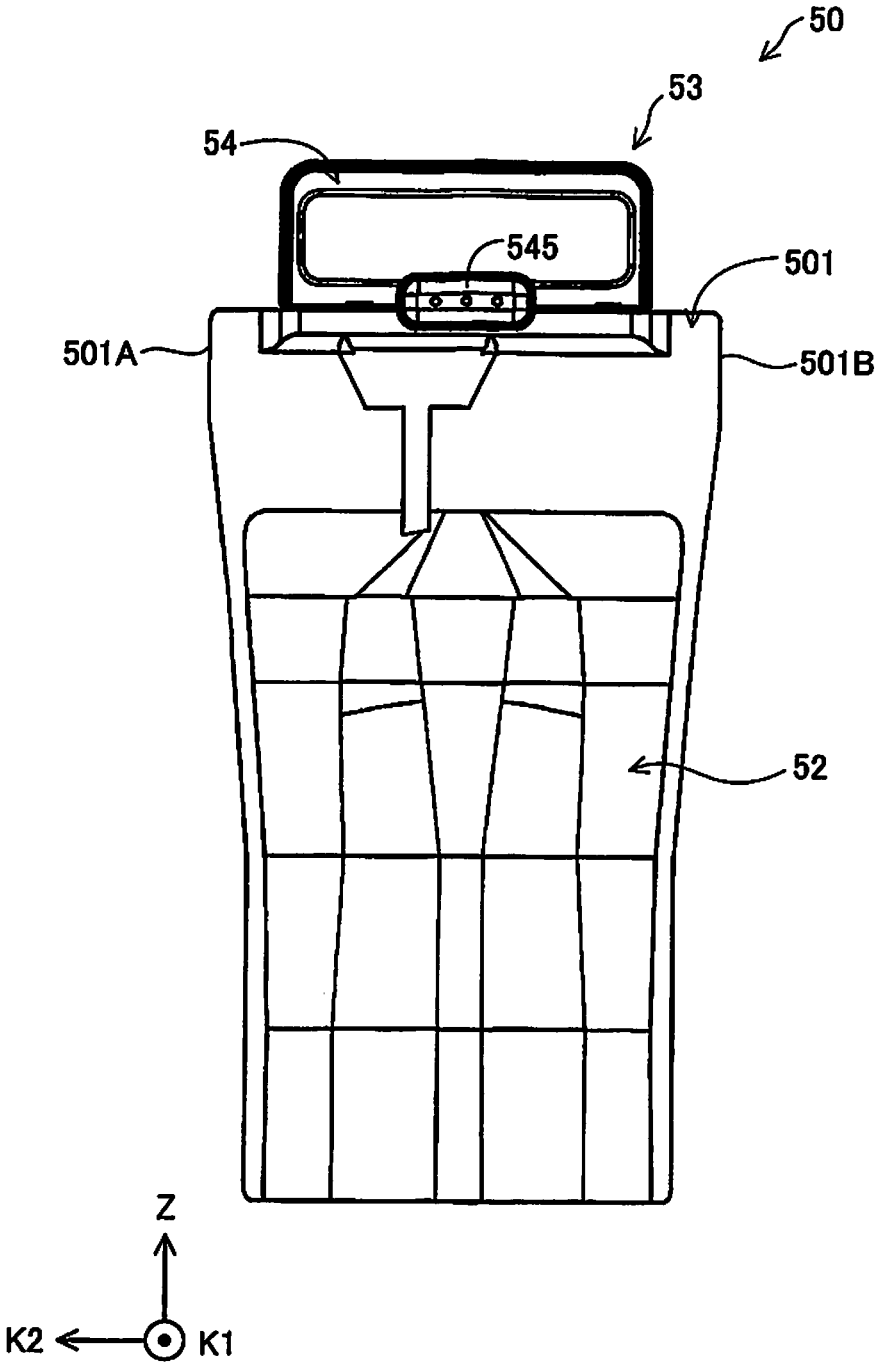
FIG. 8B is a rear view illustrating the liquid container.

A-5. Configuration of Liquid Container 50:

FIG. 7 is a first perspective view illustrating the liquid container 50. FIG. 8 is a second perspective view illustrating the liquid container 50. FIG. 8A is a front view illustrating the liquid container 50. FIG. 8B is a rear view illustrating the liquid container 50. The Z axis, the K1 axis and the K2 axis in the state that the liquid container 50 is mounted to the mounting/demounting unit 30 (in the mounted state) are shown in FIGS. 7, 8, 8A and 8B. FIGS. 7, 8, 8A and 8B illustrate the liquid container 50 in the state that the liquid container 50 is filled with ink as the liquid but is not yet mounted to the mounting/demounting unit 30 (prior to consumption of ink by the printer 10) (unused state or initial state). The Z axis, the K1 axis and the K2 axis that are orthogonal to one another are also shown as appropriate in subsequent drawings. The configuration is described with regard to the liquid container 50C as an example with reference to FIG. 7 and subsequent drawings. The other liquid containers 50K, 50M and 50Y have similar configurations to that of the liquid container 50C.

The Z axis, the K1 axis and the K2 axis that are orthogonal to one another may be defined as follows. In the state that the liquid container 50 is connected with the printer 10, the Z axis direction is the direction of gravity (vertical direction). The +Z-axis direction is upward in the direction of gravity (upward in the vertical direction, direction reverse to the direction of gravity), and the −Z-axis direction is downward in the direction of gravity (downward in the vertical direction). The K1-axis direction (primary direction) that is the direction along the K1 axis is the horizontal direction. The −K1-axis direction is the connecting direction (moving direction or first direction) of the liquid container 50 in the process of connecting the liquid container 50 with the printer 10. As described later, in the process of connecting the liquid container 50 to the printer 10, moving a liquid supply unit 55 described later (shown in FIG. 7) in the connecting direction (−K1-axis direction) causes the liquid supply unit 55 (more specifically, its liquid supply portion 57) to be connected with the liquid introduction portion (liquid receiving portion) 362 provided in the printer 10 and causes the substrate unit 58 (more specifically, its electrical connection structure 582) to be connected with the electrical connection structure 382 (shown in FIG. 5C) provided in the printer 10. The +K1-axis direction is the demounting direction in the process of demounting the liquid container 50 from the printer 10. The connecting direction is the −K1-axis direction that is the horizontal direction according to this embodiment, but this is not restrictive. The connecting direction may be any direction including a horizontal direction component. The K2-axis direction (second direction) is a direction that is orthogonal to the direction of gravity (Z-axis direction) and the primary direction (K1-axis direction).

As shown in FIG. 7, the liquid container 50 includes a liquid container body (liquid containing bag) 52 and a container body support assembly 51 attached to the liquid container body 52. The liquid container body 52 is configured to contain ink as the liquid. The liquid container body 52 is attached to the container body support assembly 51 (operation member 53) in the state that the outer surface (bag surface) is exposed. In other words, the liquid container body 52 is not placed in a case or the like but is configured to be visible from outside. The volume of the liquid container body 52 decreases with reduction of ink contained therein.

The liquid container body 52 includes a first sheet 521, a second sheet 522 and a third sheet 523. The first to the third sheets 521 to 523 are configured to define a space for containing ink inside thereof. One end of the liquid container body 52 to which the operation member 53 (container body support assembly 51) is attached is defined as one end 501 (one end portion, upper end or upper end portion), and an opposite end opposed to the one end 501 is defined as the other end 502 (other end portion, bottom end or bottom end portion). One edge (+K2-axis direction edge) of the liquid container body 52 is defined as first side edge (first side edge portion) 503, and the other edge (−K2-axis direction edge) is defined as second side edge (second side edge portion) 504. As shown in FIG. 8A, the liquid supply assembly 55 and the substrate unit 58 are located on the one end 501-side of the liquid container body 52. According to this embodiment, when the liquid container 50 is viewed along the K1-axis direction, the liquid supply assembly 55 and the substrate unit 58 are located such as to at least partly overlap the one end portion 501.

The liquid supply assembly 55 supports the liquid container body 52 on the upper side (+Z-axis direction side) of the liquid container body 52 in the direction of gravity (Z-axis direction) in the process of connecting the liquid container 50 with the printer 10. More specifically, as described later, the liquid supply assembly 55 (more specifically its positioning structure 56 described later) is supported by the supply portion support structure 42 of the movable member 40 (shown in FIG. 5), so as to support the liquid container body 52.

The substrate unit 58, in cooperation with the liquid supply assembly 55, supports the liquid container body 52 on the upper side (+Z-axis direction side) of the liquid container body 52 in the direction of gravity (Z-axis direction) in the process of connecting the liquid container 50 with the printer 10. More specifically, as described later, the substrate unit 58 (more specifically its circuit board holding structure 59 described later) is supported by the board support structure 48 of the movable member 40 (shown in FIG. 5), so as to support the liquid container body 52.

As shown in FIG. 8A, in the connected state of the liquid container 50, the liquid supply unit 55 and the substrate unit 58 are arranged side by side along the K2-axis direction (second direction). More specifically, when the liquid container 50 is viewed from a direction along the K2-axis direction, the liquid supply unit 55 and the substrate unit 58 are arranged to at least partly overlap with each other (as shown in FIG. 17H described later).

As shown in FIG. 7 and FIG. 8, in the mounted state of the liquid container 50, the first sheet 521 and the second sheet 522 form side faces of the liquid container body 52. In the mounted state of the liquid container 50, the third sheet 523 forms a bottom face of the liquid container body 52. The first sheet 521 and the second sheet 522 are arranged to face each other. Respective peripheral areas 51W of the first sheet 521 and the second sheet 522 are partly welded to each other. More specifically, one end 501-portions, first side edge 503-portions and second side edge 504-portions of the respective peripheral areas 51W are welded. For the purpose of better understanding, the welded portions of the first and the second sheets 521 and 522 are shown by cross-hatching in FIGS. 7 and 8. The container body support assembly 51 (operation member 53) is welded to the one end 501 of the liquid container body 52 (more specifically, the respective one ends of the first and the second sheets 521 and 522). In other words, the container body support assembly 51 (operation member 53) is a member attachable to the one end 501 of the liquid container body 52. The operation member 53 is a member located on the one end portion 501-side of the liquid container body 52. For the purpose of better understanding, the welded portions of the container body support assembly 51 (operation member 53) to the first and the second sheets 521 and 522 are shown by solid-line single hatching in FIGS. 7 and 8. The first and the second sheet members 521 and 522 are attached to a mounting portion (joint portion) 549 of the operation member 53 by welding as described later in detail.

As shown in FIG. 7, a peripheral area 51Y of the third sheet 523 is welded to portions of the peripheral areas 51W of the first and the second sheets 521 and 522. The welded portions of the third sheet 523 to the first and the second sheets 521 and 522 are shown by one-dot chain line single hatching. As described above, the liquid container body 52 of the embodiment is in such a form that the three sheets 521, 522 and 523 are bonded by welding or the like (pouch-like form having a bottom face).

The first to the third sheets 521 to 523 are respectively flexible members. The material employed for the first to the third sheets 521 to 523 may be, for example, polyethylene terephthalate (PET), nylon or polyethylene. A laminated structure by stacking a plurality of films may be employed to form the first to the third sheets 521 to 523. In this laminated structure, for example, an outer layer may be formed from PET or nylon having excellent impact resistance and an inner layer may be formed from polyethylene having excellent ink resistance. Additionally, a film including a deposition layer of aluminum or the like may be used as one component of the laminated structure. This enhances the gas barrier property and thereby suppresses, for example, a change in concentration of ink contained in the liquid container body 52. The material of the liquid container body 52 may be determined arbitrarily as described above.

The shapes and the sizes of the respective liquid container bodies 52 may be set arbitrarily. For example, the liquid container body 52K containing black ink may have a larger capacity (larger size) than that of the liquid container body 52C containing another color (for example, cyan) ink. In another example, the liquid container body 52 is in the form that the first to the third sheets 521 to 523 are bonded by welding or the like according to the embodiment, but may be in such a form that the first and the second sheets 521 and 522 are bonded by welding or the like with omission of the third sheet 523 (pillow-like form). As described above, the liquid container body 52 and the operation member 53 are provided as separate members. This configuration allows the type (shape, size and material) of the liquid container body 52 to be readily changed, while using the same operation member 53. The shape, the size and the material of the liquid container body 52 may thus be set according to, for example, the properties and the amount of the liquid contained in the liquid container body 52. This enhances the flexibility of design.

The container body support assembly 51 includes an operation member (handle portion) 53, a liquid supply unit 55 and a substrate unit 58. The operation member 53 is a frame-like member that is open in the K1-axis direction. The operation member 53 includes a grip portion 54 located on a +Z-axis direction end and a pressed portion 545 located on a −Z-axis direction end (shown in FIG. 8). The grip portion 54 is a portion gripped by the user to support (hold) the liquid container 50. The grip portion 54 may thus also be called "handle structure 54" or "handle part 54". The grip portion 54 is extended along the K2-axis direction. The grip portion 54 of the operation member 53 is formed in a rectangular frame-like shape according to this embodiment but may be formed in a C shape or in a T shape.

As shown in FIG. 7, the liquid container 50 includes the liquid container body 52 and the operation member (linkage member, handle portion) 53. The operation member 53 is attached to the liquid container body 52. The operation member 53 includes the grip portion (support portion) 54, the liquid supply unit 55, the substrate unit (container-side electrical connection structure) 58 and the pressed portion 545 (shown in FIG. 8). The liquid supply unit 55 is a part corresponding to the liquid introduction portion 362 and the supply portion support structure 42 (shown in FIG. 6) included in the mounting/demounting unit 30. The substrate unit 58 is a part corresponding to the electrical connection structure 382 and the board support structure 48 (shown in FIG. 6) included in the mounting/demounting unit 30.

The pressed portion 545 is a portion pressed by the user in the process of connecting the liquid container 50 with the printer 10. In other words, the pressed portion 545 is a manually pressed portion. The user presses the pressed portion 545 in the −K1-axis direction (connecting direction), so as to move the movable member 40 (shown in FIG. 6I) with the liquid container 50 set thereon in the −K1-axis direction. The pressed portion 545 is provided on the opposite side of the operation member 53 opposite to the side where the liquid supply unit 55 and the substrate unit 58 are provided. The pressed portion 545 is provided on a −Z-axis direction end of the operation member 53. The pressed portion 545 is provided to be protruded outward (in the +K1-axis direction) from the operation member 53. This configuration facilitates discrimination of the pressed portion 545 from the remaining part.

The liquid container 50 further includes a flow path member 70 configured to cause the ink contained in the liquid container body 52 to be flowed to the liquid supply unit 55 (more specifically its liquid supply portion). According to this embodiment, the flow path member 70 is a tube. The flow path member 70 is located inside of the liquid container body 52.

As described below with reference to FIG. 8A, the respective components of the liquid container 50 have the following relationship. A width W54 denotes the width of the grip portion 54 along the longitudinal direction (K2-axis direction) at the one end portion 501 of the liquid container body 52. A width W549 denotes the width of the joint portion 549 along the longitudinal direction (K2-axis direction) of the joint portion 549. The width W54 is a distance between one end portion (first handle end) 54A and the other end portion (second handle end) 54B of the grip portion 54 in the longitudinal direction (K2-axis direction). The width W54 is smaller than the width W549. In the longitudinal direction (K2-axis direction), the liquid supply unit 55 and the substrate unit 58 are located between the respective end portions 54A and 54B of the grip portion 54.

The liquid supply unit (liquid supply assembly) 55 and the substrate unit 58 (container-side electrical connection structure) 58 are arranged at positions with a center P54 (center line C54) of the handle structure 54 placed therebetween in the second direction (K2-axis direction, longitudinal direction). The center line C54 is a line that passes through the center P54 and is along the Z-axis direction.

One edge of the one end portion 501 of the liquid container body 52 in the second direction (K2-axis direction) is defined as first edge 501A, and the other edge is defined as second edge 501B. In this sense, the liquid supply unit (liquid supply assembly) 55 and the substrate unit (container-side electrical connection structure) 58 are arranged at positions nearer to a center P52 (center line C52) of the one end portion 501 than the first edge 501A and the second edge 501B in the second direction (K2-axis direction). The center line C52 is a line that passes through the center P52 and is along the Z-axis direction. According to this embodiment, the center line C52 is approximately equal to the center line C54.

As shown in FIG. 7, the liquid supply unit 55 and the substrate unit 58 are provided on a −Z-axis direction end of the operation member 53. The liquid supply unit 55 and the substrate unit 58 are arranged side by side in the K2-axis direction. The liquid supply unit 55 serves to supply ink contained in the liquid container body 52 to outside (for example, the liquid introduction portion 362 shown in FIG. 5B). The substrate unit 58 serves to be electrically connected with the apparatus-side terminals 381 of the contact mechanism 38. The liquid supply unit 55 and the substrate unit 58 are provided to be protruded outward (in the −K1-axis direction) from the operation member 53. The liquid supply unit 55 and the substrate unit 58 are protruded in the same direction. The protruding direction of the substrate unit 58 and the protruding direction of the liquid supply portion 57 may not be necessarily identical with each other but may be arranged approximately parallel to each other. The substrate unit 58 and the liquid supply unit 55 are protruded from the operation member 53 toward the same direction (−K1-axis direction) relative to the operation member 53.

Figure 9:
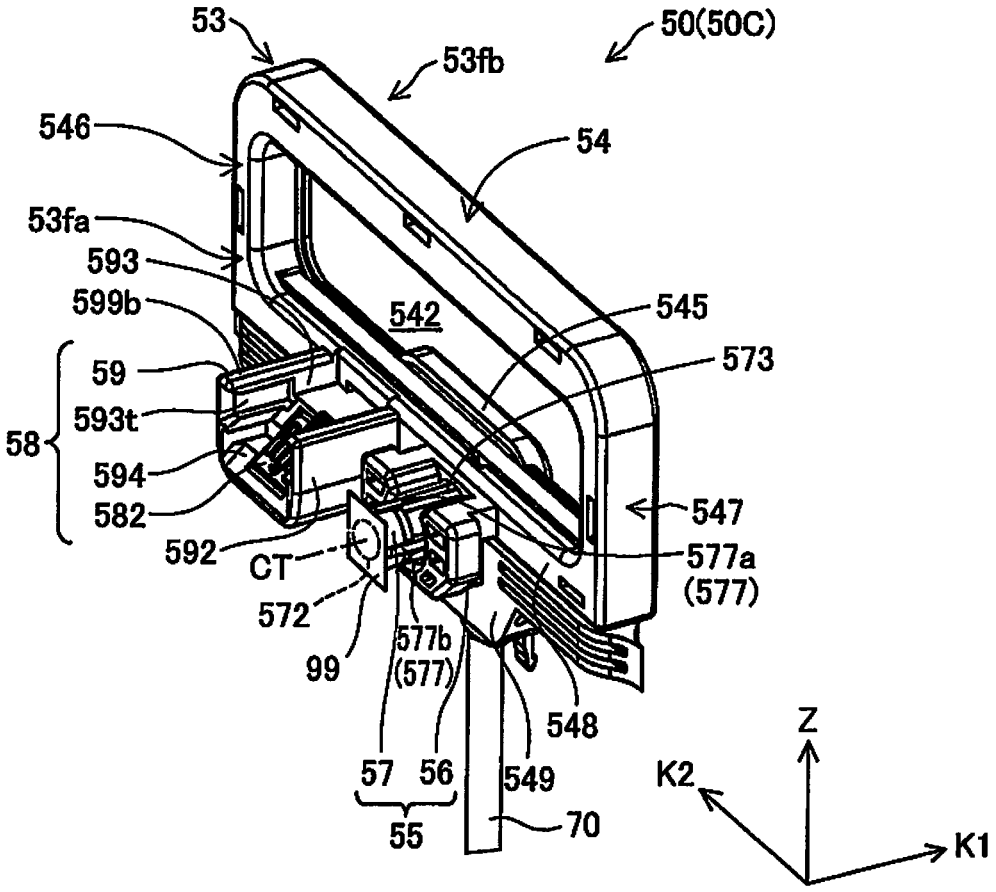
FIG. 9 is a first perspective view illustrating part of the liquid container.
Figure 10:
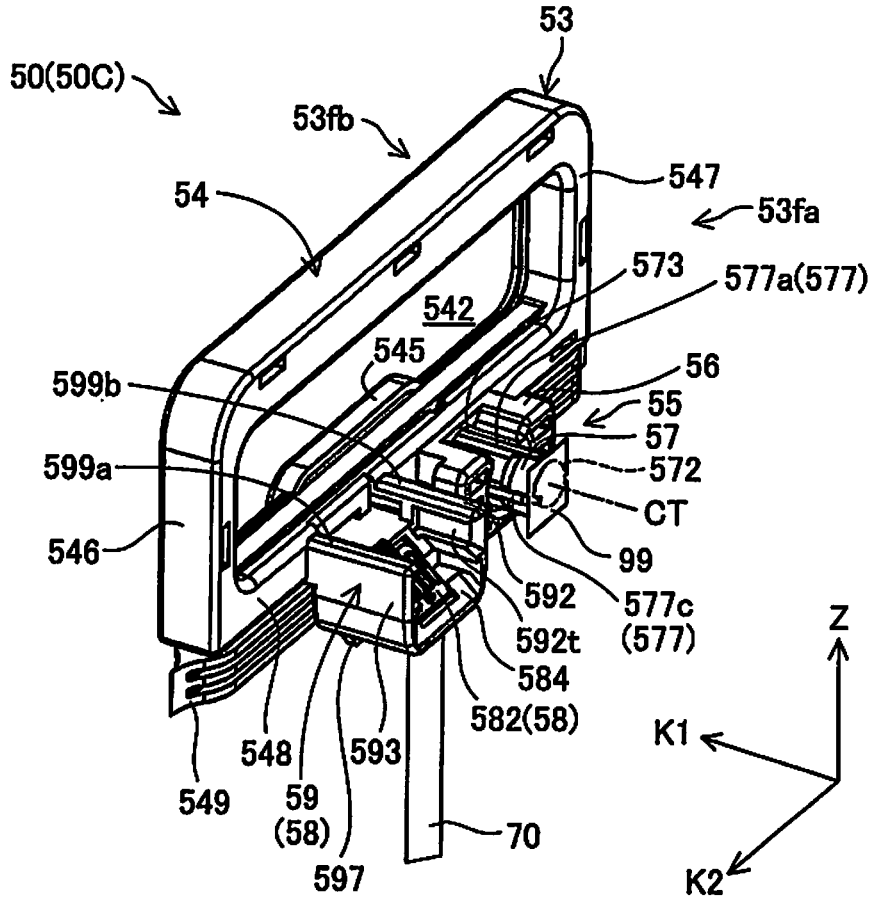
FIG. 10 is a second perspective view illustrating part of the liquid container.
Figure 11:
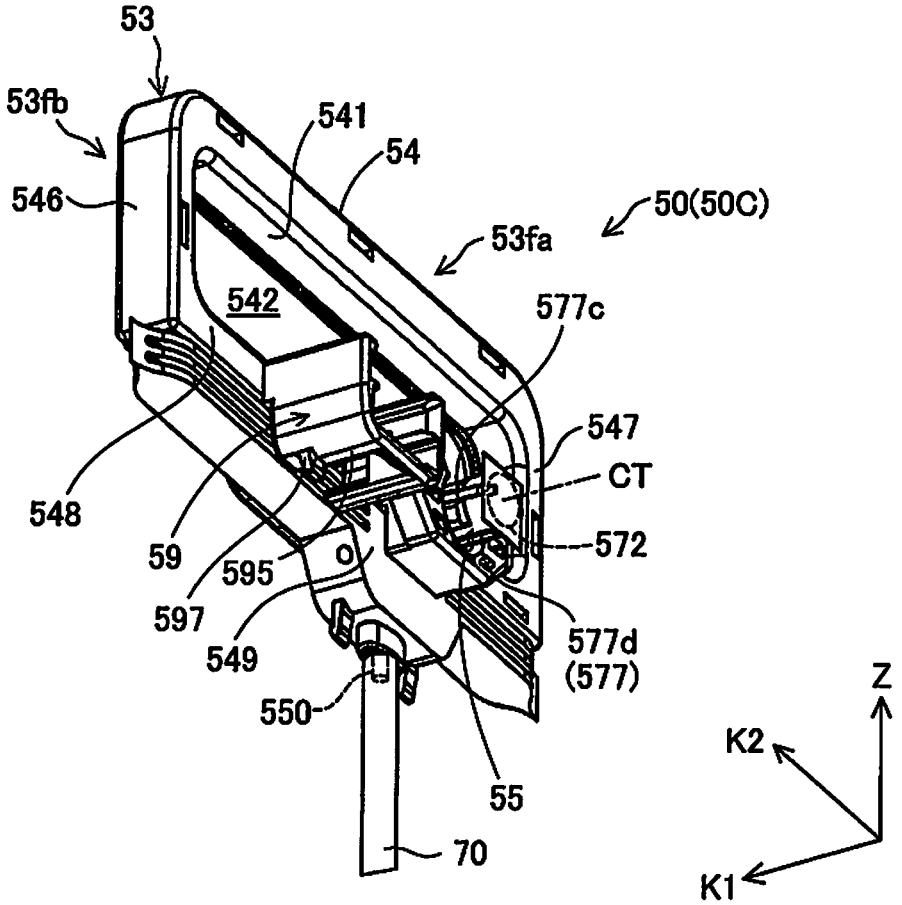
FIG. 11 is a third perspective view illustrating part of the liquid container.
Figure 12:
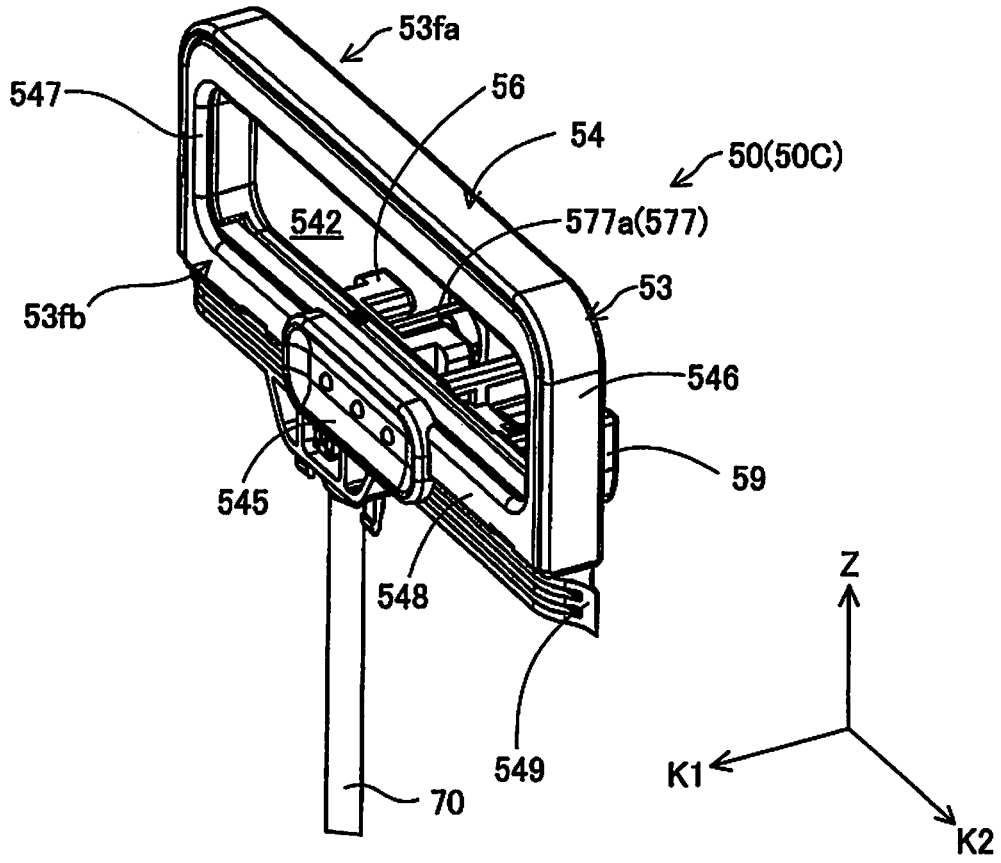
FIG. 12 is a fourth perspective view illustrating part of the liquid container.
Figure 13:
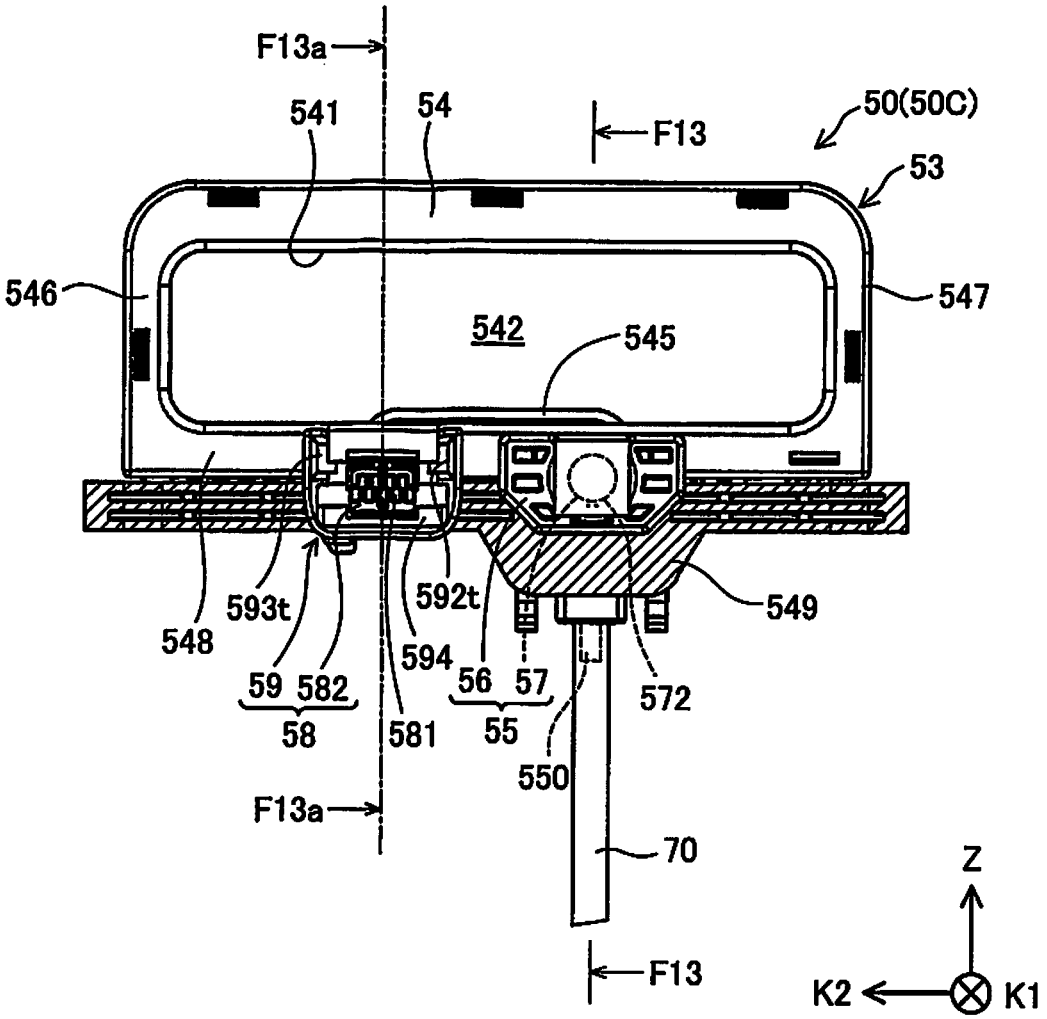
FIG. 13 is a front view illustrating part of the liquid container.
Figure 14:
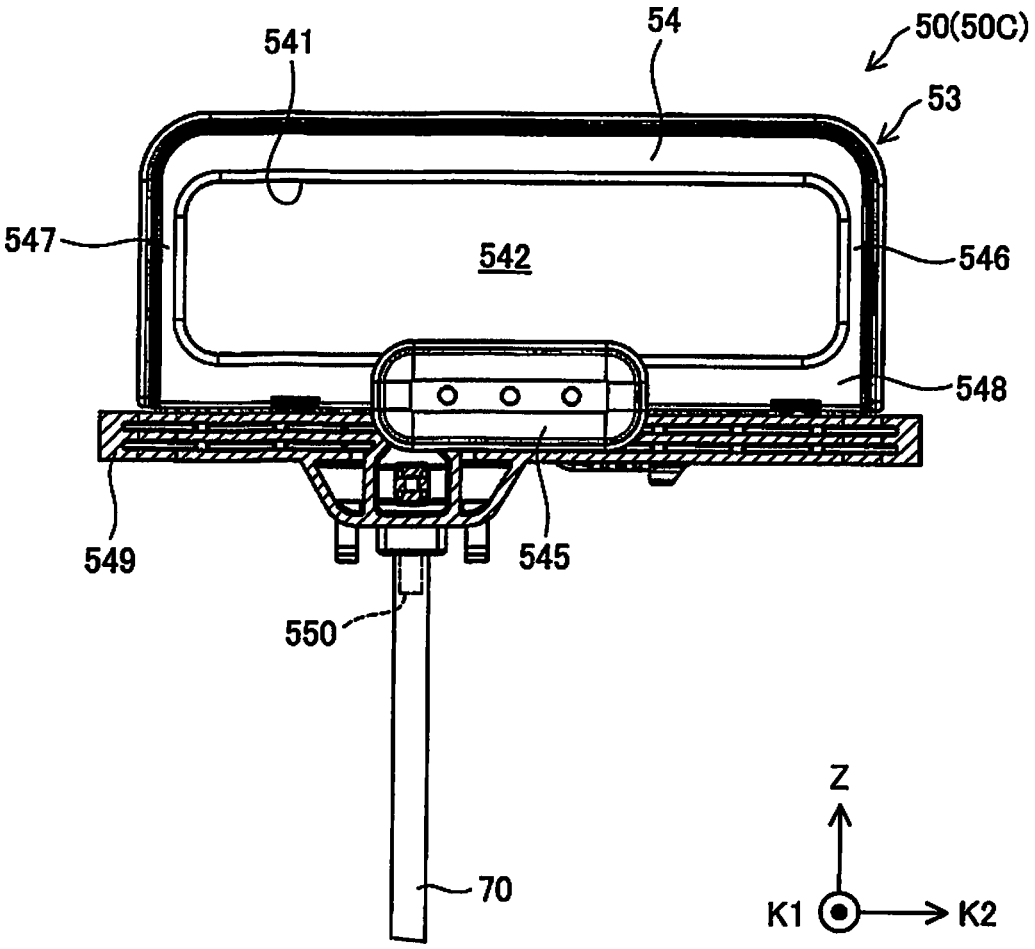
FIG. 14 is a rear view illustrating part of the liquid container.
Figure 15:
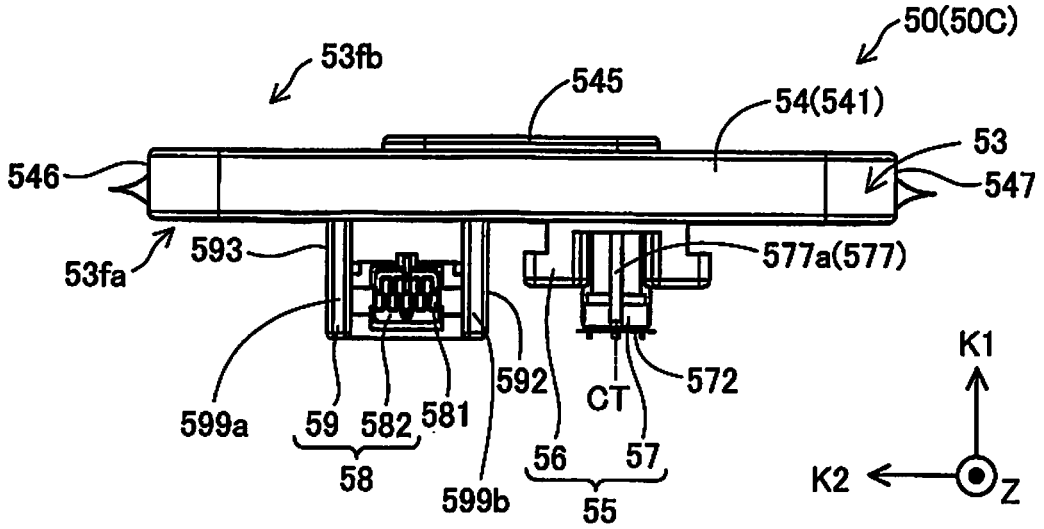
FIG. 15 is a top view illustrating part of the liquid container.
Figure 16:
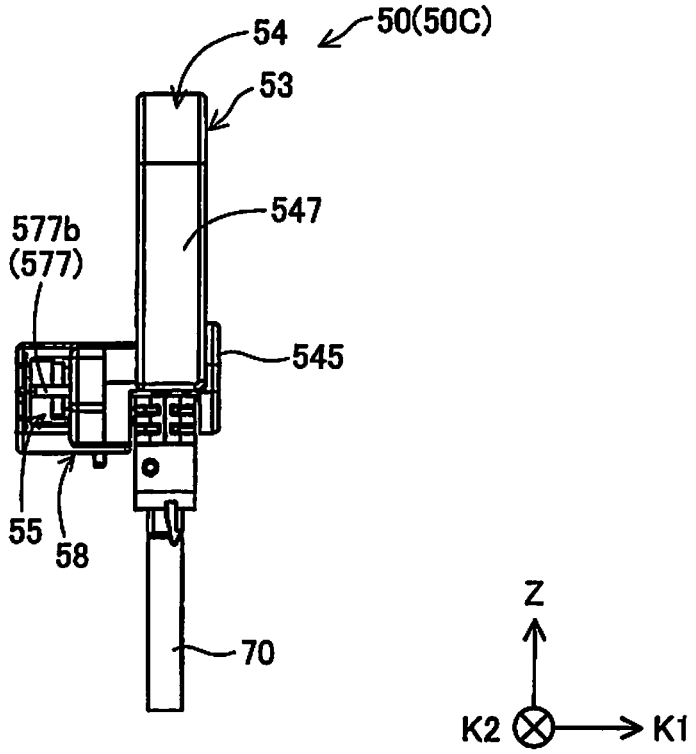
FIG. 16 is a right side view illustrating part of the liquid container.
Figure 16A:
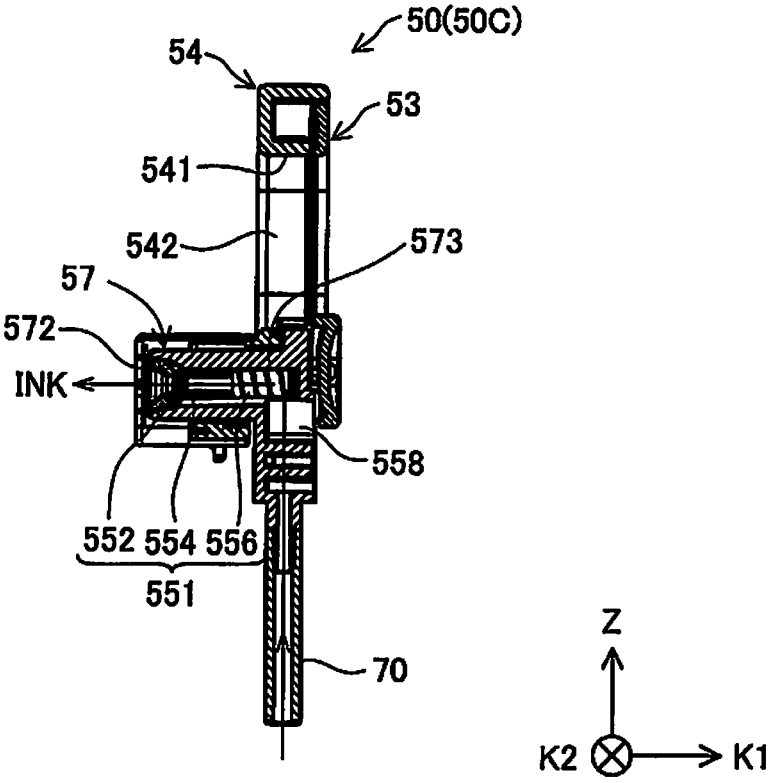
FIG. 16A is an F13-F13 sectional view of FIG. 13.
Figure 16B:
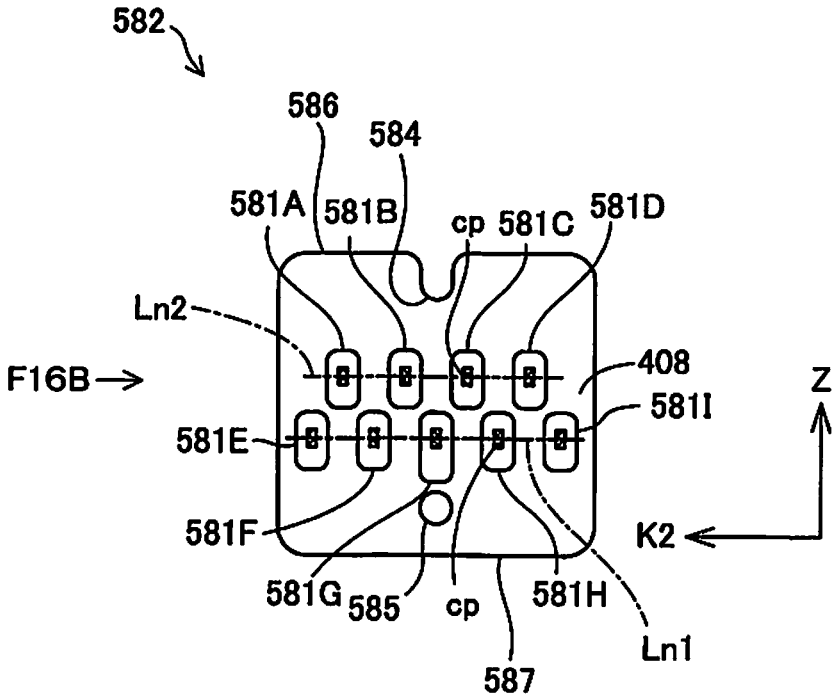
FIG. 16B is a front view illustrating a circuit board.
Figure 16C:
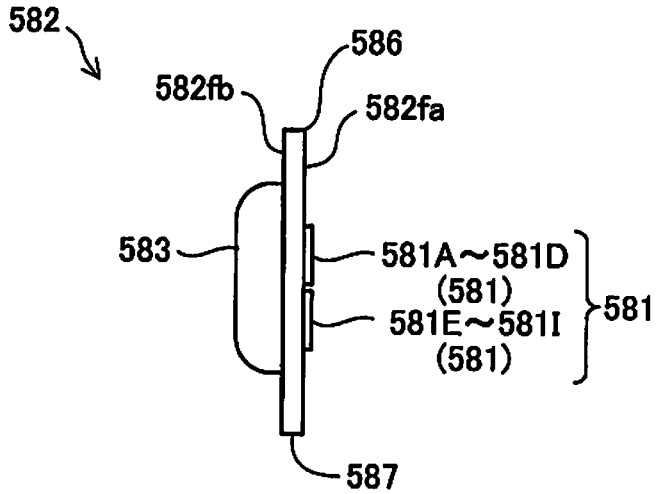
FIG. 16C is a view from an arrow F16B in FIG. 16B.
Figure 16E:
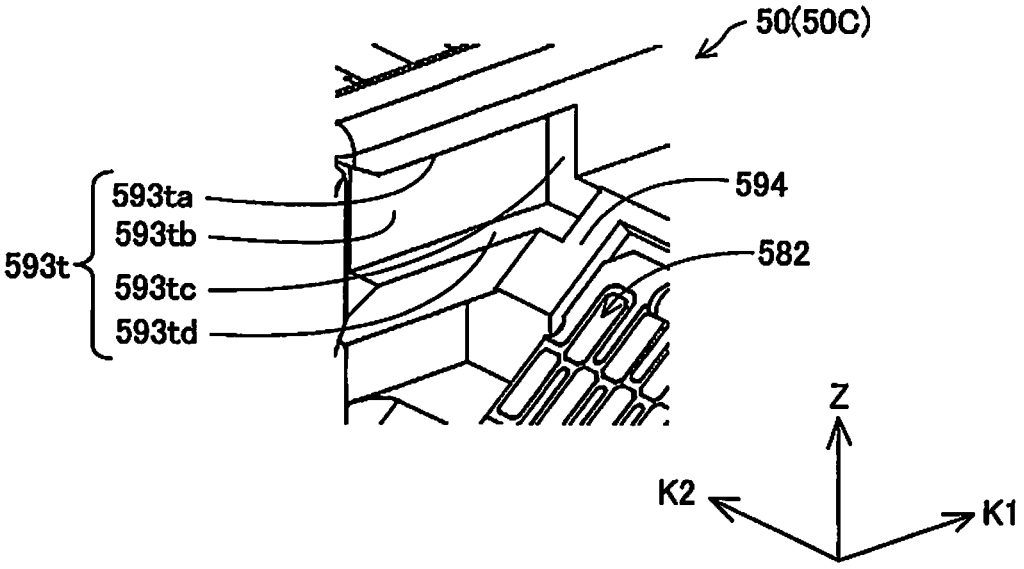
FIG. 16E is a perspective view illustrating a groove.
Figure 16F:
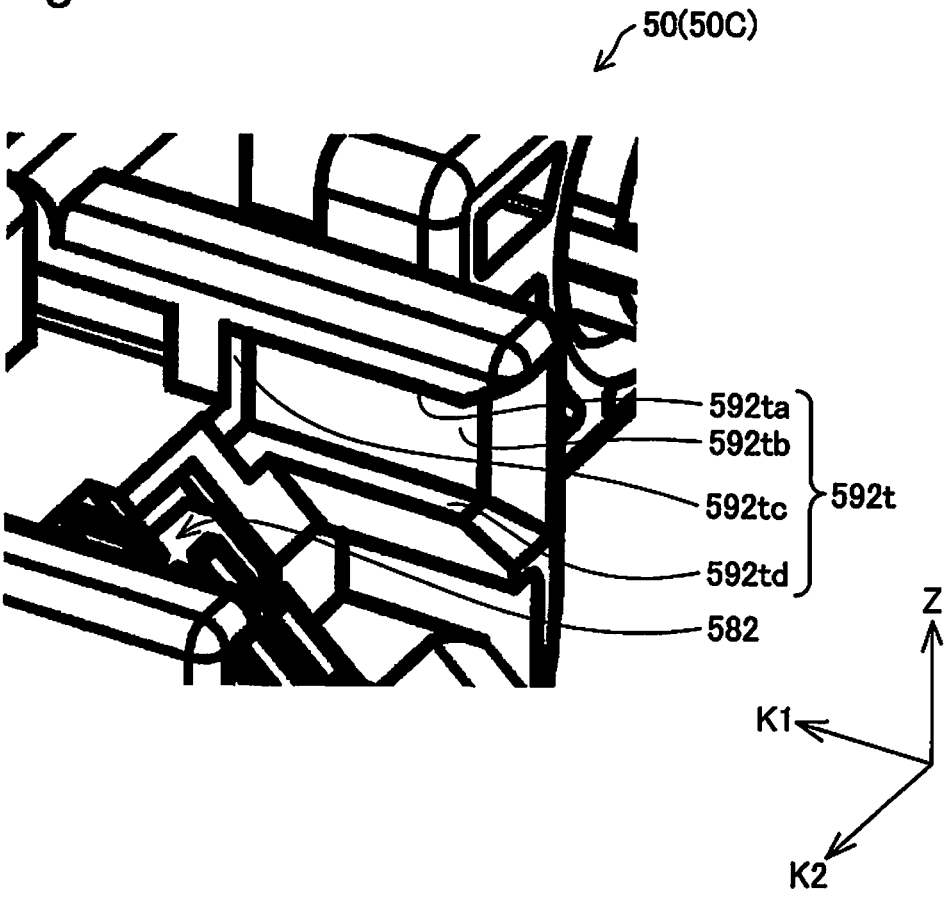
FIG. 16F is a perspective view illustrating a groove.

FIG. 9 is a first perspective view illustrating part of the liquid container 50. FIG. 10 is a second perspective view illustrating part of the liquid container 50. FIG. 11 is a third perspective view illustrating part of the liquid container 50. FIG. 12 is a fourth perspective view illustrating part of the liquid container 50. FIG. 13 is a front view illustrating part of the liquid container 50. FIG. 14 is a rear view illustrating part of the liquid container 50. FIG. 15 is a top view illustrating part of the liquid container 50. FIG. 16 is a right side view illustrating part of the liquid container 50. FIG. 16A is an F13-F13 sectional view of FIG. 13. FIG. 16B is a front view illustrating the circuit board 582. FIG. 16C is a view from an arrow F16B in FIG. 16B. FIG. 16D is an F13*a*-F13*a* partial sectional view of FIG. 13. FIG. 16E is a perspective view illustrating a groove 593*t*. FIG. 16F is a perspective view illustrating a groove 592*t*. The liquid container body 52 of the liquid container 50 is omitted from the illustration in FIGS. 9 to 16A.

With regard to the operation member 53, the Z-axis direction is also called "height direction", the K1-axis direction is also called "thickness direction", and the K2-axis direction is also called "width direction". According to this embodiment, the "height direction", "thickness direction" and "width direction" of the operation member 53 correspond to the "height direction", "thickness direction" and "width direction" of the liquid container 50. According to this embodiment, the dimensions of the liquid container 50 decrease in the sequence of the height, the width and the thickness.

As shown in FIGS. 9 and 10, the operation member 53 includes a first connecting portion 546, a second connecting portion 547, a base portion 548 and a mounting portion 549 to which the liquid container body 52 is mounted by welding or the like, in addition to the grip portion 54.

The grip portion 54, the first connecting portion 546, the second connecting portion 547 and the base portion 548 are respectively in rod-like shapes. The grip portion 54, the first connecting portion 546, the second connecting portion 547 and the base portion 548 form a frame-like member. Accordingly a receiving space 542 in an approximately rectangular shape is defined and formed in the operation member 53 to receive the user's hand. As shown in FIG. 11, the grip portion 54 has a grip surface (support surface) 541 that is exposed to the receiving space 542. The grip surface 541 is a plane approximately perpendicular to the Z-axis direction in the mounted state.

The grip portion 54 is a holdable part. The grip portion 54 is a portion gripped by the user to hold the liquid container 50. The grip portion 54 is extended along the K2-axis direction. As shown in FIG. 11, the grip portion 54 has the grip surface (support surface) 541 that is exposed to the receiving space 542. The grip surface 541 is a part directly supported (held) by the user. The grip surface 541 is the plane approximately perpendicular to the Z-axis direction in the mounted state that the liquid container 50 is mounted to the mounting/demounting unit 30.

As shown in FIG. 9, the base portion 548 is extended along the K2-axis direction. The liquid supply unit 55 and the substrate unit 58 are attached to the base portion 548. In other words, the liquid supply unit 55 and the substrate unit 58 are linked with each other via the base portion 548. The liquid supply unit 55 and the substrate unit 58 accordingly move in conjunction with the motion of the base portion 548. This configuration allows the user to operate the motions of the liquid supply unit 55 and the substrate unit 58 used for connecting the liquid container 50 with the printer 10 by simply operating the motion of one member (base portion 548 according to this embodiment).

As shown in FIG. 9, the first connecting portion 546 is a member extended from one edge of the grip portion 54 in the K2-axis direction toward the base portion 548 (in the −Z-axis direction, toward the liquid container body 52 shown in FIG. 7). The second connecting portion 547 is a member extended from the other edge of the grip portion 54 in the K2-axis direction toward the base portion 548 (in the −Z-axis direction, toward the liquid container body 52 shown in FIG. 7). The base portion 548 is a portion opposed to the grip portion 54 across the receiving space 542. The base portion 54 is extended along the K2-axis direction. The positioning structure 56 described later, the circuit board holding structure (contact placement structure, board holding structure) 59 and the pressed portion 545 (shown in FIG. 12) are attached to the base portion 548. In other words, the positioning structure 56 of the liquid supply unit 55 and the container-side electrical connection structure 58 including the circuit board holding structure (contact placement structure) 59 are linked with each other via the base portion 548. The liquid supply unit 55 and the circuit board holding structure 59 accordingly move in conjunction with the motion of the base portion 548. This configuration allows the user to operate the motions of the liquid supply unit 55 and the circuit board holding structure 59 used for connecting the liquid container 50 with the printer 10 by simply operating the motion of one member (base portion 548 according to this embodiment). The term "linked" herein means that members linked with each other are connected to be movable in conjunction with each other.

The mounting portion (joint portion) 549 is located on the opposite side that is opposite to the side where the grip portion 54 is located across the base portion 548. The mounting portion 549 is arranged adjacent to the base portion 548. The mounting portion 549 is extended along the K2-axis direction. The mounting portion 549 is a portion which one end 501 of the liquid container body 52 (shown in FIG. 7) is mounted to (or joined with) by welding or the like. The mounting portion 549 is linked with the operation member 53. As shown in FIG. 13 and FIG. 16A, the mounting portion 549 has a lead-out portion 550 configured to cause ink contained in the liquid container body 52 to be flowed to the liquid supply portion 57. Connecting a flow path member 70 with the lead-out portion 550 causes ink flowing in the flow path member 70 to be flowed to the liquid supply portion 57 described later via the lead-out portion 550. For the purpose of better understanding, part of the mounting portion 549 to which the liquid container body 52 is mounted is shown by single hatching in FIGS. 13 and 14.

As shown in FIGS. 9 and 10, the liquid supply unit 55 includes the liquid supply portion (liquid lead-out portion) 57 and a container body-side support structure (positioning structure) 56. The container body-side support structure (positioning structure) 56 is provided separately from the liquid supply portion 57, a small clearance is formed between the container body-side support structure 56 and the liquid supply portion 57. The liquid supply unit 55 (positioning structure 56) is provided to be protruded outward (in the −K1-axis direction) from the operation member 53.

The liquid supply portion 57 is configured to cause the ink contained in the liquid container body 52 to be flowed to the printer 10. The liquid supply portion 57 includes a liquid supply port 572 on one end and a supply connecting portion 573 on the other end. The liquid supply port 572 is arranged to communicate with inside of the liquid container body 52 and causes the ink contained in the liquid container body 52 to be flowed out to the outside (printer 10). The liquid supply portion 57 is extended from the operation member 53 to face in a first direction (−K1-axis direction) that is a direction intersecting with the direction of gravity (Z-axis direction) in the process of supplying ink to the printer 10. The liquid introduction portion 362 (shown in FIG. 5B) is inserted into the liquid supply port 572 in the mounted state of the liquid container 50. The liquid supply port 572 defines a plane perpendicular to the grip surface 541 (surface defined by the Z-axis direction and the K2-axis direction). The liquid supply port 572 is open toward the primary direction (K1-axis direction). More specifically, the liquid supply port 572 is open toward the first direction (−K1-axis direction, connecting direction). The opening direction herein is a direction that is perpendicular to the plane defined by the liquid supply port 572 and is a direction toward outside. The liquid supply port 572 is, however, not necessarily limited to the configuration that the liquid supply port 572 is open toward the first direction but may be open toward a direction including a first direction component.

The supply connecting portion 573 is connected with the operation member 53. The liquid supply portion 57 is a tubular member (ring-shaped member) extended along the K1-axis direction (center axis CT direction). The liquid supply portion 57 is provided to be protruded outward (in the −K1-axis direction) from the operation member 53.

The liquid supply portion 57 has a center axis CT. The center axis CT is parallel to the K1-axis direction. With regard to the K1-axis direction, a direction from the liquid supply port 572 toward the supply connecting portion 573 is +K1-axis direction, and a direction from the supply connecting portion 573 toward the liquid supply port 572 is −K1-axis direction.

As shown in FIG. 15, the grip surface 541 is located on a perpendicular direction side (+Z-axis direction side) perpendicular to the center axis CT direction of the liquid supply portion 57 (K1-axis direction). The operation member 53 including the grip surface 541 is provided to be offset in the center axis CT direction relative to the liquid supply port 572. In other words, when the liquid container 50 is viewed in the direction from the liquid supply portion 57 toward the grip surface 541 (in the +Z-axis direction), the liquid supply port 572 is arranged at a position that does not overlap with the grip surface 541 (operation member 53). Accordingly the grip surface 541 and the liquid supply port 52 satisfy the non-overlapped positional relationship in projection of the liquid container 50 onto a plane perpendicular to the grip surface 541.

As shown in FIG. 9, in the unused state of the liquid container 50, the liquid supply port 572 is closed by a film 99. This configuration suppresses leakage of ink from the liquid supply port 572 to outside before the liquid container 50 is mounted to the mounting/demounting unit 30 (shown in FIG. 5). The film 99 is broken by the liquid introduction portion 362 (shown in FIG. 5B) in the process of mounting the liquid container 50 to the mounting/demounting unit 30.

As shown in FIGS. 9 to 11, positioning structures 577 are provided to surround the outer circumference of the liquid supply portion 57 about the center axis CT. The positioning structures 577 abut on the supply portion positioning structures 364 of the liquid introduction portion 362 (shown in FIG. 5B) so as to position the liquid supply portion 57 relative to the liquid introduction portion 362 in the process of connecting the liquid container 50 with the printer 10. The positioning structures 577 may be regarded as part of the liquid supply portion 57.

The positioning structures 577 include a first container-side positioning structure 577*a*, a second container-side positioning structure 577*b*, a third container-side positioning structure 577*c* and a fourth container-side positioning structure 577*d*. The first to the fourth container-side positioning structures 577*a* to 577*d* are members protruded from the liquid supply portion 57 (protruded members). The first to the fourth container-side positioning structures 577*a* to 577*d* are members extended along the K1-axis direction. Respective −K1-axis direction ends of the first to the fourth container-side positioning structures 577*a* to 577*d* are arranged near to the liquid supply port 572.

The first container-side positioning structure 577*a* is located on the upper side of the liquid supply portion 57 in the direction of gravity (on the +Z-axis direction side). The second container-side positioning structure 577*b* is located on the −K2-axis direction side of the liquid supply portion 57. The third container-side positioning structure 577*c* is located on the +K2-axis direction side of the liquid supply portion 57. The fourth container-side positioning structure 577*d* is located on the lower side of the liquid supply portion 57 in the direction of gravity (on the −Z-axis direction side). The first and the fourth container-side positioning structures 577*a* and 577*d* are opposed to each other in the Z-axis direction. The second and the third container-side positioning structures 577*b* and 577*c* are opposed to each other in the K2-axis direction.

As shown in FIG. 16A, a valve mechanism 551 is placed inside of the liquid supply portion 57 to open and close a liquid flow path formed by the liquid supply portion 57. The valve mechanism 551 includes a valve seat 552, a valve element 554 and a spring 556. The valve seat 552, the valve element 554 and the spring 556 are placed in the liquid supply portion 57 to be arranged in this sequence from the liquid supply port 572 toward the supply connecting portion 573 of the liquid supply portion 57.

The valve seat 552 is an approximately annula 53 r member. The valve seat 552 is formed from an elastic body, for example, a rubber or an elastomer. The valve seat 552 is pressed into the liquid supply portion 57. The valve element 554 is an approximately cylindrical member. The valve element 554 is arranged to close a hole formed in the valve seat 552 (valve hole) in the state before mounting of the liquid container 50 to the mounting/demounting unit 30. The spring 556 is a compression coil spring. The spring 556 presses the valve element 554 in a direction toward the valve seat 552. In the mounted state of the liquid container 50, the liquid introduction portion 362 (shown in FIG. 5B) presses the vale element 554 toward the supply connecting portion 573, so as to move the valve element 554 toward the supply connecting portion 573. The valve element 554 is accordingly separated from the valve seat 552 to set the valve mechanism 551 in the open position. In the open position of the valve mechanism 551, the ink contained in the liquid container body 52 (shown in FIG. 7) is allowed to flow through the flow path member 70, an inner flow path 558 of the operation member 53 and the liquid supply portion 57 to outside.

As shown in FIG. 9, the container body-side support structure (positioning structure) 56 is configured to roughly position the liquid container 50 (liquid container body 52) including the liquid supply port 572 relative to the printer 10 in the process of connecting the liquid container 50 with the printer 10. The container body-side support structure (positioning structure) 56 is provided integrally with the operation member 53. According to this embodiment, the positioning structure 56 is integrally molded with the operation member 53, so as to be provided integrally with the operation member 53. The term "provided integrally" means that the positioning structure 56 is provided in the operation member 53 to be in conjunction with the motion of the operation member 53. According to another embodiment, the positioning structure 56 may be attached to the operation member 53 by welding or the like, so as to be provided integrally with the operation member 53. The positioning structure 56 is provided in the vicinity of the liquid supply port 572 such as to surround its circumferential direction other than above the liquid supply port 572. When the operation member 53 is formed from a material that is not readily deformable, the positioning structure 56 may be provided in the operation member 53 at a position some distance away from the liquid supply port 572. The positioning structure 56 is protruded in the −K1-axis direction from the operation member 53. The container body-side support structure (positioning structure) 56 is in a recessed shape that is open on the +Z-axis direction side. The container body-side support structure 56 is arranged to surround the circumference of the liquid supply portion 57 about the center axis CT except the Z-axis direction side (upper side in the direction of gravity). The container body-side support structure 56 is arranged at a position adjacent to the liquid supply port 572 of the liquid supply portion 57. When the operation member 53 is formed from a material that is not readily deformable, the container body-side support structure 56 may be provided in the operation member 53 at a position some distance away from the liquid supply port 572. The container body-side support structure 56 is protruded in the −K1-axis direction from the operation member 53.

As shown in FIG. 9 and FIG. 10, the positioning structure 56 is arranged near to the liquid supply port 572. As shown in FIG. 13, at least part of the positioning structure 56 is provided on the liquid container body 52-side (shown in FIG. 7) (on the −Z-axis direction side) of the liquid supply port 572. According to this embodiment, the positioning structure 56 is arranged to surround the circumference of the liquid supply portion 57 about the center axis CT. More specifically, the positioning structure 56 is arranged to surround the circumference of the liquid supply portion 57 except the grip portion 54-side. The container body-side support structure 56 is placed inside of the supply portion support structure 42 (shown in FIG. 5C) of the mounting/demounting unit 30 (shown in FIG. 5) in the process of connecting the liquid container 50 with the printer 10. This configuration causes a plurality of surfaces defining and forming the supply portion support structure 42 (for example, the first support surface 402, the second support surface 403 and the third support surface 404 shown in FIG. 5C) to abut on the container body-side support structure (positioning structure) 56. This restricts the motion of the liquid supply portion 57 and roughly positions the liquid container 50. The liquid supply port 572 is then connected with the liquid introduction portion 362 in the state that the liquid supply port 572 is positioned by the projections 577 (577*a*, 577*b*, 577*c* and 577*d*) provided on the liquid supply portion 57 at the positions above, below, on the left of and on the right of the liquid supply port 572 and the positioning projections 366 (366*a*, 366*b*, 366*c* and 366*d*) provided at the positions above, below, on the left of and on the right of the liquid introduction portion 362 and shown in FIGS. 5 and 6. More specifically, the liquid supply port 572 is connected with the liquid introduction portion 362 in the state that the liquid supply port 572 is positioned by the projections 577*a* to 577*d* (shown in FIGS. 9 to 11) serving as the container-side positioning structures. The projections 577*a* to 577*d* are provided on the outer circumference of the liquid supply portion 57 about the center axis CT. The projections 577*a* to 577*d* are provided on the liquid supply portion 57 at the positions above, below, on the left of and on the right of the liquid supply port 572. More specifically, as shown in FIG. 9, the first projection 577*a* is arranged above the liquid supply portion 57 in the direction of gravity (on the +Z-axis direction side of the liquid supply portion 57). The second projection 577*b* is arranged on the −K2-axis direction side of the liquid supply portion 57. As shown in FIG. 10, the third projection 577*c* is arranged on the +K2-axis direction side of the liquid supply portion 57. As shown in FIG. 11, the fourth projection 577*d* is arranged below the liquid supply portion 57 in the direction of gravity (on the −Z-axis direction side of the liquid supply portion 57). When there is no need to distinguish among the first to the fourth projections 577*a* to 577*d*, these are expressed by a reference sign "577". The container body-side support structure 56 abuts on the third support surface 404 when the liquid container 50 is set in the movable member 40 of the mounting/demounting unit 30, so that the liquid container body 52 is supported by the movable member 40 to be suspended below the grip portion 54 in the direction of gravity by the own weight.

The liquid supply unit 55 serves to supply the ink contained in the liquid container body 52 (shown in FIG. 7) to the printer 10. The liquid supply unit 55 may thus be regarded as "liquid supply assembly". The liquid supply unit 55 provided as the liquid supply assembly includes the liquid supply portion (liquid flow portion) 57 with the liquid supply port 572 and the container body-side support structure (positioning structure) 56 on one end.

As shown in FIGS. 9 and 10, the substrate unit (container-side electrical connection structure) 58 includes a circuit board 582 and a circuit board holding structure 59 as a holder structure (placement structure). The substrate unit 58 is provided to be protruded outward (in the −K1-axis direction) from the operation member 53. The protruding direction of the substrate unit 58 is identical with the protruding direction of the liquid supply portion 57 (−K1-axis direction). The protruding direction of the substrate unit 58 and the protruding direction of the liquid supply portion 57 may, however, not be necessarily identical with each other but may be arranged substantially parallel (approximately parallel) to each other. The term "substantially" means that some error may be included. The substrate unit 58 and the liquid supply portion 57 are protruded from the operation member 53 toward the same side of the operation member 53 (−K1-axis direction side).

As shown in FIG. 15, the substrate unit 58 and the liquid supply unit 55 are arranged side by side in the direction parallel to the grip surface 541. More specifically, the substrate unit 58 and the liquid supply unit 55 are arranged side by side in the K2-axis direction that is parallel to the grip surface 541 and is orthogonal to the center axis CT.

As shown in FIG. 9, the circuit board holding structure 59 is configured to position the circuit board 582 relative to the printer 10 in the process of connecting the liquid container 50 with the printer 10. The circuit board holding structure 59 is provided integrally with the operation member 53. According to this embodiment, the circuit board holding structure 59 is integrally molded with the operation member 53, so as to be provided integrally with the operation member 53. The term "provided integrally" means that the circuit board holding structure 59 is provided in the operation member 53 to be in conjunction with the motion of the operation member 53. According to another embodiment, the circuit board holding structure 59 may be attached to the operation member 53 by welding or the like, so as to be provided integrally with the operation member 53.

The circuit board holding structure 59 is in a recessed shape that is open on the +Z-axis direction side (side where the grip portion 54 is located). A bottom 594 of the recessed shape is inclined to the grip surface 541 (shown in FIG. 11). The circuit board 582 is mounted on the bottom 594, such as to be held obliquely on the circuit board holding structure 59 as described above. At least part (bottom 594) of the circuit board holding structure 59 is provided on the liquid container body 52-side (shown in FIG. 7) (on the −Z-axis direction side) of the circuit board 582 (contact portions cp). In other words, at least part (bottom 594) of the substrate unit (container-side electrical connection structure) 58 that is different from the contact portions cp (shown in FIG. 17B) is provided on the liquid container body 52-side of the contact portions cp.

The circuit board holding structure 59 includes a first side wall portion 592 and a second side wall portion 593 that are respectively extended in the +Z-axis direction from the respective sides in the K2-axis direction of the bottom 594. As shown in FIG. 10, the first side wall portion 592 includes a groove 592*t*. As shown in FIG. 9, the second side wall portion 593 includes a groove 593*t*. In the process of connecting the liquid container 50 with the printer 10, the circuit board holding structure 59 is first supported by the board support structure 48 (shown in FIG. 5). This configuration roughly positions the circuit board holding structure 59 and the circuit board 582 relative to the apparatus-side terminals 381 (shown in FIG. 5). When the movable member 40 of the mounting/demounting unit 30 shown in FIG. 5 is moved in the −K1-axis direction, the apparatus-side board positioning structure 385 shown in FIG. 6 enters the groove 593*t* of the circuit board holding structure 59 (shown in FIG. 9), while the apparatus-side board positioning structure 384 shown in FIG. 6 enters the groove 592*t* of the circuit board holding structure 59 (shown in FIG. 10). This configuration positions the circuit board holding structure 59 and the circuit board 582 relative to the apparatus-side terminals 381.

The circuit board holding structure 59 and the liquid supply portion 57 are arranged side by side in a direction (K2-axis direction) that intersects with the first direction (−K1-axis direction). The circuit board holding structure 59 is configured to hold (support or place) the circuit board 582. In other words, the circuit board holding structure 59 is configured to place contact portions cp of the circuit board 582. The circuit board holding structure 59 is configured to hold (place) the circuit board 582 (its contact portions cp) to be located above the liquid container body 52 in the process of connecting the liquid container 50 with the printer 10. The circuit board holding structure 59 is a member having rigidity. More specifically, the circuit board holding structure 59 has such a level of rigidity that does not allow for displacement of the circuit board 582 when the liquid container 50 is set in the movable member 40 of the mounting/demounting unit 30. The circuit board holding structure 59 may be formed from, for example, a material such as ABS resin or polystyrene (PS). The circuit board holding structure 59 is supported by the supply portion support structure 42 of the movable member 40 (shown in FIG. 5C) when the circuit board holding structure 59 is set in the movable member 40.

As shown in FIG. 9, the circuit board holding structure 59 is in a recessed shape that is open on the +Z-axis direction side (side where the grip portion 54 is located). A −K1-axis direction side of the circuit board holding structure 59 is open to receive the contact mechanism 38. The circuit board holding structure 59 includes a bottom (bottom face) 595 (shown in FIG. 11), a first side wall portion 592 and a second side wall portion 593. The bottom 595, the first side wall portion 592 and the second side wall portion 593 define the recessed shape of the circuit board holding structure 59. The first side wall portion 592 is a wall portion extended upward in the direction of gravity from a −K2-axis direction side portion of the bottom 595. The second side wall portion 593 is a wall portion extended upward in the direction of gravity from a +K2-axis direction side portion of the bottom 595. The first and the second side wall portions 592 and 593 connected with the bottom 595 are opposed to each other.

As shown in FIG. 9, the circuit board holding structure 59 includes a placement portion (placement surface) 594. The circuit board 582 is mounted on the placement portion 594. The placement portion 594 is located between the first and the second side wall portions 592 and 593. The placement portion 594 is inclined such that its lower end is located on the −K1-axis direction side of its upper end. The placement portion 594 is inclined to face in a direction including a +Z-axis direction component and a −K1-axis direction component. The placement portion 594 is located on the +Z-axis direction side of the bottom 595.

The circuit board holding structure 59 includes the first side wall portion 592 and the second side wall portion 593 that are respectively extended in the +Z-axis direction from the respective sides in the K2-axis direction of the bottom 595. As shown in FIG. 10 and FIG. 15, the first side wall portion 592 includes a groove 592*t* serving as a holding structure-side positioning element and a holding structure-side upper restriction portion 599*b*. As shown in FIG. 9 and FIG. 15, the second side wall portion 593 includes a groove 593*t* serving as a holding structure-side positioning element and a holding structure-side upper restriction portion 599*a*.

As shown in FIG. 15, the holding structure-side upper restriction portion 599*a* (or 599*b*) is an end face on the upper side of the second side wall portion 593 (or the first side wall portion 592) in the direction of gravity. When the electrical connection structure 582 is connected with the apparatus-side terminals 381 of the electrical connection unit 38 (shown in FIG. 5C), the holding structure-side upper restriction portion 599*a* abuts on the apparatus-side upper restriction portion 377*a* (shown in FIG. 6M), while the holding structure-side upper restriction portion 599*b* abuts on the apparatus-side upper restriction portion 377*b* (shown in FIG. 6M). This configuration restricts the upward motion of the circuit board holding structure 59 in the direction of gravity.

As shown in FIG. 13, the two grooves 592*t* and 593*t* are provided on the respective sides in the K2-axis direction with the circuit board 582 placed therebetween. The two grooves 592*t* and 593*t* are respectively formed in an approximately rectangular parallelepiped shape. In the process of connecting the liquid container 50 with the printer 10, the circuit board holding structure 59 is first supported by the board support structure 48 (shown in FIG. 5C). This configuration roughly positions the circuit board holding structure 59 and the circuit board 582 relative to the apparatus-side terminals 381 (shown in FIG. 5C). When the movable member 40 of the mounting/demounting unit 30 shown in FIG. 5C is moved in the −K1-axis direction, the apparatus-side board positioning structure 385 shown in FIG. 5B enters the groove 593*t* of the circuit board holding structure 59 (shown in FIG. 13), while the apparatus-side board positioning structure 384 shown in FIG. 5B enters the groove 592*t* of the circuit board holding structure 59 (shown in FIG. 13). This configuration determines the final positions of the circuit board holding structure 59 and the circuit board 582 relative to the apparatus-side terminals 381.

As shown in FIG. 16E, in the mounted state of the liquid container 50, the second contact-side positioning structure 385 of the contact mechanism 38 (shown in FIG. 5B) is inserted into the groove 593*t* (second groove 593*t*). The groove 593*t* includes a top face 593*ta*, a side face 593*tb*, a base end face 593*tc* and a bottom face 593*td*. The top face 593*ta* and the bottom face 593*td* are opposed to each other in the Z-axis direction. The top face 593*ta* is located on the +Z-axis direction side, and the bottom face 593*td* is located on the −Z-axis direction side. The side face 593*td* forms a +K2-axis direction side face of the groove 593*t*. The base end face 593*tc* forms a +K1-axis direction side face of the groove 593*t*.

As shown in FIG. 16F, in the mounted state of the liquid container 50, the first contact-side positioning structure 384 of the contact mechanism 38 (shown in FIG. 5B) is inserted into the groove 592*t* (first groove 592*t*). The groove 592*t* has the same configuration as that of the groove 593*t*. The groove 592*t* includes a top face 592*ta*, a side face 592*tb*, a base end face 592*tc* and a bottom face 592*td*. The top face 592*ta* and the bottom face 592*td* are opposed to each other in the Z-axis direction. The top face 592*ta* is located on the +Z-axis direction side, and the bottom face 592*td* is located on the −Z-axis direction side. The side face 592*td* forms a −K2-axis direction side face of the groove 592*t*. The base end face 592*tc* forms a +K1-axis direction side face of the groove 592*t*.

When the circuit board 582 comes into contact with the electrical connection structure 382 (shown in FIG. 5B) to be electrically connected with the electrical connection structure 382, the circuit board 582 is positioned relative to the electrical connection structure 382 in the first direction (−K1-axis direction) and in directions (Z-axis direction and K2-axis direction) intersecting with the first direction as described below.

When the liquid container 50 is set in the movable member 40 and is pressed in the connecting direction (in the −K1-axis direction), the apparatus-side board positioning structures 384 and 385 (shown in FIG. 6P and FIG. 6Q) start insertion into the grooves 592*t* and 593*t*. This causes the first restriction element 385*a* (shown in FIG. 6T) to abut on the top face 593*ta* (shown in FIG. 16E), while causing the first restriction element 384*a* (shown in FIG. 6U) to abut on the top face 592*ta* (shown in FIG. 16F). This restricts the motion of the circuit board holding structure 59 in the +Z-axis direction and thereby achieves positioning in the +Z-axis direction. This also causes the fourth restriction element 385*d* (shown in FIG. 6T) to abut on the bottom face 593*td* (shown in FIG. 16E), while causing the fourth restriction element 384*d* (shown in FIG. 6U) to abut on the bottom face 592*td* (shown in FIG. 16F). This restricts the motion of the circuit board holding structure 59 in the −Z-axis direction and thereby achieves positioning in the −Z-axis direction. Additionally, this causes the second restriction element 385*b* (shown in FIG. 6T) to abut on the side face 593*tb* (shown in FIG. 16E), while causing the second restriction element 384*b* (shown in FIG. 6U) to abut on the side face 592*tb* (shown in FIG. 16F). This restricts the motion of the circuit board holding structure 59 in the K2-axis direction and thereby achieves positioning in the K2-axis direction.

Further pressing the liquid container 50 in the connecting direction (−K1-axis direction) causes the third restriction element 385*c* (shown in FIG. 6T) to abut on the base end face 593*tc* (shown in FIG. 16E), while causing the third restriction element 384*c* (shown in FIG. 6U) to abut on the base end face 592*tc* (shown in FIG. 16F). This restricts the motion of the circuit board holding structure 59 in the first direction (in the −K1-axis direction) and thereby achieves positioning in the first direction. This configuration enables the circuit board 582 and the electrical connection structure 382 to come into contact with each other with high accuracy at predetermined positions.

As shown in FIG. 11, the restriction element 597 is provided on the bottom 595. The restriction element 597 is a projection protruded outward (in the −Z-axis direction) from the bottom 595. The restriction element 597 abuts on the apparatus-side restriction element 489 of the movable member 40 (shown in FIG. 6K), so as to restrict the motion of the circuit board holding structure 59 in an opposite direction (+K1-axis direction) opposite to the first direction (−K1-axis direction).

As shown in FIG. 16B, a boss groove 584 is formed on a +Z-axis direction side upper end 586 of the circuit board 582, and a boss hole 585 is formed on a −Z-axis direction side lower end 587 of the circuit board 582. The circuit board 582 is fixed to the placement portion (bottom) 594 using the boss groove 584 and the boss hole 585.

As shown in FIGS. 16B and 16C, the circuit board 582 includes a liquid container-side terminal group 580 provided on a surface 582*fa* and a storage device 583 provided on a rear face 582*fb*. The surface 582*fa* and the rear face 582*fb* are planes.

The liquid container-side terminal group 580 consists of nine terminals 581A to 581I. The storage device 583 stores, for example, information regarding the liquid container 50 (for example, the remaining amount of ink and the color of ink).

As shown in FIG. 16B, the nine liquid container-side terminals 581A to 581I are respectively formed in an approximately rectangular shape and are arranged in two lines Ln1 and Ln2 at different positions in the Z-axis direction. The lines Ln1 and Ln2 are parallel to the K2-axis direction.

The liquid container-side terminals 581A to 581I respectively have contact portions cp arranged in their centers to come into contact with the corresponding apparatus-side terminals 381A to 381I (shown in FIG. 6V). The above lines Ln1 and Ln2 may be regarded as lines formed by a plurality of the contact portions cp. When there is no need to distinguish among the nine liquid container-side terminals 581A to 581I, these are expressed by a reference sign "581". The liquid container-side terminals 581A to 581I have approximately rectangular outer shapes.

As shown in FIG. 16D, in the mounted state of the liquid container 50, the surface 582*fa* with the plurality of contact portions cp placed thereon is inclined such that the lower end 587 is located on the first direction side (on the −K1-axis direction side or connecting direction side) of the upper end 586. A plane (contact plane) TP defined by the plurality of contact portions cp is inclined such that the lower side is located on the first direction side of the upper side. The surface 582*fa* and the plane TP are inclined to face in a direction including a +Z-axis direction component (upward component in the direction of gravity) and a −K1-axis direction component (first direction component).

The container-side electrical connection structure 58 has the contact portions cp that are allowed to come into contact with the apparatus-side electrical connection structure 382. As shown in FIG. 9, the container-side electrical connection structure 58 is provided integrally with the operation member 53.

As shown in FIG. 15, the grip surface 541 is located on a perpendicular direction side (+Z-axis direction side) perpendicular to the center axis CT direction of the liquid supply portion 57. The substrate unit 58 serving as the container-side electrical connection structure is provided to be offset in the center axis CT direction relative to the operation member 53 including the grip surface 541. In other words, when the liquid container 50 is viewed in the direction that is orthogonal to the grip surface 541 and is from the liquid supply portion 57 toward the grip surface 541 (in the +Z-axis direction), the substrate unit 58 is arranged at a position that does not overlap with the grip surface 541 (operation member 53). Accordingly the grip surface 541 and the substrate unit 58 satisfy the non-overlapped positional relationship in projection of the liquid container 50 onto a plane perpendicular to the grip surface 541. In this case, it is required that at least the circuit board 582 of the substrate unit 58 is arranged at a position that does not overlap with the grip surface 541 (operation member 53).

As shown in FIG. 9 and FIG. 12, a −K1-axis direction side of the operation member 53 is defined as first side 53*fa*, and a +K1-axis direction side of the operation member 53 that is opposite to the first side 53*fa* is defined as second side 53*fb*. As shown in FIG. 9, the substrate unit 58 including the circuit board holding structure 59 and the positioning structure 56 are provided on the same side, i.e., on the first side 53*fa*.

As shown in FIG. 12 and FIG. 15, the pressed portion 545 is provided on the second side 53*f* that is opposite to the liquid supply unit (liquid supply assembly) 55 including the positioning structure 56 and the substrate unit (container-side electrical connection structure) 58 including the circuit board holding structure 59 across the operation member 53. More specifically, the positioning structure 56 and the circuit board holding structure 59 are provided on the surface of the first side 53*fa* of the base portion 548 as shown in FIG. 11. The pressed portion 545 is, on the other hand, provided on the surface of the second side 53*fb* of the base portion 548 as shown in FIG. 12. As shown in FIGS. 15 and 16, at least part of the pressed portion 545 is arranged opposite to the positioning structure 56 and the circuit board holding structure 59 across the operation member 53.

The pressed portion 545 is a portion pressed by the user in the process of connecting the liquid container 50 with the printer 10. In other words, the pressed portion 545 is a manually pressed portion. The user presses the pressed portion 545 in the −K1-axis direction (connecting direction), so as to move the movable member 40 (shown in FIG. 6) with the liquid container 50 set thereon in the −K1-axis direction.

The pressed portion 545 is provided to be protruded outward (in the +K1-axis direction) from the operation member 53. This configuration facilitates discrimination of the pressed portion 545 from the remaining part. This encourages the user to press the pressed portion 545, in order to connect the liquid container 50 with the printer 10. As shown in FIG. 14, when the operation member 53 is viewed from the direction along the K1-axis direction, part of the outline of the pressed portion 545 is protruded outside of the base portion 548. This configuration increases the surface area of the pressed portion 545 and accordingly facilitates the user to press the pressed portion 545.

The operation member 53, the circuit board holding structure 59, the positioning structure 56, the liquid supply portion 57 and pressed portion 545 may be formed from the same material or may be formed from different materials according to the application. The material of the operation member 53 may be, for example, a synthetic resin such as polyethylene (PE), polypropylene (PP) or ABS resin.

Figure 17A:
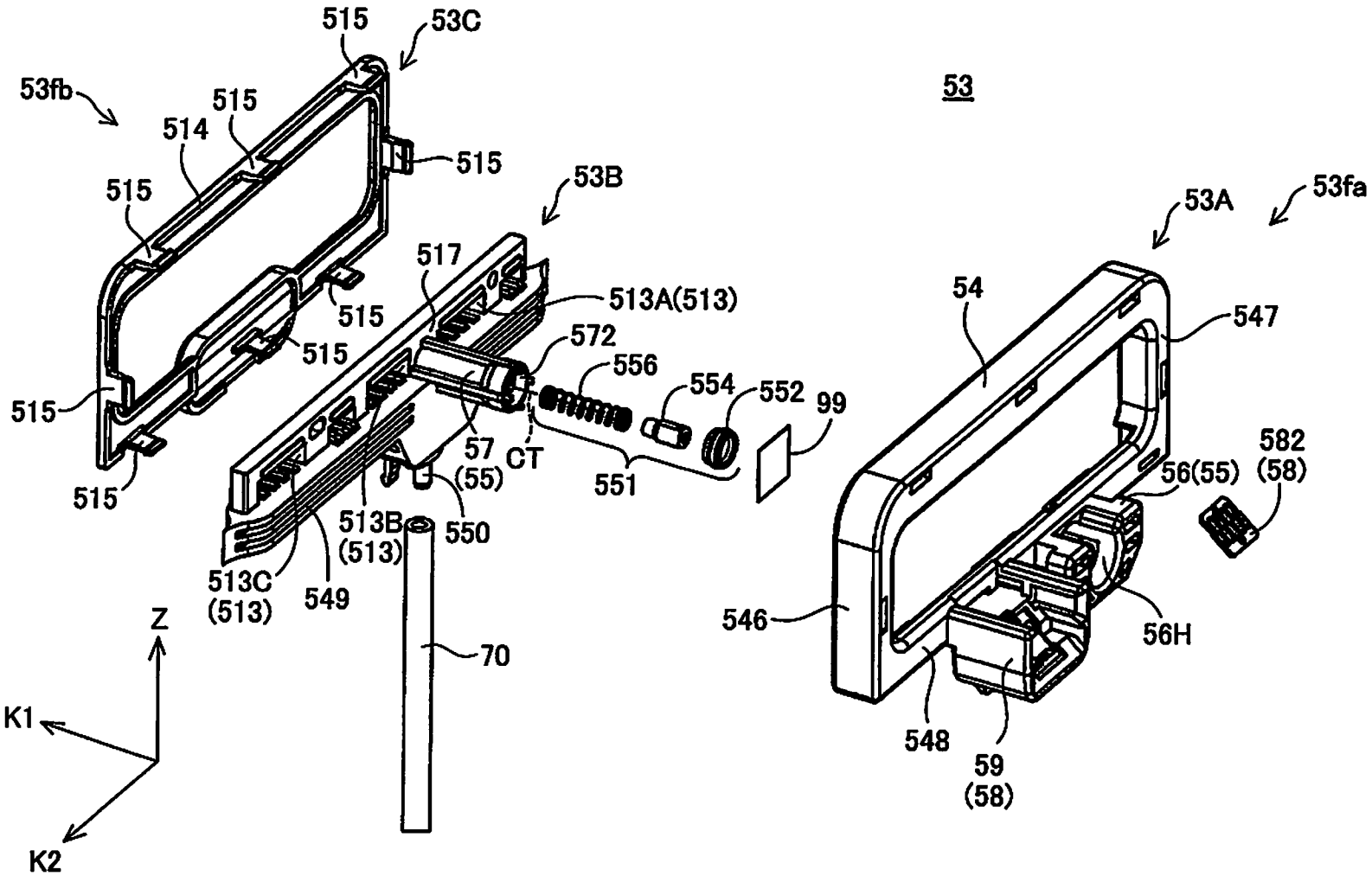
FIG. 17A is a first exploded perspective view illustrating an operation member.
Figure 17B:
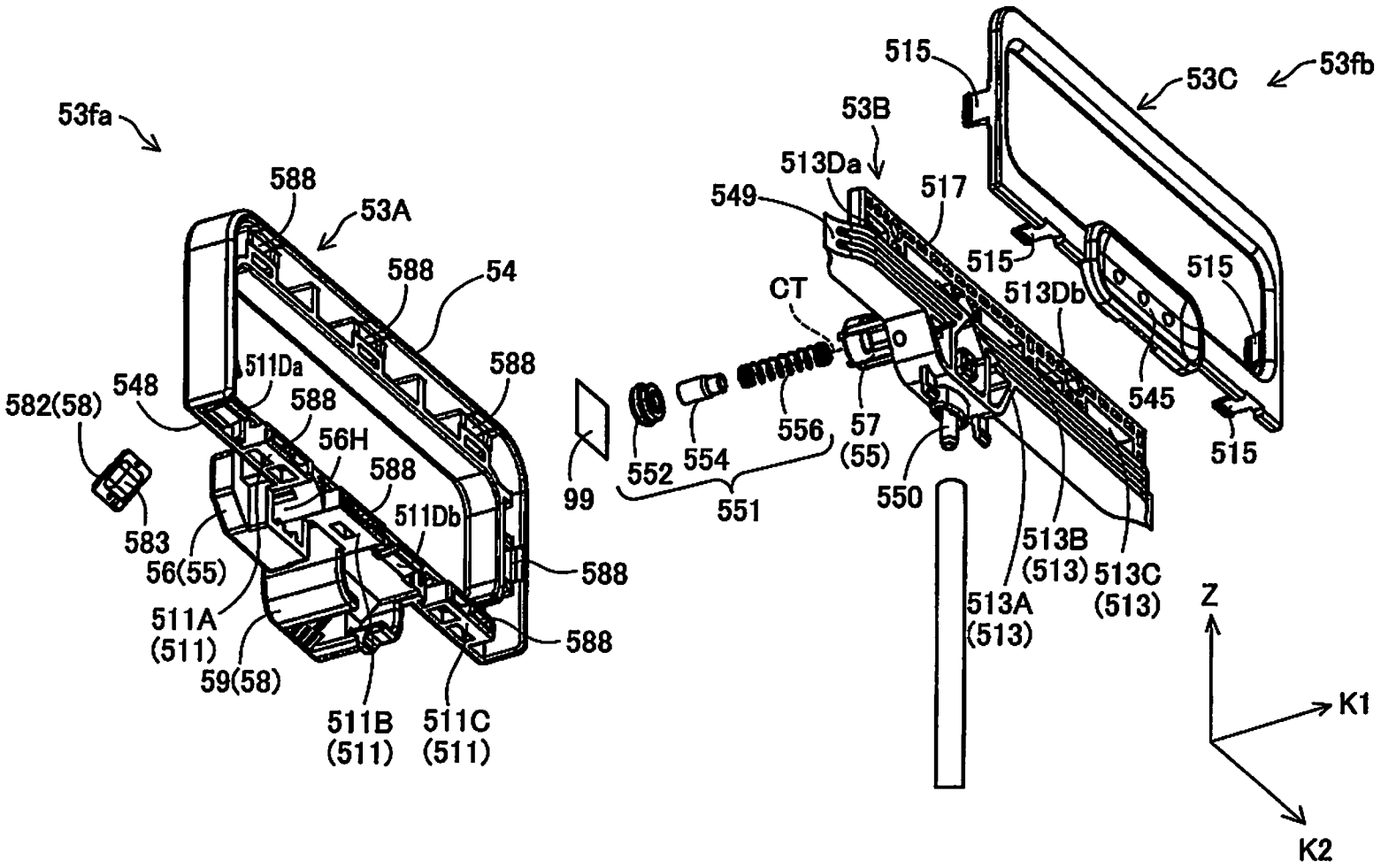
FIG. 17B is a second exploded perspective view illustrating the operation member.
Figure 17C:
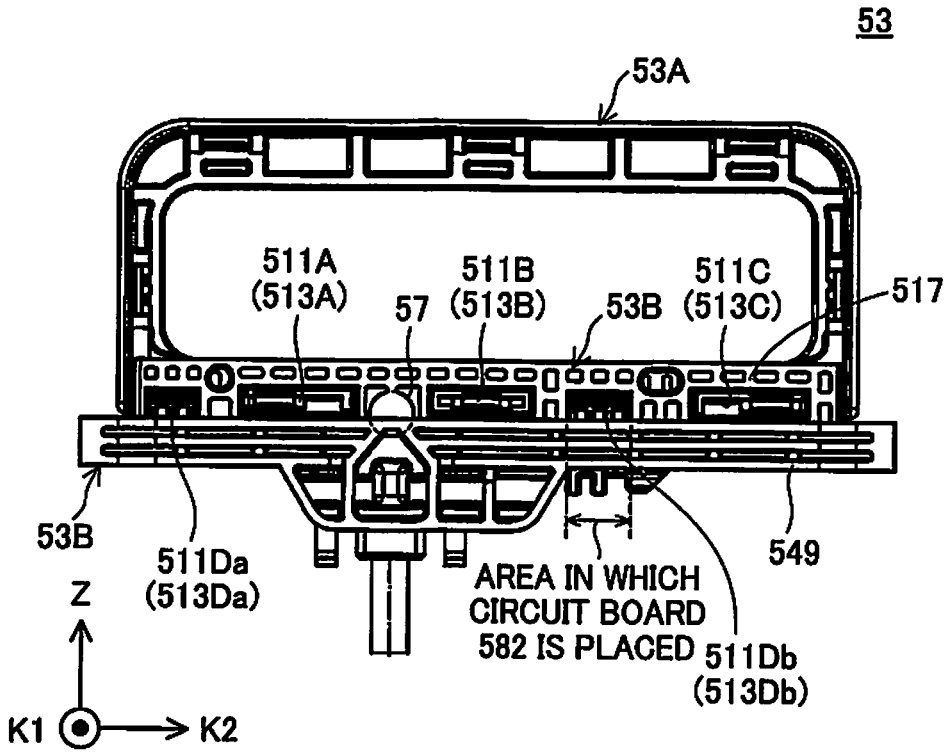
FIG. 17C is a rear view illustrating the operation member.
Figure 17D:
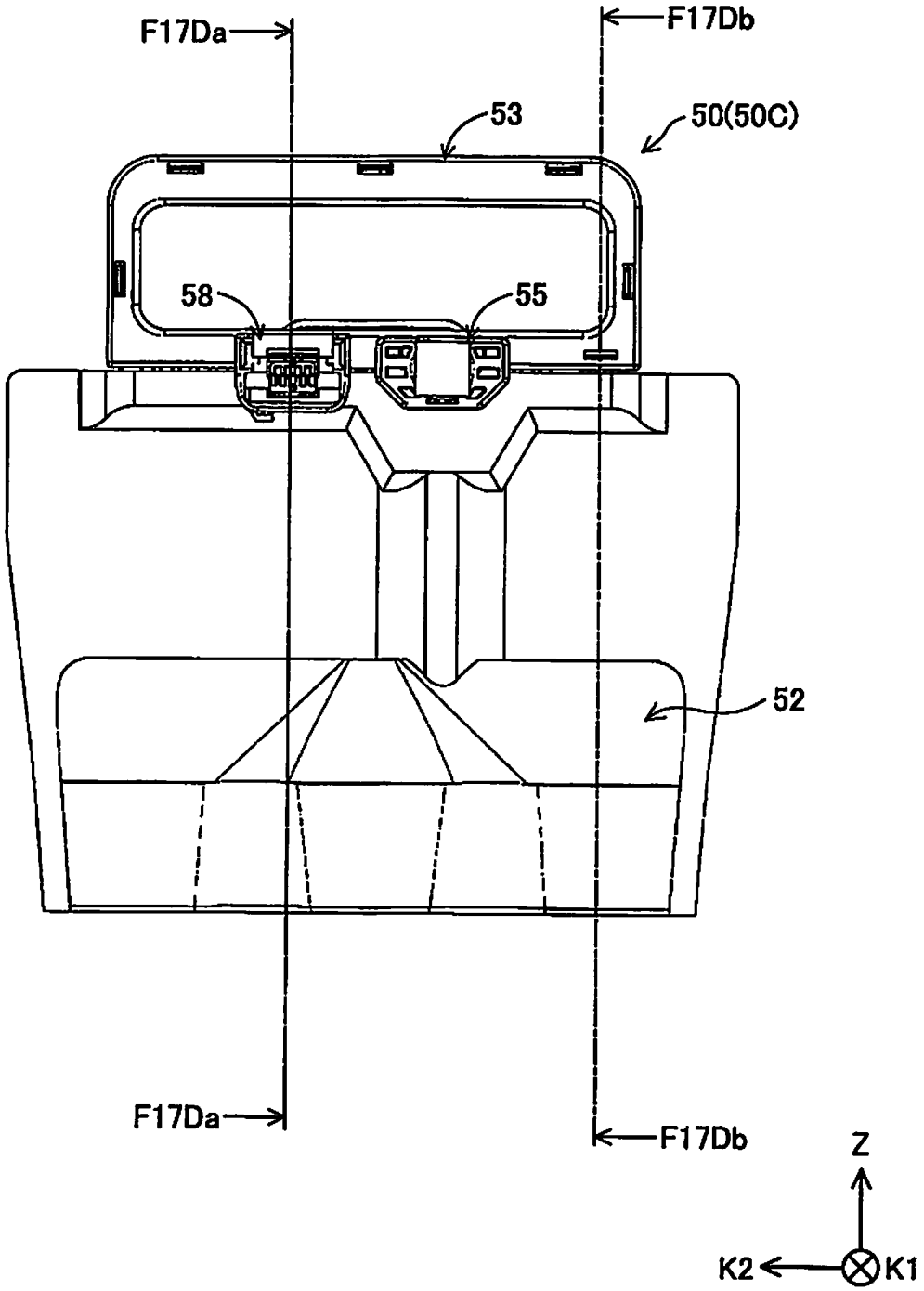
FIG. 17D is a front view illustrating the liquid container.
Figure 17E:
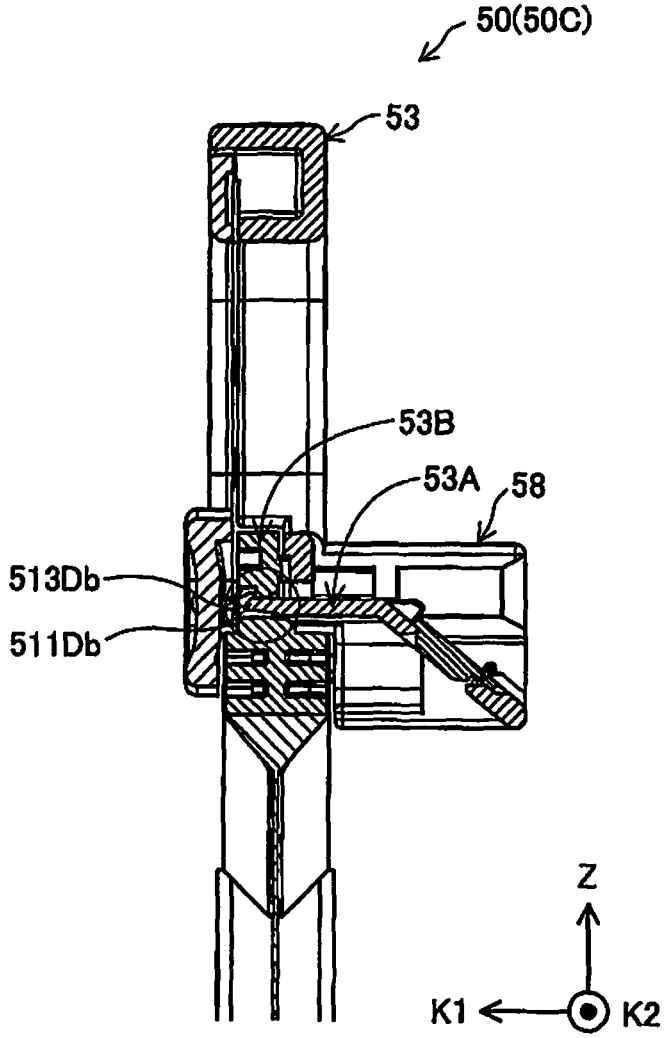
FIG. 17E is an F17Da-F17Da partial sectional view of FIG. 17D.
Figure 17F:
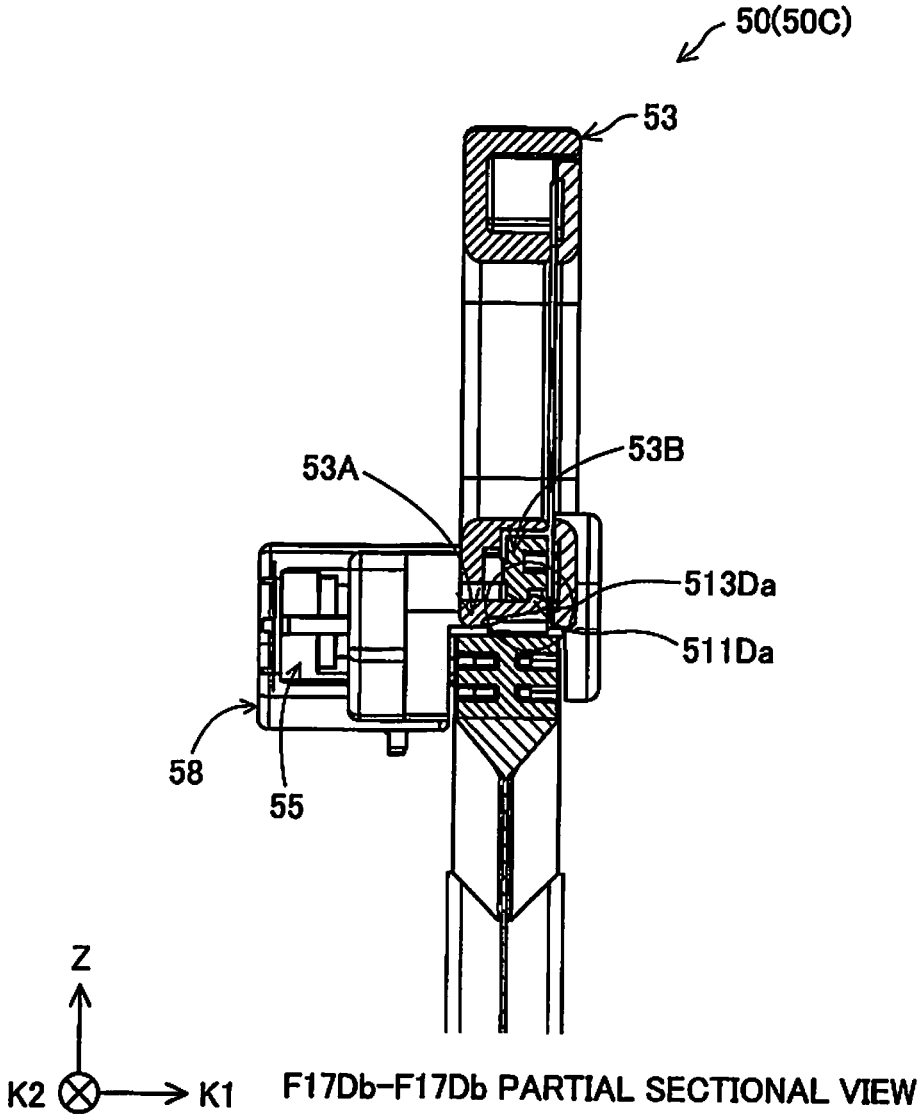
FIG. 17F is an F17Db-D17Db partial sectional view of FIG. 17D.

FIG. 17A is a first exploded perspective view illustrating an operation member 53. FIG. 17B is a second exploded perspective view illustrating the operation member 53. FIG. 17C is a rear view illustrating the operation member 53. FIG. 17D is a front view illustrating the liquid container 50. FIG. 17E is an F17Da-F17Da partial sectional view of FIG. 17D. FIG. 17F is an F17Db-D17Db partial sectional view of FIG. 17D. The flow path member 70 is illustrated in FIGS. 17A to 17C for the purpose of better understanding. FIG. 17C illustrates the state that a third member (pressing member) 53C described later is detached.

As shown in FIGS. 17A and 17B, the operation member (linkage member, handle portion) 53 includes a first member 53A, a second member 53B and a third member 53C. Assembling the first member 53A to the third member 53C forms the operation member 53. More specifically, the respective members 53A to 53C are assembled such that the second member 53B is placed between the first member 53A and the third member 53C. Each of the first member 53A to the third member 53C is formed by integrally molding a material such as synthetic resin.

The first member 53A includes the grip portion 54. The first member 53A is formed in a frame-like shape. The first member 53A is a plate-like member along a plane perpendicular to the K1-axis direction (center axis CT direction). The positioning structure 56 and the circuit board holding structure 59 are integrally molded and thereby connected with the linkage portion 548 of the first member 53A (more specifically, first side 53*fa*-portion of the linkage portion 548). As understood from the above description, the first member 53A of the operation member 53 may thus be regarded as the "linkage member 53A" or the "handle portion 53A".

As shown in FIG. 17B, the first member 53A has three engagement elements 511A, 511B and 511C on the second side 53*fb* that are engaged with the second member 53B so as to link (connect) the first member 53A with the second member 53B. The three engagement elements 511A, 511B and 511C are arranged side by side along the K2-axis direction (direction where the positioning structure 56 and the circuit board holding structure 59 are arranged side by side). The number of the engagement elements 511A, 511B and 511C may be two or less or may be four or more. When there is no need to distinguish among the three engagement elements 511A, 511B and 511C, these are expressed by a reference sign "511".

The engagement elements 511 are provided in the base portion 548 on the second side 53*fb* of the first member 53A. The engagement element 511 is formed in an approximately rectangular parallelepiped shape. In other words, the engagement element 511 has an approximately rectangular outer shape to surround a direction along the K1-axis direction (center axis CT direction of the flow portion 57) (K1-axis direction). The engagement element 511 is in a convex shape that is protruded from the base portion 548 toward the second member 53B (toward the +K1-axis direction).

As shown in FIG. 17B, the first member 53A also has eight member engagement elements 588 (only seven are illustrated) on the second side 531*b* that are engaged with the third member (pressing member) 53C so as to link (connect) the first member 53A with the third member 53C. The member engagement element 588 is in a concave shape.

As shown in FIGS. 17A and 17B, the liquid supply portion 57 is integrally molded and thereby connected with the second member 53B. The mounting portion (joint portion) 549 is also integrally molded and thereby linked (connected) with the second member 53B.

The second member 53B has three engagement elements 513A, 513B and 513C that are engaged with the engagement elements 511 so as to join the first member 53A with the second member 53B. When there is no need to distinguish among the three engagement elements 513A, 513B and 513C, these are expressed by a reference sign "513". The number of the engagement elements 513 may be four or more or may be two or less.

The three engagement elements 513A, 513B and 513C are provided corresponding to the three engagement elements 511A, 511B and 511C of the first member 53A. The engagement element 513 is a through hole formed to pass through in the K1-axis direction). The engagement element 513 is formed in such an outer shape that allows the engagement element 511 to be fit in. The engagement element 513 has an approximately rectangular outer shape to surround a direction along the K1-axis direction (center axis CT direction of the flow portion 57) (K1-axis direction).

As shown in FIG. 17C, the engagement elements 511A, 511B and 511C formed in the convex shape are fit in the corresponding engagement elements 513A, 513B and 513C formed as the through holes, so that the second member 53B is attached to the first member 53A. Accordingly a portion 517 where the engagement elements 513 are provided is called "protruded portion 517" that is protruded from the joint portion 549 to outside of the liquid container body 52 (shown in FIG. 7). The engagement elements 511 of the linkage member 53A are engaged with the engagement elements 513 of the protruded portion 517, so that the linkage member 53A is linked with the joint portion 549.

The three engagement elements 511A, 511B and 511C of the handle portion 53A serve as described below by engagement with the second member 53B to which the liquid container body 52 is attached. When the user grips the handle portion 53A to hold the liquid container 50, the three engagement elements 511A, 511B and 511C serve as portions to receive a load generated by the own weight of the liquid container body 52. Accordingly the three engagement elements 511A, 511B and 511C are also called support portions 511A, 511B and 511C.

The handle portion 53A and the second member 53B are assembled, so that the handle portion 53A is connected with the liquid supply portion 57. The "connected" state in the description of this paragraph includes not only the state that the handle portion 53A and the liquid supply portion 57 are connected directly but the state that the handle portion 53A and the liquid supply portion 57 are connected indirectly via another member.

Engagement of the engagement element 511B with the engagement element 513B restricts the motions of the second member 53B in the K2-axis direction and in the Z-axis direction relative to the linkage member 53A. Engagement of the engagement element 511A with the engagement element 513A and engagement of the engagement element 511C with the engagement element 513C restrict the motion of the second member 53B in the Z-axis direction relative to the linkage member 53A. More specifically, the engagement elements 511 and the engagement elements 513 have the outer shapes to surround the direction (K1-axis direction) along the center axis CT direction (K1-axis direction) and thereby reduce a positional misalignment between the linkage member 53A and the second member 53B in a plane direction orthogonal to the center axis CT direction (plane direction defined by the Z-axis direction and the K2-axis direction).

As shown in FIG. 17B, the linkage member 53A also has locking pawls 511Da and 511Db in a convex shape. The locking pawls 511Da and 511Db are provided on the second side 53*fb* of the linkage portion 548 of the first member 53A. The second member 53B has through holes 513Da and 513Db at positions corresponding to the locking pawls 511Da and 511Db in the convex shape.

As shown in FIG. 17E and FIG. 17F, the locking pawls 511Da and 511Db are locked to the member forming the through holes 513Da and 513Db, so as to restrict the motion of the second member 53B in the +K1-axis direction relative to the linkage member 53A. Part of the second member 53B abuts on part of the linkage member 53A, so as to restrict the motion of the second member 53B in the −K1-axis direction relative to the linkage member 53A.

As described above, engagement of the engagement elements 511 of the linkage member 53A with the engagement elements 513 of the second member 53B positions these members 53A and 53B relative to each other. The circuit board holding structure 59 is connected or joined with the linkage member 53A, while the liquid supply portion 57 connected with the printer 10 is connected or joined with the second member 53B. Accordingly engagement of the engagement elements 511 of the linkage member 53A with the engagement elements 513 of the second member 53B positions the liquid supply portion 57 and the circuit board holding structure 59 relative to each other. The engagement elements 511 are also called "member positioning elements 511".

As shown in FIG. 17C, the engagement element 511A and the engagement element 511B are arranged at positions with the liquid supply portion 57 placed therebetween in the longitudinal direction of the joint portion 549 (in the K2-axis direction). The engagement element 511A and the engagement element 511C are arranged at positions with the liquid supply portion 57 placed therebetween in the longitudinal direction (K2-axis direction). The engagement element 511B and the engagement element 511C are arranged at positions with the circuit board 582 placed therebetween in the longitudinal direction (K2-axis direction). The engagement element 511A and the engagement element 511C are arranged at positions with the circuit board 582 placed therebetween in the longitudinal direction (K2-axis direction).

As shown in FIG. 17B, the third member 53C includes the pressed portion 545. The third member 53C is formed in a frame-like shape corresponding to the shape of the first member 53A. The third member 53C is a plate-like member along a plane perpendicular to the K1-axis direction (center axis CT direction). Eight engagement elements 515 are provided on the first side 53*fa* of the third member 53C. The number of the engagement elements 515 is, however, not limited to this number. The engagement elements 515 are engaged with the member engagement elements 588 shown in FIG. 17B, so that the first member 53A and the third member 53C are linked with each other.

The linkage member 53A (handle portion 53A), the second member 53B and the third member 53C are respectively separate members. According to this embodiment, the handle portion 53A, the second member 53B and the third member 53C are formed from different materials. It is preferable that at least the handle portion 53A and the second member 53B are formed from different materials.

The handle portion 53A is formed from a material having good deformation resistance or good creep resistance. The handle portion 53A has sufficient deformation resistance or sufficient creep resistance and is thus unlikely to be deformed when the handle portion 53A is gripped by the user and receives a load generated by the own weight of the liquid container body 52. The handle portion 53A is formed from a material having the better (higher) deformation resistance than the second member 53B or the third member 53C. It is preferable that the handle portion 53A is formed from a material having the better (higher) creep resistance than the second member 53B or the third member 53C. The handle portion 53A is formed from a material such as ABS resin, heat-resistant ABS resin having the more enhanced heat resistance than the general ABS or polystyrene (PS). According to this embodiment, the handle portion 53A is formed using the ABS resin. The heat-resistance ABS may be a material having the deflection temperature of not lower than 120° C. under a load of 1.82 MPa. At least part of the handle portion 53A with which the liquid supply portion 57 is connected may be formed from a material having good deformation resistance or good creep resistance.

The deformation resistance may be evaluated with the index that is the magnitude of the flexural modulus. The "material having good deformation resistance" is, for example, preferably a material having the flexural modulus according to JIS K7171 of not lower than 1800 MPa, more preferably a material having the flexural modulus of not lower than 2000 MPa and furthermore preferably a material having the flexural modulus of not lower than 2500 MPa. The "material having good deformation resistance" may be a material having the higher flexural modulus according to JIS K7171 than polyethylene.

The creep resistance may be evaluated with the index that is the magnitude of an amount of deformation (amount of warpage) when a constant load (for example, 2.8 MPa) is continuously applied to a member formed from a predetermined material. The "material having good creep resistance" is preferably a material having a smaller amount of deformation than polyethylene when a member is formed in a predetermined shape.

The second member 53B is formed from a material having resistance to the ink contained in the liquid container body 52. The second member 53B is formed from a material such as polyethylene (PE), polypropylene (PP) or polyacetal (POM).

The "resistance to the liquid" may be regarded as "chemical resistance". The "material having resistance to the liquid" denotes a material (or a member formed from a material) that does not react with the liquid when the material is soaked in the liquid. In other words, the "material having resistance to the liquid" denotes a material (or a member formed from a material) that does not produce impurity such as solid substance over a predetermined level in the liquid when the material is soaked in the liquid. For example, the "material having resistance to the liquid" may be evaluated as described below. A member formed from a material that is an object to be evaluated (second member 53B according to this embodiment) is soaked in the ink contained in the liquid container body 52 and is then left in a high temperature environment (for example, 80° C.) for a predetermined time period (for example, 48 hours). After the second member 53B is left for the predetermined time period, the second member 53B is observed from the following three viewpoints:

(i) whether any solid substance is present or not present in the ink;

(ii) an amount of change in the mass of the second member 53B before and after the second member 53B is soaked in the ink; and (iii) whether a change in appearance configuration is within ±5% before and after the second member 53B is soaked in the ink.

With regard to the above viewpoints (i) to (iii), the conditions that no solid substance is present in the ink, the mass has no significant change (within ±5%) and the appearance configuration has no significant change provide the evaluation result of the "material having resistance to the liquid". At least part of the second member 53B that is exposed to the ink (i.e., the inner surface of the liquid supply portion 57) may be formed from a material having resistance to the ink.

As shown in FIGS. 17A and 17B, the third member 53C is formed from, for example, a material such as polyethylene (PE), polypropylene (PP) or polyacetal (POM). The pressed portion 545 provided in the third member 53C is located on the opposite side to the liquid supply portion 57 across the handle portion 53A. The third member 53C is colored in the color of ink contained in the liquid container body 52. For example, in the case of the liquid container 50Y containing yellow ink, the third member 53C is colored in yellow. Herein "colored in the color of ink" includes colored in a similar color to the color of ink. The "similar color" may be any color in a range that enables the user to identify the color of ink contained in the liquid container when observing the third member 53C. The "similar color" means, for example, colors having the hue differences of 0 (zero) to 3 in the 20 color wheel (also called modified Munsell color wheel) employed in JIS standards (JIS Z 8102) as described above.

As described above, the third member 53C serves as an identification portion that is colored in the color of ink contained in the liquid container body 52 (contained ink). The identification portion (colored portion) may not be necessarily the entire third member 53C but may be a part that is visible from outside. For example, at least part of the pressed portion 545 of the third member 53C may be the identification portion.

The third member 53C may be colored in the same color as the color of ink, in order to allow the user to identify the color of the contained ink. This configuration is, however, not restrictive, but the third member 53C may have any appearance that allows the user to identify the color of the contained ink. For example, the color of ink may be displayed as letter or character information on the surface of the pressed portion 545.

The connecting member 40 (shown in FIG. 5) is also identifiable by the color of the contained ink. The third member 53C accordingly has a colored portion that is colored in the same color as the color of the connecting member 40 that is to be connected. The colored portion is the entire third member 53C according to the embodiment, but part of the third member (for example, at least part of the pressed portion 545) may have the colored portion.

Figure 17G:
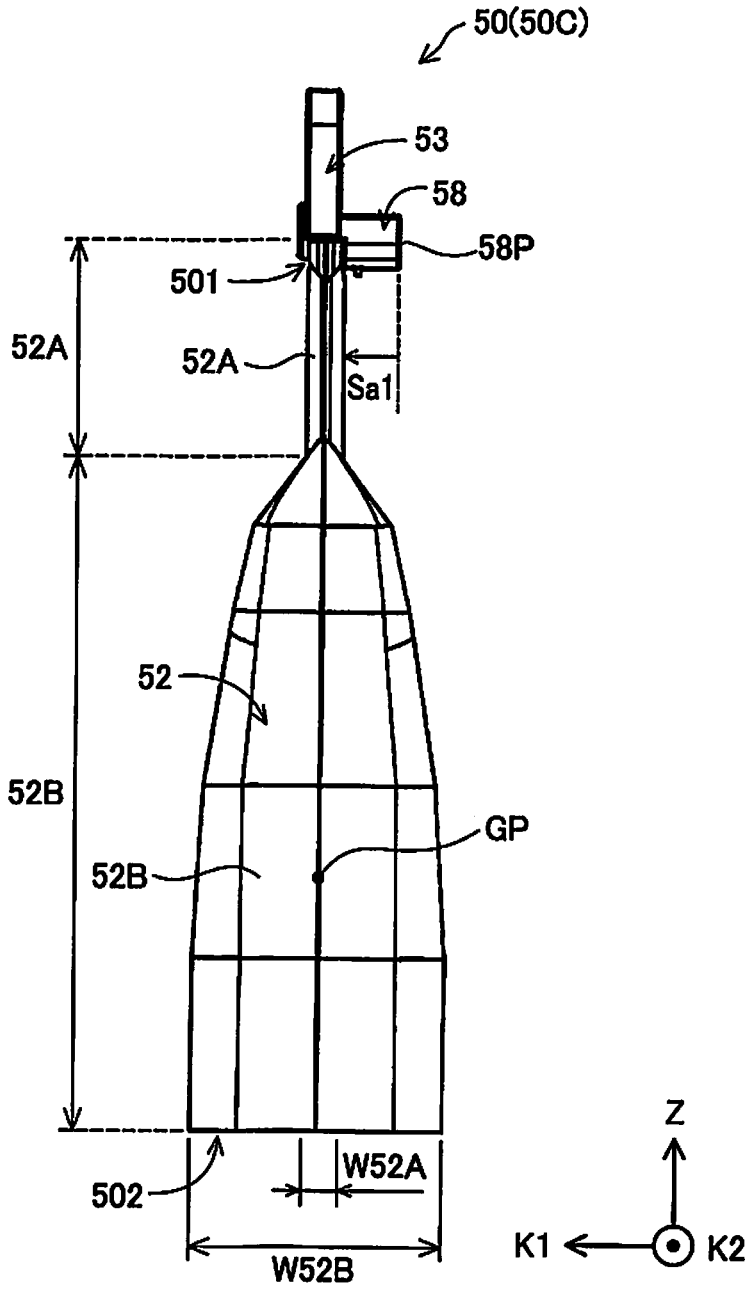
FIG. 17G is a left side view illustrating the liquid container.
Figure 17H:
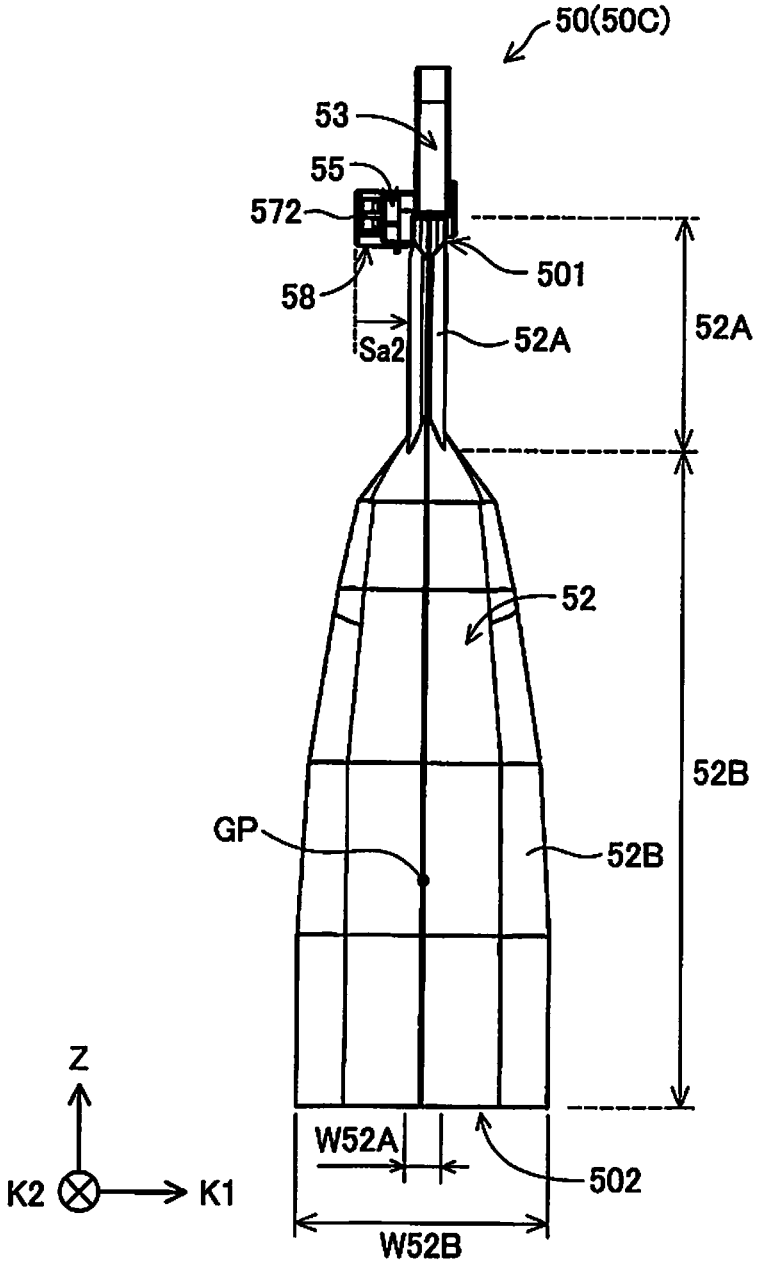
FIG. 17H is a right side view illustrating the liquid container.

FIG. 17G is a left side view illustrating the liquid container 50. FIG. 17H is a right side view illustrating the liquid container 50. The liquid container 50 is further described with reference to FIG. 17G and FIG. 17H. The state of the liquid container 50 shown in FIGS. 17G and 17H is the initial state that the liquid container body 52 is filled with ink and is prior to consumption of ink by the printer 10. FIGS. 17G and 17H also illustrate the state that the user grips the handle portion 53 to suspend the liquid container body 52 below the handle portion 53 in the direction of gravity (Z-axis direction) by its own weight. In other words, FIGS. 17G and 17H illustrate the state that the liquid container body 52 is located below the liquid supply assembly 55 and the container-side electrical connection structure 58 in the direction of gravity (Z-axis direction). FIGS. 17G and 17H also illustrate the connected state that the liquid container 50 is connected with the printer 10.

The liquid container body 52 includes a first containing portion 52A and a second containing portion 52B. The first containing portion 52A includes the one end portion 501 of the liquid container body 52. The second containing portion 52B includes the other end portion 502 of the liquid container body 52. The first containing portion 52A is connected with the handle portion 53 via the joint portion 549 (shown in FIG. 7). The second containing portion 52B is located below the first containing portion 52A in the direction of gravity (Z-axis direction). A length of the first containing portion 52A in the K1-axis direction (primary direction, direction along the connecting direction) is defined as length W52A. A length of the second containing portion 52B in the K1-axis direction (primary direction, connecting direction) is defined as length W52B. The liquid container body 52 is filled with such an amount of ink that provides the greater length W52B than the length W52A. According to this embodiment, when the maximum amount of ink containable in the liquid container body 52 is 100%, filling the amount of ink that is between 50% and 80% inclusive in the liquid container body 52 provides the first containing portion 52A and the second containing portion 52B. The "maximum amount of ink containable in the liquid container body 52" denotes the upper limit of the containable amount of ink over which the liquid container body 52 is damaged (ruptured).

As shown in FIG. 17G, one edge (leading edge) 58P of the container-side electrical connection structure 58 is located on the −K1-axis direction side (connecting direction side) of the first containing portion 52A by a predetermined value Sa1. As shown in FIG. 17H, the liquid supply port 572 at one edge of the liquid supply assembly 55 is located on the −K1-axis direction side (connecting direction side) of the first containing portion 52A by a predetermined value Sa2. The liquid container body 52 has a center of gravity GP that is located inside of the second containing portion 52B.

A-6. Method of Mounting Liquid Container 50 to Mounting/Demounting Unit 30

Figure 18:
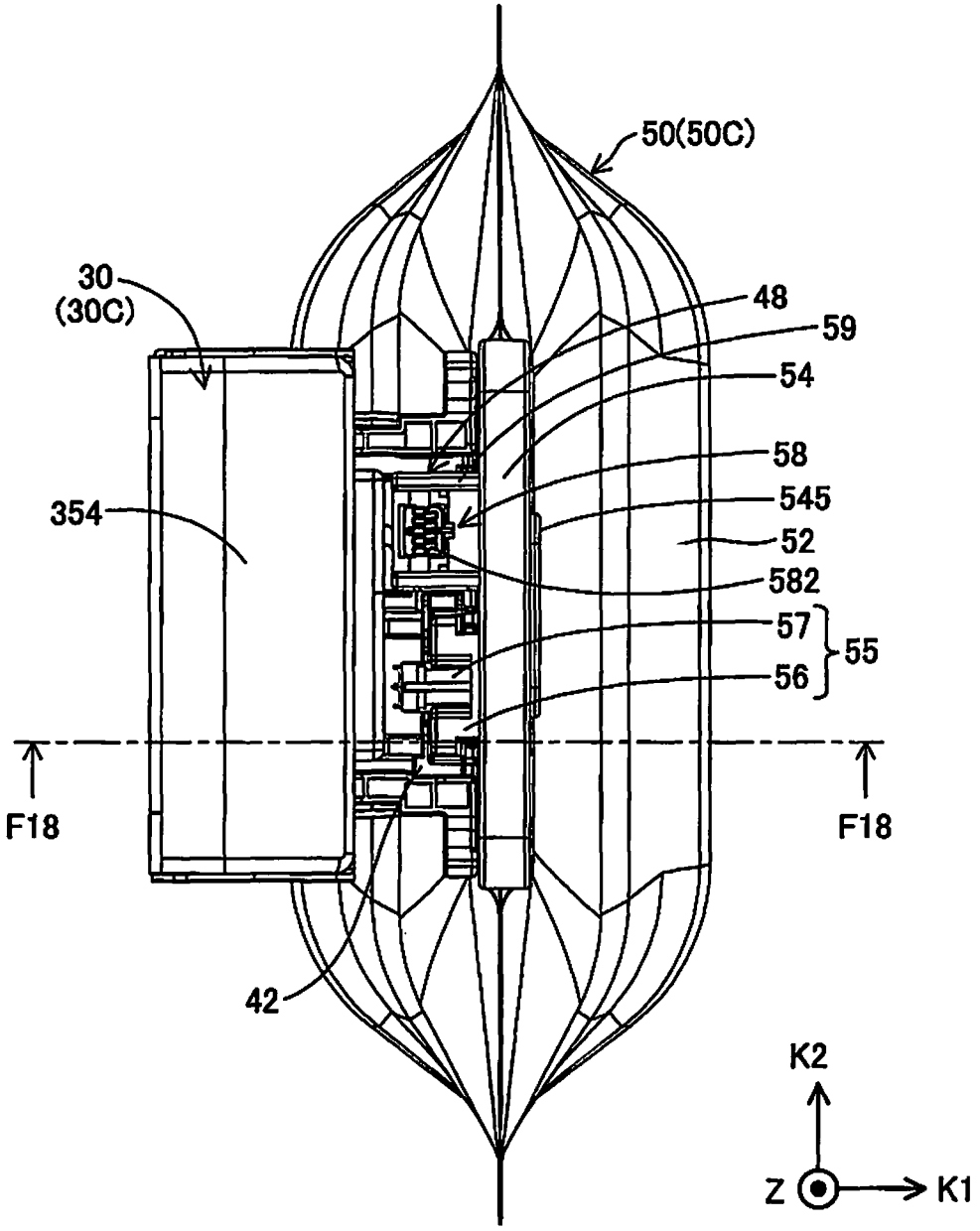
FIG. 18 is a diagram illustrating the state that the liquid container is set in the mounting/demounting unit.
Figure 19:
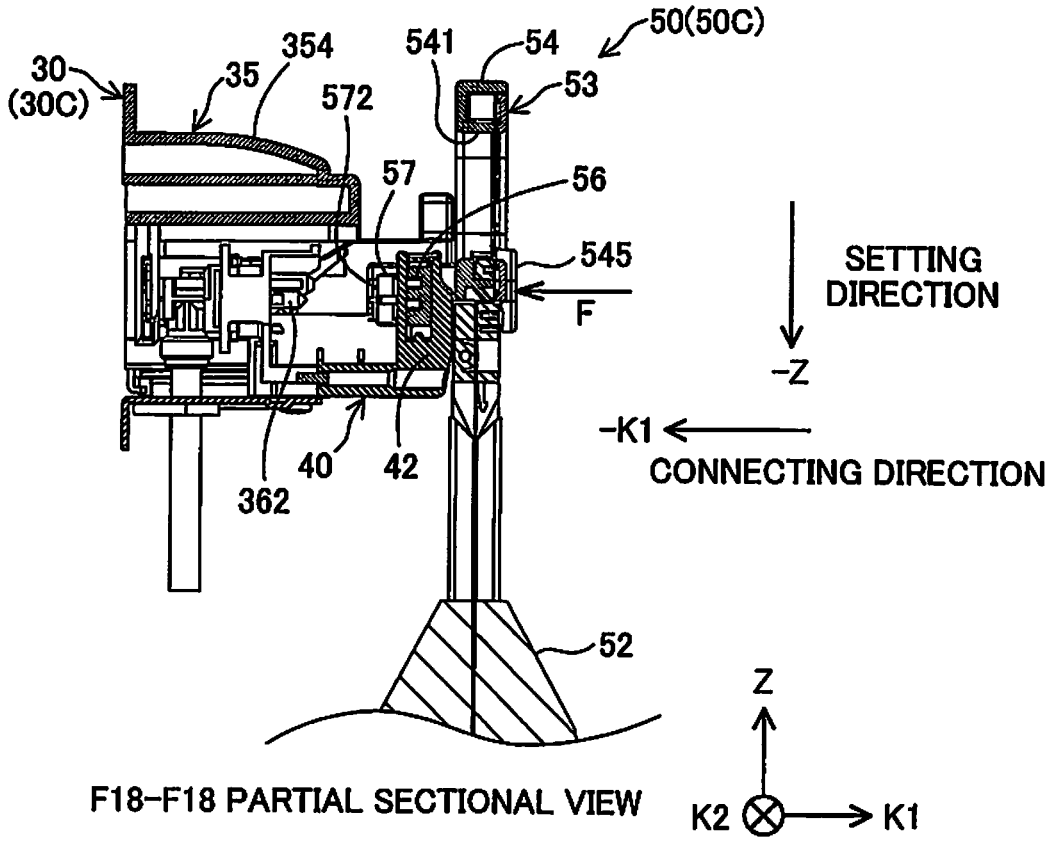
FIG. 19 is an F18-F18 partial sectional view of FIG. 18.
Figure 20:
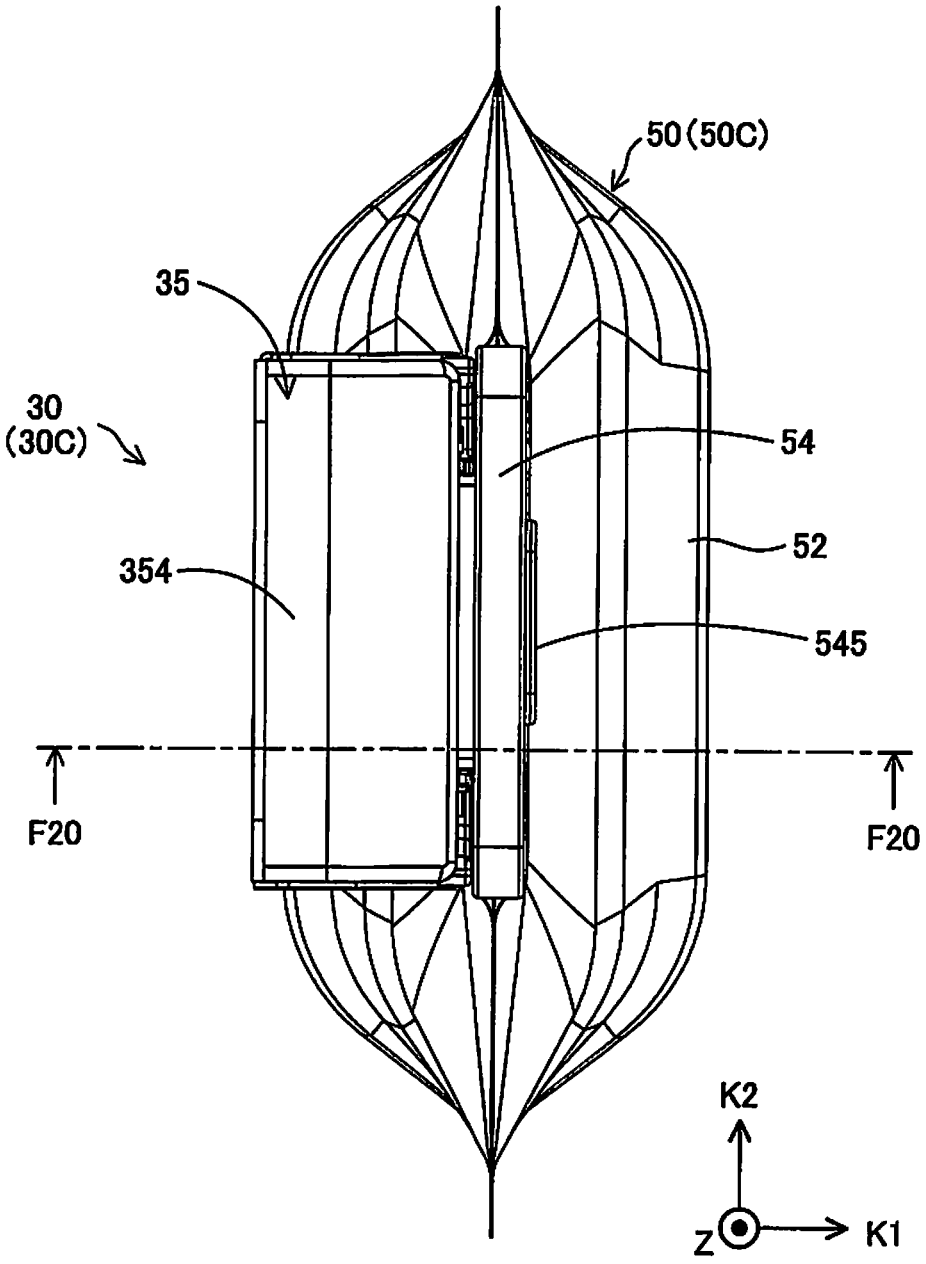
FIG. 20 is a diagram illustrating the state that the liquid container is mounted to the mounting/demounting unit.
Figure 21:
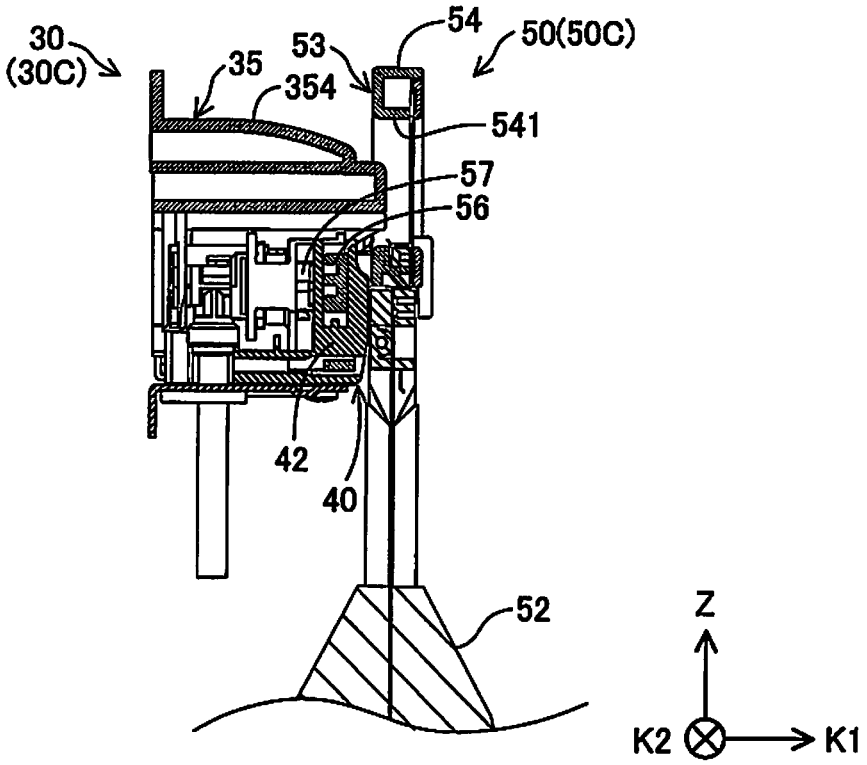
FIG. 21 is an F20-F20 partial sectional view of FIG. 20.

FIG. 18 is a diagram illustrating the state that the liquid container 50 is set in the mounting/demounting unit 30. FIG. 19 is an F18-F18 partial sectional view of FIG. 18. FIG. 20 is a diagram illustrating the state that the liquid container 50 is mounted to the mounting/demounting unit 30. FIG. 21 is an F20-F20 partial sectional view of FIG. 20. The state of the mounting/demounting unit 30 shown in FIG. 18 and FIG. 19 is the first state like the state of FIG. 5. The state of the mounting/demounting unit 30 shown in FIG. 20 and FIG. 21 is the second state like the state of FIG. 6.

As shown in FIG. 19, the liquid container 50 is mounted to the mounting/demounting unit 30 by two operations, i.e., operation of moving the liquid container 50 in a setting direction (setting operation or first operation) and operation of moving the liquid container 50 in a connecting direction (connecting operation or second operation). The setting direction is a direction including a downward component in the direction of gravity (downward component in the vertical direction, −Z-axis direction component). According to this embodiment, the setting direction is downward in the direction of gravity. The connecting direction is a direction including a horizontal direction component (primary direction component, K1-axis direction component). According to this embodiment, the connecting direction is the −K1-axis direction (first direction) that is the horizontal direction.

When the mounting/demounting unit 30 is in the first state, the user sets the liquid container 50 in the movable member 40 of the mounting/demounting unit 30. More specifically, the user holds the grip portion 54 in such an orientation that the operation member 53 is located above the liquid container body 52 in the direction of gravity (above in the vertical direction). As shown in FIGS. 18 and 19, the user places the container body-side support structure (positioning structure) 56 of the liquid container 50 in the supply portion support structure 42, while placing the circuit board holding structure 59 in the board support structure 48.

After setting the liquid container 50 in the movable member 40, as shown by an arrow F in FIG. 19, the user presses the pressed portion 545 in the −K1-axis direction. This moves the liquid container 50 and the movable member 40 in the connecting direction (−K1-axis direction).

As shown in FIG. 21, in the second state of the mounting/demounting unit 30 where the movable member 40 is placed in the stationary member 35, the liquid introduction portion 362 (shown in FIG. 19) is inserted into (connected with inside of) the liquid supply portion 57. In the second state, the terminal 581 of the circuit board 582 (shown in FIG. 13) come into contact with the apparatus-side terminals 381 of the electrical connection structure 382 (shown in FIG. 5B), so that the circuit board 582 and the electrical connection structure 382 are electrically connected. In the mounted state shown in FIG. 21, the protective member 354 is located above the electrical connection structure 582 of the liquid container 50 to cover the upper portion of (above) the electrical connection structure 582. In the state of FIG. 21, the electrical connection structure 582 is located on the +K2-axis direction side of the liquid supply portion 57.

The above expression of "in the process of connecting the liquid container 50 with the mounting/demounting unit 30 (printer 10)" denotes at least part of a time period from the time when the user holds the operation member (handle portion) 53 and starts the setting operation to the time when connection of the liquid container 50 with the printer 10 is completed by the connecting operation. According to this embodiment, part of the time period is a time period from the time when the liquid container 50 is set in the movable member 40 and is slightly moved in the connecting direction to the time when the connection is completed. As shown in FIGS. 18 to 21, the movable member 40 supports the liquid container 50 such that the liquid supply portion 57 of the liquid container 50 is located above the liquid container body 52 in the direction of gravity (on the +Z-axis direction side).

A-7 Connecting Timings of Respective Components

Figure 22:
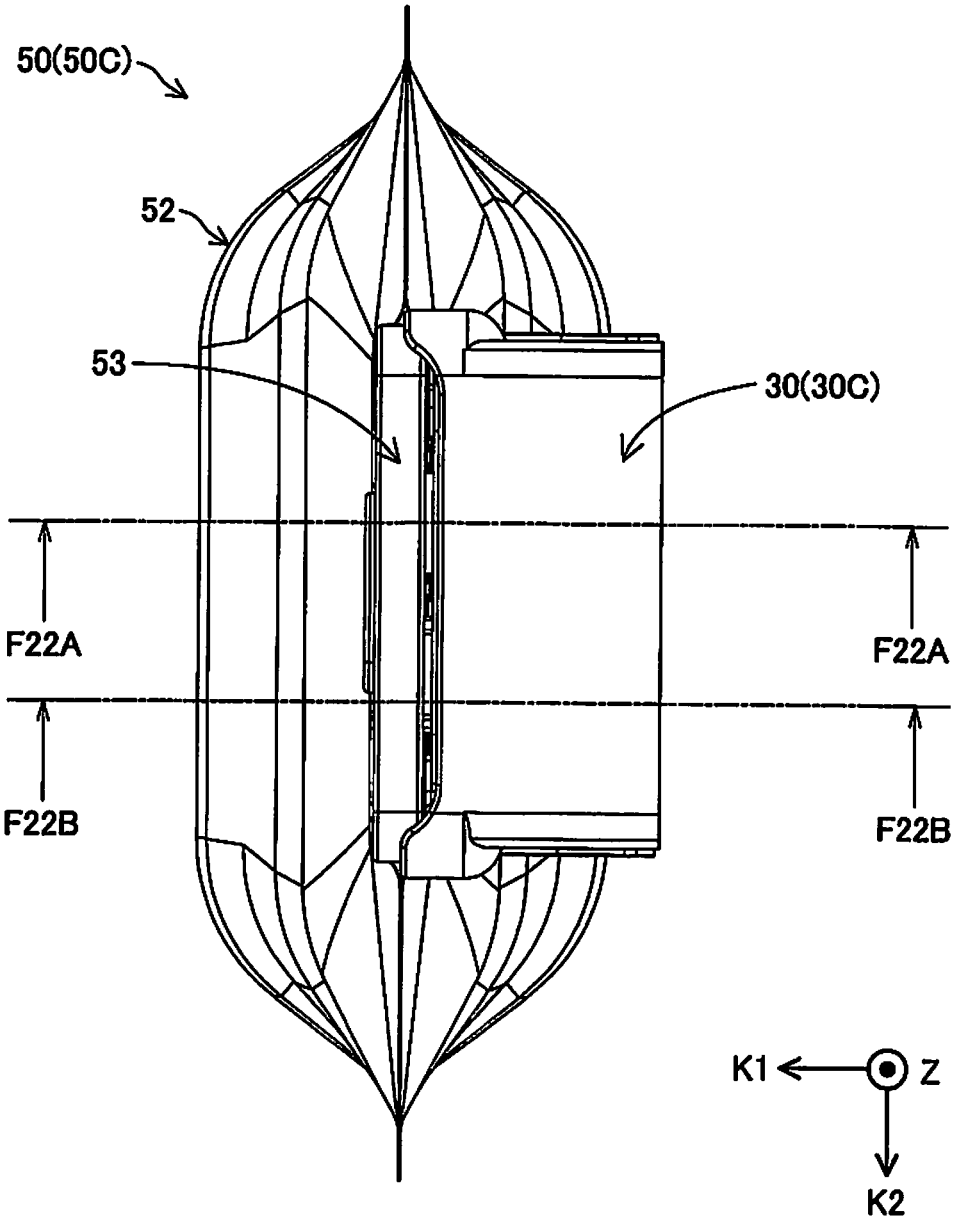
FIG. 22 is a first diagram illustrating connection timing.
Figure 23:
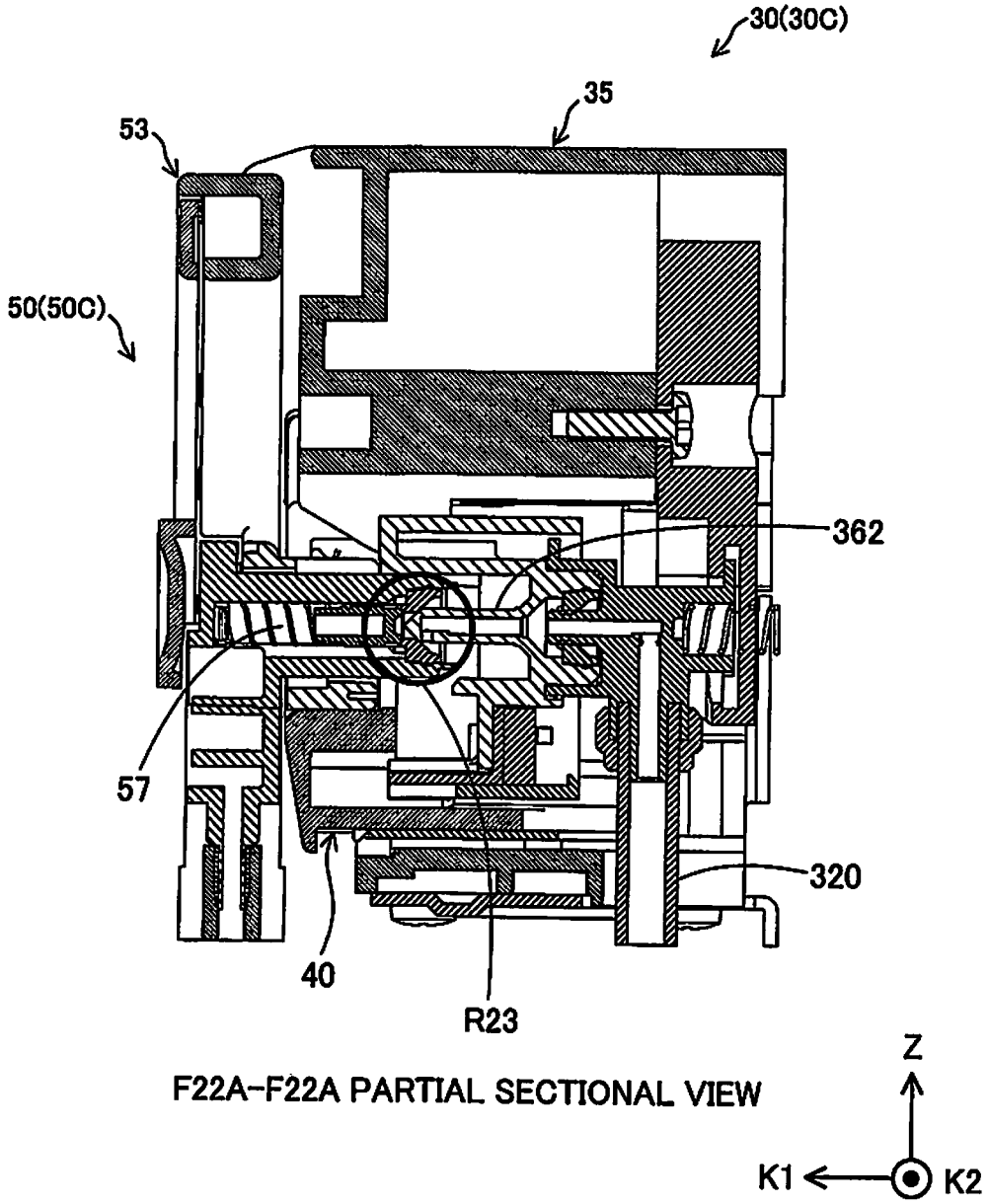
FIG. 23 is an F22A-F22A partial sectional view of FIG. 22.
Figure 24:
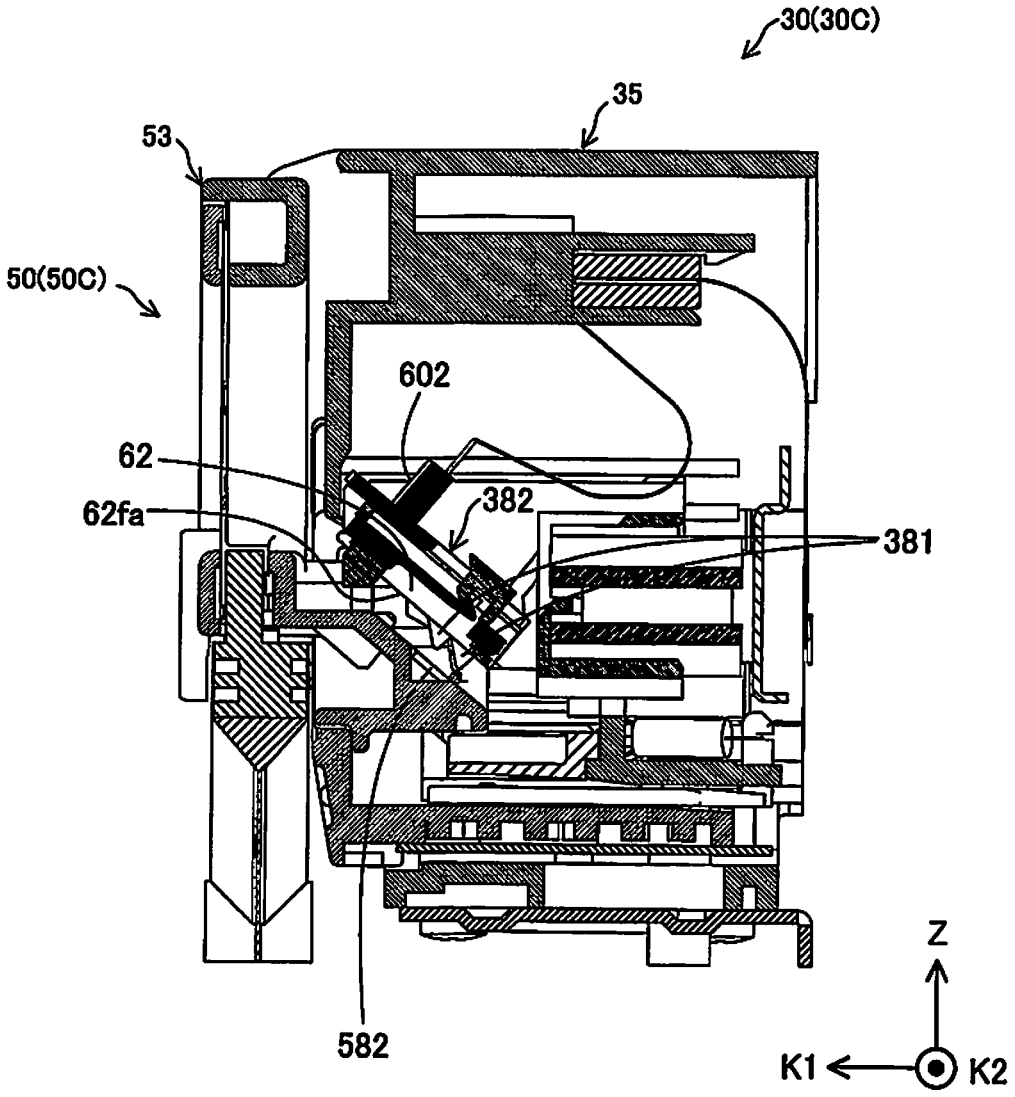
FIG. 24 is an F22B-F22B partial sectional view of FIG. 22.

FIG. 22 is a first diagram illustrating connection timing. FIG. 23 is an F22A-F22A partial sectional view of FIG. 22. FIG. 24 is an F22B-F22B partial sectional view of FIG. 22.

Figure 25:
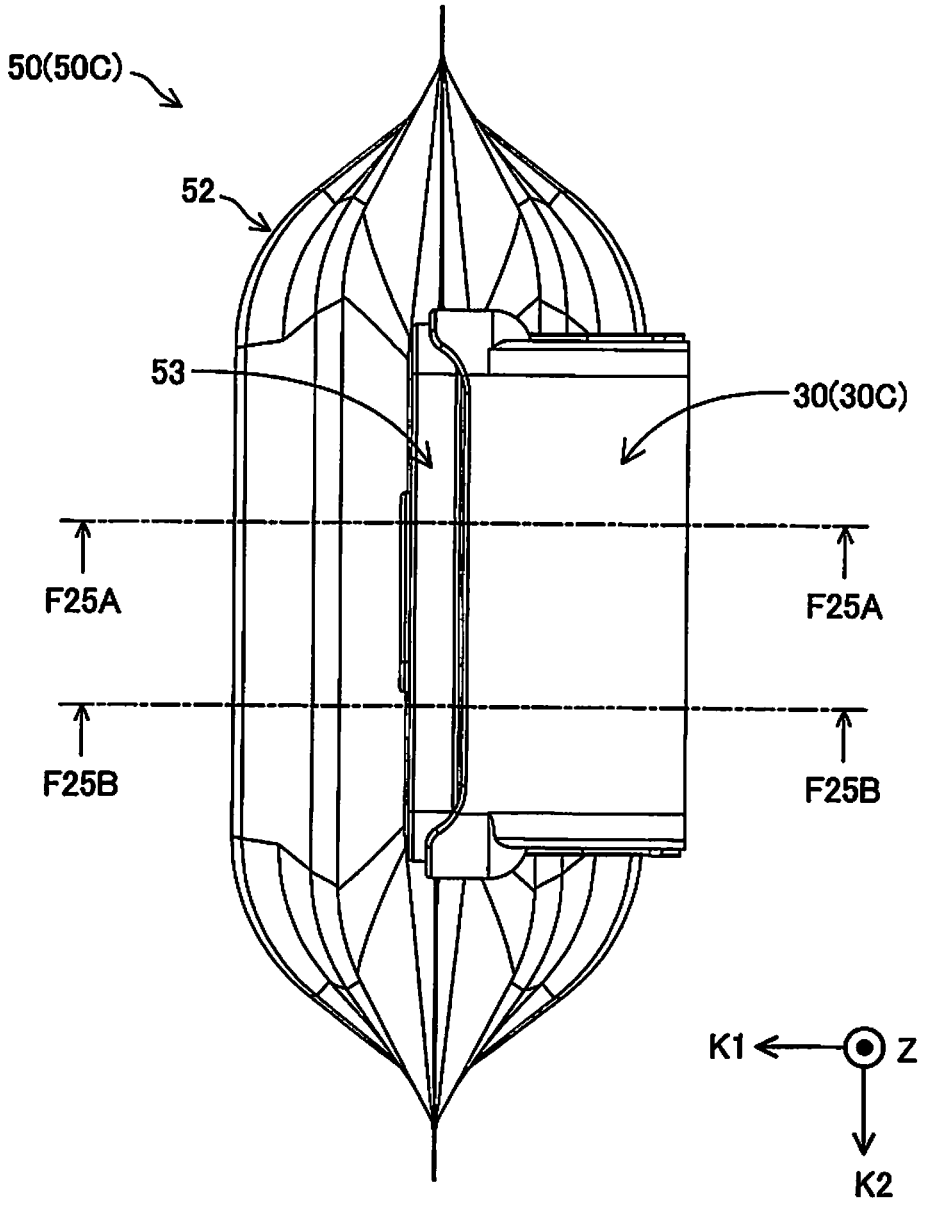
FIG. 25 is a second diagram illustrating connection timing.
Figure 26:
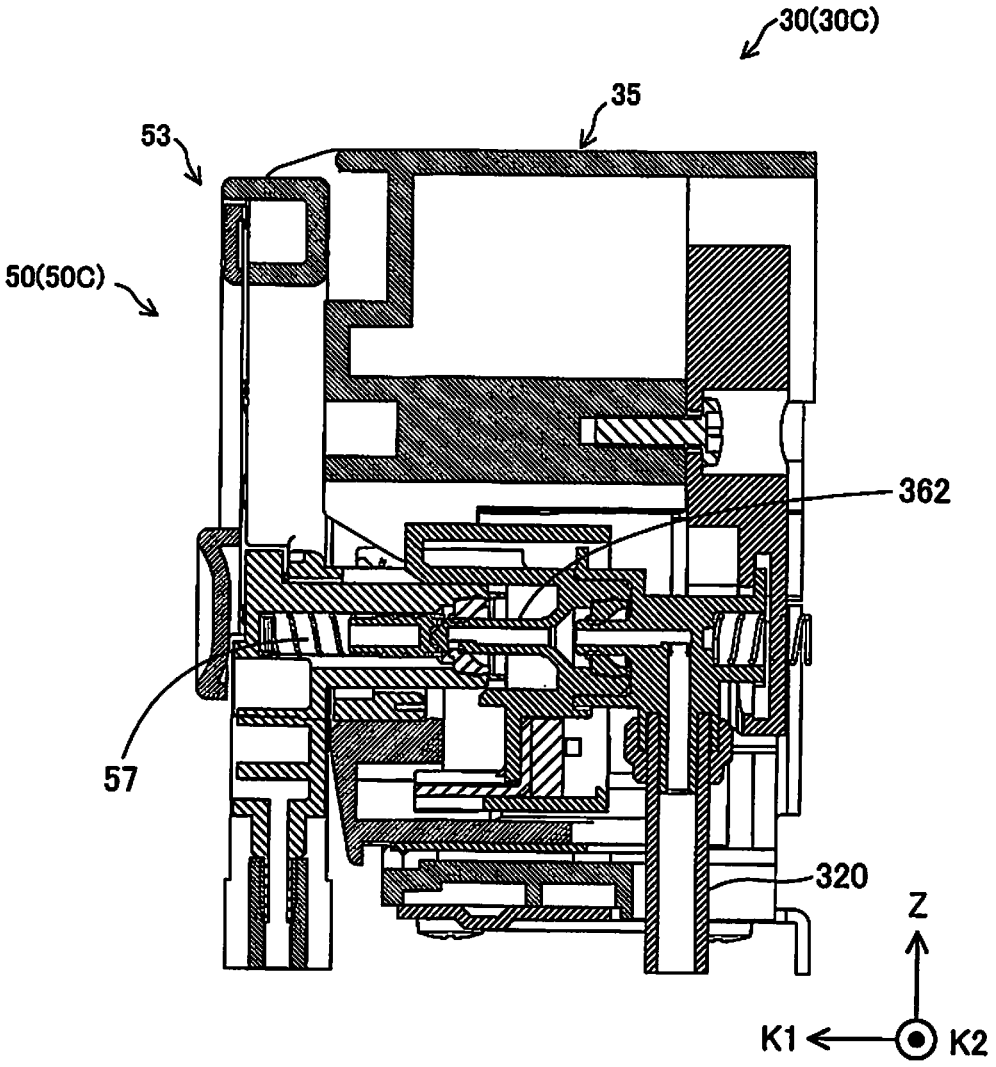
FIG. 26 is an F25A-F25A partial sectional view of FIG. 25.
Figure 27:
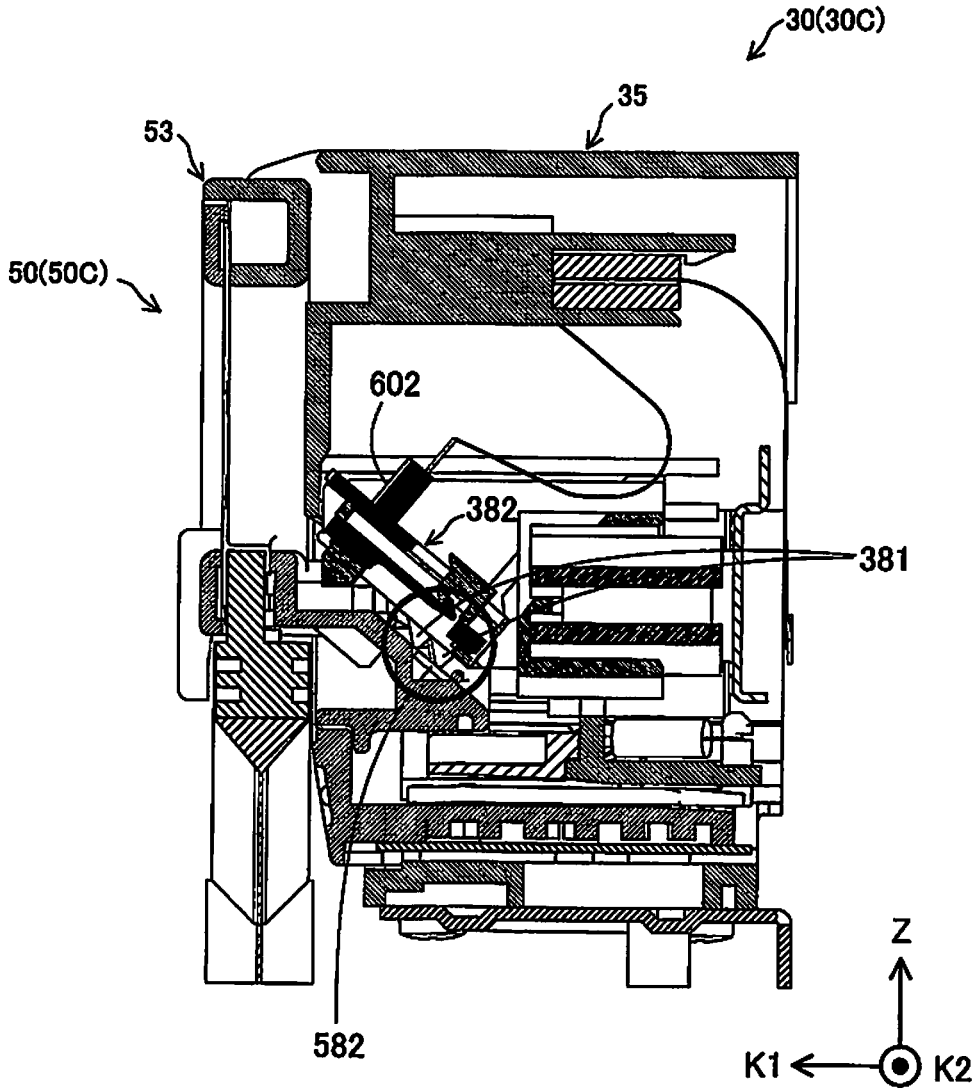
FIG. 27 is an F25B-F25B partial sectional view of FIG. 25.

FIG. 25 is a second diagram illustrating connection timing. FIG. 26 is an F25A-F25A partial sectional view of FIG. 25. FIG. 27 is an F25B-F25B partial sectional view of FIG. 25. FIG. 22 is a first diagram prior to completion of mounting the liquid container 50. FIG. 25 is a second diagram prior to completion of mounting the liquid container 50.

As shown in FIGS. 23 and 24, pressing the liquid container 50 in the connecting direction (−K1-axis direction or first direction) causes the liquid supply portion 57 to start connecting with the liquid introduction portion 362, before causing the circuit board 582 (more specifically, the terminals 581 of the circuit board 582) to start connecting (coming into contact) with the apparatus-side terminals 381. For the purpose of better understanding, an area where the liquid supply portion 57 starts connecting with the liquid introduction portion 362 is shown by a reference sign "R23" in FIG. 23.

As shown in FIGS. 26 and 27, further pressing the liquid container 50 in the connecting direction causes the terminals 581 of the circuit board 582 to start coming into contact with the apparatus-side terminals 381.

A-8. Relationship of Respective Components of Printer 10 and Liquid Container 50

A-8-1. Supporting in Connecting

Figure 28:
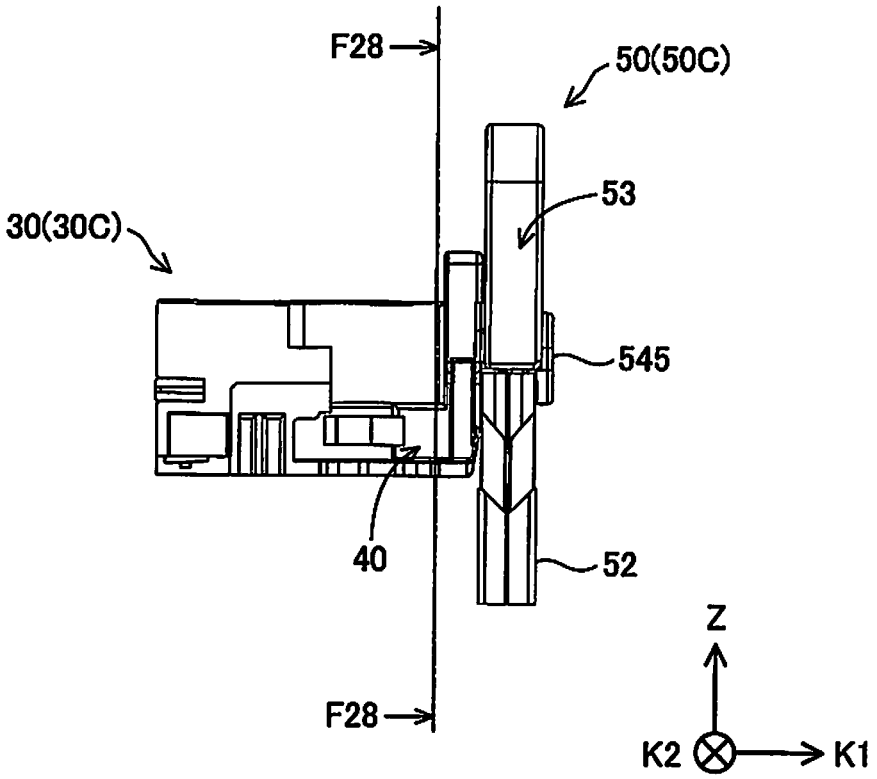
FIG. 28 is a side view illustrating the state that the liquid container is set in the movable member.
Figure 29:
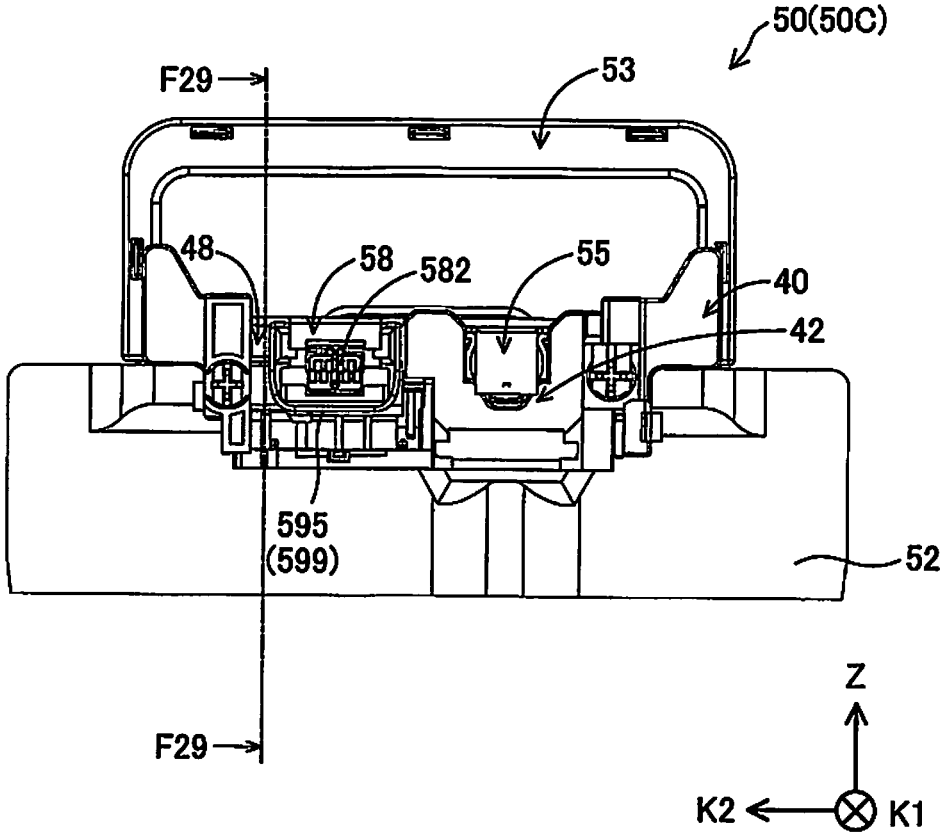
FIG. 29 is a front view illustrating the state that the liquid container is set in the movable member.
Figure 30:
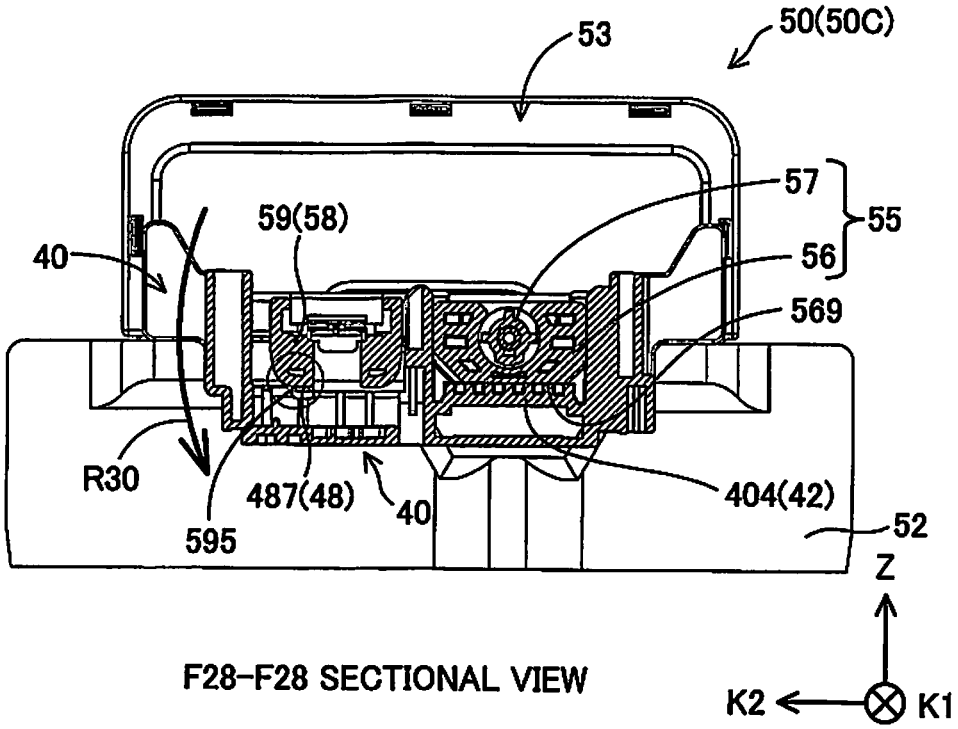
FIG. 30 is an F28-F28 sectional view of FIG. 28.
Figure 31:
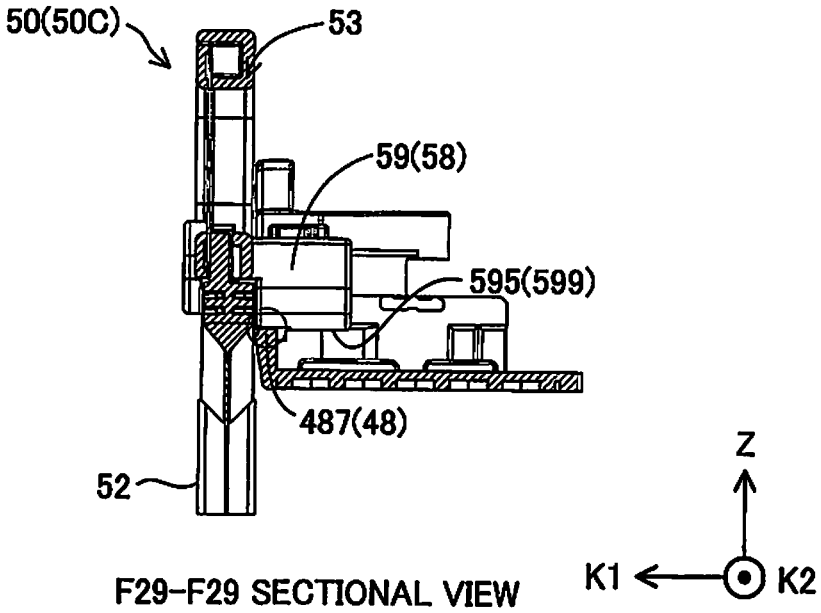
FIG. 31 is an F29-F29 sectional view of FIG. 29.
Figure 32:
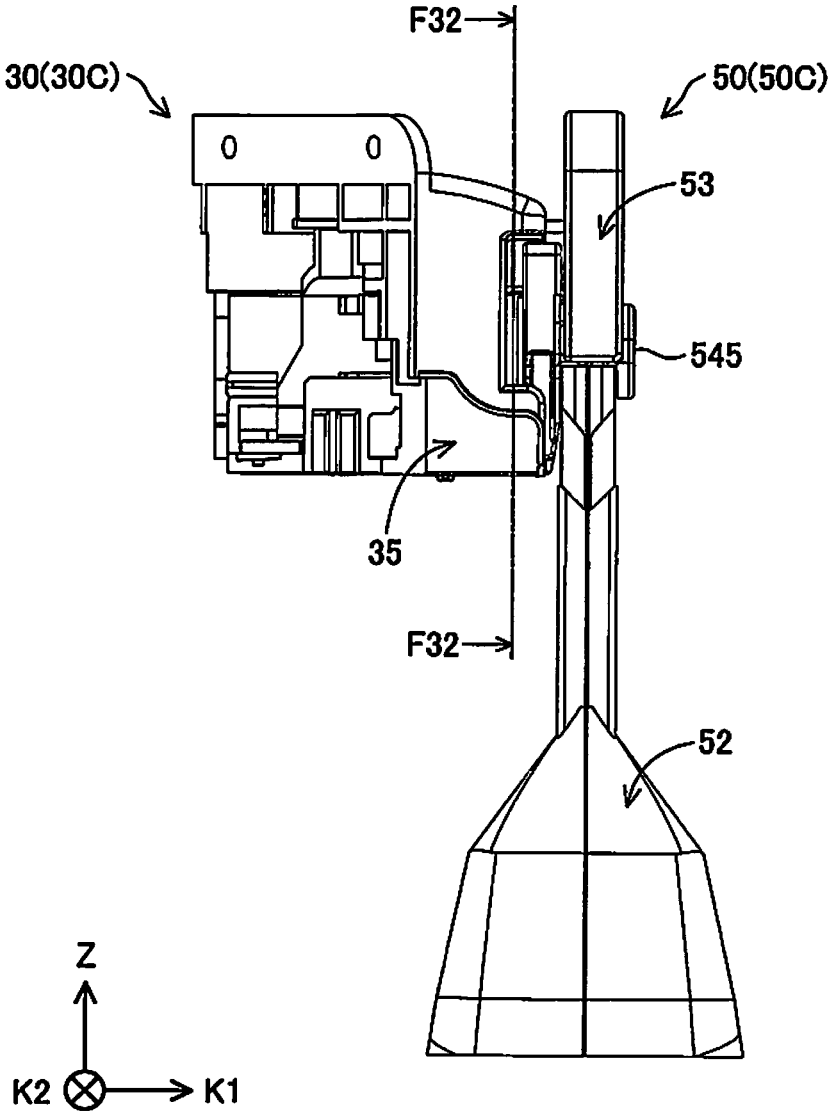
FIG. 32 is a side view illustrating the state that mounting of the liquid container to the mounting/demounting unit is completed.
Figure 33:
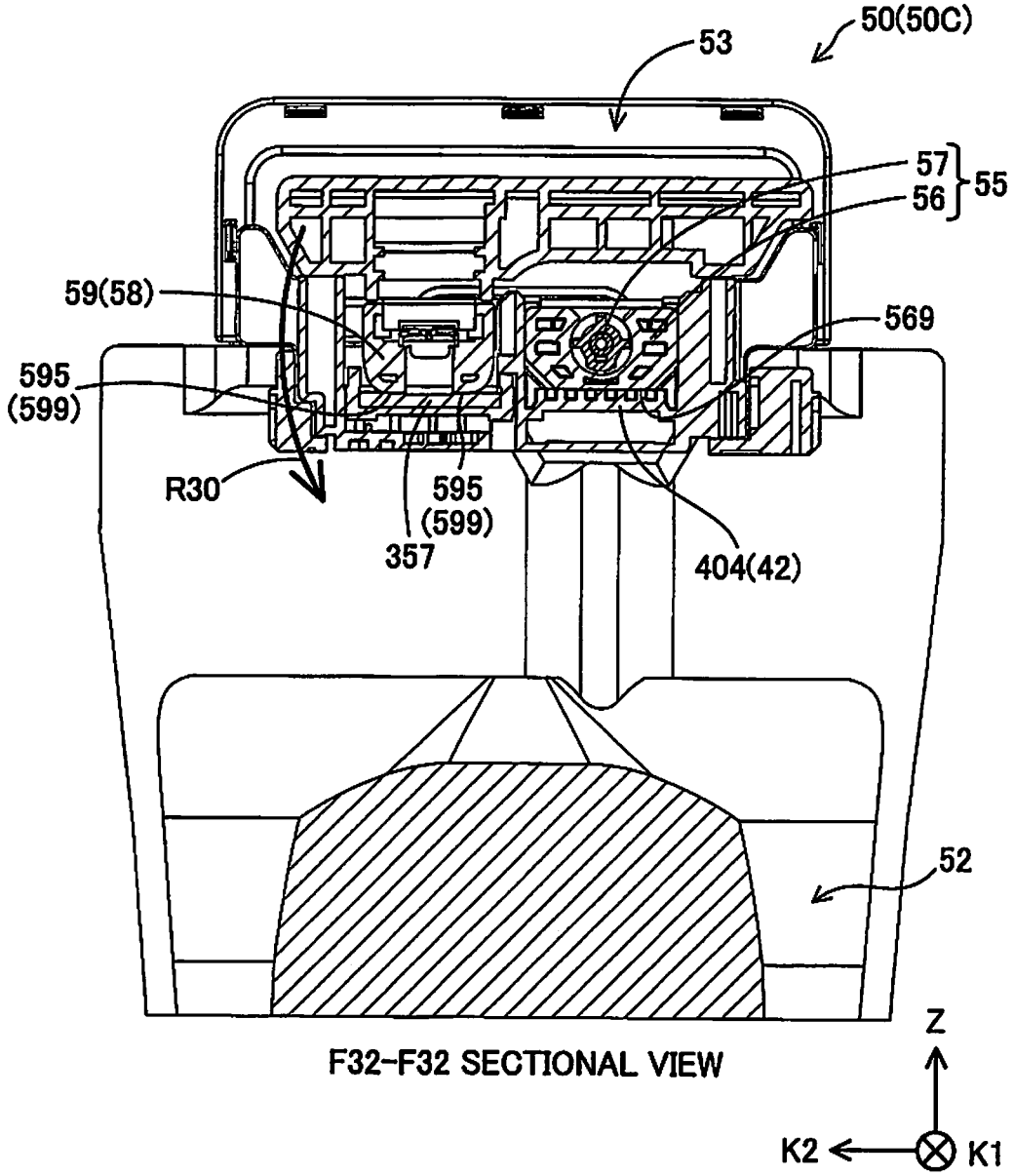
FIG. 33 is an F32-F32 sectional view of FIG. 32.

FIG. 28 is a side view illustrating the state that the liquid container 50 is set in the movable member 40 included in the mounting/demounting unit 30. FIG. 29 is a front view illustrating the state that the liquid container 50 is set in the movable member 40 included in the mounting/demounting unit 30. FIG. 30 is an F28-F28 sectional view of FIG. 28. FIG. 31 is an F29-F29 sectional view of FIG. 29. FIG. 32 is a side view illustrating the state that mounting (connection) of the liquid container 50 to (with) the mounting/demounting unit 30 is completed. FIG. 33 is an F32-F32 sectional view of FIG. 32. The state of the mounting/demounting unit 30 shown in FIG. 28 is the first state like the state of FIG. 5C. The state of the mounting/demounting unit 30 shown in FIG. 32 is the second state like the state of FIG. 6A.

As shown in FIG. 30, in the state that the liquid container 50 is set in the movable member 40, the liquid supply unit 55 and the substrate unit 58 support the liquid container body 52 such that the liquid supply unit 55 and the substrate unit 58 are located above the liquid container body 52 in the direction of gravity (on the +Z-axis direction side). As shown in FIG. 30, a bottom (bottom outer surface) 569 of the container body-side support structure (positioning structure) 56 abuts on the third support surface 404 of the supply portion support structure 42. This restricts the downward motion of the liquid container 50 in the direction of gravity (in the −Z-axis direction). This configuration supports the −K2-axis direction side of the liquid container body 52.

As shown in FIG. 33, as in the state that the liquid container 50 is set in the movable member 40, in the state that the liquid container 50 is connected with the mounting/demounting unit 30 (in the mounted state), the liquid supply unit 55 and the substrate unit 58 support the liquid container body 52 such that the liquid supply unit 55 and the substrate unit 58 are located above the liquid container body 52 in the direction of gravity (on the +Z-axis direction side). More specifically, the bottom 595 of the circuit board holding structure 59 abuts on a bottom 357 of the stationary member 35. This restricts the downward motion of the liquid container 50 in the direction of gravity (in the −Z-axis direction). The bottom 569 of the container body-side support structure 56 abuts on the third support surface 404 of the supply portion support structure 42. This restricts the downward motion of the liquid container 50 in the direction of gravity (in the −Z-axis direction). The liquid supply unit (liquid supply assembly) 55 and the substrate unit (container-side electrical connection structure) 58 restrict the downward motion of the liquid container 50 in the direction of gravity in this manner and support the liquid container 50. The circuit board holding structure 59 starts abutting on the bottom 357 of the stationary member 35 during a time period from the time when the liquid container 50 is set in the movable member 40 and is moved in the connecting direction to the time when connection is completed.

As shown in FIGS. 30 and 33, duration rotation in the direction of an arrow R30, the bottom 595 of the circuit board holding structure 59 abuts on an apparatus-side rotation restriction element 487 of the movable member 40. This restricts rotation of the circuit board holding structure 59 about the liquid supply portion 57 in the direction of the arrow R30. The bottom 595 is thus also called rotation restriction element 595.

A-8-2. Positioning of Liquid Supply Portion 57 and Liquid Introduction Portion 362

Figure 34:
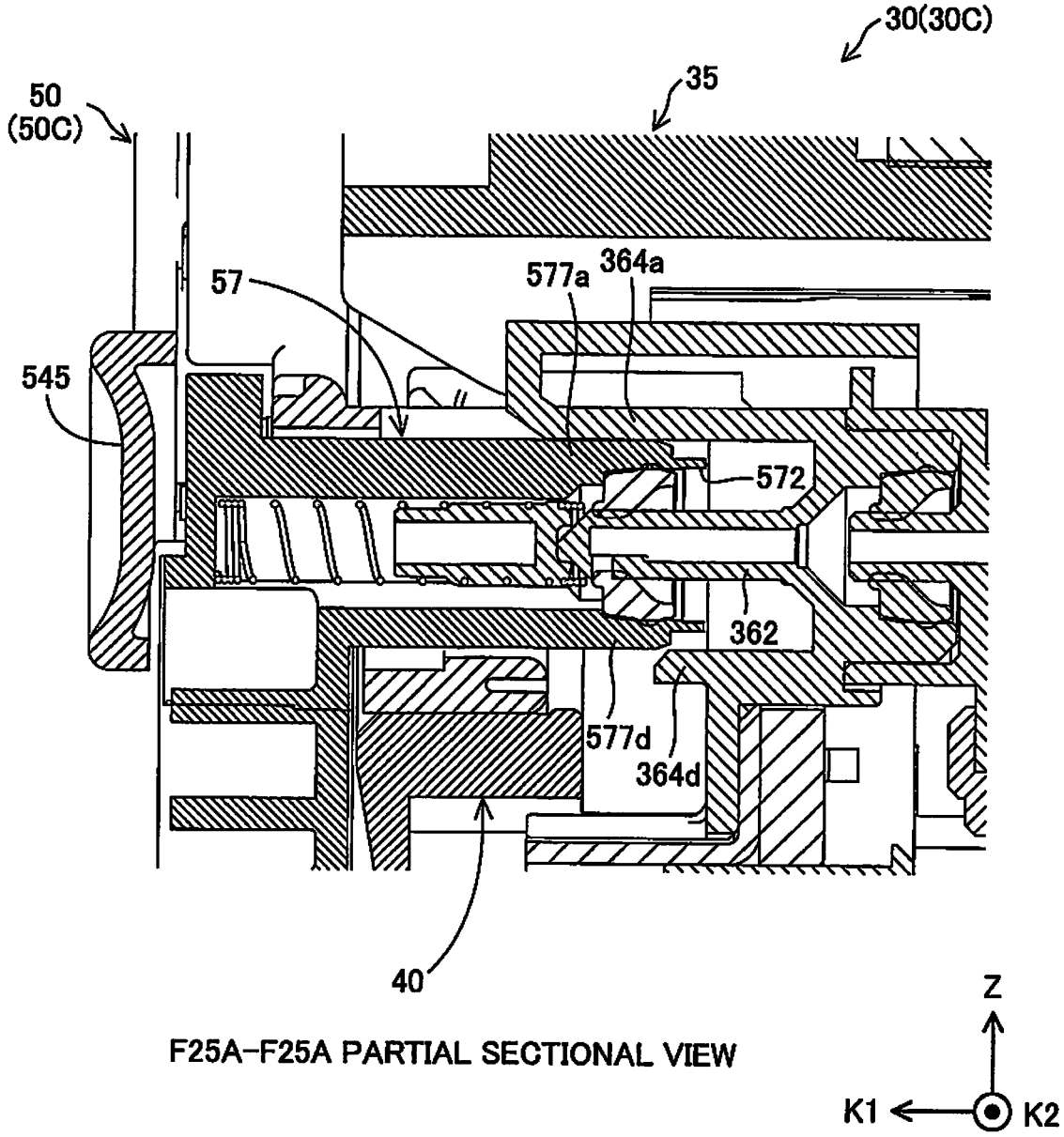
FIG. 34 is an F25A-F25A partial enlarged view of FIG. 25.
Figure 35:
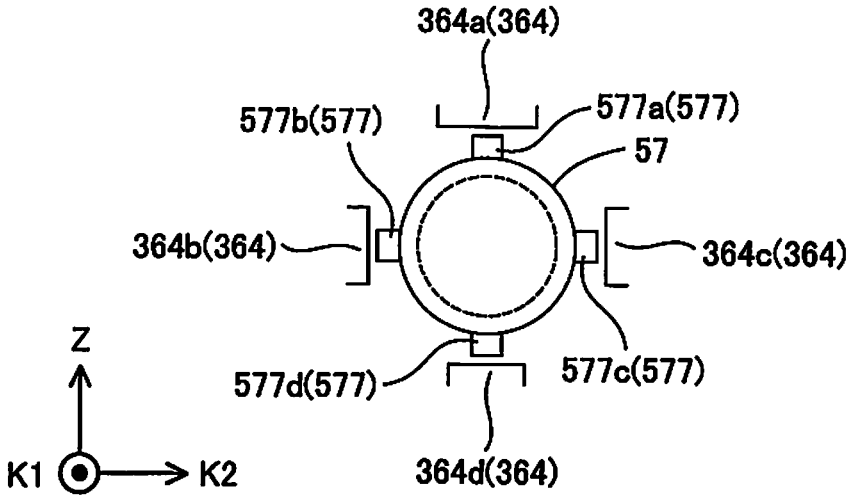
FIG. 35 is a diagram illustrating positioning.

FIG. 34 is an F25A-F25A partial enlarged view of FIG. 25. FIG. 35 is a diagram illustrating positioning.

As shown in FIG. 34, for example, when the liquid supply portion 57 is located above the designed position of the liquid introduction portion 362 in the direction of gravity, the first supply portion positioning structure 364*a* abuts on the first container-side positioning structure 577*a*, so as to position the liquid supply portion 57 in the +Z-axis direction.

As shown in FIG. 35, in the process of connecting the liquid container 50 with the mounting/demounting unit 30, the positioning structures 577 provided around the liquid supply portion 57 enter inside of the positioning structures 364 provided around the liquid introduction portion 362. When the liquid supply portion 57 is misaligned relative to the liquid introduction portion 362, the positioning structure 577 abuts on the supply portion positioning structure 364, so as to finely adjust the position of the liquid supply portion 57 relative to the liquid introduction portion 362. Accordingly the positioning structures 577 and the supply portion positioning structures 364 are members serving to position the liquid supply portion 57 relative to the liquid introduction portion 362 in a direction intersecting with the connecting direction (−K1-axis direction).

A-9. Details of Liquid Introduction Mechanism 36 and Displacement Mechanism (Aligning) of Liquid Introduction Portion 362

Figure 36:
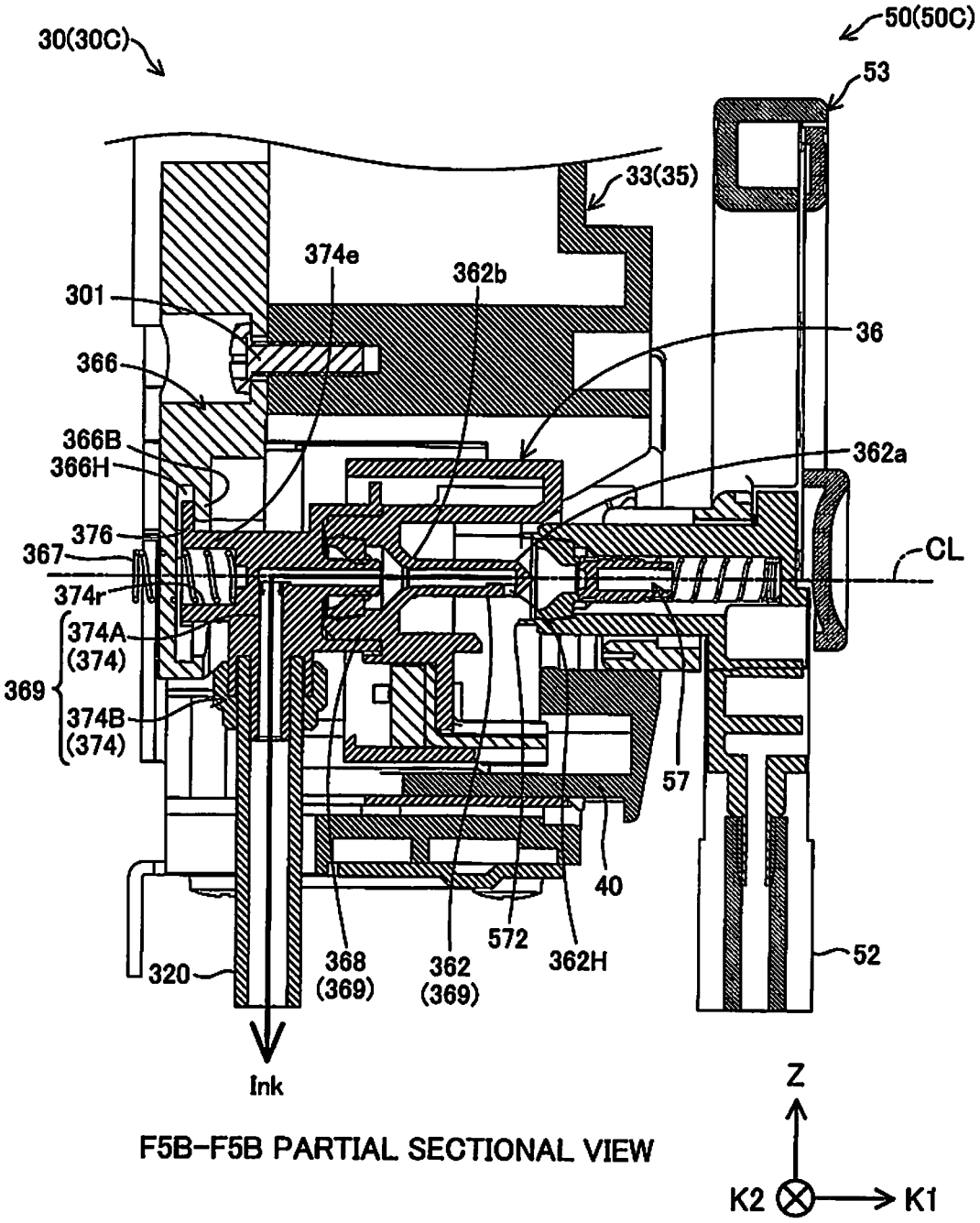
FIG. 36 is an F5B-F5B partial sectional view of FIG. 5B.
Figure 37:
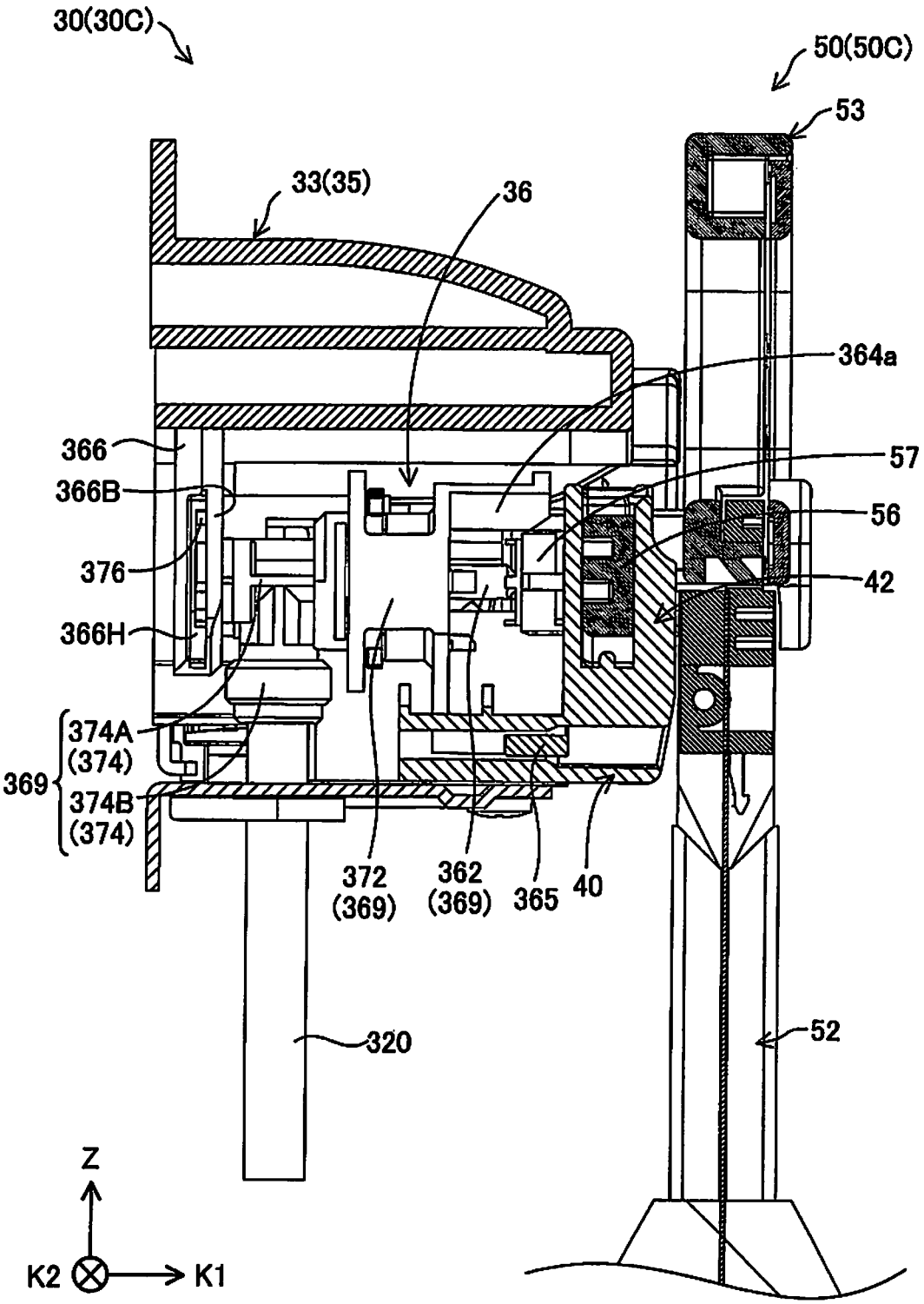
FIG. 37 is a diagram illustrating a liquid introduction portion viewed from a −K2-axis direction side.
Figure 38:
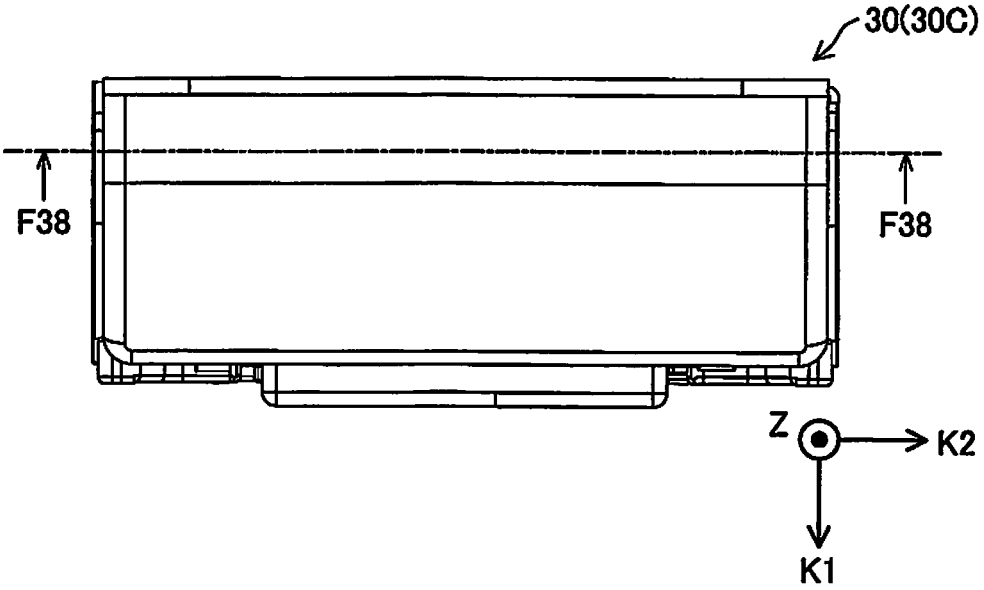
FIG. 38 is a top view illustrating the mounting/demounting unit.
Figure 39:
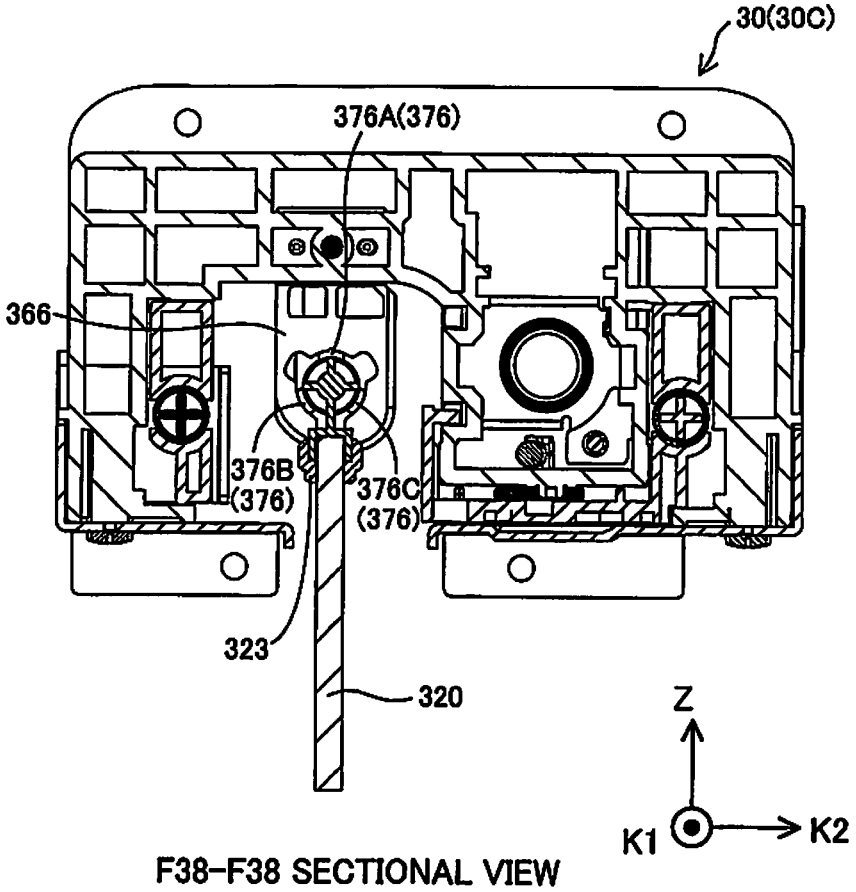
FIG. 39 is an F38-F38 sectional view.
Figure 40:
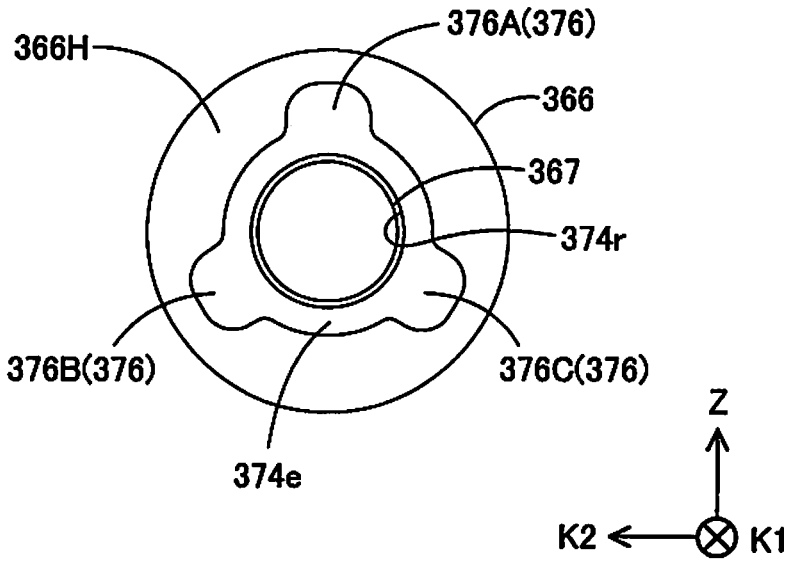
FIG. 40 is a diagram illustrating a displacement mechanism.

FIG. 36 is an F5B-F5B partial sectional view of FIG. 5B. FIG. 37 is a diagram illustrating the liquid introduction portion 362 viewed from the −K2-axis direction side. FIG. 38 is a top view illustrating the mounting/demounting unit 30. FIG. 39 is an F38-F38 sectional view. FIG. 40 is a diagram illustrating a displacement mechanism. The liquid container 50 is also illustrated in FIG. 36 and FIG. 37 for the purpose of better understanding.

As shown in FIG. 36 and FIG. 37, the liquid introduction mechanism 36 includes a liquid flow portion 369 configured to form a flow path through which ink contained in the liquid container 50 is flowed to the printer 10. The liquid flow portion 369 includes the liquid introduction portion 362, the liquid introduction main body 368 and a connecting flow path portion 374 arranged in this sequence from the upstream side in the flow direction of ink from outside toward the printer 10. In the description below, the "upstream side" and the "downstream side" are defined on the basis of the flow direction of ink from outside (liquid container 50) toward the printer 10. The liquid flow portion 369 forms a flow path parallel to the center axis CT on the upstream side and forms a downward flow path in the direction of gravity on the downstream side. The liquid flow portion 369 may be regarded as the "liquid introduction portion 362".

A liquid introducing hole 362H is formed on an upstream side end of the liquid introduction portion 362 and causes ink from outside to be flowed into a flow path in the liquid introduction portion 362. A downstream side end of the liquid introduction portion 362 is connected with the liquid introduction main body 368. The liquid introduction portion 362 and the liquid introduction main body 368 form a flow path parallel to a center axis CL. The liquid introduction main body 368 may be regarded as part of the liquid introduction portion 362. In this sense, the liquid introduction main body 368 forms a downstream side end of the liquid introduction portion 362.

An upstream side end of the connecting flow path portion 374 is connected with the liquid introduction main body 368, and a downstream side end is connected with the liquid flow tube 320. The connecting flow path portion 374 forms a bent flow path. More specifically, the connecting flow path portion 374 forms a flow path parallel to the center axis CL and a downward flow path in the direction of gravity. The connecting flow path portion 374 includes a flow path forming portion 374A configured to form a flow path and a connection structure 374B configured to join the liquid flow tube 320 with the flow path forming portion 374A in the airtight manner. The flow path forming portion 374A and the connection structure 374B are formed by two-color molding. This configuration enables the flow path forming portion 374A and the connection structure 374B to be readily formed by using different materials.

The liquid flow portion 369 (liquid introduction portion 362) is insert molded in the state that one end of the liquid flow tube 320 is inserted into the connection structure 374B of the liquid flow portion 362. More specifically, the connection structure 374B and the flow path forming portion 374A are molded components, and the liquid flow tube 320 is an insert component. More specifically, after the flow path forming portion 374A and the liquid flow tube 320 are connected, the connection structure 374B is injection molded to cover the periphery of the connecting region. Insert molding of the liquid flow tube 320 in the liquid flow portion 369 enables the connecting region to be made airtight by the connection structure 374B. This configuration reduces the possibility that ink is leaked outside from the connecting region between the liquid flow tube 320 and the liquid flow portion 369. In the configuration that the liquid flow tube 320 is connected with the connection structure 374 and is fixed by means of a spring, there is a possibility that a portion fixed by the spring creeps to be cracked and cause leakage of the liquid. The liquid supply device 20 of this configuration, however, reduces the possibility of such leakage of the liquid. The other end (not shown) of the liquid flow tube 320 that is located on the printer 10-side is also insert molded in the state that the other end is inserted into a connection structure.

As described above, the liquid flow portion 369 has an upstream-side introduction portion that includes a leading edge (upstream side end) 362*a* that is to be connected with the liquid lead-out portion 57 and forms a flow path parallel to the first direction (−K1-axis direction). The liquid flow portion 369 also has a downstream-side introduction portion that includes a downstream side end that is to be connected with the liquid flow tube 320 and is extended from the upstream-side introduction portion downward in the direction of gravity (in the −Z-axis direction). The liquid flow portion 369 includes the downstream-side introduction portion that is extended in the direction intersecting with the first direction (downward in the direction of gravity). This configuration suppresses size expansion of the liquid supply device 20 in the first direction.

As shown in FIG. 36, a recess 374*r* serving as a spring receiver to receive the other end of the coil spring 367 is formed on the opposite side of the connecting flow path portion 374 (connection structure base end 374*e*) that is opposite to the side where the liquid introduction main body 368 is located in the direction parallel to the center axis CL (center axis CL direction). One end of the coil spring 367 abuts on the wall surface of the printer 10 (for example, the apparatus third surface 106 shown in FIG. 2). The coil spring 367 presses the liquid flow portion 369 toward the leading edge 362*a* of the liquid introduction portion 362 (in the +K1-axis direction or in the direction toward the liquid supply portion 57). With regard to the liquid introduction portion 362, a direction from the leading edge 362*a* toward a base end 362*b* (or to the connection structure base end 374*e*) is the −K1-axis direction (connecting direction).

As shown in FIG. 36 and FIG. 40, the connection structure base end 374*e* includes restriction elements 376 that are protruded outward in a plane direction perpendicular to the center axis CL direction. As shown in FIG. 36, the restriction elements 376 are placed in an inner housing space 366H of the fixation structure 366. The restriction elements 376 abut on a wall portion 366B configured to define and form the inner housing space 366H. This configuration restricts the motion of the liquid flow portion 369 toward the leading edge 362*a* by the coil spring 367.

As shown in FIG. 40, three restriction elements 376 are provided at approximately fixed intervals in the circumferential direction of the connection structure base end 374*e* having an approximately circular section. More specifically, the restriction elements 376 include a first restriction element 376A, a second restriction element 376B and a third restriction element 376C as shown in FIGS. 39 and 40. The restriction elements 376 are arranged with some backlash (clearance) relative to the wall portion configured to define and form the inner housing space 366H in a direction perpendicular to the center axis CL direction (K1-axis direction) (direction parallel to the plane defined by the Z-axis direction and the K2-axis direction). The liquid flow portion 369 is accordingly configured to be displaceable by the coil spring 367 and the fixation structure 366 fixed to the stationary member 35 in the direction intersecting with the first direction (−K1-axis direction) (direction parallel to the plane defined by the Z-axis direction and the K2-axis direction).

A-10. Displacement Mechanism of Movable Member 40

Figure 41:
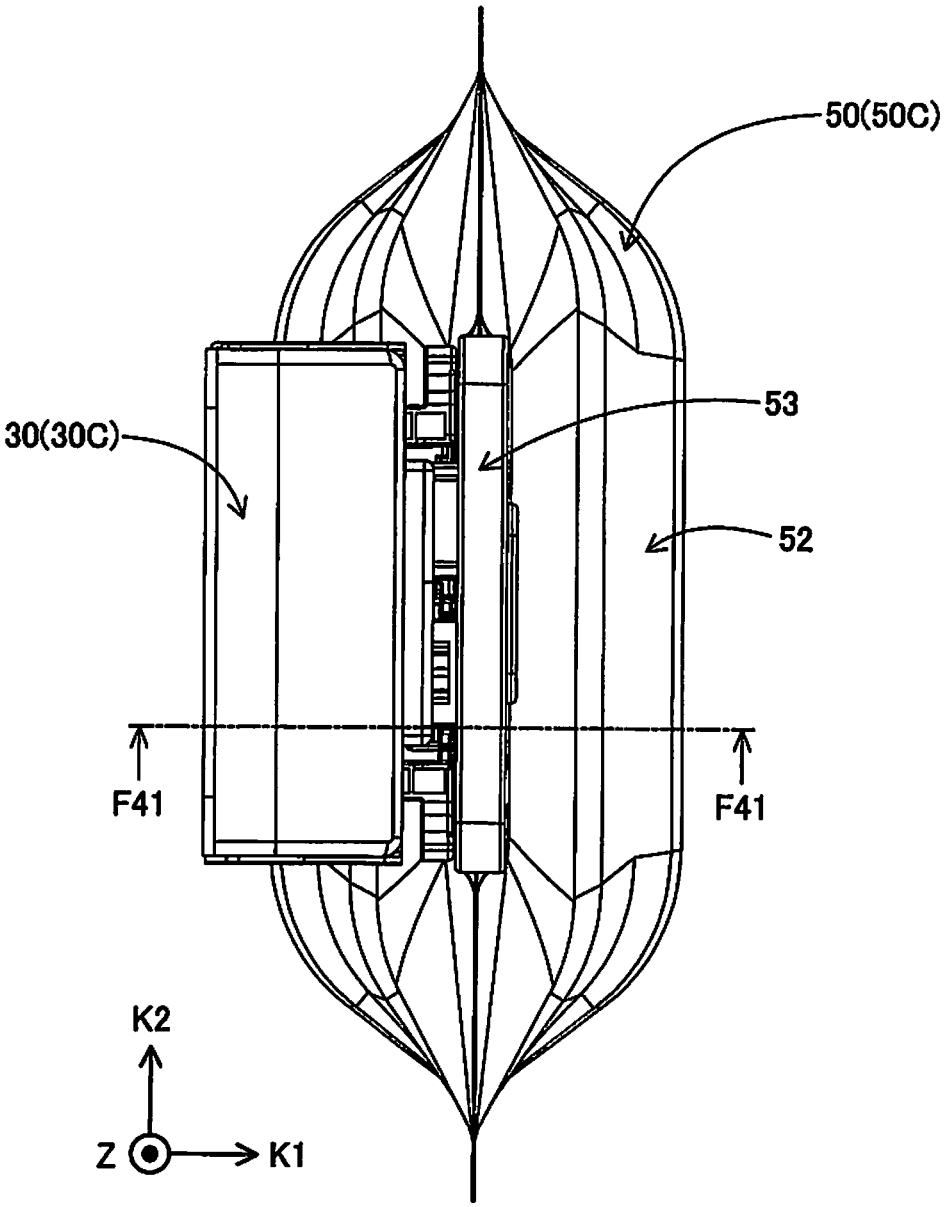
FIG. 41 is a top view illustrating the mounting/demounting unit and the liquid container.
Figure 42:
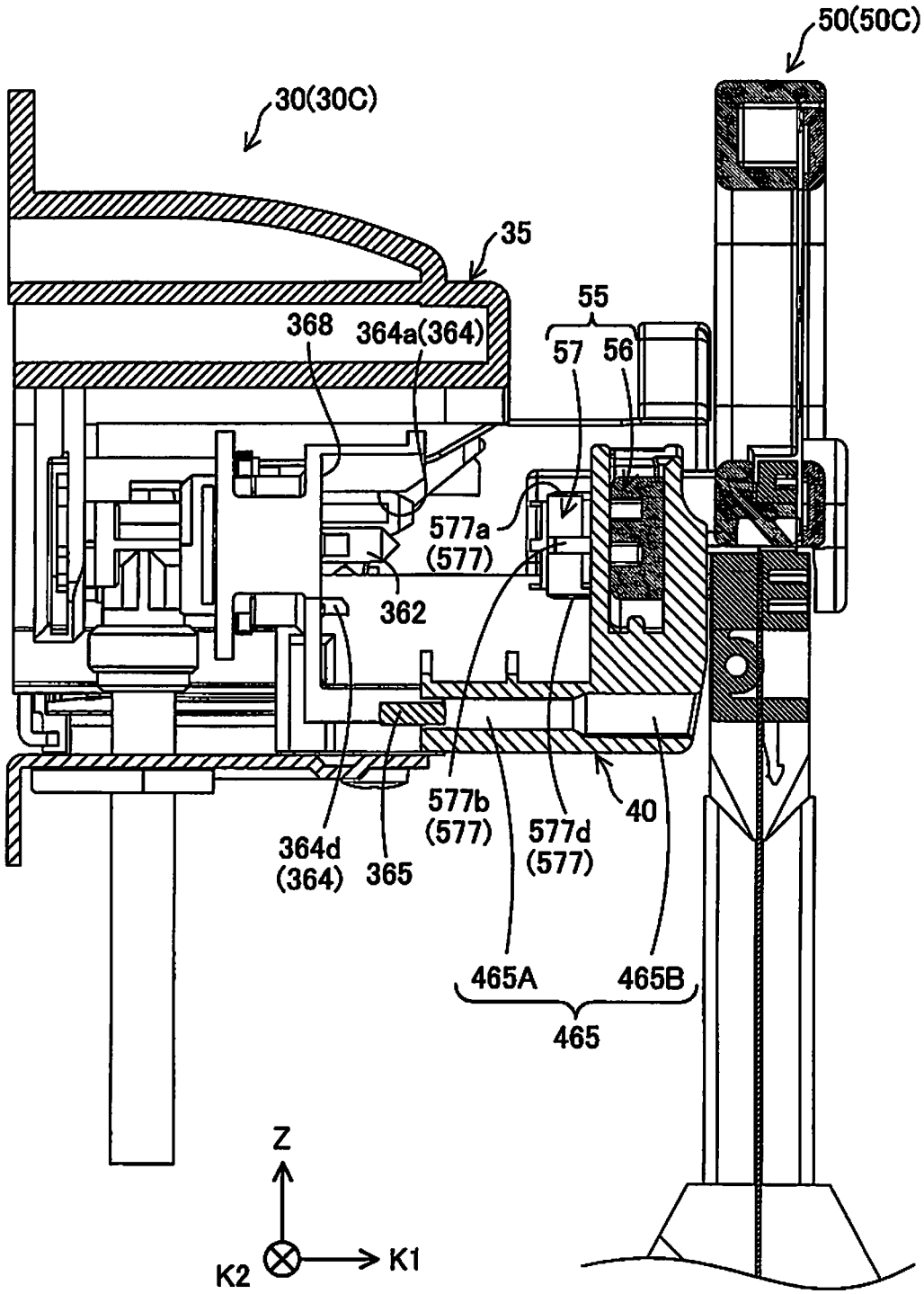
FIG. 42 is a first diagram corresponding to an F41-F41 partial sectional view.
Figure 43:
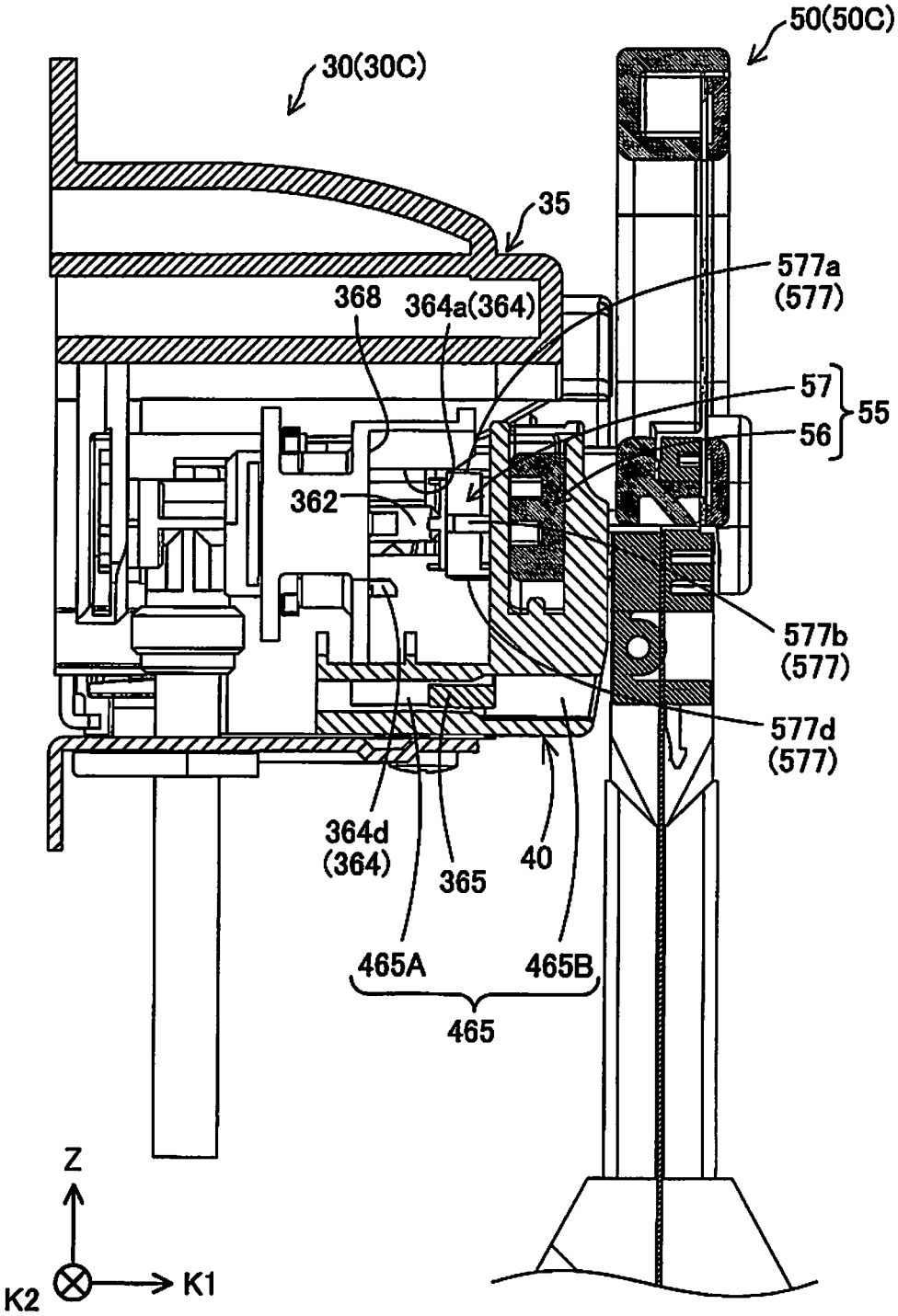
FIG. 43 is a second diagram corresponding to the F41-F41 partial sectional view.
Figure 44:
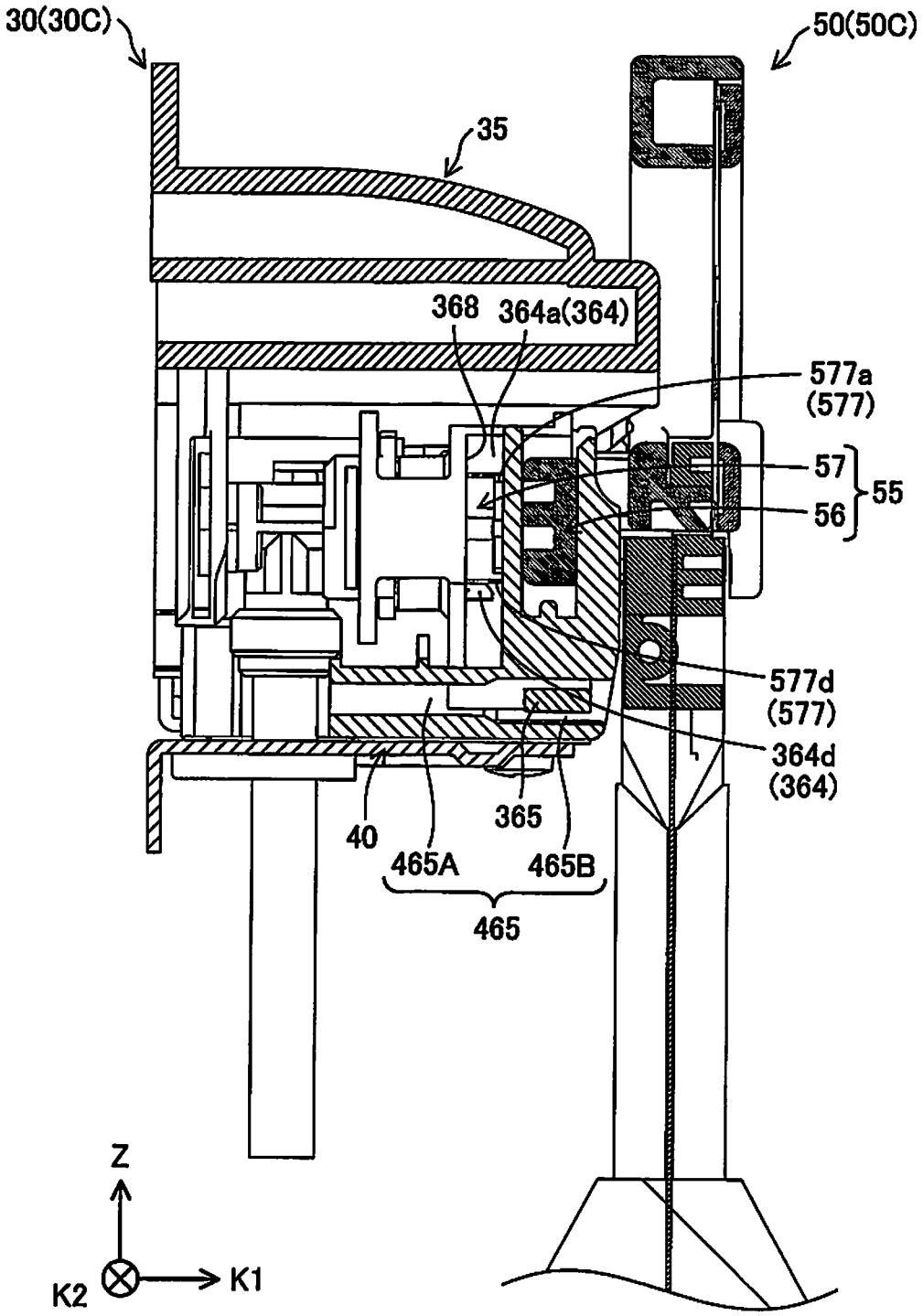
FIG. 44 is a third view corresponding to the F41-F41 partial sectional view.

FIG. 41 is a top view illustrating the mounting/demounting unit 30 and the liquid container 50. FIG. 42 is a first diagram corresponding to an F41-F41 partial sectional view. FIG. 43 is a second diagram corresponding to the F41-F41 partial sectional view. FIG. 44 is a third view corresponding to the F41-F41 partial sectional view. In FIGS. 42 to 44, the positions of the movable member 40 and the liquid container 50 are changed relative to the stationary member 35. FIG. 42 is a diagram illustrating the state that the liquid container 50 is set in the movable member 40 in the first state that the movable member 40 is protruded outward relative to the stationary member 35. FIG. 43 is a diagram illustrating the state that the movable member 40 is pressed in the connecting direction (−K1-axis direction) and causes the liquid supply portion 57 to start connecting with the liquid introduction portion 362. FIG. 44 is a diagram illustrating the mounted state of the liquid container 50.

As shown in FIG. 42, the movable member 40 includes the guiding portion 465 in which the guide structure 365 of the liquid introduction main body 368 is inserted. The guiding portion 465 includes a first guiding portion 465A and a second guiding portion 465B. The first guiding portion 465A is located on the first direction (−K1-axis direction) side of the second guiding portion 465B. The second guiding portion 465B is connected with the first guiding portion 465A. The second guiding portion 465B has a greater length in the direction of gravity (Z-axis direction) than the first guiding portion 465A. Accordingly, as shown in FIG. 42 and FIG. 44, a clearance between the second guiding portion 465B and the guide structure 365 in the direction of gravity is larger than a clearance between the first guiding portion 465A and the guide structure 365 in the direction of gravity.

As shown in FIG. 42, in the state that the movable member 40 is protruded most outward (+K1-axis direction) relative to the stationary member 35, part of the guide structure 365 is placed in the first guiding portion 465A. When the movable member 40 is pressed inward (in the first direction or −K1-axis direction) from the state shown in FIG. 42, the liquid supply portion 57 starts connecting with the liquid introduction portion 362 as shown in FIG. 43. At the start of connection, the guide structure 365 reaches the boundary between the first guiding portion 465A and the second guiding portion 465B. Further pressing the movable member 40 inward completes the connection of the liquid supply portion 57 with the liquid introduction portion 362 as shown in FIG. 44.

As described above, the guide structure 365 is located in the first guiding portion 465A for a time period from the time when the liquid container 50 is set in the movable member 40 to the time when the liquid supply portion 57 starts connecting with the liquid introduction portion 362 (as shown in FIGS. 42 and 43). The guide structure 365 is located in the second guiding portion 465B for a time period from the time when the liquid supply portion 57 starts connecting with the liquid introduction portion 362 to the time when the connection is completed (as shown in FIG. 43 and FIG. 44). The guiding portion 465 of the movable member (first support assembly) 40 accordingly supports the liquid supply portion (liquid lead-out portion) 57 such that a side of the liquid supply portion 57 far from the liquid introduction portion 362 (first side) is displaceable by a greater degree in the direction intersecting with the first direction (in the Z-axis direction) than a side near to the liquid introduction portion 362 (second side). The "far side" is the supply connecting portion 573 (shown in FIG. 9) that is the other end of the liquid supply portion 57, and the "near side" is the liquid supply port 572 (shown in FIG. 9) that is one end of the liquid supply portion 57.

The configuration of the guide structure 365 and the guiding portion 465 serving as the displacement mechanism facilitates positioning of the liquid supply portion 57 relative to the liquid introduction portion 362 at the start of connection of the liquid supply portion 57 with the liquid introduction portion 362, and reduces restriction of the motion of the liquid supply portion 57 immediately before completion of the connection compared with that at the start of connection. This ensures smooth connection of the liquid supply portion 57 with the liquid introduction portion 362. Prior to a start of connection, setting a small backlash enables the liquid supply portion 57 to be positioned with high accuracy relative to the liquid introduction portion 362. After a start of connection, on the other hand, setting a large backlash enables the liquid introduction portion 362 to readily follow the motion of the liquid supply portion 57.

In addition to the above configuration, the guiding portion 465 of the movable member (first support assembly) 40 may be configured to support the liquid supply portion (liquid lead-out portion) 57 such that the side of the liquid supply portion 57 far from the liquid introduction portion 362 is displaceable by a greater degree in the K2-axis direction than the side near to the liquid introduction portion 362. This additional configuration may be implemented by, for example, making a clearance between the second guiding portion 465B and the guide structure 365 in the K2-axis direction larger than a clearance between the first guiding portion 465A and the guide structure 365 in the K2-axis direction.

Figure 45:
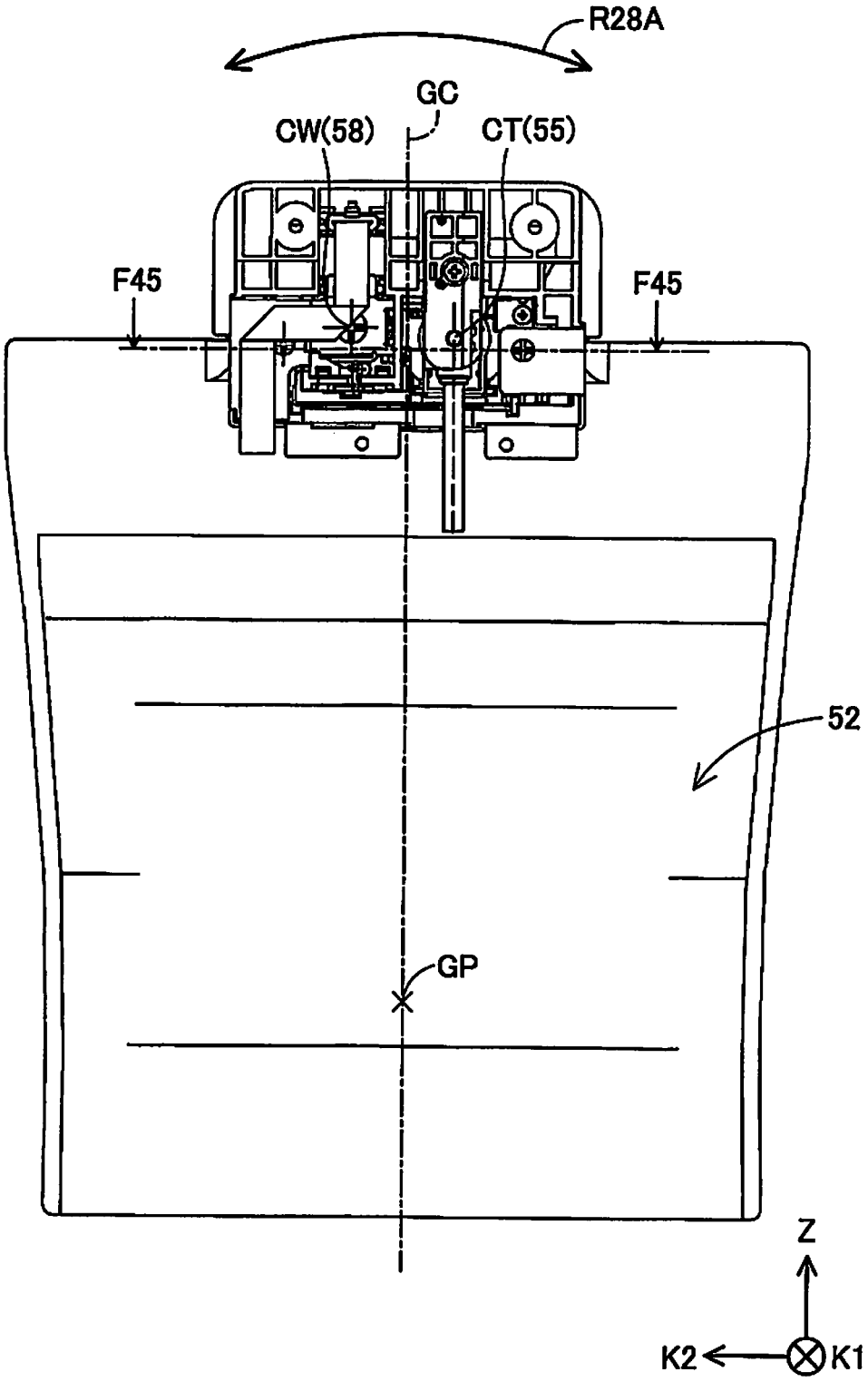
FIG. 45 is a sectional view illustrating the state that connection of the liquid container with the mounting/demounting unit is completed (in the connected state)
Figure 46:
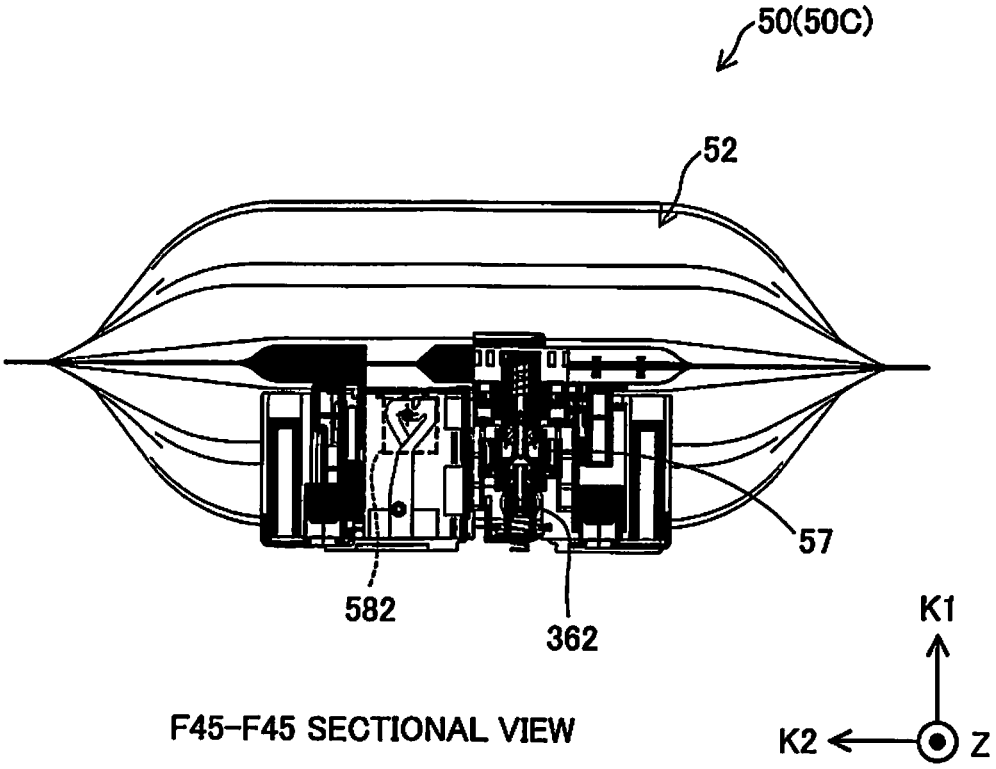
FIG. 46 is an F45-F45 sectional view of FIG. 45.

FIG. 45 is a sectional view illustrating the state that connection of the liquid container 50 with the mounting/demounting unit 30 is completed (in the connected state). FIG. 46 is an F45-F45 sectional view of FIG. 45. The liquid container 50 shown in FIG. 45 is in the state prior to consumption of ink by the printer 10. In FIG. 45, a reference sign "GC" represents a center-of-gravity line that passes through the center of gravity GP of the liquid container body 52 and is along the Z-axis direction.

As shown in FIG. 45, the liquid supply assembly 55 and the substrate unit (container-side electrical connection structure) 58 are arranged at positions with the center of gravity GP (center-of-gravity line GC) placed therebetween in the K2-axis direction (second direction). It is required that a center (center axis) CT of the liquid supply assembly 55 and a center CW of the container-side electrical connection structure 58 are arranged at positions with at least the center of gravity GP (center-of-gravity line GC) placed therebetween. The center CW denotes the center of the length of the circuit board 582 in the K2-axis direction shown in FIG. 15.

The positioning structure 56 is supported by the supply portion support structure 42 (as shown in FIG. 30). As described later, the circuit board holding structure 59 is supported by the board support structure 48 (as shown in FIG. 30). This configuration causes the liquid container body 52 to be suspended below the supporting position in the direction of gravity, in the mounted state of the liquid container 50.

It is here assumed that the substrate unit 58 and the liquid supply unit 55 including a part for supporting the liquid container body 52 are deflected to one side across the center of gravity GP of the liquid container body 52 in the K2-axis direction. In this configuration, a load is applied to the supporting part by the own weight of the liquid container body 52. The liquid container body 52 is thus likely to rotate in the direction of an arrow R28A including a K2-axis direction component about the supporting part.

According to this embodiment, on the other hand, the liquid supply unit 55 and the substrate unit 58 are arranged at the positions with the center of gravity GP placed therebetween in the K2-axis direction. This configuration enables the liquid container body 52 to be supported on the respective sides across the center of gravity GP and thereby suppresses the liquid container body 52 from rotating in the direction of the arrow R28A.

A-11. Advantageous Effects

According to the embodiment described above, as shown in FIG. 19, the first support assembly 40 supports the liquid lead-out portion 57 such as to locate the liquid lead-out portion 57 above the liquid container body 52 in the direction of gravity and such as to move the liquid lead-out portion 57 along the first direction (−K1-axis direction)

intersecting with the direction of gravity (Z-axis direction). This configuration reduces the possibility of failed connection of the liquid lead-out portion 57 with the liquid introduction portion 362 due to the interference by the liquid container body 52. According to the embodiment described above, as shown in FIG. 35, the positioning structures 364 are arranged around the liquid introduction portion 362. This configuration enables the liquid lead-out portion 57 to be positioned relative to the liquid introduction portion 362 in the direction intersecting with the first direction (−K1-axis direction) (direction parallel to the plane defined by the Z-axis direction and the K2-axis direction). This ensures smooth connection of the liquid lead-out portion 57 with the liquid introduction portion 362.

According to the above embodiment, as shown in FIGS. 36, 39 and 40, the second support structure 366 supports the liquid introduction portion 362 such that the liquid introduction portion 362 is displaceable in the direction intersecting with the first direction. This configuration enables the liquid introduction portion 362 to be displaced following the motion of the liquid lead-out portion 57 in the process of connecting the liquid introduction portion 362 with the liquid lead-out portion 57. This ensures smoother connection of the liquid lead-out portion 57 with the liquid introduction portion 362.

According to the above embodiment, as shown in FIG. 36, the liquid introduction portion 362 is pressed by the coil spring 367 in the direction toward the liquid lead-out portion 57. This configuration reduces the possibility that the liquid lead-out portion 57 is dropped off from the liquid introduction portion 362 in the mounted state of the liquid container 50. In other words, this configuration reduces the possibility of failed connection of the liquid introduction portion 362 with the liquid lead-out portion 57.

According to the above embodiment, as shown in FIG. 36, the liquid introduction mechanism 36 including the liquid supply connection structure 362 (liquid introduction portion 362) is supported by the outer wall (for example, the apparatus third surface 106 shown in FIG. 4) via the fixation structure 366 and the stationary member 35. This configuration facilitates connection of the liquid container 50 with the liquid supply connection structure 362, compared with the configuration that the liquid supply connection structure 362 is placed inside of the printer 10. This configuration also suppresses size expansion of the printer 10 and provides a large space for the liquid container 50 placed therein, compared with the configuration that the liquid supply connection structure 362 is placed inside of the printer 10. This provides the large capacity of the liquid container body 52 of the liquid container 50 and accordingly enables a large amount of liquid to be contained in the liquid container 50. This configuration shortens the flow path of ink from the liquid container 50 to the printer 10 (liquid supply passage), compared with the external configuration that the liquid container 50 is placed at a location away from the printer 10. This accordingly shortens a time period required for the ink contained in the liquid container 50 to reach the printer 10. This also suppresses the ink component from being vaporized through the liquid supply passage to change the properties of ink. This additionally reduces the flow resistance in the liquid supply passage and thereby reduces the power required for supplying ink from the liquid container 50 to the printer 10 (for example, the power of a pump used to suck ink).

According to the above embodiment, as shown in FIG. 6A and FIG. 6J, the contact mechanism 38 including the apparatus-side electrical connection structure 382 is supported by the outer wall (for example, the apparatus third surface 106 shown in FIG. 4) via the sheet metal 323 and the stationary member 35. This configuration facilitates connection of the apparatus-side electrical connection structure 382 with the container-side electrical connection structure 582 (circuit board 582), compared with the configuration that the apparatus-side electrical connection structure 382 is placed inside of the printer 10.

According to the above embodiment, as shown in FIG. 5B, the liquid supply connection structure 362 and the apparatus-side electrical connection structure 382 are arranged side by side in the K2-axis direction. More specifically, the liquid supply connection structure 362 and the apparatus-side electrical connection structure 382 are arranged adjacent to each other in the K2-axis direction. In other words, the liquid supply connection structure 362 and the apparatus-side electrical connection structure 382 are arranged next to each other, such as to allow the user to simultaneously observe these structures 362 and 382. The user can thus simultaneously observe the liquid supply connection structure 362 and the apparatus-side electrical connection structure 382 and connect the corresponding portions (the liquid lead-out portion 57 and the circuit board 582) of the liquid container 50. This enhances the operability in mounting the liquid container 50 to the printer 10. The term "adjacent" in the description hereof means that two members are arranged next to each other but do not necessarily adjoin to each other. Accordingly the two members may not be in contact with each other.

According to the above embodiment, as shown in FIG. 5A, the liquid supply device 20 includes the liquid container holder 22 that has the bottom face 27 and the openable and closable top. Even if ink is leaked out from the liquid supply connection structure 362 during mounting or demounting of the liquid supply portion 57 to or from the liquid supply connection structure 362, the leaked ink is accumulated on the bottom face 27. This reduces the possibility that the outside of the liquid supply device 20 is stained with ink. The top of the liquid container holder 22 is opened and closed only when needed, for example, for mounting and demounting the liquid container 50 to and from the printer 10. The liquid container 50 is accordingly protected by the liquid container holder 22 in the ordinary state, for example, during use of the printer 10. This reduces the possibility that the liquid container 50 is damaged. The liquid supply connection structure 362 is placed inside of the liquid container holder 22. This reduces the possibility that the liquid supply connection structure 362 is damaged.

According to the above embodiment, as shown in FIG. 10 and FIG. 18, the holding structure 59 supports the container-side electrical connection structure 582 to be located above the liquid container body 52 (on the upper side in the direction of gravity) in the process of connecting the liquid container 50 with the printer 10. Even in the state that the liquid container body 52 hangs down in the direction of gravity by the dead weight (in the free state), the holding structure 59 supports the container-side electrical connection structure 582, such as to locate the container-side electrical connection structure 582 in the designed range. This configuration ensures favorable electrical connection between the container-side electrical connection structure 582 and the apparatus-side electrical connection structure 3

According to the above embodiment, as shown in FIG. 16D, the contact plane TP is inclined such that the lower side is located on the first direction side (−K1-axis direction side) of the upper side. The surface 62*fa* of the terminal holder 62 is accordingly inclined such that the upper side is protruded more than the lower side in the opposite direction (+K1-axis direction) opposite to the first direction as shown in FIG. 24. In other words, the surface 62*fa* of the terminal holder 62 is arranged to cover over the contact portions cp of the circuit board 582. This configuration reduces the possibility that impurity such as dust adheres to the electrical connection structure 382 (for example, the surface 62*fa* or the apparatus-side terminals 381). This accordingly ensures more favorable electrical connection between the container-side electrical connection structure 582 and the apparatus-side electrical connection structure 382.

According to the above embodiment, as shown in FIG. 6K and FIG. 11, the holding structure 59 includes the restriction element 597 that abuts on the first support assembly 40 so as to restrict the motion of the holding structure 59 in the opposite direction (+K1-axis direction) opposite to the first direction. In the mounted state, an external force in the +K1-axis direction may be applied to the holding structure 59 of the liquid container 50. This external force may be, for example, the pressing force of the coil spring 387 shown in FIG. 6J or the elastic force of the apparatus-side terminals 381 shown in FIG. 6V. Applying such an external force in the +K1-axis direction to the holding structure 59 is likely to move the holding structure 59 in the +K1-axis direction and cut off the electrical connection between the container-side electrical connection structure 582 and the apparatus-side electrical connection structure 382. The restriction element 597, however, serves to restrict the motion of the holding structure 59 in the +K1-axis direction and thereby stably maintains the electrical connection between the container-side electrical connection structure 582 and the apparatus-side electrical connection structure 382.

According to the above embodiment, as shown in FIG. 30 and FIG. 33, the holding structure 59 includes the rotation restriction element 595 that abuts on the first support assembly 40 so as to restrict rotation of the holding structure 59 in the direction of the arrow R30. This configuration restricts rotation of the holding structure 59 and thereby further stably maintains the electrical connection between the container-side electrical connection structure 582 and the apparatus-side electrical connection structure 382.

According to the above embodiment, as shown in FIG. 6A, the printer 10 includes the first support assembly 40 and the stationary member 35 to which the electrical connection unit 38 including the liquid introduction portion 362 and the apparatus-side electrical connection structure 382 is attached. As shown in FIG. 6R, the apparatus-side electrical connection structure 382 is attached such as to be displaceable in the direction intersecting with the first direction (−K1-axis direction) (direction parallel to the plane defined by the Z-axis direction and the K2-axis direction). As shown in FIG. 16E and FIG. 16F, the holding structure 59 is configured to be connectable with the apparatus-side electrical connection structure 382 to which the container-side electrical connection structure 582 is attached in a displaceable manner. The holding structure 59 has the grooves 593*t* and 592*t* configured to receive the apparatus-side board positioning structures 384 and 385 (shown in FIG. 6T) of the electrical connection unit 38 as shown in FIG. 16E and FIG. 16F. This configuration allows the apparatus-side electrical connection structure 382 to be displaced following the motion of the holding structure 59 in the process of connecting the container-side electrical connection structure 582 with the apparatus-side electrical connection structure. This ensures favorable electrical connection between the container-side electrical connection structure 582 and the apparatus-side electrical connection structure 382.

According to the above embodiment, as shown in FIG. 16E and FIG. 16F, the holding structure 59 of the liquid container 50 abuts on the apparatus-side board positioning structures 384 and 385 (shown in FIG. 6T) in the process of connecting the container-side electrical connection structure 582 with the apparatus-side electrical connection structure 382. This configuration positions the container-side electrical connection structure 582 relative to the apparatus-side electrical connection structure 382 and thereby ensures favorable electrical connection between the apparatus-side electrical connection structure 382 and the container-side electrical connection structure 582. This configuration, for example, makes the apparatus-side electrical connection structure 382 and the container-side electrical connection structure 582 unlikely to be affected by the load of a downward component in the direction of gravity generated by the dead weight of the liquid container body 52. This reduces the possibility of failed electrical connection between these connection structures 382 and 582.

According to the above embodiment, as shown in FIG. 13, the holding structure-side positioning elements 592*t* and 593*t* are provided on the respective sides with the container-side electrical connection structure 582 placed therebetween. As shown in FIG. 6T, the apparatus-side board positioning structures 384 and 385 are provided on the respective sides with the apparatus-side terminals 381 of the apparatus-side electrical connection structure 382 placed therebetween. This configuration reduces the possibility that the container-side electrical connection structure 582 (or the apparatus-side electrical connection structure 382) is inclined, compared with the configuration that has only the holding structure-side positioning elements 592*t* and 593*t* (or has only the apparatus-side board positioning structures 384 and 385) provided only one of the container-side or the apparatus-side.

According to the above embodiment, as shown in FIG. 15, the holding structure 59 includes the holding structure-side upper restriction portions 599*a* and 599*b*. As shown in FIG. 6M, the fixation structure 37 includes the apparatus-side upper restriction portions 377*a* and 377*b*. When the container-side electrical connection structure 582 is connected with the apparatus-side electrical connection structure 382, the holding structure-side upper restriction portions 599*a* and 599*b* of the holding structure 59 abut on the apparatus-side upper restriction portions 377*a* and 377*b* of the fixation structure 37. This restricts the upward motion of the holding structure 59 in the direction of gravity. This accordingly ensures more favorable electrical connection between the container-side electrical connection structure 582 and the apparatus-side electrical connection structure 382. According to the above embodiment, such restriction starts prior to start of positioning by the apparatus-side board positioning structures 384 and 385 (shown in FIG. 6T) and the holding structure-side positioning elements 593*t* and 592*t* (shown in FIGS. 16E and 16F) of the holding structure 59. This roughly positions the apparatus-side board positioning structures 384 and 385 provided as the projections relative to the holding structure-side positioning elements 593*t* and 592*t* provided as the grooves. This accordingly enables the apparatus-side board positioning structures 384 and 385 to be securely inserted into the holding structure-side positioning elements 593*t* and 592*t*.

According to the above embodiment, the protective member (cover portion) 354 is used to cover over the apparatus-side electrical connection structure 382 as shown in FIG. 5C. This cover portion 354 is arranged to cover over the holding structure 59 and the circuit board 582 of the liquid container 50 when the container-side electrical connection structure 582 is connected with the apparatus-side electrical connection structure 382 (for example, in the mounted state). This reduces the possibility that impurity such as dust falls down from above the apparatus-side electrical connection structure 382 and adheres to the apparatus-side electrical connection structure 382. This accordingly ensures more favorable electrical connection between the container-side electrical connection structure 582 and the apparatus-side electrical connection structure 382.

According to the above embodiment, as shown in FIG. 8A, the liquid supply assembly 55 is located on the one end portion 501-side of the liquid container body 52. As shown in FIG. 24, the liquid supply assembly 55 supports the liquid container body 52 on the upper side of the liquid container body 52 in the direction of gravity (on the +Z-axis direction side) in the process of connecting with the printer 10. As shown in FIG. 19, the liquid supply assembly 55 is moved in the connecting direction (−K1-axis direction) including a component of the primary direction that is the horizontal direction (K1-axis direction component), so as to be connected with the liquid introduction portion 362 provided on the printer 10.

In the process of connecting the liquid container 50 with the printer 10, the liquid supply assembly 55 supports the liquid container body 52 to be suspended in the direction of gravity (more specifically, in the −Z-axis direction that is downward in the direction of gravity). There is accordingly no need to support the liquid container body 52 in the horizontal direction in the process of connecting the liquid container 50 with the printer 10. This suppresses size expansion of the printer 10 in the horizontal direction. This also eliminates the need for a case to support the liquid container body 52 in the horizontal direction. This reduces the total number of components and simplifies the configuration. The liquid supply assembly 55 is located above the liquid container body 52 in the direction of gravity (on the +Z-axis direction side of the liquid container body 52). This causes the connecting part (for example, the liquid supply assembly 55) to be readily visible in the process of connecting with the printer 10 and thereby facilitates the connection (connecting operation). For example, the user can observe the liquid supply assembly 55 and the container-side electrical connection structure 58 without interference by the other members as shown in FIG. 18. The "container-side electrical connection structure" may be regarded as the "substrate unit 58", may be regarded as the "circuit board 582" or may be regarded as the "contact portions cp".

According to the above embodiment, as shown in FIG. 19, the connecting direction of the liquid container 50 to the printer 10 is the horizontal direction. More specifically, the connecting direction is the −K1-axis direction that is one direction of the horizontal direction. The connecting direction is a single direction. This further facilitates the connecting operation.

According to the above embodiment, as shown in FIG. 9 and FIG. 10, the liquid supply port 572 is open toward the primary direction (more specifically, toward the −K1-axis direction). The connecting direction is the primary direction (more specifically, the −K1-axis direction) as shown in FIG. 19. Accordingly the opening direction of the liquid supply port 572 and the connecting direction of the liquid container 50 have an identical direction component. The liquid introduction portion 362 (shown in FIG. 19) of the printer 10 can thus be readily inserted into the liquid supply port 572 by moving the liquid container 50 in the connecting direction (−K1-axis direction). This further facilitates connection of the liquid container 50 with the printer 10.

According to the above embodiment, as shown in FIG. 8A, the container-side electrical connection structure 58 is located on the one end portion 501-side of the liquid container body 52. As shown in FIG. 24 and FIG. 27, the container-side electrical connection structure 58 supports the liquid container body 52 on the upper side of the liquid container body 52 in the direction of gravity (on the +Z-axis direction side) in the process of connecting with the printer 10. As shown in FIG. 19, the container-side electrical connection structure 58 is moved in the connecting direction (−K1-axis direction) to be electrically connected with the apparatus-side electrical connection structure 382 provided on the printer 10. The liquid container body 52 is thus supported to be suspended in the direction of gravity (more specifically, in the −Z-axis direction that is downward in the direction of gravity) by the container-side electrical connection structure 58 in addition to the liquid supply assembly 55 in the process of connecting the liquid container 50 with the printer 10. This enables the liquid container body 52 to be supported more reliably. The container-side electrical connection structure 58 is located above the liquid container body 52 in the direction of gravity (on the +Z-axis direction side of the liquid container body 52). This causes the connecting part (for example, the container-side electrical connection structure 58) to be readily visible in the process of connecting with the printer 10 and thereby facilitates the connection.

According to the above embodiment, as shown in FIG. 18, the liquid supply assembly 55 and the container-side electrical connection structure 58 are arranged side by side along the second direction (K2-axis direction) in the process of connecting the liquid container 50 with the printer 10. For example, this configuration causes the liquid supply assembly 55 and the container-side electrical connection structure 58 to be readily visible as shown in FIG. 18 when the liquid container 50 is moved in the connecting direction (−K1-axis direction). The user can thus readily check the positions of these components 55 and 58. This enables the liquid supply assembly 55 and the container-side electrical connection structure 58 to be connected with the printer 10 with high accuracy.

According to the above embodiment, as shown in FIG. 8A, the liquid supply assembly 55 and the container-side electrical connection structure 58 are arranged at the positions nearer to the center P52 of the one end portion 501 than the first edge 501A and the second edge 501B. This configuration reduces the rotation of the liquid container 50 caused by connection of one of the liquid supply assembly 55 and the container-side electrical connection structure 58 prior to connection of the other, compared with a configuration that the liquid supply assembly 55 and the container-side electrical connection structure 58 are arranged at positions nearer to the first edge 501A or the second edge 501B than the center P52 of the one end portion 501.

According to the above embodiment, as shown in FIG. 8A, the liquid supply assembly 55 and the container-side electrical connection structure 58 are placed between the first handle end 54A and the second handle end 54B. This configuration enables the positions of the liquid supply assembly 55 and the container-side electrical connection structure 58 to be readily determined relative to the printer 10 when the user holds the handle portion 53. Accordingly this enables the liquid supply assembly 55 and the container-side electrical connection structure 58 to be readily connected with the printer 10. For example, even when the liquid container 50 is rotated about the handle structure 54 that is gripped by the user in the process of connecting with the printer 10 or the like, this configuration reduces the rotations of the liquid supply assembly 55 and the container-side electrical connection structure 58. This enhances the operability in the process of connecting the liquid container 50 with the printer 10.

According to the above embodiment, as shown in FIG. 8A, the liquid supply assembly 55 and the container-side electrical connection structure 58 are arranged at the positions with the center P54 of the handle structure 54 placed therebetween. For example, even when the liquid container 50 is rotated about the handle structure 54 that is gripped by the user, this configuration reduces the rotations of the liquid supply assembly 55 and the container-side electrical connection structure 58. This further enhances the operability in the process of connecting the liquid container 50 with the printer 10.

According to the above embodiment, as shown in FIG. 17G and FIG. 17H, the liquid container body 52 includes the first containing portion 52A that is connected with the handle portion 53 and the second containing portion 52B that is located below the first containing portion 52A in the direction of gravity (on the −Z-axis direction side of the first containing portion 52A) and has the greater length in the primary direction (K1-axis direction) than the first containing portion 52A. This configuration provides the second containing portion 52B having the sufficient capacity for containing ink, while reducing the likelihood of failed connection of the liquid supply assembly 55 and the container-side electrical connection structure 58 with the printer 10 due to the interference by the first containing portion 52A when the liquid container 50 is moved in the connecting direction including a primary direction component (K1-axis direction component) to be connected with the printer 10. This advantageous effect is described below more in detail with reference to FIGS. 47 to 52.

Figure 47:
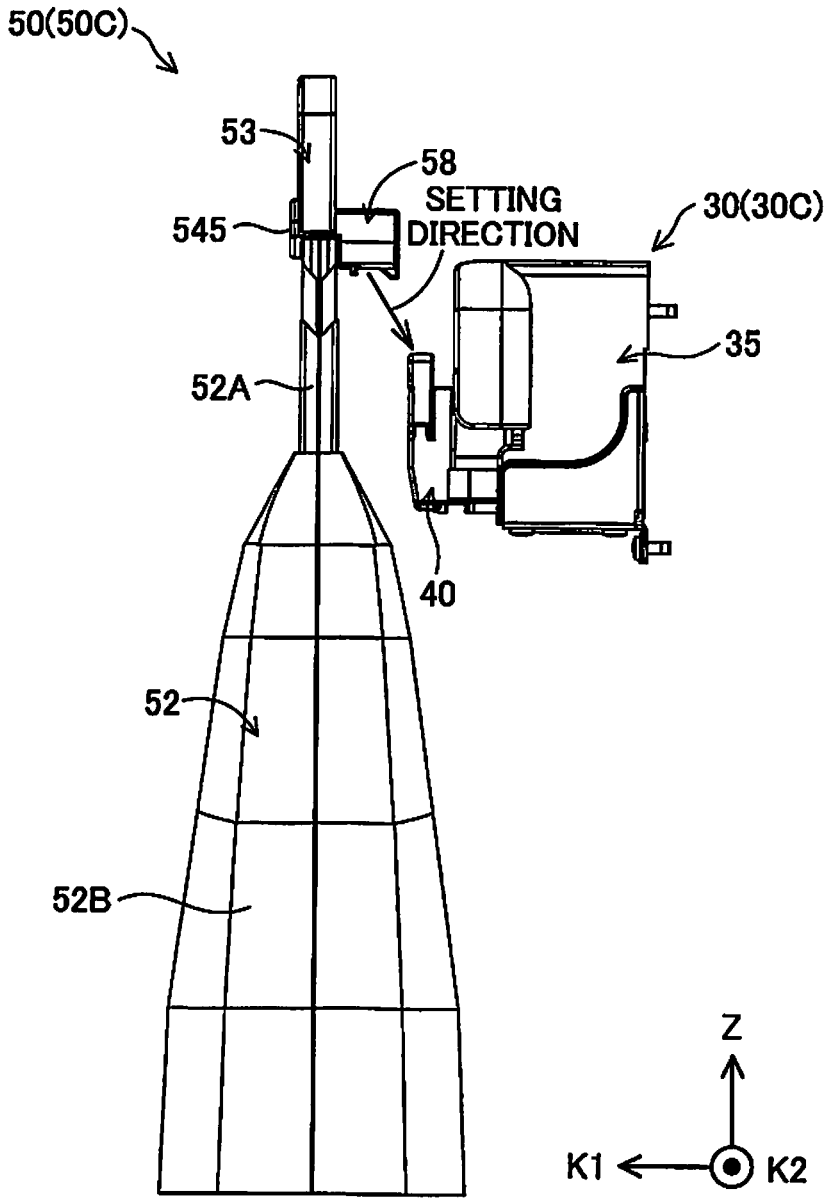
FIG. 47 is a first diagram illustrating the state prior to setting the liquid container in the mounting/demounting unit.
Figure 48:
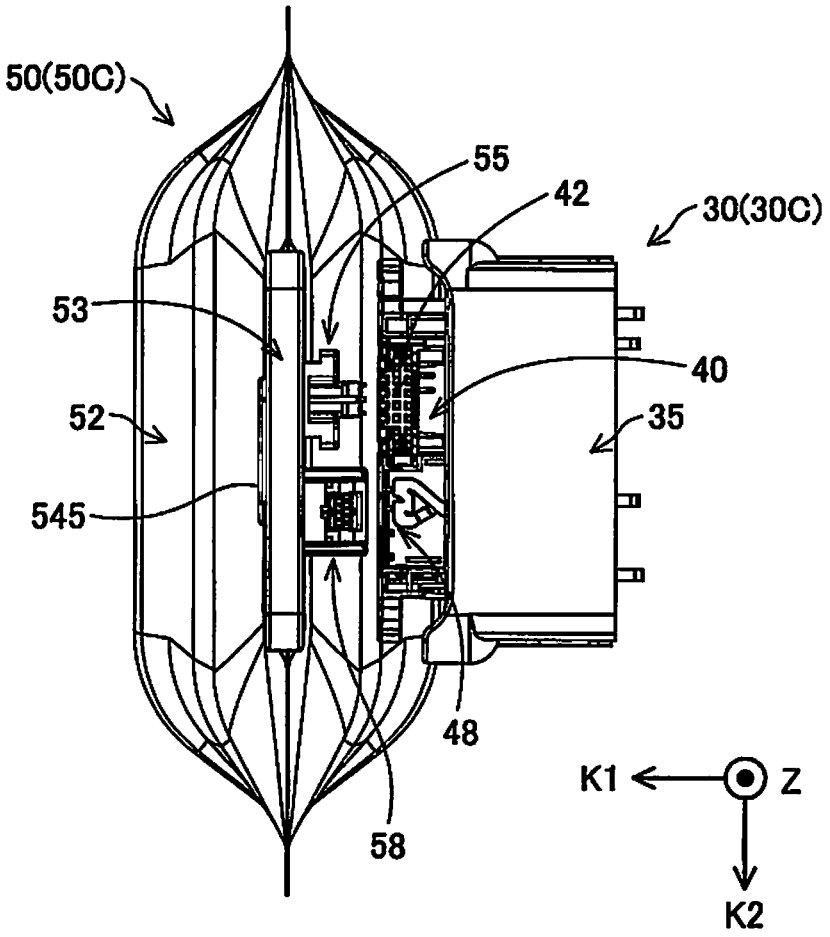
FIG. 48 is a diagram of FIG. 47 viewed from the +Z-axis direction side.
Figure 49:
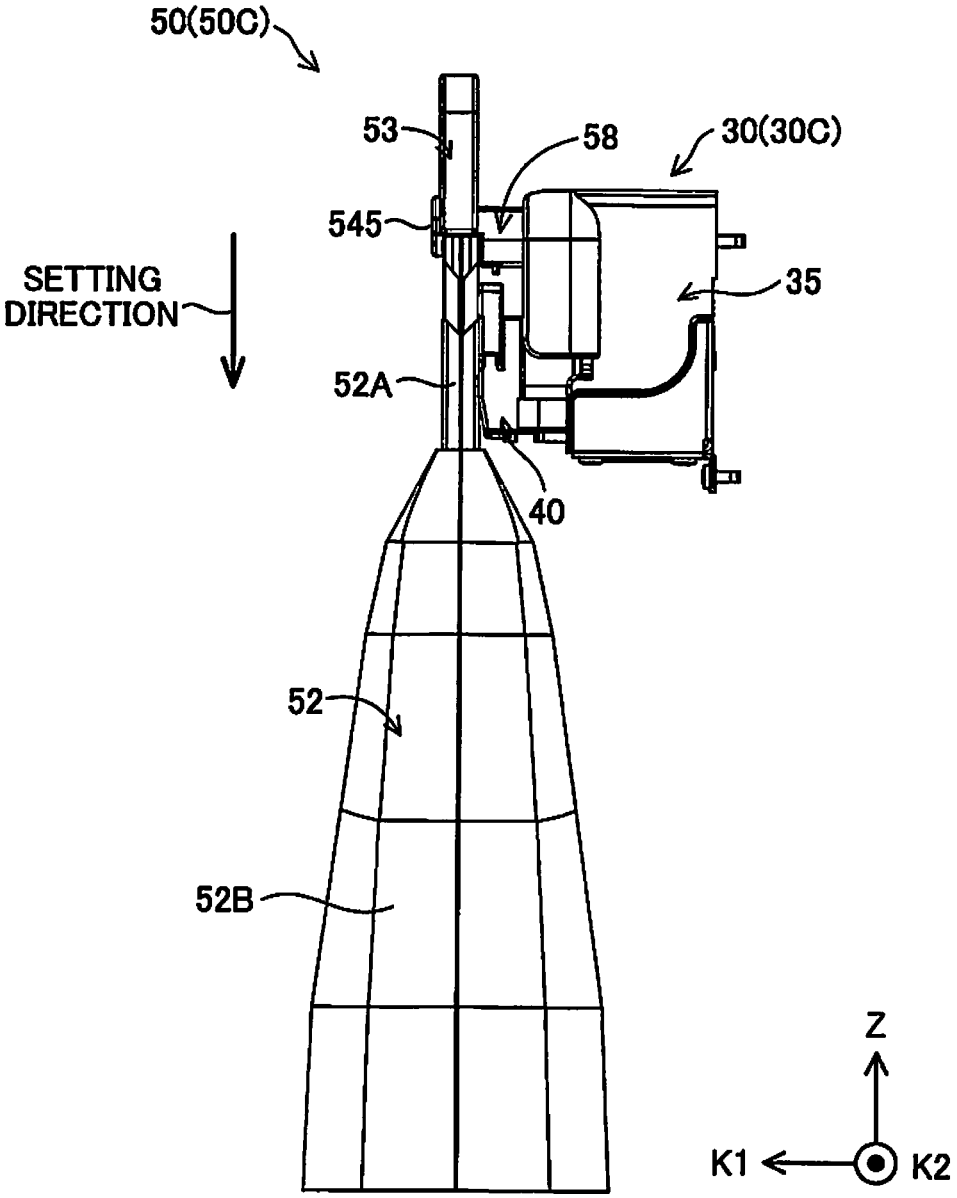
FIG. 49 is a second diagram illustrating the state prior to setting the liquid container in the mounting/demounting unit.
Figure 50:
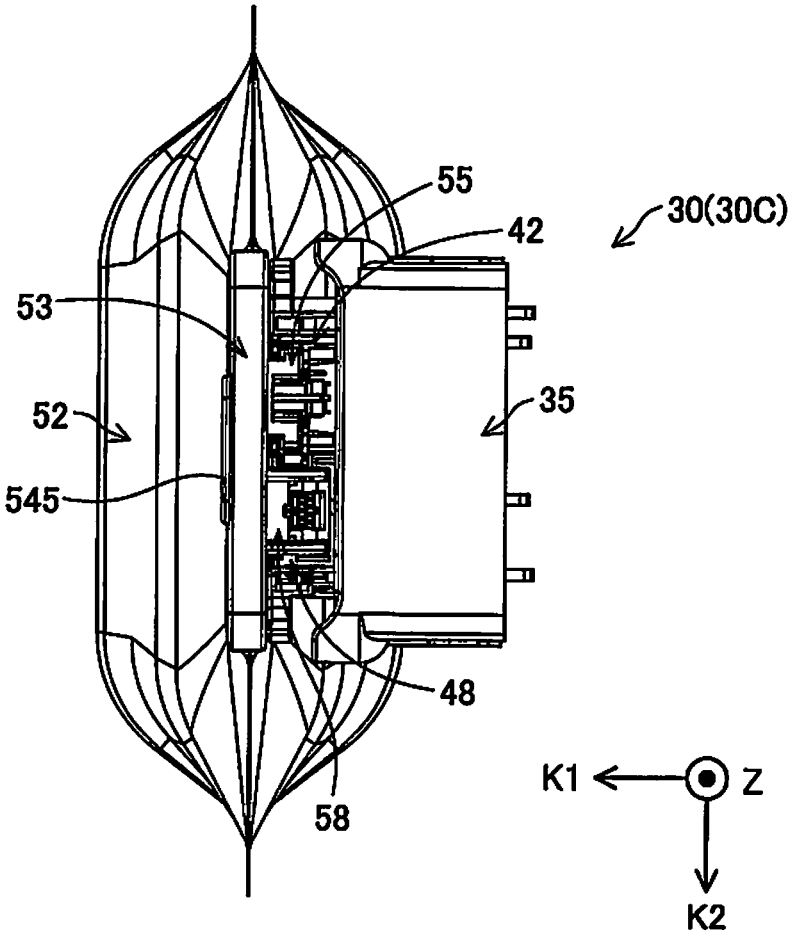
FIG. 50 is a diagram of FIG. 49 viewed from the +Z-axis direction side.
Figure 51:
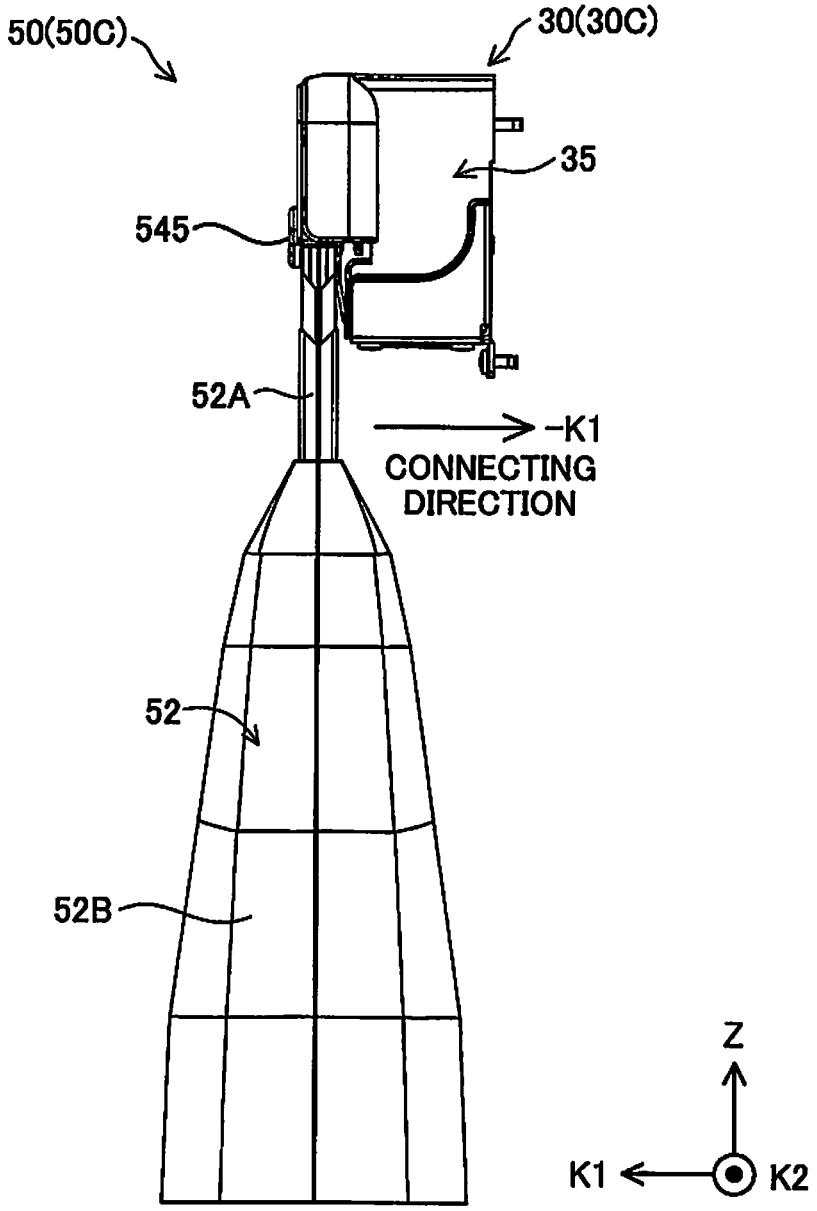
FIG. 51 is a diagram illustrating the state that the liquid container is mounted to the mounting/demounting unit.
Figure 52:
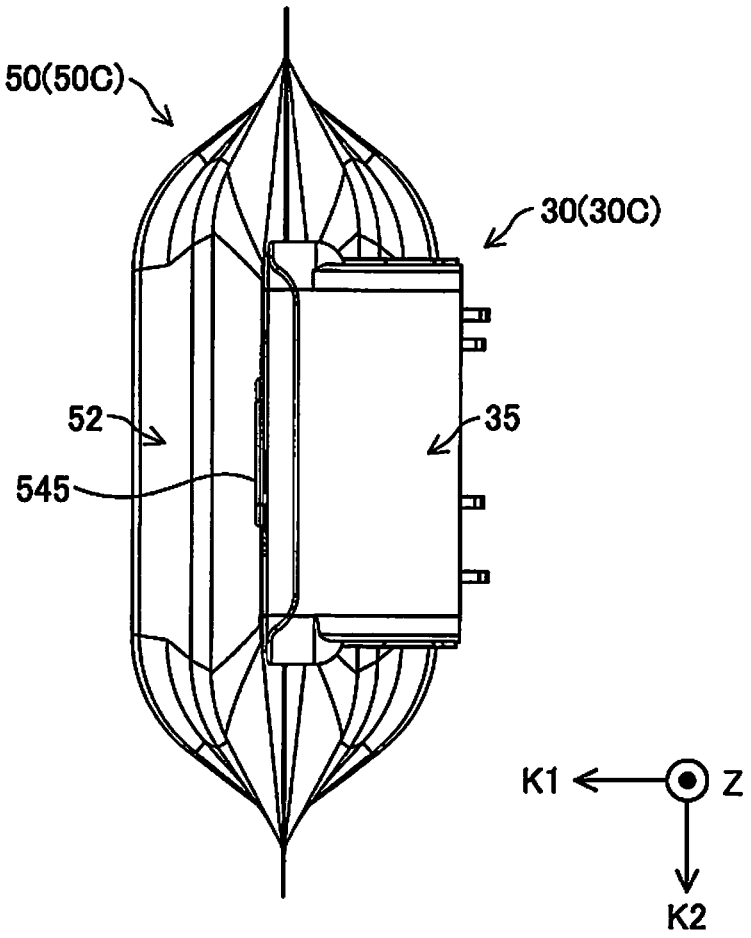
FIG. 52 is a diagram of FIG. 51 viewed from the +Z-axis direction side.

FIG. 47 is a first diagram illustrating the state prior to setting the liquid container 50 in the mounting/demounting unit 30. FIG. 48 is a diagram of FIG. 47 viewed from the +Z-axis direction side. FIG. 49 is a second diagram illustrating the state prior to setting the liquid container 50 in the mounting/demounting unit 30. FIG. 50 is a diagram of FIG. 49 viewed from the +Z-axis direction side. FIG. 51 is a diagram illustrating the state that the liquid container 40 is mounted to the mounting/demounting unit 30. FIG. 52 is a diagram of FIG. 51 viewed from the +Z-axis direction side. The liquid container 50 is moved in the sequence of FIG. 47, FIG. 49 and FIG. 51 to mount the liquid container 50 to the mounting/demounting unit 30. The mounting method shown in FIGS. 47 to 52 employs a different setting direction from that in the mounting method described above with reference to FIGS. 18 to 21. Otherwise the mounting method is similar to the mounting method of FIGS. 18 to 21.

As shown in FIG. 47, the user moves the liquid container 50 obliquely downward toward the movable member 40, in order to set the liquid container 50 in the movable member 40. As shown in FIG. 49, the user subsequently places the members of the liquid container 50 (the substrate unit 58 and the liquid supply unit 55) that are to be set in the movable member 40, immediately above the movable member 40 and then moves the liquid container 50 downward in the direction of gravity (in the −Z-axis direction). This causes the liquid container 50 to be set in the mounting/demounting unit 30. The user subsequently presses the pressed portion 545 and moves the liquid container 50 set in the movable member 40 in the connecting direction (−K1-axis direction), so as to connect the liquid container 50 with the mounting/demounting unit 30 as shown in FIG. 51.

As shown in FIGS. 49 and 50, the user may locate the liquid supply assembly 55 immediately above the supply portion support structure 42 and locate the container-side electrical connection structure 58 immediately above the board support structure 48, in order to set the liquid container 50 in the mounting/demounting unit 30. As shown in FIG. 49, the length in the K1-axis direction of the first containing portion 52A connected with the handle portion 53 is smaller than the length in the K1-axis direction of the second containing portion 52B. In other words, the liquid supply assembly 55 and the container-side electrical connection structure 58 are configured to be protruded in the connecting direction (−K1-axis direction) by the predetermined values Sa1 and Sa2 relative to the first containing portion 52A. This configuration reduces the likelihood of failed setting of the liquid supply assembly 55 and the container-side electrical connection structure 58 in the mounting/demounting unit 30 due to the interference by the liquid container body 52 when the liquid container 50 is moved to be connected with the printer 10.

According to the above embodiment, as shown in FIG. 45, in the connected state, the liquid supply assembly 55 and the container-side electrical connection structure 58 are arranged at the positions with the center of gravity GP (center-of-gravity line GC) placed therebetween in the second direction (K2-axis direction). This configuration reduces the rotation of the liquid container 50 about either one of the liquid supply assembly 55 and the container-side electrical connection structure 58 as the supporting point in the connected state.

According to the above embodiment, the positioning structure 56 and the container-side electrical connection structure 58 including the circuit board holding structure 59 that are required for connection with the printer 10 are provided integrally with the operation member 53 (as shown in FIG. 9). There is accordingly no need to provide any other component (for example, a case used to mount the liquid container 50) for connecting the liquid container 50 with the printer 10. The less number of components sufficiently achieve the function of connecting the liquid container 50 with the printer 10. Providing the positioning structure 56 and the container-side electrical connection structure 58 including the circuit board holding structure 59 integrally with the operation member 53 allows the liquid container 50 to be operated by holding the operation member 53 in the process of connecting the liquid container 50 with the printer 10. This configuration provides the better operability than a configuration without the operation member 53.

Elimination of the need to mount the liquid container 50 to a case in advance simplifies the process of connecting the liquid container 50 with the printer 10. Elimination of the need for a case allows for downsizing of the liquid container 50. Elimination of the need for a case also enables the liquid container body 52 to be readily folded down and discarded after consumption of ink.

According to the above embodiment, the liquid container body 52 is attached to the operation member 53 in the state that the liquid container body 52 is visible from outside of the liquid container 50 (as shown in FIG. 7). This configuration enables the amount of ink contained in the liquid container body 52 to be readily recognized from outside according to a change in state of the liquid container body 52, for example, a volume change, a shape change or a change in amount of ink.

According to the above embodiment, the positioning structure 56 and the container-side electrical connection structure 58 including the circuit board holding structure 59 are provided on the first side 53*fa* of the operation member 53, whereas the pressed portion 545 is provided on the second side 53*fb* to be arranged opposite to the positioning structure 56 and the container-side electrical connection structure 58 including the circuit board holding structure 59 across the operation member 53 (shown in FIG. 9 and FIG. 12). This configuration enables the positioning structure 56 and the container-side electrical connection structure 58 including the circuit board holding structure 59 that are used for positioning relative to the printer 10, as well as the pressed portion 545 that is pressed in the process of connecting the liquid container 50 with the printer 10, to be readily visible from outside. This facilitates the connecting operation of the liquid container 50 with the printer 10. The force applied to the pressed portion 545 by the user's pressing is transmitted directly to the liquid supply assembly 55 and the container-side electrical connection structure 58. This stabilizes the motions of the liquid supply assembly 55 and the container-side electrical connection structure 58 to the motions along the connecting direction (−K1-axis direction).

When the liquid container 50 is dropped, the liquid container 50 is likely to fall in the attitude that the liquid container body that contains ink and has the large weight is located below the operation member 53. According to the above embodiment, at least part of the positioning structure 56 is provided on the liquid container body 52-side (−Z-axis direction side) of the liquid supply port 572 (as shown in FIG. 7 and FIG. 13). Even when the liquid container 50 is dropped, the presence of the positioning structure 56 reduces the likelihood that the liquid supply port 572 collides with an object such as the ground. This accordingly reduces the possibility that the liquid supply port 572 is damaged.

According to the above embodiment, at least part of the circuit board holding structure 59 (i.e., part of the container-side electrical connection structure 58 other than the contact portion cp) is provided on the liquid container body 52-side (−Z-axis direction side) of the circuit board 582 (contact portions cp) (as shown in FIG. 7 and FIG. 13). Even when the liquid container 50 is dropped, the presence of the circuit board holding structure 59 reduces the likelihood that the circuit board 582 (contact portions cp) collides with an object such as the ground. This accordingly reduces the possibility that the circuit board 582 (contact portions cp) is damaged.

According to the above embodiment, the operation member 53 is provided such that the grip surface 541 is offset in the center axis CT direction relative to the liquid supply port 572 when the grip surface 541 is placed relative to the liquid supply portion 57 in the direction perpendicular to the center axis CT direction of the liquid supply portion 57 (in the +Z-axis direction) (as shown in FIG. 15). This configuration causes the liquid supply port 572 not to be hidden by the operation member 53 but to be visible when the user holds the grip portion 54 of the operation member 53 to mount the liquid container 50 to the printer 10. This enables the user to readily mount the liquid container 50 to the printer 10. The user holds the operation member 53 to handle the liquid container 50. This reduces the likelihood that the user touches the liquid container body 52. This reduces the possibility that the liquid container body 52 is damaged and ink contained inside of the liquid container body 52 is leaked out.

According to the above embodiment, the liquid supply unit 55 is provided to be protruded outward (in the −K1-axis direction) from the operation member 53 (shown in FIGS. 9 and 10). This configuration enables the user to readily recognize that the protruding direction of the liquid supply unit 55 is the connecting direction for connecting the liquid container 50 with the printer 10 (shown in FIG. 9). This enables the user to more readily mount the liquid container 50 to the printer 10.

According to the above embodiment, the liquid container 50 has the positioning structure 56 (shown in FIG. 9). The positioning structure 56 serves to roughly position the liquid container 50 including the liquid supply portion 57 relative to the printer 10. This enables the liquid container 50 to be mounted to the printer 10 in the appropriate state (in the correct mounted state).

According to the above embodiment, the substrate unit 58 is provided to be offset relative to the grip surface 541 when the grip surface 541 is placed in the direction perpendicular to the center axis CT direction of the liquid supply portion 57 (in the +Z-axis direction) (as shown in FIG. 15). This configuration causes the substrate unit 58 to be visible when the user holds the grip surface 541 of the operation member 53 to mount the liquid container 50 to the printer 10. This enables the user to more readily mount the liquid container 50 to the printer 10.

According to the above embodiment, the protruding direction of the substrate unit 58 (−K1-axis direction) is identical with the protruding direction of the liquid supply portion 57 (−K1-axis direction) (as shown in FIG. 9 and FIG. 10). This enables the user to simultaneously observe the substrate unit 58 and the liquid supply portion 57 in the process of mounting the liquid container 50 to the printer 10. This allows for easy connection of the liquid supply portion 57 with the printer 10 and easy electrical connection of the substrate unit 58 with the printer 10. This also enables the user to recognize that the connecting direction of the substrate unit 58 with the printer 10 (−K1-axis direction) is identical with the connecting direction of the liquid supply portion 57 with the printer 10 (−K1-axis direction) when the user holds the grip surface 541 of the operation member 53 to mount the liquid container 50 to the printer 10, as shown in FIG. 19. This enables the user to more readily mount the liquid container 50 to the printer 10. Additionally, connecting the liquid supply portion 57 with the printer 10 provides the electrical connection of the substrate unit 58 with the printer 10.

According to the above embodiment, the substrate unit 58 and the liquid supply unit 55 are arranged side by side in the K2-axis direction that is parallel to the grip surface 541 and is orthogonal to the center axis CT (as shown in FIGS. 9 and 10). These units 58 and 55 are arranged side by side in the direction orthogonal to the connecting direction (−K1-axis direction). This configuration further facilitates electrical connection of the substrate unit 58 with the apparatus-side electrical connection structure 382 and connection of the liquid supply portion 57 with the printer 10.

According to the above embodiment, the liquid supply unit 55 (more specifically, the positioning structure) and the circuit board holding structure 59 are linked with each other by the linkage member 53A (shown in FIG. 17A). When the user holds the grip portion 54 and moves the linkage member 53A, the liquid supply unit 55 and the circuit board holding structure 59 are moved in conjunction with the motion of the linkage member 53A. Because of the interlocking motions of the liquid supply unit 55 and the circuit board holding structure 59, there is no need to independently connect the respective components 55 and 59 with the corresponding mechanisms 36 and 38 (shown in FIG. 6) of the printer 10. This configuration thus enables the liquid supply unit 55 and the circuit board holding structure 59 to be readily connected with the printer 10.

The linkage member 53A has the holdable grip portion 54, so that an external force is likely to be applied to the linkage member 53A and a member joined with the linkage member 53A (for example, the joint portion 549). According to the above embodiment, as shown in FIG. 17A, the liquid supply portion 57 is integrally molded with the joint portion 549. In other words, the liquid supply portion 57 is connected with the joint portion 549. As shown in FIG. 17A, the linkage member 53 is joined with the second member 53B, so as to be linked with the joint portion 549. This reduces the likelihood that an external force is applied to a remaining part (primary part) of the liquid container body 52 other than the portion attached to the joint portion 549. This accordingly reduces the possibility that the primary part of the liquid container body 52 is damaged. This thereby reduces the possibility that the ink contained in the liquid container body 52 is leaked out.

According to the above embodiment, as shown in FIG. 17B, the linkage member 53A including the grip portion 54 and the second member 53B including the joint portion 549 that is attached to the liquid container body 52 are provided as separate members. The engagement elements 513 provided on the protruded portion 517 of the second member 53B are engaged with the engagement elements 511 provided on the linkage member 53A, so that the linkage member 53A and the second member 53B are linked with each other. The joint portion 549 attached to the liquid container body 52 and the linkage member 53A are formed as separate members. This configuration increases the flexibility of design. For example, the engagement elements 511 of the linkage member 53A may be formed in a shape corresponding to the shape of the engagement elements 513 of the second member 53B. This enables the linkage member 53A formed in a different shape to be linked with the second member 53B.

According to the above embodiment, as shown in FIG. 17B, the engagement elements 511 of the linkage member 53A are engaged with the engagement elements 513 of the second member 53B. This positions the linkage member 53A and the second member 53B relative to each other. In other words, the engagement elements 511 serving as the member positioning elements readily position the liquid supply portion 57 and the circuit board 582 relative to each other. This enables the liquid supply portion 57 and the circuit board 582 to be connected with the printer 10 with high accuracy.

According to the above embodiment, as shown in FIG. 17B, the engagement elements 511 serving as the member positioning elements have the outer shape (more specifically approximately rectangular shape) that surround the direction along the center axis CT of the liquid supply portion 57 (K1-axis direction). This configuration reduces positional misalignment between the second member 53B with the liquid supply portion 57 and the first member 53A with the circuit board 582 in the direction perpendicular to the center axis CT (in-plane direction defined by the Z-axis direction and the K2-axis direction).

According to the above embodiment, as shown in FIG. 17B, the linkage member 53A has the three engagement elements 511A, 511B and 511C that are arranged side by side in the direction (K2-axis direction) intersecting with the direction of gravity (Z-axis direction). The load generated by the own weight of the liquid container body 52 is distributed to the three engagement elements 511A, 511B and 511C when the user holds the grip portion 54. This configuration reduces the possibility that the engagement element 511 is damaged.

According to the above embodiment, as shown in FIG. 17C, the engagement element 511A and the engagement element 511B or the engagement element 511A and the engagement element 511C are provided at the positions with the liquid supply portion 57 placed therebetween in the longitudinal direction of the joint portion 549 (K2-axis direction). The load generated by the own weight of the liquid container body 52 is accordingly applied to the respective sides of the linkage member 53A and the second member 53B across the liquid supply portion 57. This configuration reduces the possibility that one side (+K2-axis direction side) of the joint portion 549 is significantly inclined to the liquid supply portion 57 (significantly deformed) compared with the other side (−K2-axis direction side). This reduces positional misalignment of the liquid supply portion 57 and thereby enables the liquid supply portion 57 to be connected with the printer 10 with high accuracy.

According to the above embodiment, as sown in FIG. 17C, the engagement element 511B and the engagement element 511C or the engagement element 511A and the engagement element 511C are provided at the positions with the circuit board 582 placed therebetween in the longitudinal direction of the joint portion 549 (K2-axis direction). The load generated by the own weight of the liquid container body 52 is accordingly applied to the respective sides of the linkage member 53A and the second member 53B across the circuit board 582. This configuration reduces the possibility that one side (+K2-axis direction side) of the joint portion 549 is significantly inclined to the circuit board 582 (significantly deformed) compared with the other side (−K2-axis direction side). This reduces positional misalignment of the circuit board 582 and thereby enables the circuit board 582 to be connected with the printer 10 with high accuracy.

According to the above embodiment, as shown in FIG. 8A, the width W54 of the grip portion 54 is smaller than the width W549 of the joint portion 549, and the liquid supply unit 55 and the substrate unit 58 are located between the respective end portions 54A and 54B of the grip portion 54. This configuration enables the liquid supply unit 55 and the substrate unit 58 to be securely supported by the grip portion 54 when the user holds the grip portion 54.

According to the above embodiment, as shown in FIG. 17A, the handle portion 53A and the liquid supply portion 57 are provided as separate members. This increases the flexibility of design of the liquid container 50. There is accordingly no need to change the material employed for the handle portion 53A, for example, even when there is a need to change the material employed for the liquid supply portion 57 with a change in type of the ink contained in the liquid container body 52. In the case of changing the type of ink, for example, the conventionally used liquid supply portion 57 is likely to be significantly eluted in the new type of ink. In this case, there is a need to form the liquid supply portion 57 from a material having chemical resistance to the new type of ink. According to this embodiment, however, the second member 53B including the liquid supply portion 57 and the handle portion 53A including the grip portion 54 are provided as separate members, so that there is no need to change the material employed for the handle portion 53A.

Accordingly the handle portion 53A and the liquid supply portion 57 may be formed separately from the materials according to the application.

According to the above embodiment, the liquid supply portion 57 is formed from a material having resistance to the ink contained in the liquid container body 52. This reduces the likelihood that the liquid supply portion 57 is deteriorated (damaged) by the ink. This also reduces the likelihood that impurity is generated in the ink supplied to the printer 10, for example, due to elution of part of the liquid supply portion 57 into the ink.

The handle portion 53A is a portion that is held by the user and directly receives an external force. According to the above embodiment, the handle portion 53A is formed from a material having good deformation resistance or good creep resistance. This suppresses deformation of the handle portion 53A. The positioning structure 56 and the circuit board holding structure 59 are connected with the handle portion 53A. These structures 56 and 59 are important portions for positioning relative to the printer 10 and the like in the process of connecting the liquid container 50 with the printer 10. Suppressing deformation of the handle portion 53A reduces positional misalignment of the respective members 56 and 59 relative to the handle portion 53A. This accordingly enables the liquid container 50 to be appropriately connected with the printer 10.

According to the above embodiment, as shown in FIG. 15 and FIG. 17B, the liquid container 50 has the pressed portion 545 at the position opposite to the liquid supply unit 55 across the handle portion 53A. This configuration enables the liquid supply portion 57 to be readily connected with the printer 10 when the user presses the pressed portion 545.

According to the above embodiment, as shown in FIG. 17A, the handle portion 53A and the third member 53C that forms the pressed portion 545 are provided as separate members. This increases the flexibility of design of the liquid container 50. For example, the shape and the area of the pressed portion 545 may be set freely, irrespective of the shape and the size of the handle portion 53A. This allows part of the pressed portion 545 to be arranged to overlap with the liquid container body 52. Arranging part of the pressed portion 545 to overlap with the liquid container body 52 effectively uses the limited space and ensures the large outer shape of the pressed portion 545, while providing the capacity of the liquid container body 52 over a predetermined level.

According to the above embodiment, the pressed portion 545 has the appearance for identifying the color of ink contained in the liquid container body 52. More specifically, according to this embodiment, the third member 53C including the pressed portion 545 (shown in FIG. 17B) is colored in the color of ink. The user can thus readily identify the color of ink contained in the liquid container body 52 by simply observing the third member 53C. In the case of changing the color of ink contained in the liquid container body 52, replacement of only the third member 53C is needed. The color of the pressed portion 545 is identical with the color of the connecting member 40 (shown in FIG. 5). The user can thus readily identify the connecting member 40 corresponding to the liquid container 50 by simply observing the pressed portion 545. This reduces the likelihood that the liquid container 50 that is not supposed to be mounted and contains a different color is mistakenly connected with the printer 10.

A-12. Preferable Aspects of Liquid Container 50

Figure 53:
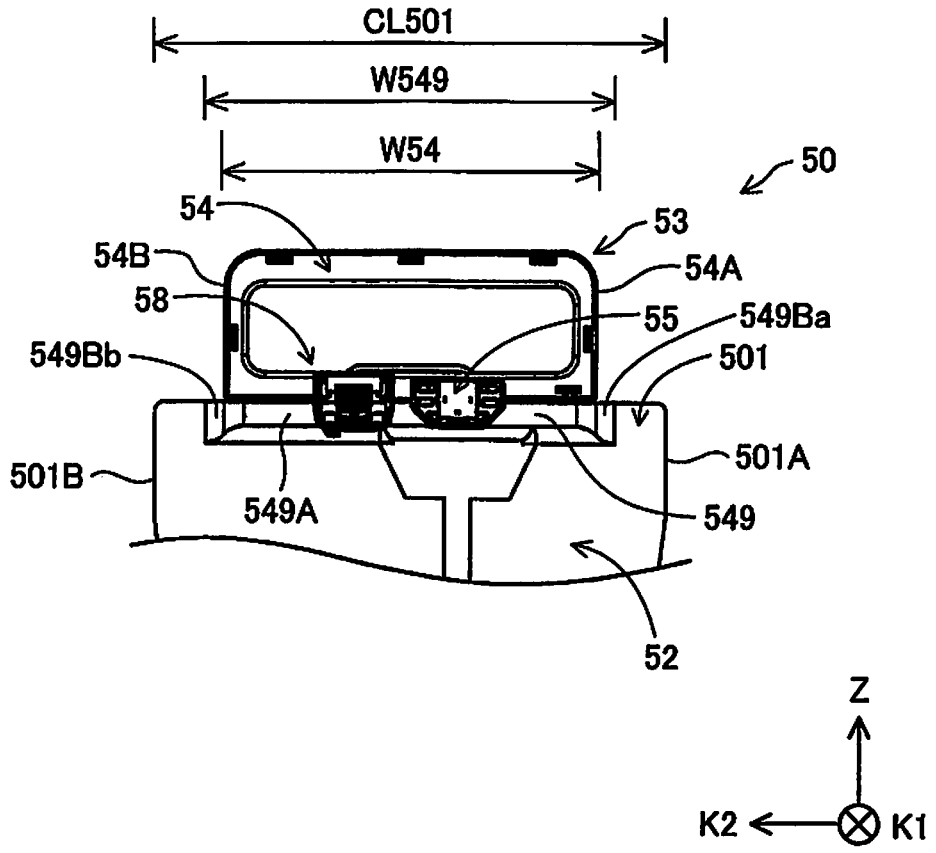
FIG. 53 is a diagram further illustrating the liquid container.
Figure 54:
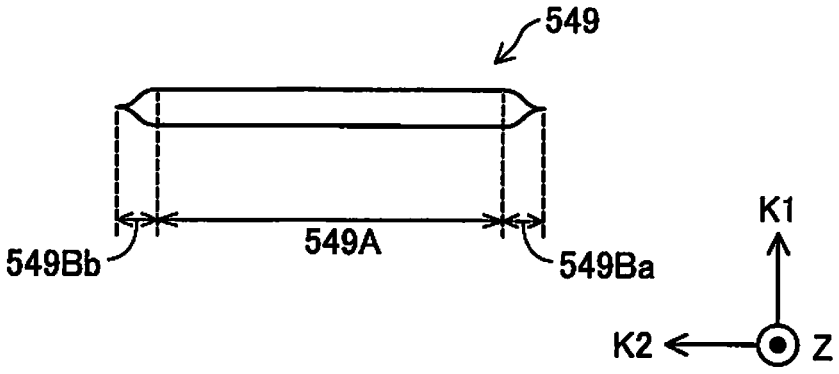
FIG. 54 is a diagram illustrating a joint portion.

FIG. 53 is a diagram further illustrating the liquid container 50. FIG. 54 is a diagram illustrating the joint portion 549. As shown in FIG. 53, the liquid container body 52 is attached to the joint portion 549 by welding. In the state prior to mounting of the liquid container body 52 to the joint portion 549, the one end portion 501 of the liquid container body 52 is open. The joint portion 549 is inserted into the open one end portion 501 and is joined with the one end portion 501 by welding. The outer circumference of the open one end portion 501 is defined as outer circumference CL501. The outer circumference CL501 denotes the length of the outer part of the one end portion 501 when the one end portion 501 is viewed from the +Z-axis direction side.

As shown in FIG. 54, the joint portion 549 includes a first joint edge portion 549Ba located on one edge in the K2-axis direction, a second joint edge portion 549Bb located on the other edge, and a center portion 549A located between the respective edge portions 549Ba and 549Bb. The center portion 549A has an approximately rectangular parallelepiped shape. The center portion 549A has a fixed length in the K1-axis direction. The first joint edge portion 549Ba and the second joint edge portion 549Bb are configured to decrease the lengths in the K1-axis direction toward the respective edges of the joint portion 549 in the K2-axis direction. In other words, the first joint edge portion 549Ba and the second joint edge portion 549Bb are in chamfered shape. As described above, the joint portion 549 includes the first and the second joint edge portions 549Ba and 549Bb that have the curvatures to decrease the lengths in the K1-axis direction toward the respective edges when the joint portion 549 is viewed downward in the direction of gravity (from the +Z-axis direction side), and the center portion 549A that has the fixed length in the K1-axis direction to connect the first and the second joint edge portions 549Ba and 549Bb with each other. The outer circumference of the joint portion 549 viewed from the +Z-axis direction side is defined as outer circumference CL549.

As shown in FIG. 53, the joint portion 549 is joined with the one end portion 501 with some intervals away from the first edge 501A and the second edge 501B of the one end portion 501 of the liquid container body 52. According to this embodiment, the joint portion 549 is joined with the one end portion 501 with the same intervals away from the first edge 501A and the second edge 501B.

The liquid container 50 preferably satisfies the relationship of outer circumference CL501×0.5≤outer circumference CL549≤outer circumference CL501×0.95. The outer circumference CL549 of the joint portion 549 may be set to be not less than 50% of the outer circumference CL501 of the one end portion 501. This configuration favorably distributes the load that is generated by the own weight of the liquid container 52 and is applied to the joined part of the joint portion 549 with the liquid container body 52. This reduces the likelihood that the joined part of the liquid container body 52 and the joint portion 549 is damaged. The outer circumference CL549 of the joint portion 549 may be set closer to the outer circumference CL501 of the one end portion 501. This configuration increases the joining area of the one end portion 501 and the joint portion 549 and more favorably distributes the load applied to the joined part.

The outer circumference CL549 has the certain preferable range. This enables the liquid container 50 to be produced using any of various different sizes of the liquid container bodies 52, while providing the fixed configurations of the joint portion 549 and the operation member 53 connected with the joint portion 549.

As shown in FIG. 53, it is preferable that the first handle end 54A is located in the range where the first joint edge portion 549Ba is placed and that the second handle end 54B is located in the range where the second joint edge portion 549Bb is placed with regard to the K2-axis direction (longitudinal direction of the one end portion 501). In other words, it is preferable that the first handle end 54A is located within the first joint edge portion 549Ba and that the second handle end 54B is located within the second joint edge portion 549Bb when the liquid container 50 is viewed from the +Z-axis direction side. This configuration increases the length in the K2-axis direction of the handle portion 53 joined with the joint portion 549 and thereby distributes the load (stress) that is generated by the own weight of the liquid container body 52 and is applied to the handle portion 53. This reduces the amount of deformation or the amount of creep deformation of the handle portion 53.

The following describes preferable aspects of the liquid container 50 that meet the above description. The reference signs of the respective components described in the above embodiment are shown in parentheses.

[Aspect 1]

A liquid container (50) configured to be connectable with a liquid consuming apparatus (10), the liquid container (50) comprising:

a liquid container body (52) configured to contain a liquid therein;

a liquid supply portion (57) configured to cause the liquid contained in the liquid container body (52) to be flowed to the liquid consuming apparatus (10); and a joint portion (549) connected with the liquid supply portion (57) and inserted into one end portion (501) that forms an opening of the liquid container body (52), so as to be attached to the liquid container body (52), wherein in a connected state that the liquid container (50) is connected with the liquid consuming apparatus (10), when the liquid container (50) is viewed from one direction side (+Z-axis direction side) in an opposed direction (Z-axis direction) where the one end portion (501) of the liquid container body (52) is opposed to other end portion (502) that is opposite to the one end portion (501), the liquid container (50) satisfies a relationship of outer circumference CL501×0.5≤outer circumference CL549≤outer circumference CL501×0.95, where the outer circumference CL501 represents an outer circumference of the one end portion (501), and the outer circumference CL549 represents an outer circumference of the joint portion (549).

The configuration of the liquid container according to this aspect favorably distributes a load that is generated by the own weight of the liquid container body 52 and is applied to the joined part of the joint portion 549 and the liquid container body 52. This reduces the likelihood that the joined part of the liquid container body 52 and the joint portion 549 is damaged.

[Aspect 2]

The liquid container (50) according to the above aspect, further comprising:

a handle portion (53) connected with the joint portion (549) and configured to have a portion (54) held by a user, wherein the joint portion (549) comprises:

a first joint edge portion (549Ba) that is a portion at one edge of the one end portion (501) in a longitudinal direction (K2-axis direction) that is orthogonal to the opposed direction, wherein when the first joint edge portion (549Ba) is viewed from the one direction side (+Z-axis direction side) in the opposed direction (Z-axis direction) in the connected state, a length of the first joint edge portion (549Ba) in a thickness direction (K1-axis direction) that is orthogonal to the opposed direction and the longitudinal direction decreases toward the one edge in the longitudinal direction;

a second joint edge portion (549Bb) that is a portion at other edge in the longitudinal direction (K2-axis direction), wherein when the second joint edge portion (549Bb) is viewed from the one direction side (+Z-axis direction side) in the opposed direction (Z-axis direction) in the connected state, a length of the second joint edge portion (549Bb) in the thickness direction (K1-axis direction) decreases toward the other edge in the longitudinal direction; and a center portion (549A) that is arranged to connect the first joint edge portion and the second joint edge portion (549Ba and 549Bb) with each other and has an approximately constant length in the thickness direction, wherein in the connected state, when the liquid container (50) is viewed from the one direction side (+Z-axis direction side) one end portion (54A) of the handle portion (53) in the longitudinal direction (K2-axis direction) is located in a range where the first joint edge portion (549Ba) is placed, and other end portion (54B) of the handle portion (53) is located in a range where the second joint edge portion (549Bb) is placed.

[Aspect 3]

The liquid container (50) according to the above aspect, wherein the liquid supply portion (57) is placed between the one end portion (54A) and the other end portion (54B) in the longitudinal direction (K2-axis direction).

[Aspect 4]

The liquid container (50) according to the above aspect, further comprising:

a circuit board (582) located between the one end portion (54A) and the other end portion (54B) in the longitudinal direction (K2-axis direction) and configured to be electrically connectable with the liquid consuming apparatus.

[Aspect 5]

The liquid container (50) according to the above aspect, further comprising:

a positioning structure (56) located between the one end portion (54A) and the other end portion (54B) in the longitudinal direction (K2-axis direction) and configured to position the liquid supply portion 57 relative to the liquid consuming apparatus (10); and a circuit board holding structure (59) located between the one end portion (54A) and the other end portion (54B) in the longitudinal direction (K2-axis direction) and configured to hold the circuit board.

The liquid container 50 of the embodiment described above may be specified by the following aspects.

[Aspect A]

A liquid container (50) connected with a liquid consuming apparatus (10) and configured to supply a liquid, the liquid container (50) comprising:

a liquid container body (52) configured to contain the liquid therein;

a liquid supply port (572) located on one end portion (501)-side of the liquid container body (52) and configured to receive part of the liquid consuming apparatus (10) inserted therein, so as to supply the liquid contained in the liquid container body to the liquid consuming apparatus (10); and a handle portion (53) located on the one end portion (501)-side of the liquid container body (52) and configured to be held by a user, wherein when the handle portion is held, the liquid container body (52) is located below the handle portion in the direction of gravity by its own weight, and the liquid supply port (572) is configured to be open toward a direction including a horizontal direction (K1-axis direction) and located in a range that does not overlap with the handle portion when the liquid supply port (572) is viewed from the handle portion side.

The configuration of the liquid container according to this aspect causes the liquid supply port to be visible for the user without interference by the handle portion. This accordingly enables the user to readily insert the liquid consuming apparatus into the liquid supply port.

[Aspect B]

According to the embodiment described above, a liquid container (50) includes a liquid container body (52) and a container body support assembly connected with one end portion (501) of the liquid container body (52).

The container body support assembly includes a liquid supply unit (55) configured to be moved in a connecting direction (−K1-axis direction) including a primary direction component (K1-axis direction component) and thereby to be connectable with a liquid introduction portion (362) of a liquid consuming apparatus (10).

The liquid supply unit (55) may include:

- a liquid supply port (572) provided at one end to be connected with the liquid introduction portion (362); and
- a positioning structure (56) configured to support the liquid container body (52) such that the liquid container body (52) is located below the container body support assembly in the direction of gravity in a process of connecting the liquid container (50) with the liquid consuming apparatus (10).

The container body support assembly may have a substrate unit (58).

The substrate unit (58) may include:

- a circuit board (582) configured to be electrically connected with apparatus-side terminals (381) of the liquid consuming apparatus (10); and
- a circuit board holding structure (59) configured to hold the circuit board (582).

The circuit board holding structure (59), in cooperation with the positioning structure (56), may support the liquid container body (52) such that the liquid container body (52) is located below the container body support assembly in the direction of gravity in the process of connecting the liquid container (50) with the liquid consuming apparatus (10).

The container body support assembly may include a pressed portion (545) configured to be pressed in the connecting direction in the process of connecting the liquid container (50) with the liquid consuming apparatus.

The pressed portion (545) may be provided on an opposite side of the container body support assembly opposite to the liquid supply unit (55) and the substrate unit (58).

The container body support assembly may include a handle portion (53).

The handle portion (53) may include a grip portion (54) configured to be held by a user and located above the liquid supply unit (55) and the substrate unit (58) in the direction of gravity when the grip portion (54) is held to suspend the liquid container body (52) by its own weight.

When the liquid container (50) suspended by its own weight is viewed from an upper side in the direction of gravity, the liquid supply unit (55) and the substrate unit (58) may be protruded in the connecting direction (−K1-axis direction) relative to the handle portion (53).

As described above, the container body support assembly includes at least one of the liquid supply unit 55, the substrate unit 58, the pressed portion 545 and the handle portion 53.

A-13. Electrical Connector

Figure 55:
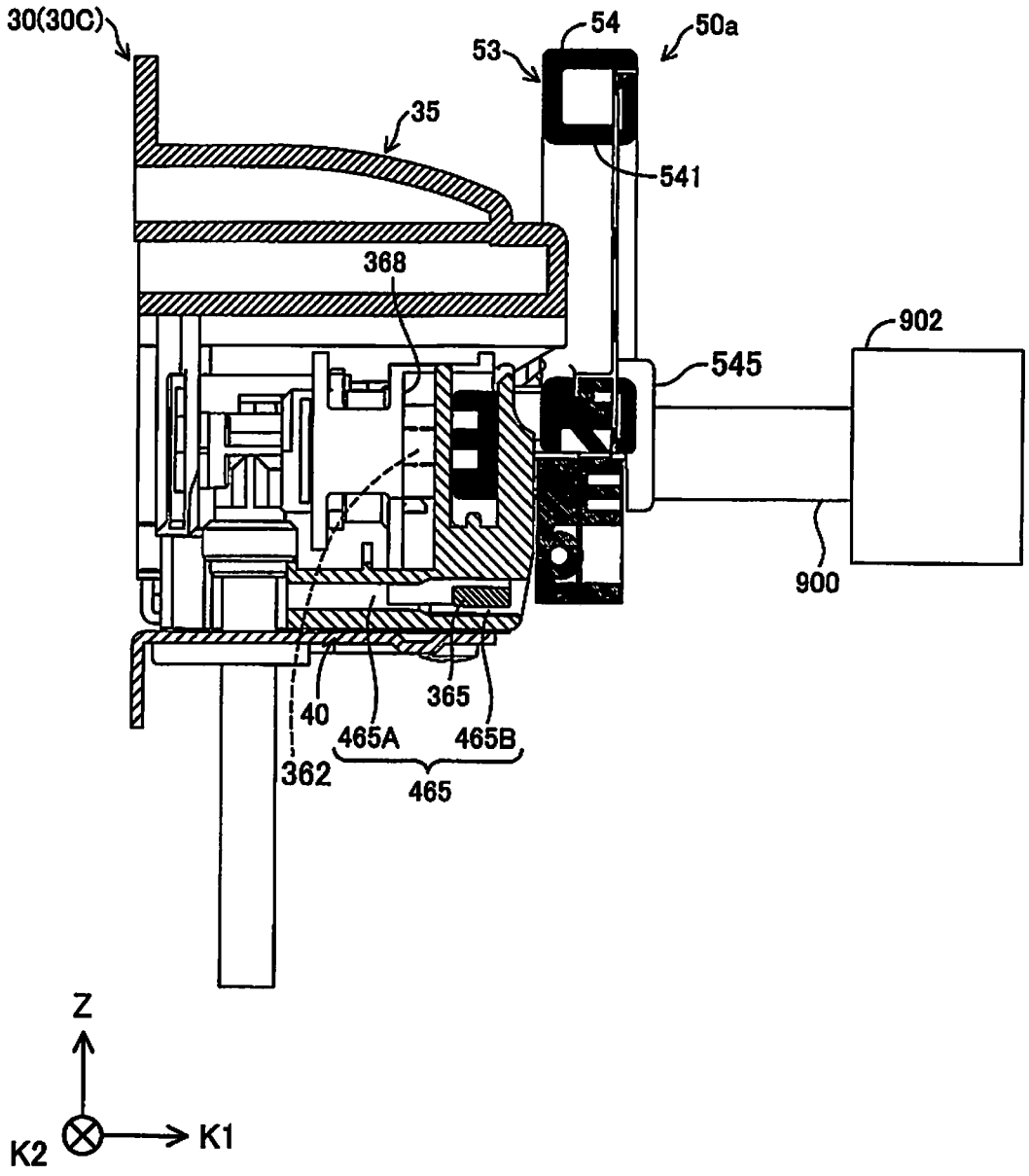
FIG. 55 is a diagram illustrating an electrical connector.

FIG. 55 is a diagram illustrating an electrical connector 50*a*. In the above embodiment, the liquid container 50 includes the liquid containing bag 52 and the liquid supply portion 57 (shown in FIG. 7 and FIG. 9). The electrical connector 50*a* may be provided with omission of the liquid containing bag 52 and the liquid supply portion 57. In other words, the electrical connector 50*a* is configured to exclude the liquid containing bag 52 and the liquid supply portion 57 from the configuration of the liquid container 50 and otherwise has the same configuration as that of the liquid container 50. In an application using this electrical connector 50*a*, ink is supplied from a tank (liquid reservoir) 902 that is placed outside to contain ink, to the printer 10 via a liquid flow tube (hose) 900 arranged to connect the tank 902 with the liquid introduction portion 362. The liquid supply tube (hose) 900 may be connected halfway in the liquid flow tube from the liquid introduction portion 362 to the liquid ejection assembly of the printer 10. The configuration of FIG. 55 provides the similar advantageous effects to those of the above embodiment. For example, the contact plane TP is inclined such that the lower side is located on the first direction side (−K1-axis direction side) of the upper side as shown in FIG. 16D. The surface 62*fa* of the terminal holder 62 is accordingly inclined such that the upper side is protruded more than the lower side in the opposite direction (+K1-axis direction) opposite to the first direction as shown in FIG. 24. In other words, the surface 62*fa* of the terminal holder 62 is arranged to cover over the contact portions cp of the circuit board 582. This configuration reduces the possibility that impurity such as dust adheres to the electrical connection structure 382 (for example, the surface 62*fa* or the apparatus-side terminals 381). This accordingly ensures more favorable electrical connection between the container-side electrical connection structure 582 and the apparatus-side electrical connection structure 382. This configuration also provides the similar advantageous effects to those of the above embodiment. For example, the user is allowed to hold the operation member 53 and operate the electrical connector 50*a* in the process of connecting the electrical connector 50*a* with the printer 10. This configuration has the better operability than a configuration without the operation member 53. The liquid flow tube (hose) 900 may be connected in the middle of a liquid flow tube that is arranged to connect the liquid introduction portion 362 with the liquid consuming apparatus of the printer 10.

A-14. Another Preferable Embodiment

Figure 56:
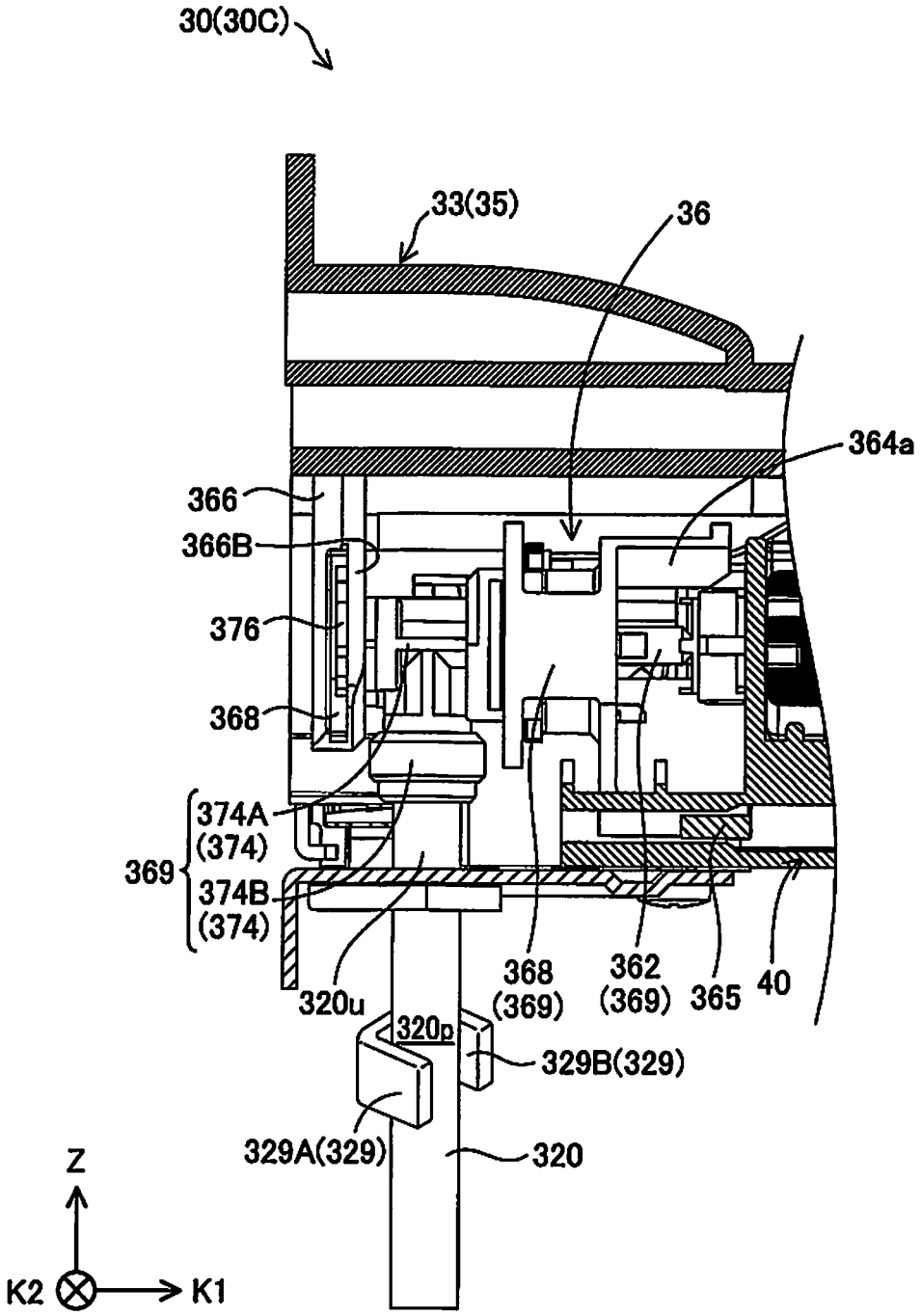
FIG. 56 is a diagram illustrating a preferable configuration according to the embodiment.

FIG. 56 is a diagram illustrating a preferable embodiment. The liquid supply device 20 may further include a liquid flow tube 320 and a holding member 329. The holding member 329 is configured to hold the liquid flow tube 320. According to this embodiment, the holding member 329 includes a pair of ribs 329A and 329B provided on the outer wall of the printer 10 (for example, the apparatus third surface 106 shown in FIG. 2). The liquid flow tube 320 is placed and is thereby held between the pair of ribs 329A and 329B. More specifically, the holding member 329 holds the liquid flow tube 320 such that an upstream end portion of the liquid flow tube 320 from an upstream end 320*u* to a position 320*p* where the holding member 329 is located is extended along the direction of gravity (Z-axis direction) in the flow direction of ink from the liquid introduction portion 362 to the printer 10. Accordingly the holding member 329 is located immediately below the connecting flow path portion 374.

Even in an arrangement that a downstream side of the liquid flow tube 320 is bent from its upstream end portion, this configuration enables the upstream end portion to be maintained in the shape along the direction of gravity. Even when a reaction force is produced by bending the downstream side of the liquid flow tube 320, the holding member 329 serves to receive the reaction force. For example, this reduces the possibility that another member of the liquid supply device (for example, second support structure 366) is affected by the downstream side of the liquid flow tube. In a configuration of the liquid supply device 20 without the holding member 329, bending the upstream side of the liquid flow tube 320 is likely to cause a failure in placing the restriction elements 376 at the designed positions in the second support structure 366 by the effect of the reaction force of the liquid flow tube 320. The reaction force of the liquid flow tube 320 applied to the second support structure 366 is also likely to cause deformation of the second support structure 366.

The holding member 329, however, maintains the upstream end portion of the liquid flow tube 320 in the shape along the direction of gravity. More specifically, even when the reaction force is produced in the upstream end portion by bending the downstream side of the liquid flow tube 320 from the upstream end portion, the holding member 329 receives the produced reaction force. This configuration enables the restriction elements 376 to be placed at the designed positions in the second support structure 366 with high accuracy. This enables the displacement mechanism using the second support structure 366 of the liquid flow portion 369 to work in the designed range. The holding member 329 is not limited to the ribs but may be any shape that can hold the liquid flow tube 320. For example, the holding member 329 may be a ring-shaped member. In this configuration, the liquid flow tube 320 is inserted through the ring shape.

In the embodiment, the substrate unit 58 is also called "container-side electrical connection structure 58". The circuit board holding structure 59 is also called "placement structure 59". The holding structure-side positioning elements 592*t* and 593*t* are also called "container-side electrical connection structure positioning elements". The holding structure-side upper restriction portions 599*a* and 599*b* are also called "container-side electrical connection structure upper restriction portions 599*a* and 599*b*".

B. Modifications

The disclosure is not limited to any of the embodiments and the examples described above but may be implemented by a diversity of other aspects without departing from the scope of the disclosure. Some of possible modifications are given below.

B-1. First Modification

In the above embodiment, the liquid container body 52 is formed from the flexible material. This is, however, not restrictive but any material may be employed to provide a liquid container body configured to contain a liquid inside thereof. For example, the liquid container body 52 may be formed partly from a flexible material or may be formed from a hard material that does not change the volume irrespective of consumption of the liquid. Forming at least part of the liquid container body 52 from the flexible material causes the volume of the liquid container body 52 to be changed with a change in amount of ink contained in the liquid container body 52.

B-2. Second Modification

In the above embodiment, as shown in FIG. 19, the connecting direction of the liquid container 50 to the mounting/demounting unit 30 is the horizontal direction (K1-axis direction). This is, however, not restrictive, but the connecting direction may be any direction including a first direction component (−K1-axis direction component). For example, the connecting direction may be a direction including a −Z-axis direction component and a −K1-axis direction component. In this modification, the movable member 40 is also moved in a direction corresponding to the connecting direction of the liquid container 50.

B-3. Third Modification

Figure 57:
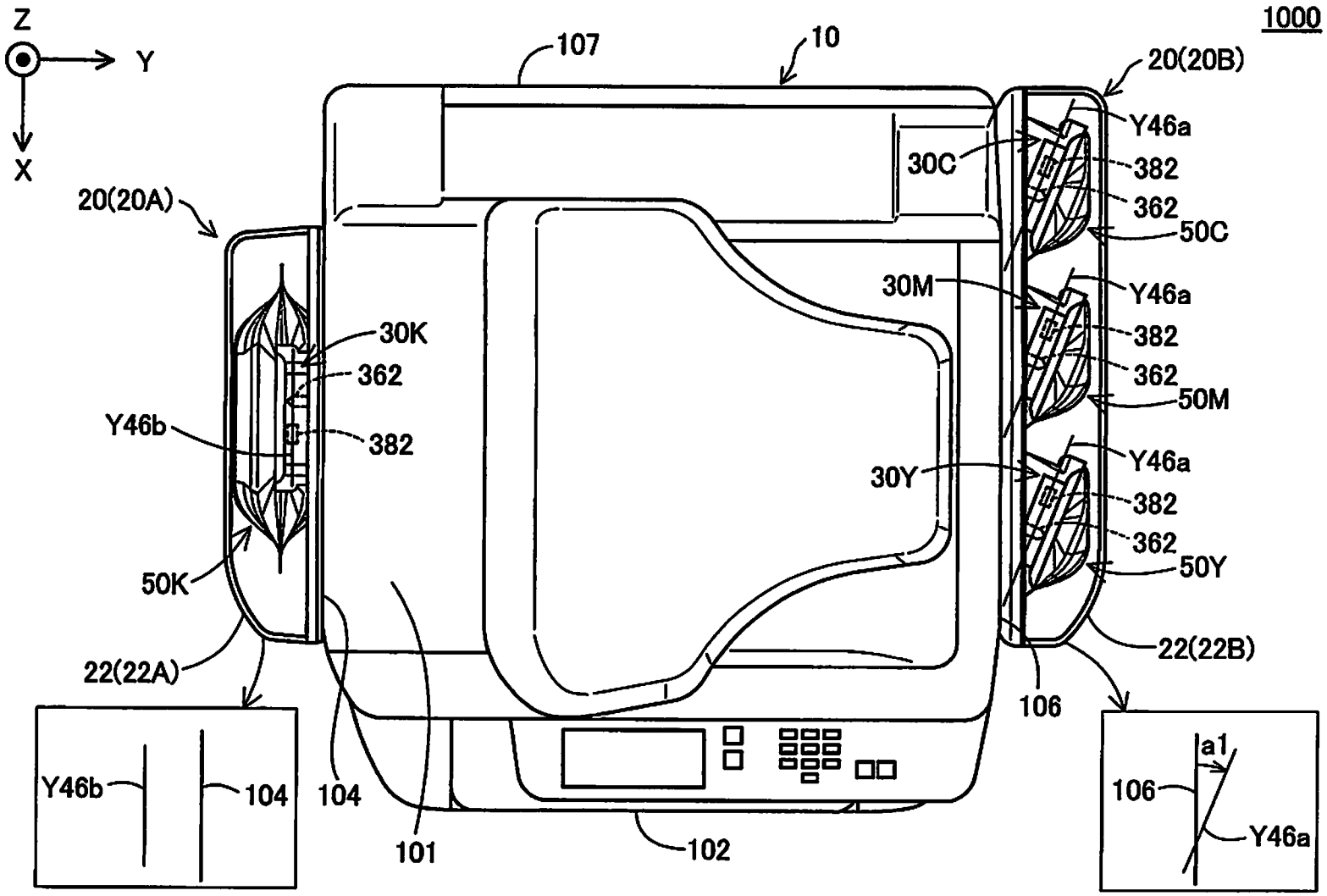
FIG. 57 is a diagram illustrating an example of preferable arrangement according to the embodiment.

FIG. 57 is a diagram illustrating an example of preferable arrangement according to the embodiment. FIG. 57 is a diagram of FIG. 1 viewed from the +Z-axis direction (vertically downward). For the purpose of better understanding, the liquid containers 50C, 50M, 50Y and 50K placed inside of the cover members 22 are also illustrated. The printer 10 further includes a top face (upper wall) 101 on the +Z-axis direction side and an apparatus fourth surface (rear face, rear wall) 107 that is opposed to the apparatus first surface 102.

The liquid containers 50C, 50M and 50Y are connected with the second liquid supply device 20B on the apparatus third surface (right side wall, first side wall) 106-side. The liquid supply connection structure 362 and the apparatus-side electrical connection structure 382 of each of the mounting/demounting units 30C, 30M and 30Y are arranged side by side in a predetermined direction Y46*a*. The liquid supply connection structure 362 and the apparatus-side electrical connection structure 382 of the mounting/demounting unit 30K are arranged side by side in a predetermined direction Y46*b*. Multiple sets of the liquid supply connection structures 362 and the apparatus-side electrical connection structures 382 are accordingly arranged on the apparatus third surface 106. The multiple sets are arranged in a direction in which the front face 102 and the rear face 107 are opposed to each other (i.e., in the X-axis direction).

The liquid container 50K is connected with the first liquid supply device 20A on the apparatus second surface (left side wall, apparatus second side wall) 104-side. The liquid container 50K has a larger capacity than those of the liquid containers 50C, 50M and 50Y and is capable of containing a larger amount of ink. The magnitude relationship of ink capacity is provided by the following configuration according to the embodiment. The length of the liquid container 50K in the predetermined direction Y46*b* (width direction, K2-axis direction in FIG. 7) is longer than the lengths of the liquid containers 50C, 50M and 50Y in the predetermined direction Y46*a* (width direction, K2-axis direction in FIG. 7). According to this embodiment, the length of the liquid container 50K in a direction (thickness direction, K1-axis direction in FIG. 7) orthogonal to the predetermined direction Y46*b* is longer than the lengths of the liquid containers 50C, 50M and 50Y in a direction (thickness direction, K1-axis direction in FIG. 7) orthogonal to the predetermined direction Y46*a*.

With regard to the clockwise direction from the apparatus third surface 106, an angle between the apparatus third surface 106 and the predetermined direction Y46*a* is defined as angle a1. The angle a1 is greater than 0 degree and smaller than 90 degrees. The predetermined direction Y46*b* is parallel to the apparatus second surface 104. Accordingly the liquid supply connection structure 362 and the apparatus-side electrical connection structure 382 supported on the apparatus second surface 104 are arranged side by side along a direction parallel to the apparatus second surface 104.

When the mounting/demounting units 30C, 30M and 30Y are arranged on the apparatus second surface 104-side, with regard to the counterclockwise direction from the apparatus second surface 104, an angle a2 between the apparatus second surface 104 and the predetermined direction Y46*a* is preferably greater than 0 degree and smaller than 90 degrees.

The angle a1 or the angle a2 is greater than 0 degree and smaller than 90 degrees as described above. This configuration suppresses expansion of the width in the left-right direction (Y-axis direction) in which the apparatus second surface 104 and the apparatus third surface 106 are opposed to each other. The liquid container 50K having the larger capacity is arranged parallel to the apparatus second surface 104. This configuration provides substantially equal spaces for mounting the liquid containers 50 on the apparatus second surface 104-side and the apparatus third surface 106-side across the printer 10.

B-4. Fourth Modification

In the above embodiment, the container-side electrical connection structure 58 includes the circuit board 582. This configuration is, however, not restrictive, but the container-side electrical connection structure may have any configuration that includes the contact portions cp configured to come into contact with the apparatus-side electrical connection structure 382. For example, the circuit board 582 may not be provided with the storage device 583. For example, the container-side electrical connection structure 58 may include a contact of a terminal used for detection of mounting or demounting of the liquid container 50. The container-side electrical connection structure 58 may include an overall circuit board including a flexible cable, such as flexible printed circuit board (FPC). A contact configured to come into contact with the apparatus-side electrical connection structure 382 is provided on one end of this circuit board, and the other end may be connected with, for example, are reset device. This modified configuration may be employed in place of the circuit board 582 or may be employed in addition to the circuit board 582.

B-5. Fifth Modification

In the above embodiment, the operation member 53 is in the frame-like shape (shown in FIG. 13). The operation member 53 is, however, not limited to this shape but may be formed in any shape holdable by the user. For example, the operation member 53 may be formed in a rod-like (plate-like) shape extended along the Z-axis direction.

B-6. Sixth Modification

In the above embodiment, for example, the handle portion 53A, the liquid supply unit 55 and the circuit board holding structure 59 are formed by assembling the three members 53A, 53B and 53C as shown in FIG. 17B. This configuration is, however, not restrictive. For example, an assembly formed by assembling the three members 53A, 53B and 53C may be integrally formed. A method employed for integral forming may be integral molding or a method of joining the respective members 53A, 53B and 53C with one another by means of an adhesive or the like. This facilitates manufacture of the liquid container 50. Integrally forming the liquid supply unit 55 and the substrate unit 58 allows for accurate positioning of the respective units 55 and 58 relative to each other. This also enables the linkage member 53A and the joint portion 549 to be formed integrally. This reduces the likelihood that the joint portion 549 and the linkage member 53A are separated from each other by the weight of the liquid container body 52 when the user holds the linkage member 53A. When the user holds the linkage member 53A, the load generated by the own weight of the liquid container body 52 is applied to the linkage member 53A via the joint portion 549. This reduces an external force applied to the liquid container body 52 itself and thereby reduces the possibility that the liquid container body 52 is damaged.

B-7. Seventh Modification

In the above embodiment, as shown in FIG. 19, the connecting direction of the liquid container 50 with the mounting/demounting unit 30 is the horizontal direction (K1-axis direction). This is, however, not restrictive. The connecting direction may be any direction including a primary direction component (−K1-axis direction component). For example, the connecting direction may be a direction including a −Z-axis direction component and a −K1-axis direction component. In this case, the movable member 40 is also moved in a direction corresponding to the connecting direction of the liquid container 50.

B-8. Eighth Modification

The disclosure is not limited to the inkjet printer or its liquid container 50 but is also applicable to any printing apparatus (liquid consuming apparatus) configured to eject any liquid other than ink and a liquid container configured to contain the liquid. For example, the disclosure may be applied to any of various liquid consuming apparatuses and their liquid containers given below:

(1) image recording apparatus such as a facsimile machine;

(2) color material ejection apparatus configured to eject a color material used for manufacturing color filters for an image display apparatus such as a liquid crystal display;

(3) electrode material ejection apparatus configured to eject an electrode material used for forming electrodes of, for example, an organic EL (electroluminescence) display and a field emission display (FED);

(4) liquid consuming apparatus configured to eject a bioorganic material-containing liquid used for manufacturing biochips;

(5) sample ejection apparatus used as a precision pipette;

(6) ejection apparatus of lubricating oil;

(7) ejection apparatus of a resin solution;

(8) liquid consuming apparatus for pinpoint ejection of lubricating oil on precision machines such as watches and cameras;

(9) liquid consuming apparatus configured to eject a transparent resin solution, such as an ultraviolet curable resin solution, onto a substrate in order to manufacture a hemispherical microlens (optical lens) used for, for example, optical communication elements;

(10) liquid consuming apparatus configured to eject an acidic or alkaline etching solution in order to etch a substrate or the like; and

(11) liquid consuming apparatus equipped with a liquid ejection head configured to eject a very small volume of droplets of any other liquid.

The "droplet" herein means the state of liquid ejected from the liquid consuming apparatus and may be in a granular shape, a teardrop shape or a tapered threadlike shape. The "liquid" herein may be any material ejectable from the liquid consuming apparatus. The "liquid" may be any material in the liquid phase. For example, liquid-state materials of high viscosity or low viscosity, sols, aqueous gels and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The ink herein includes general water-based inks and oil-based inks, as well as various liquid compositions, such as gel inks and hot-melt inks. In an application that UV ink curable by UV radiation is contained in a liquid container body and is connected with the printer, the liquid container body is away from the placement surface. This reduces the likelihood that the UV ink is cured by transmission of heat from the placement surface to the liquid container body.

The disclosure is not limited to any of the embodiments, the examples and the modifications described above but may be implemented by a diversity of other configurations without departing from the scope of the disclosure. For example, the technical features of any of the embodiments, the examples and the modifications corresponding to the technical features of each of the aspects described in Summary may be replaced or combined appropriately, in order to solve part or all of the problems described above or in order to achieve part or all of the advantageous effects described above. Any of the technical features may be omitted appropriately unless the technical feature is described as essential herein.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid container configured to be connectable with a liquid consuming apparatus, the liquid container comprising:

a liquid supply portion configured to be connectable with the liquid consuming apparatus;

a liquid container body configured to communicate with the liquid supply portion and contain a liquid therein; and a container-side electrical connection structure provided to have a contact portion that is configured to come into contact with an apparatus-side electrical connection structure provided in the liquid consuming apparatus, wherein the container-side electrical connection structure includes a placement portion configured to place the contact portion and the liquid supply portion to be located above the liquid container body in the direction of gravity in a process of connecting the liquid container with the liquid consuming apparatus.

2. The liquid container according to claim 1, wherein the placement portion is supported by a first support assembly that is movable in a first direction intersecting with the direction of gravity in a process of connecting the liquid container with the liquid consuming apparatus, the container-side electrical connection structure includes a plurality of the contact portions, and a contact plane defined by the plurality of contact portions is inclined such that a lower side of the contact plane is located on a first direction side of an upper side of the contact plane.

3. The liquid container according to claim 2, wherein the placement portion includes a restriction element configured to abut on the first support assembly and restrict motion of the container-side electrical connection structure in an opposite direction opposite to the first direction.

4. The liquid container according to claim 2, wherein the placement portion and the liquid supply portion are arranged side by side in a direction intersecting with the first direction, and the placement portion includes a rotation restriction element configured to abut on the first support assembly and restrict rotation of the container-side electrical connection structure about the liquid supply portion.

5. The liquid container according to claim 2, wherein the placement portion is configured such that the contact portions come into contact with the apparatus-side electrical connection structure that is configured to be displaceable in a direction intersecting with the first direction.

6. The liquid container according to claim 5, wherein the placement portion includes a container-side electrical connection structure positioning element that is positioned by a positioning structure provided in the apparatus-side electrical connection structure for positioning in the first direction and in the direction intersecting with the first direction, when the contact portions come into contact with the apparatus-side electrical connection structure.

7. The liquid container according to claim 6, wherein the container-side electrical connection structure positioning element is provided on respective sides across the contact portions.

8. The liquid container according to claim 1, wherein the placement portion includes a container-side electrical connection structure upper restriction portion configured to abut on the liquid consuming apparatus and restrict motion of the container-side electrical connection structure in a reverse direction reverse to the direction of gravity when the contact portion comes into contact with the apparatus-side electrical connection structure.

9. The liquid container according to claim 2, wherein the placement portion has an upper portion that is covered by a cover portion provided in the liquid consuming apparatus to be located above the apparatus-side electrical connection structure and to be protruded in the opposite direction opposite to the first direction, when the contact portions come into contact with the apparatus-side electrical connection structure.

10. An electrical connector, comprising:

an electrical connection structure including a plurality of contact portions that are configured to come into contact with an apparatus-side electrical connection structure of an electrical connection unit provided in a liquid consuming apparatus, and a placement portion in which the contact portions are placed, wherein the placement portion is supported by a first support assembly that is configured to be movable in a first direction intersecting with the direction of gravity in a process of connecting the electrical connector with the liquid consuming apparatus, a contact plane defined by the plurality of contact portions is inclined such that a lower side of the contact plane is located on a first direction side of an upper side of the contact plane, and the placement portion includes a bottom and a restriction element configured to abut on the first support assembly and restrict motion of the placement portion in an opposite direction opposite to the first direction, the restriction element being a projection protruded outward from the bottom.

11. The electrical connector according to claim 10, wherein the placement portion includes a rotation restriction element configured to abut on the first support assembly and restrict rotation of the placement portion.

* * * * *